US010967630B2

(12) United States Patent
Bernard et al.

(10) Patent No.: US 10,967,630 B2
(45) Date of Patent: Apr. 6, 2021

(54) SHEET-FED PRINTING PRESS

(71) Applicant: KOENIG & BAUER AG, Würzburg (DE)

(72) Inventors: Andreas Bernard, Sulzfeld (DE); Hartmut Breunig, Arnstein (DE); Frank Huppmann, Zell am Main (DE); Bernd Masuch, Kürnach (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/621,285

(22) PCT Filed: Jul. 17, 2018

(86) PCT No.: PCT/EP2018/069390
§ 371 (c)(1),
(2) Date: Dec. 11, 2019

(87) PCT Pub. No.: WO2019/020434
PCT Pub. Date: Jan. 31, 2019

(65) Prior Publication Data

US 2020/0156365 A1 May 21, 2020

(30) Foreign Application Priority Data

Jul. 27, 2017 (DE) ..... 10 2017 212 987.5

(51) Int. Cl.
*B41F 19/00* (2006.01)
*B41J 11/00* (2006.01)
(Continued)

(52) U.S. Cl.
CPC ..... *B41F 19/007* (2013.01); *B41J 11/007* (2013.01); *B41F 13/0024* (2013.01);
(Continued)

(58) Field of Classification Search
CPC ..... B41J 29/02; B41J 11/007; B41J 25/001; B41J 25/308; B41J 3/28; B41F 19/007
See application file for complete search history.

(56) References Cited

U.S. PATENT DOCUMENTS 4,841,306 A 6/1989 Archer et al.
5,383,392 A 1/1995 Kowalewski et al.
(Continued)

FOREIGN PATENT DOCUMENTS

DE 10227241 A1 1/2004
DE 69721715 T2 3/2004
(Continued)

OTHER PUBLICATIONS

International Search Report of PCT/EP2018/069390 dated Sep. 27, 2018.

*Primary Examiner* — John Zimmermann
(74) *Attorney, Agent, or Firm* — Mattingly & Malur, PC

(57) ABSTRACT

A sheet-fed printing press has at least one coating assembly configured as a non-impact coating assembly. The sheet-fed printing press has at least one transport belt which extends, having at least one transport section of a circular path thereto, parallel to a transport direction along a partial region of a transport path provided for a sheet. At least one coating location of the at least one coating assembly is arranged along the transport section of the at least one transport belt. At least one printing head is arranged connected to at least one first frame of the at least one coating assembly. The at least one transport belt is arranged, connected to at least one second frame, via at least one deflection device and at least one radial bearing. The at least one first frame, apart from at least one installation surface which is different from the at least one first frame and the at least one second frame, is arranged in contact to the second frame at most via flexible connections.

14 Claims, 45 Drawing Sheets

(51) Int. Cl.
*B41F 13/00* (2006.01)
*B41F 21/00* (2006.01)

(52) U.S. Cl.
CPC ..... *B41F 19/001* (2013.01); *B41F 21/00* (2013.01); *B41J 11/002* (2013.01); *B41J 11/0085* (2013.01); *B41P 2217/11* (2013.01); *B65H 2801/21* (2013.01)

(56) References Cited

U.S. PATENT DOCUMENTS 5,582,569 A 12/1996 Kowalewski et al.
5,757,389 A * 5/1998 Schwede ..... B41J 25/308 347/4
5,813,327 A 9/1998 Freeman et al.
6,176,484 B1 1/2001 Greive
6,755,518 B2 * 6/2004 Codos ..... B41J 3/28 345/101
7,001,016 B2 * 2/2006 Baxter ..... B41J 3/4073 347/101
7,118,103 B2 * 10/2006 Greive ..... B41J 11/007 271/275
7,390,362 B2 * 6/2008 Russ ..... B41J 3/4071 118/324
7,434,902 B2 * 10/2008 Baker ..... B41J 25/308 347/8
8,506,047 B2 8/2013 Wachter et al.
8,517,496 B2 * 8/2013 Sugimura ..... B41J 15/04 347/16
2001/0022422 A1 9/2001 Tamura
2002/0180138 A1 12/2002 Marshall et al.
2008/0280028 A1 * 11/2008 Albrecht ..... B41J 11/0015 427/8
2009/0251714 A1 * 10/2009 Franco ..... E06B 9/24 358/1.9
2011/0128323 A1 * 6/2011 Saito ..... B41J 2/16585 347/40
2012/0113190 A1 5/2012 Wachter et al.
2013/0216291 A1 8/2013 Fukusaka et al.
2016/0136979 A1 * 5/2016 Boerstal ..... B65H 5/021 347/104

FOREIGN PATENT DOCUMENTS

DE 19901698 B4 1/2008
DE 102010060405 A1 5/2012
DE 102011088776 B3 1/2013
DE 102015111525 A1 2/2016
DE 102016202124 A1 9/2016
EP 0615941 A1 9/1994
EP 0669208 A1 8/1995
EP 1375140 A1 1/2004
WO 2014/047513 A2 3/2014

* cited by examiner

SHEET-FED PRINTING PRESS

CROSS REFERENCE TO RELATED APPLICATIONS

This application is the U.S. National Phase, under 35 U.S.C. § 371, of PCT/EP2018/069390, filed Jul. 17, 2018; published as WO 2019/020434 A1 on Jan. 31, 2019, and claiming priority to DE 10 2017 212 987.5, filed Jul. 27, 2017, the disclosures of which are expressly incorporated herein in their entireties by reference.

FIELD OF THE INVENTION

The present invention relates to a sheet-fed printing press.

BACKGROUND OF THE INVENTION

A number of different printing methods are used in printing presses. Non-impact printing (NIP) methods are understood as printing methods that do not require a fixed, that is to say, a physically unalterable printing forme. Printing methods of this type are able to produce different printed images in each printing operation. Examples of non-impact printing methods include ionographic methods, magnetographic methods, thermographic methods, electrophotography, laser printing, and in particular inkjet printing methods. Such printing methods typically involve at least one image producing device, for example at least one print head. In the inkjet printing method, such a print head is configured, for example, as an inkjet print head and has at least one and preferably a plurality of nozzles, by means of which at least one printing fluid, for example in the form of ink droplets, can be transferred selectively onto a printing substrate. Alternative printing methods, such as intaglio printing, planographic printing, offset printing and letterpress printing methods, in particular flexographic printing, use fixed printing formes. Depending upon the size of the print run and/or other requirements such as print quality, a non-impact printing method or a printing method that uses a fixed printing forme may be preferable.

The precise matching of a printed image on the front and back sides of a printing substrate that is printed on both sides is referred to as register (DIN 16500-2). In multicolor printing, the merging of individual printed images of different colors in precise alignment to form a single image is referred to as color registration (DIN 16500-2). In inkjet printing, as with other processes, appropriate measures must be implemented to maintain color registration and/or register. In particular, it is important for the relative position between print head and printing substrate to be known and/or kept constant. Registration is also referred to as color register. In the following, the term register mark will therefore also be understood as referring to a registration mark, i.e. a mark for checking color registration or color register.

Sheet-fed printing presses are known. However, conventional transport systems cannot always be used with particularly thick sheets.

From DE 10 2015 111525 A1, a sheet-fed printing press is known, which operates according to the principle of offset printing and which is equipped with additional inkjet printing elements that have print heads and dryers, which are optionally arranged so as to be movable. Drives for transporting sheets are not described.

From DE 102 27241 A1, a drive system of a sheet-fed printing press is known, in which drive control units act as module control units.

From DE 10 2011 088776 B3, a printing press that has inkjet print heads and dryers is known. The transport of printing substrate and drives provided for said transport are described only in connection with a web-fed printing press.

EP 0669208 A1 discloses a sheet-fed printing press having drive motors for cylinders and the capability of positioning said drives axially.

EP 0615941 A1 discloses a sheet-fed printing press having individually driven acceleration means.

From DE 697 21715 T2, a method and a device are known, in which mailpieces, in particular postcards, are singulated and fed to an inkjet print head. The mailpieces are accelerated to a first speed by a primary acceleration means and are accelerated to a second speed by a secondary acceleration means. The two acceleration means are driven by a common drive. A motor controller controls this drive as well as a drive that transports the mailpieces past the print head module. The mailpieces are decelerated by the secondary acceleration means as needed in order to increase the gap between a mailpiece and the mailpiece that precedes it. Because of the common drive, decelerating this secondary acceleration means also necessarily decelerates the first acceleration means.

US 2001/0022422 A1 and US 2013/0216291 A1 each disclose a method and a copying machine by which paper sheets are removed from a pile from above, singulated, and fed to a print position.

US 2002/0180138 A1 discloses a method and a device in which checks are singulated and marked. A primary acceleration means is operated more slowly than a secondary acceleration means. The checks are decelerated or accelerated by the secondary acceleration means as needed in order to adjust the gap between a check and the check that precedes it. At the same time, the primary acceleration means is decelerated or accelerated in the same ratio.

DE 10 2016 202 124 A1 discloses a sheet-fed printing press of modular construction, having inkjet print heads and conveyor belts.

DE 199 01 698 B4 discloses a printing press with a conveyor belt and inkjet print head.

From WO 2014/047513 A2, a non-impact sheet-fed printing press having a conveyor belt and coating positions is known.

U.S. Pat. No. 4,841,306 A discloses a non-impact printing machine for textiles, which likewise has a conveyor belt. The respective conveyor belt is mounted in a frame. Print heads are connected to or removed from said frame by means of replaceable sub-frames. Mechanisms are disclosed, with which the sub-frames are connected to the frames.

From DE 10 2010 060 405 A1, a non-impact printing press is known, in which the position of print heads in sub-frames can be adjusted.

SUMMARY OF THE INVENTION

The object of the present invention is to devise a sheet-fed printing press.

The object is achieved according to the invention by the provision of a sheet-fed printing press which has at least one coating unit that is configured as a non-impact coating unit. The sheet-fed printing press has at least one conveyor belt which extends, with at least one conveying section of its circulation path, parallel to a transport direction, along a section of a transport path provided for sheets. Along the conveying section of the at least one conveyor belt, at least one coating position of the at least one coating unit is located. The at least one coating unit has at least one print head. The at least one print head is arranged connected to at least one first frame of the at least one coating unit. The at least one conveyor belt is arranged connected, via at least one deflection device and at least one radial bearing, to at least one second frame. Apart from at least one installation surface that is different from the at least one first frame and the at least one second frame, the at least one first frame is arranged in contact with the second frame at most via flexible connections.

A sheet processing machine is configured as a sheet-fed printing press. The sheet processing machine is preferably configured as a sheet processing machine for processing corrugated cardboard sheets, i.e., as a corrugated cardboard sheet processing machine. Further preferably, the sheet processing machine is configured as a sheet-fed printing press for coating and in particular for printing corrugated cardboard sheets, i.e., as a sheet-fed corrugated cardboard printing press. The processing machine configured as a sheet-fed printing press preferably has at least one and more preferably at least two units configured as modules. The at least one module and more preferably each of the at least two modules preferably has at least one drive dedicated uniquely to it. At least one of the at least two modules is preferably configured as a coating module.

The processing machine configured as sheet-fed printing press is characterized in that the sheet-fed printing press has at least one coating unit configured as a non-impact coating unit, and in that the sheet-fed printing press has at least one conveyor belt that extends with at least one conveying section of its circulation path parallel to a transport direction along a section of a transport path provided for sheets. At least one coating position of at least one coating unit of the sheet-fed printing press is arranged along the conveying section of the at least one conveyor belt, more preferably multiple coating positions. The at least one coating unit has at least one print heads, the at least one print head being arranged connected to at least one first frame of the at least one coating unit.

The at least one conveyor belt is arranged connected to at least one second frame via at least one deflection means and at least one radial bearing. The at least one first frame is arranged connected to, i.e., in contact with, the second frame at most via mechanically flexible connections, apart from at least one installation surface that is different from the at least one first frame and the at least one second frame and is located, in particular, beneath the at least one coating unit and/or beneath the sheet-fed printing press and/or beneath the at least one first frame and/or beneath the at least one second frame. Such a connection is therefore understood not necessarily as an adhesive and/or frictional and/or positive connection, but rather as direct contact or contact that is imparted indirectly via other components.

Such a flexible connection, in particular such a mechanically flexible connection, is formed, for example, by at least one or more in particular mechanically flexible components and/or by at least one or more in particular mechanically flexible assemblies. In particular, such flexible, in particular mechanically flexible connections are understood as an interposition of at least one in particular mechanically flexible component and/or an interposition of at least one in particular mechanically flexible assembly. Such mechanically flexible connections, in particular, are supply lines for power and/or data and/or gas and/or gas mixtures and/or liquids, for example, and/or are reversibly deformable bodies or assemblies that have deformable bodies, for example. Deformable bodies also include, for example, elastic bumpers and/or rubber bumpers and/or articulated connections. The at least one print head can thereby be decoupled particularly effectively from any vibrations that might be induced by the at least one conveyor belt and/or the deflection means thereof and/or the drive thereof.

In a refinement, the sheet-fed printing press is preferably additionally characterized in that the at least one coating module is configured as a printing module and/or as a non-impact coating module. In an alternative or additional refinement, the sheet-fed printing press is preferably characterized in that as at least one additional of the at least two modules, at least one coating module is provided, which is configured as a priming module and/or as a finish coating module. In an alternative or additional refinement, the sheet-fed printing press is preferably characterized in that at least one additional of the at least two modules includes at least one drying system or drying device and/or is embodied as at least one drying module. In an alternative or additional refinement, the sheet-fed printing press is preferably characterized in that said drying system or drying device or the at least one drying module has at least one energy output device embodied as a hot air source.

In an alternative or additional refinement, the sheet-fed printing press is preferably characterized in that the sheet-fed printing press is equipped with a transport path provided for the transport of sheets, and in that at least the portion of the transport path provided for sheets that is defined by the non-impact coating module is at least substantially flat and/or extends substantially horizontally. In an alternative or additional refinement, the sheet-fed printing press is preferably characterized in that at least one inspection system is located downstream of at least one coating system and/or downstream of at least one drying system or drying device with respect to a transport path provided for sheets.

In an alternative or additional refinement, the sheet-fed printing press is preferably characterized in that at least one of the at least two modules is embodied as a flexo coating module. In an alternative or additional refinement, the sheet-fed printing press is preferably characterized in that at least one diagonal register adjustment device is provided as a component of the respective flexo coating module. In an alternative or additional refinement, the sheet-fed printing press is preferably characterized in that the at least one flexo coating module is embodied as a priming module and/or as a printing module and/or as a finish coating module.

In an alternative or additional refinement, the sheet-fed printing press is preferably characterized in that, in addition to the non-impact coating module, at least one coating module configured as a priming module is provided, which is equipped with its own drying system or drying device, and at least one coating module configured as a finish coating module is provided, which is equipped with its own drying system or drying device. In an alternative or additional refinement, the sheet-fed printing press is preferably characterized in that a transport means provided for the transport of sheets through an exposure zone of the drying system or drying device of the priming module can be driven by means of a drive of the priming module and/or in that a transport means provided for the transport of sheets through an exposure zone of the drying system or drying device of the finish coating module can be driven by means of a drive of the finish coating module. In an alternative or additional refinement, the processing machine preferably configured as a sheet-fed printing press is preferably characterized in that an exposure zone of the drying system or drying device of the at least one additional of the at least two modules is located downstream of an application position of said at least one additional of the at least two modules with respect to the transport path provided for sheets.

In an alternative or additional refinement, the processing machine preferably configured as a sheet-fed printing press is preferably characterized in that the at least one non-impact coating module is equipped with at least two receiving units, identical in construction with respect to at least one coupling device and arranged in succession along a transport path provided for sheets, each receiving unit being configured for the optional accommodation of a standard assembly, each assembly being embodied as at least one print head assembly or as at least one dryer assembly.

In an alternative or additional refinement, the sheet-fed printing press is preferably characterized in that the non-impact coating module has its own, in particular integrated, drying system or drying device. In an alternative or additional refinement, the processing machine preferably configured as a sheet-fed printing press is preferably characterized in that, along the transport path provided for sheets, at least one first application position designated for the application of colored coating medium by at least one non-impact coating module is located, followed by an exposure zone of at least one drying device associated with the first application position, followed by at least one additional application position designated for the application of colored coating medium by at least one non-impact coating module, followed by an exposure zone of at least one additional drying device associated with the additional application position.

A module is preferably understood as a respective unit or a structure composed of multiple units, which has at least one controllable and/or regulable drive of its own and/or at least one transfer means for sheets and/or at least one section of a transport path provided for the transport of sheets that begins and/or ends at a standard height which is the same for a plurality of modules, without deviation or with a maximum deviation of 5 cm, and/or is configured as an independently functioning module and/or as a machine unit or functional assembly which is produced and/or assembled individually.

In an alternative or additional refinement, the processing machine preferably configured as a sheet-fed printing press is preferably characterized in that it has at least two units configured as modules and in that each of the at least two modules has at least one drive dedicated uniquely to it, and in that at least one of the at least two modules is configured as a non-impact coating module and in that at least one of the at least two modules is configured as a drying module. Like other sheet processing machines of modular construction, this machine has the advantage, in particular, that the units of the sheet processing machine configured as modules allow a cost-effective and particularly variable configuration and subsequent expansion of processing machines.

In an alternative or additional refinement, the processing machine preferably configured as a sheet-fed printing press is preferably characterized in that it has a transport path provided for the transport of sheets, and in that for a plurality of the modules of the processing machine, preferably configured as a sheet-fed printing press, more preferably for at least three and even more preferably for all of said modules, a respective section of the transport path provided for the transport of sheets, which section is defined by the respective module, has a minimum radius of curvature of at least 2 meters and/or has a direction over the entire region of the respective module that deviates no more than 30° from at least one horizontal direction. This allows even sheets of particularly great thickness that are relatively inflexible to be processed, in particular. For example, corrugated cardboard sheets measuring, e.g. 10 mm or more in thickness can be processed by said machine. Furthermore, it is ensured that modules can be easily connected to one another, again in particular without severe or even without any deformation of the sheets.

In an alternative or additional refinement, the processing machine preferably configured as a sheet-fed printing press is preferably characterized in that each of the at least two modules has at least one drive of its own, each said drive serving to effect a transport of sheets through the module in question and/or through at least one operating zone of the module in question, and/or each drive serving to directly or indirectly drive at least one component of the module in question which is intended for contact with sheets, and/or in that each of the dedicated drives is configured as a position-controlled electric motor. This increases flexibility in the assembly of individual modules and enables drive power to be optimized regardless of the overall size of the processing machine.

In an alternative or additional refinement, the processing machine preferably configured as a sheet-fed printing press is preferably characterized in that it comprises at least three modules, and in that at least one of the at least three modules is configured as a sheet feeder module and/or as a preprocessing module and/or as an infeed module and/or as a priming module and/or as a transport module and/or as a finish coating module and/or as a post-processing module and/or as a shaping module and/or as a die-cutting module and/or as a delivery module, and in that for a plurality of the modules of the sheet-fed printing press, more preferably for at least three and even more preferably for all of said modules, each module has at least one drive dedicated uniquely to it.

In an alternative or additional refinement, the processing machine preferably configured as a sheet-fed printing press is preferably characterized in that each module of the processing machine preferably configured as a sheet-fed printing press has at least one drive dedicated uniquely to it, and/or in that with the exception of an optionally provided feeder module and/or with the exception of an optionally provided delivery module, for all of the modules of the processing machine preferably configured as a sheet-fed printing press, a respective section of the transport path defined by the respective module and provided for the transport of sheets has a minimum radius of curvature of at least 2 meters and/or has a direction over the entire region of the respective module that deviates no more than 30° from at least one horizontal direction.

In an alternative or additional refinement, the processing machine preferably configured as a sheet-fed printing press is preferably characterized in that drive control systems and/or drive controllers of the individual modules can be operated individually and independently of one another, and/or in that the individual modules of the processing machine are and/or can be operated synchronized with one another with respect to their drives, and/or in that the individual modules of the processing machine are and/or can be operated synchronized with one another, at least with respect to their drives, by means of at least one electronic master axis. This enables high processing precision to be achieved despite the modular configuration.

In an alternative or additional refinement, the processing machine preferably configured as a sheet-fed printing press is preferably characterized in that the sheet processing machine has at least one unit that has at least one suction transport means, configured as a suction belt, for the transport of sheets in a transport direction, and in that this at least one suction belt has at least three conveyor belts arranged side by side and spaced from one another with respect to a transverse direction that in particular is oriented orthogonally to the transport direction, and in that at least one displacement means is provided, by means of which at least one of the at least three conveyor belts is displaceable sideways, in and/or opposite the transverse direction, in particular as an entire unit and/or linearly and/or without any pivoting movement, said displacement in particular being adjustable. More preferably, the at least one unit for aligning sheets with respect to the transverse direction has at least one lateral stop, in particular fixed in place while the sheet processing machine is in operation, and/or at least one side lay mark, in particular fixed in place while the sheet processing machine is in operation, and even more preferably at least two such lateral stops and/or at least two such side lay marks.

In an alternative or additional refinement, the processing machine preferably configured as a sheet-fed printing press is preferably characterized in that it has at least three modules, and each of at least two of the modules has at least one transfer means that serves to facilitate or carry out the transport of sheets between the module in question and at least one other module, and/or in that a section of a transport path provided for sheets, which is defined by the module in question, begins at a respective intake height of the module in question and/or ends at a respective outlet height of the module in question, and for a plurality of modules of the processing machine, the respective intake height of the module in question deviates no more than 5 cm from the same first standard height and/or the respective outlet height of the module in question deviates no more than 5 cm from the same first standard height, and/or the respective intake height of the module in question deviates no more than 5 cm from the respective outlet height of the module in question. This ensures, in particular, that modules can be easily connected to one another, once again in particular without severe or even without any deformation of the sheets.

In an alternative or additional refinement, the processing machine preferably configured as a sheet-fed printing press is preferably characterized in that at least the non-impact coating module and the drying module each have at least one suction transport means and/or in that the non-impact coating module is configured as an inkjet coating module. This enables particularly precise printing, in particular even for flexible print images.

In an alternative or additional refinement, the processing machine preferably configured as a sheet-fed printing press is preferably characterized in that the non-impact coating module has at least one and preferably precisely one transport means configured as a suction belt.

In an alternative or additional refinement, the processing machine preferably configured as a sheet-fed printing press is preferably characterized in that the width of the conveyor belt of the at least one suction belt of the coating system, in particular the non-impact coating system, measured in the transverse direction, is at least 30 cm, preferably at least 50 cm, more preferably at least 100 cm, and even more preferably at least 150 cm.

In an alternative or additional refinement, the processing machine preferably configured as a sheet-fed printing press is preferably characterized in that the at least one coating module, in particular a non-impact coating module, has at least one platform for at least one press operator, which is and/or can be positioned, at least intermittently, vertically above the suction belt, in particular above the conveyor belt of the suction belt.

In an alternative or additional refinement, the processing machine preferably configured as a sheet-fed printing press is preferably characterized in that at least one tensioning means for adjusting and/or maintaining in particular a mechanical tension of the conveyor belt of the suction belt is provided, in particular positioned in contact with the conveyor belt. Preferably, the at least one tensioning means is arranged so as to be displaceable in and/or opposite at least one tensioning direction, and/or all components of the at least one tensioning means that are in contact with the at least one conveyor belt are arranged so as to be movable collectively in a linear fashion.

In an alternative or additional refinement, the processing machine preferably configured as a sheet-fed printing press is preferably characterized in that at least one after-drying system is provided, which is equipped with at least one air outlet opening arranged aligned at least partially toward the at least one and preferably precisely one transport means of the non-impact coating module, configured as a suction belt, and more preferably in that at least one air supply line of said at least one after-drying system is connected to at least one air exhaust line of at least one drying system or drying device located upstream with respect to the transport direction of the suction belt for the purpose of transmitting energy and/or transmitting gas by means of at least one gas line and/or by means of at least one heat exchanger.

In an alternative or additional refinement, the processing machine preferably configured as a sheet-fed printing press is preferably characterized in that the drying system or drying device has at least one energy output device configured as an infrared radiation source and/or in that the drying system or drying device has at least one energy output device configured as a UV radiation source and/or in that the drying system or drying device has at least one energy output device configured as an electron beam source.

In an alternative or additional refinement, the processing machine preferably configured as a sheet-fed printing press is preferably characterized in that at least one of the at least two modules is configured as a substrate supply system, and in that at least one of the at least two modules is configured as a printing module, and in that the substrate supply system has at least one primary acceleration means having a primary drive or primary acceleration drive of the substrate supply system and has at least one secondary acceleration means, located downstream of the at least one primary acceleration means along a transport path provided for sheets and having a secondary drive or secondary acceleration drive of the substrate supply system, and in that the at least one primary acceleration means is located below a storage space provided for storage of a pile of sheets, and in that a drive for the transport of sheets, which is different from the primary drive of the substrate supply system and the secondary drive of the substrate supply system, is assigned to the at least one printing module. This has the advantage, in particular, that the sheets can be accelerated particularly effectively, independently of printing operations.

In an alternative or additional refinement, the processing machine preferably configured as a sheet-fed printing press is preferably characterized in that the processing machine preferably configured as a sheet-fed printing press has at least three units configured as modules, and in that each of the at least three modules has at least one drive dedicated uniquely to it, and/or in that the sheet-fed printing press has a plurality of units configured as printing modules, each of which has at least one drive dedicated uniquely to it.

In an alternative or additional refinement, the processing machine preferably configured as a sheet-fed printing press is preferably characterized in that the at least one primary acceleration means is configured as at least one acceleration means that acts in each case on the bottommost sheet of a pile, and/or in that the at least one printing module is configured as a printing module that applies coating medium from above, and/or the at least one printing module is configured as a non-impact coating unit and/or as an inkjet printing unit. If a plurality of printing modules are provided, the above preferably applies to a plurality of the printing modules, and more preferably to all of the printing modules. In an alternative or additional refinement, the processing machine preferably configured as a sheet-fed printing press is preferably characterized in that the drying system or drying device is configured as a drying system or drying device that dries and/or is capable of drying from above.

In an alternative or additional refinement, the processing machine preferably configured as a sheet-fed printing press is preferably characterized in that sheets are and/or can be accelerated by means of the at least one primary acceleration means to a first speed, and in that sheets are and/or can be accelerated by means of the at least one secondary acceleration means in particular from the first speed to a second speed which is greater than the first speed, and/or in that the second speed is a printing speed intended for transporting the sheets through the at least one printing unit.

In an alternative or additional refinement, the processing machine preferably configured as a sheet-fed printing press is preferably characterized in that it has at least two units configured as modules and in that each of the at least two modules preferably has at least one drive dedicated uniquely to it, and in that at least one of the at least two modules is preferably a sheet feeder module configured as a substrate supply system, and in that the substrate supply system preferably has at least one primary acceleration means having a primary drive of the substrate supply system and at least one secondary acceleration means having a secondary drive of the substrate supply system and being arranged downstream of the at least one primary acceleration means in the transport direction along a transport path provided for the transport of sheets, and in that at least one additional drive for the transport of sheets, which is different from the primary drive of the substrate supply system and the secondary drive of the substrate supply system, is preferably associated with at least one additional module. In an alternative or additional refinement, the processing machine preferably configured as a sheet-fed printing press is preferably characterized in that the primary drive and the secondary drive and the at least one additional drive are each configured as a position-controlled electric motor, and in that a drive controller of the primary drive is different from a drive controller of the secondary drive, and in that further preferably, a drive controller of the at least one additional drive is different from the drive controller of the primary drive and from the drive controller of the secondary drive, and in that preferably the drive controller of the primary drive and the drive controller of the secondary drive, and more preferably also the drive controller of at least one additional drive are connected in terms of circuitry to a machine controller of the sheet processing machine. In an alternative or additional refinement, the processing machine preferably configured as a sheet-fed printing press is preferably characterized in that at least one sheet sensor of the substrate supply system is arranged aligned toward the provided transport path for the purpose of detecting a respective leading edge and/or a respective trailing edge of respective sheets. The detection zone of said at least one sheet sensor preferably overlaps with the transport path provided for the transport of sheets.

In an alternative or additional refinement, the processing machine preferably configured as a sheet-fed printing press is preferably characterized in that a drive controller of the primary drive is different from a drive controller of the secondary drive, and in that a drive controller of the drive of the printing module is different from the drive controller of the primary drive and from the drive controller of the secondary drive, and/or in that a drive controller of the primary drive and a drive controller of the secondary drive, different from that of the primary drive, and a drive controller of the drive of the printing module, different from that of the secondary drive, are connected in terms of circuitry to a machine controller of the sheet processing machine configured, in particular, as a sheet-fed printing press.

In an alternative or additional refinement, the processing machine preferably configured as a sheet-fed printing press is preferably characterized in that as the at least one primary acceleration means, a plurality of subsets of primary acceleration means are provided, which can be operated, at least intermittently, at sheet speeds that are different from subset to subset, and/or each of which has at least one respective primary drive assigned to only that respective subset of acceleration means, and/or the at least one primary acceleration means is configured as at least one transport roller and/or as at least one conveyor belt and/or as at least one suction transport means and/or as at least one suction belt and/or as at least one suction box belt and/or as at least one roller suction system and/or as at least one suction gripper and/or as at least one suction roller. Each such subset may have one primary acceleration means or a plurality of primary acceleration means.

In an alternative or additional refinement, the processing machine preferably configured as a sheet-fed printing press is preferably characterized in that the at least one secondary acceleration means is configured as at least one outgoing transport means of the substrate supply system and/or as at least one transport roller and/or as at least one pair of transport rollers that together form a transport nip and/or as at least one vacuum transport means and/or as at least one pair of conveyor belts that together form a transport nip.

In an alternative or additional refinement, the processing machine preferably configured as a sheet-fed printing press is preferably characterized in that the at least one primary acceleration means is at the same time configured as a sheet alignment means for alignment with respect to the transverse direction and/or a pivot position, and/or in that the at least one secondary acceleration means is at the same time configured as a sheet alignment means for alignment with respect to the transverse direction and/or a pivot position.

In an alternative or additional refinement, the processing machine preferably configured as a sheet-fed printing press is preferably characterized in that it has at least one suction transport means configured as a suction belt, and in that said at least one suction transport means has at least one conveyor belt, in particular a flexible conveyor belt, which extends with at least one conveying section of its circulation path parallel to a transport direction along a section of a transport path provided for the transport of sheets, in particular over a transport length. Preferably, the at least one conveyor belt has a multiplicity of suction openings. At least two, more preferably at least three, even more preferably at least five, and more preferably still at least ten vacuum pressure chambers, which in particular are and/or can be separated from one another with respect to the transport direction and each of which has at least one suction inlet, are preferably arranged one behind the other along the transport path provided for the transport of sheets. Preferably, the conveying section of the circulation path of the at least one conveyor belt at least partially covers at least one suction inlet of multiple and/or of all of these vacuum pressure chambers arranged one behind the other. This enables even sheets that are relatively thick, for example, or that for other reasons are relatively inflexible, in particular corrugated cardboard sheets, to still be transported very precisely and safely and in a flat position, even if these sheets are under tension and/or curved and/or resistant to flat positioning, and/or even if said sheets tend to lift away from edge regions or center regions of a conveyor belt, for example. This is possible, in particular, even when working with small sheets 02 and/or with large distances between sheets 02 and/or with a first sheet 02 and/or with a last sheet 02.

In an alternative or additional refinement, the processing machine preferably configured as a sheet-fed printing press is preferably characterized in that it has at least one conveyor belt, which preferably extends with at least one conveying section of its circulation path parallel to a transport direction along a section of a transport path provided for sheets. At least one coating position and more preferably multiple coating positions of at least one coating unit of the sheet-fed printing press is/are preferably arranged along the conveying section of the at least one conveyor belt. Preferably, at least one belt alignment means of the at least one conveyor belt is arranged in contact with the at least one conveyor belt. By adjusting the position of the at least one belt alignment means relative to at least one, in particular stationary frame of the processing machine preferably configured as a sheet-fed printing press, the position of the at least one conveyor belt can preferably be influenced with respect to a horizontal transverse direction oriented orthogonally to the transport direction. In an alternative or additional refinement, the processing machine preferably configured as a sheet-fed printing press is preferably characterized in that the at least one belt alignment means has at least one alignment drive configured, for example, as an electric motor and/or as a pneumatic cylinder and/or as a hydraulic cylinder and/or as a linear drive, and/or in that the at least one belt alignment means is configured as controllable and/or regulable by means of a computer system.

In an alternative or additional refinement, the processing machine preferably configured as a sheet-fed printing press is preferably characterized in that the at least one belt alignment means is configured as at least one belt alignment roller, the axis of rotation of which is adjustable in terms of its orientation, and/or in that the at least one belt alignment means has at least one radial bearing, the axis of rotation of which is displaceable at least with respect to an adjustment direction, at least relative to at least one, in particular stationary frame of the processing machine preferably configured as a sheet-fed printing press, and/or in that the at least one belt alignment means has at least two radial bearings, arranged spaced apart in the transverse direction, the axes of rotation of which are displaceable, at least with respect to an adjustment direction, at least relative to one another and/or independently of one another and/or relative to at least one, in particular stationary frame of the processing machine preferably configured as a sheet-fed printing press. Preferably, the at least one radial bearing is linearly displaceable at least in and/or opposite the adjustment direction, and/or the at least two radial bearings are linearly displaceable at least in and/or opposite the adjustment direction.

In an alternative or additional refinement, the processing machine preferably configured as a sheet-fed printing press is preferably characterized in that the sheet-fed printing press has at least one coating unit configured as a non-impact coating unit, and in that the sheet-fed printing press has at least one conveyor belt that extends with at least one conveying section of its circulation path parallel to a transport direction along a section of a transport path provided for sheets. At least one coating position and more preferably multiple coating positions of at least one coating unit of the sheet-fed printing press is/are preferably arranged along the conveying section of the at least one conveyor belt. Preferably, the at least one coating unit has at least one print head, and the at least one print head is further preferably arranged connected to at least a first frame of the at least one coating unit. Preferably, the at least one conveyor belt is arranged connected to at least one second frame via at least one deflection means and at least one radial bearing. Further preferably, the at least one first frame, with the exception of at least one of installation surface that is different from the at least one first frame and the at least one second frame and is located, in particular, beneath the at least one coating unit and/or beneath the sheet-fed printing press and/or beneath the at least one first frame and/or beneath the at least one second frame, is arranged connected to, i.e., in contact with, the second frame at most via in particular mechanically flexible connections. Such a connection is therefore understood not necessarily as an adhesive and/or frictional and/or positive connection, but rather as contact that is imparted directly or indirectly via other components.

Such a flexible connection, in particular such a mechanically flexible connection, is formed, for example, by at least one or more in particular mechanically flexible components and/or by at least one or more in particular mechanically flexible assemblies. In particular, such flexible, in particular mechanically flexible connections are understood as an interposition of at least one in particular mechanically flexible component and/or an interposition of at least one in particular mechanically flexible assembly. Such mechanically flexible connections, in particular, are supply lines for power and/or data and/or gas and/or gas mixtures and/or liquids, for example, and/or are reversibly deformable bodies or assemblies that have deformable bodies, for example. Deformable bodies also include, for example, elastic bumpers and/or rubber bumpers and/or articulated connections. The at least one print head can thereby be decoupled particularly effectively from any vibrations that might be induced by the at least one conveyor belt and/or the deflection means thereof and/or the drive thereof.

In an alternative or additional refinement, the processing machine preferably configured as a sheet-fed printing press is preferably characterized in that at least one protrusion sensor for detecting at least one spatial extension of sheets is arranged along a transport path provided for the transport of sheets, and/or in that at least one compression device is provided, which has at least one first compression member and at least one second compression member and at least one force element, and/or in that the at least one first compression member is movable by means of the at least one force element from a pass-through position toward the at least one second compression member into a compression position, and/or in that when the first compression element is in the pass-through position, the at least one force element is prestressed, and/or in that the at least one compression device has at least one retention device, which can be switched at least between a retention state and a release state, and which in the retention state is disposed so as to prevent any movement of the at least one first compression member from its pass-through position into its compression position.

Preferred is a method for operating a processing machine configured, in particular, as a sheet-fed printing press, wherein at least one sheet is transported by means of a suction transport means configured as a suction belt and having at least one conveyor belt, in particular a flexible conveyor belt, at least one conveying section of the circulation path of which moves, in particular over a transport length, parallel to a transport direction along a section of a transport path intended for sheets, and wherein at least two, more preferably at least three, even more preferably at least five, and more preferably still at least ten vacuum pressure chambers, each of which has at least one suction inlet, and which are separated and/or separable from one another in particular with respect to the transport direction, are arranged one behind the other along the transport path intended for sheets. The conveying section of the circulation path of the at least one conveyor belt preferably at least partially covers at least one suction inlet of multiple and/or all of these vacuum pressure chambers arranged one behind the other. In that case, the respective vacuum pressure of the at least two vacuum pressure chambers arranged one behind the other is preferably influenced individually and at varying times depending at least upon data that characterize the position of the at least one sheet along the conveying section of the circulation path of the at least one conveyor belt. In this way, suction power and thus energy can be saved, in particular because, at least intermittently, no attempts are then made to apply vacuum pressure to vacuum pressure chambers that are not adequately sealed.

Preferred is a method for operating a processing machine configured in particular as a sheet-fed printing press. The method is preferably characterized in that sheets coming from a pile are singulated. In an alternative or additional refinement, the method is preferably characterized in that the sheets are each accelerated to a first speed by means of at least one primary acceleration means of a substrate supply system, driven by a primary drive, with the at least one primary drive more preferably being configured as a position-controlled electric motor. In an alternative or additional refinement, the method is preferably characterized in that the sheets are then each accelerated to a second speed by means of at least one secondary acceleration means of the substrate supply system, driven by a secondary drive, wherein the at least one secondary drive is more preferably configured as a position-controlled electric motor and/or the second speed is greater than the first speed. In an alternative or additional refinement, the method is preferably characterized in that each of the sheets is then accelerated by means of said at least one secondary acceleration means to a third speed, which is greater than the second speed, and in that afterward, each of the sheets is decelerated, in particular by means of said at least one secondary acceleration means, back to the second speed.

In an alternative or additional refinement, the method is preferably characterized in that the sheets are transported along a transport path from the substrate supply system to at least one additional module of the sheet processing machine, in particular at least one printing module, and wherein thereafter, the sheets are each transported by means of at least one drive of the at least one additional module, in particular of the at least one printing module, at a processing speed, in particular printing speed, through the respective additional module, in particular printing module, and are processed, in particular printed, in said respective additional module, in particular printing module. The first speed is preferably lower than the processing speed, in particular the printing speed. The processing speed, in particular the printing speed, is preferably equal to the second speed. The first speed and the second speed and the third speed and the processing speed and the printing speed always refer to the transport speed of the sheets and/or the surface speed or circumferential speed of the respective component or acceleration means.

The method is preferably alternatively or additionally characterized in that the printing speed is equal to the second speed, and/or in that the second speed is higher than the first speed and/or the first speed is at least 10%, more preferably at least 20%, and even more preferably at least 30% lower than the processing speed, in particular the printing speed, and/or in that the first speed amounts to at least 20%, more preferably at least 30%, and even more preferably at least 40% of the second speed, and/or in that the first speed amounts to at most 80%, and more preferably at most 70%, and even more preferably at most 60% of the second speed, and/or in that the third speed is at least 10%, and more preferably at least 20%, and even more preferably at least 30%, and more preferably still at least 50% higher than the second speed.

In an alternative or additional refinement, the method is preferably characterized in that at least one sheet sensor detects a trailing edge of a preceding sheet and generates a trailing edge signal, and in that at least one sheet sensor detects a leading edge of a subsequent sheet and generates a leading edge signal, and in that the acceleration and/or the deceleration of the respective, in particular subsequent sheet is controlled and/or regulated by means of the at least one secondary acceleration means, factoring in the trailing edge signal and the leading edge signal.

In an alternative or additional refinement, the method is preferably characterized in that the at least one primary drive and the at least one secondary drive are operated in synchronization with one another, in particular factoring in the trailing edge signal and/or the leading edge signal, such that a gap between a preceding sheet and a subsequent sheet is reduced and/or adjusted to a value within a predefined tolerance range around a target value.

In an alternative or additional refinement, the method is preferably characterized in that a primary acceleration profile for the at least one primary acceleration means and/or the primary drive thereof is stored, and/or in that a secondary acceleration profile for the at least one secondary acceleration means and/or the secondary drive thereof is stored, and/or in that based upon signals from the at least one sheet sensor, the primary acceleration profile and/or preferably the secondary acceleration profile is modified.

Preferably, the method is alternatively or additionally characterized in that each of the sheets is in contact at least at one point in time with both the primary acceleration means and the secondary acceleration means.

Preferably, the method is alternatively or additionally characterized in that a deceleration of the at least one primary acceleration means does not cause any deceleration of the respective sheet accelerated immediately previously by said primary acceleration means and/or in that a deceleration of the at least one secondary acceleration means does not cause any deceleration of the respective sheet accelerated immediately previously by said secondary acceleration means. This is due to the fact, for example, that the respective acceleration means is not decelerated until the sheet has already moved out of contact with said acceleration means.

Preferably, the method is alternatively or additionally characterized in that the sheets are printed from above in the at least one printing module and/or in that the sheets are printed from above in the at least one printing module by means of a non-impact printing method and/or by means of an inkjet printing method.

Preferably, the method is alternatively or additionally characterized in that the at least one primary acceleration means is brought into contact with the sheets on the underside of each sheet, in particular exclusively with the underside of each sheet, and/or in that the at least one secondary acceleration means has at least one transport nip in which the sheets are at least partially disposed while the at least one secondary acceleration means is accelerating them to the second speed.

Preferably, the method is alternatively or additionally characterized in that during the acceleration by means of the at least one primary acceleration means, a displacement of the respective sheet in a transverse direction and/or a pivoting movement of the respective sheet about a pivot axis extending orthogonally to the transverse direction and/or an adjustment of a phase position of the respective sheet to at least one subsequent sheet-transporting component of the processing machine preferably configured as a sheet-fed printing press is carried out, and/or in that during the acceleration by means of the at least one secondary acceleration means, a displacement of the respective sheet with respect to the transverse direction and/or a pivoting movement of the respective sheet about a pivot axis extending orthogonally to the transverse direction and/or an adjustment of a phase position of the respective sheet to at least one subsequent sheet-transporting component of the processing machine preferably configured as a sheet-fed printing press is carried out.

Preferably, the method is alternatively or additionally characterized in that the substrate supply system is configured as a module of the processing machine preferably configured as a sheet-fed printing press.

BRIEF DESCRIPTION OF THE DRAWINGS

Exemplary embodiments of the invention are illustrated in the set of drawings and will be described in greater detail below.

In the drawings:

FIG. 24 shows a schematic, perspective diagram of a sheet feeder unit according to

FIG. 23;

DESCRIPTION OF THE PREFERRED EMBODIMENTS

Figure 1:
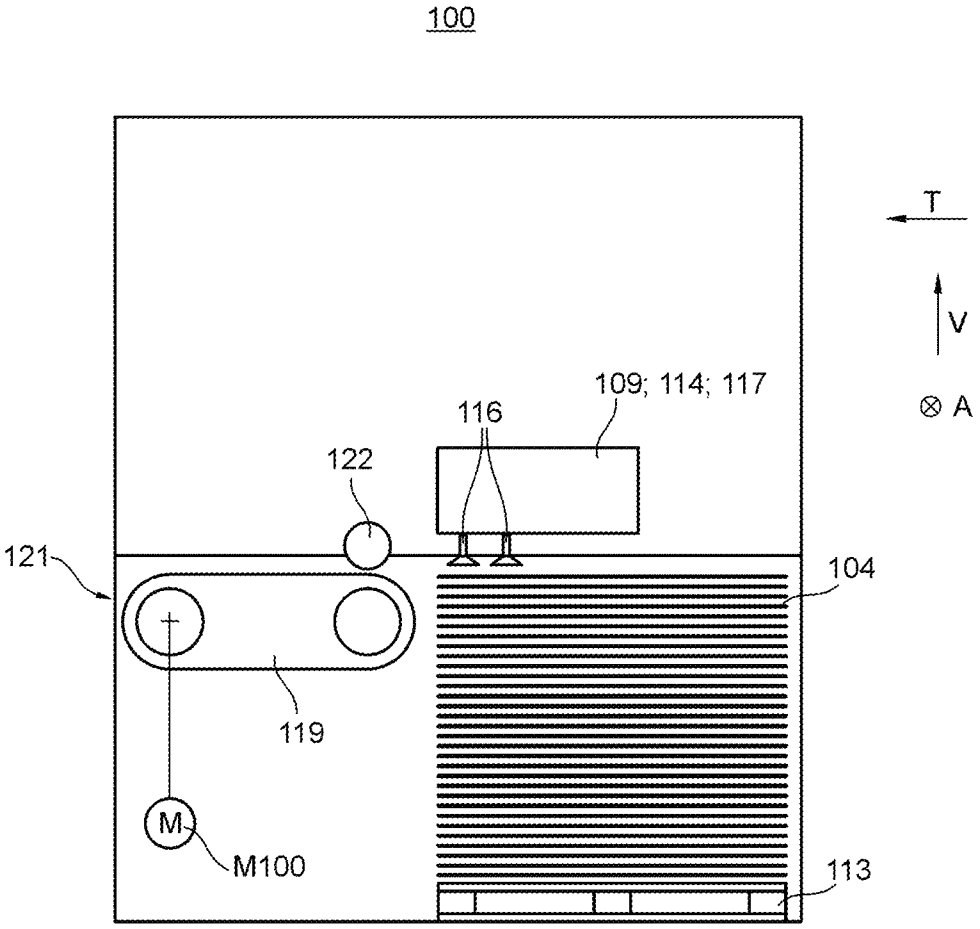
FIG. 1 shows a schematic diagram of a sheet feeder unit.

In the foregoing and in the following, the term coating medium or printing fluid refers to inks and printing inks, but also to primers, finish coatings, and pasty materials. Printing fluids are preferably materials that are and/or can be transferred by means of a processing machine 01, in particular a printing press 01, or at least one coating unit 400; 600; 800 of the processing machine 01, in particular at least one printing unit 600 of the printing press 01, onto a substrate 02, in particular a printing substrate 02, thereby forming a texture, preferably in finely structured form and/or not merely over a large area, which is preferably visible and/or sensorially perceptible and/or mechanically detectable on the substrate 02, in particular the printing substrate 02. Inks and printing inks are preferably solutions or dispersions of at least one colorant in at least one solvent. Suitable solvents include water and/or organic solvents, for example. Alternatively or additionally, the printing fluid may be embodied as printing fluid that is cured under UV light. Inks are relatively low-viscosity printing fluids and printing inks are relatively high-viscosity printing fluids. Inks preferably contain no binding agent or relatively little binding agent, whereas printing inks preferably contain a relatively large amount of binding agent, and further preferably contain additional auxiliary agents. Colorants may be pigments and/or dyes, with pigments being insoluble in the application medium, whereas dyes are soluble in the application medium.

In the interest of simplicity, in the foregoing and in the following—unless otherwise explicitly distinguished and specified—the term "printing ink" is understood to refer to a liquid or at least flowable fluid colorant to be used for printing in the printing press, and is not limited merely to the higher viscosity fluid colorants more frequently associated colloquially with the expression "printing ink" for use in rotary printing presses, but in addition to these higher viscosity fluid colorants particularly also includes lower viscosity fluid colorants such as "inks", in particular inkjet inks, but also powdered fluid colorants, such as toners, for example. Thus in the foregoing and in the following, when printing fluids and/or inks and/or printing inks are mentioned, this also includes colorless finish coatings. In the foregoing and in the following, when printing fluids and/or inks and/or printing inks are mentioned, this also preferably includes, in particular, means for pretreating (priming or precoating) the printing substrate 02. The term coating medium may be understood as synonymous with the term printing fluid.

A processing machine 01 is preferably configured as a printing press 01. Processing machine 01 is preferably configured as a sheet processing machine 01, i.e. as a processing machine 01 for processing sheet-format substrate 02 or sheets 02, in particular sheet-format printing substrate 02. Processing machine 01 is further preferably configured as a corrugated cardboard sheet processing machine 01, i.e. as a processing machine 01 for processing sheet-format substrate 02 or sheets 02 of corrugated cardboard, in particular sheet-format printing substrate 02 made of corrugated cardboard. More preferably, processing machine 01 is configured as a sheet-fed printing press 01, in particular as a sheet-fed corrugated cardboard printing press 01, i.e., as a printing press 01 for coating and/or printing of sheet-format substrate 02 or sheets 02 of corrugated cardboard, in particular sheet-format printing substrate 02 made of corrugated cardboard. For example, printing press 01 is configured as a printing press 01 that operates according to a non-impact printing method and/or as a printing press 01 that operates according to a printing method requiring printing formes. Preferably, printing press 01 is configured as a non-impact printing press 01, in particular as an inkjet printing press 01 and/or as a flexo printing press 01. The printing press comprises at least one flexo coating unit 400; 600; 800, for example. Alternatively or additionally, coating machine 01 preferably includes at least one non-impact coating unit 400; 600; 800, in particular jet coating unit 400; 600; 800 or inkjet coating unit 400; 600; 800.

Unless otherwise explicitly stated, in this context the term sheet-format substrate 02, in particular, a printing substrate 02, specifically sheet 02, refers, in principle, to any flat substrate 02 in the form of sections, i.e. including panel-shaped or board-shaped substrates 02, i.e. including panels or boards. The sheet-format substrate 02 or the sheet 02 so defined is made, for example, of paper or cardboard, i.e. in the form of paper or cardboard sheet, or is composed of sheets 02, panels, or optionally boards made of plastic, cardboard, glass, or metal. More preferably, the substrate 02 is corrugated cardboard 02, in particular corrugated cardboard sheets 02. The thickness of a sheet 02 is preferably understood as a dimension orthogonally to the largest surface area of the sheet 02. This largest surface area is also called the main surface area. The thickness of sheet 02 is, for example, at least 0.1 mm, more preferably at least 0.3 mm and even more preferably at least 0.5 mm. With corrugated cardboard sheets 02 in particular, even significantly greater thicknesses are common, for example at least 4 mm or even 10 mm or more. Corrugated cardboard sheets 02 are relatively stable and therefore not very flexible. Appropriate adjustments to processing machine 01 therefore facilitate the processing of sheets 02 of significant thickness.

Processing machine 01 preferably comprises a plurality of units 100; 200; 300; 400; 500; 550; 600; 700; 800; 900; 1000. Each unit 100; 200; 300; 400; 500; 550; 600; 700; 800; 900; 1000 is preferably understood as a group of systems that function in cooperation, in particular to carry out a preferably self-contained processing of sheets 02. For example, at least two and preferably at least three, and more preferably all of the units 100; 200; 300; 400; 500; 550; 600; 700; 800; 900; 1000 are configured as modules 100; 200; 300; 400; 500; 550; 600; 700; 800; 900; 1000 or are at least each associated with such a module. A module 100; 200; 300; 400; 500; 550; 600; 700; 800; 900; 1000 is understood, in particular, as a respective unit 100; 200; 300; 400; 500; 550; 600; 700; 800; 900; 1000 or as a structure composed of a plurality of units 100; 200; 300; 400; 500; 550; 600; 700; 800; 900; 1000, which preferably comprises at least one transport means 111; 117; 119; 136; 211; 311; 411; 417; 511; 561; 611; 617; 711; 811; 817; 911; 1011 and/or at least one controllable and/or regulable drive M100; M200; M300; M400; M401; M500; M550; M600; M601; M700; M800; M801; M900; M1000 dedicated uniquely thereto and/or at least one transfer means 03 for sheets 02 and/or at least one section of a transport path provided for the transport of sheets 02, which section begins and/or ends at a first standard height which is the same for a plurality of modules 100; 200; 300; 400; 500; 550; 600; 700; 800; 900; 1000, without deviation or with a maximum deviation of 5 cm, preferably a maximum of 1 cm and more preferably a maximum of 2 mm, and/or is configured as an independently functioning module 100; 200; 300; 400; 500; 550; 600; 700; 800; 900; 1000 and/or as a machine unit or functional assembly which is produced and/or installed as a separate entity.

A controllable and/or regulable drive M100; M200; M300; M400; M401; M500; M550; M600; M601; M700; M800; M801; M900; M1000 dedicated solely to a unit or module is understood, in particular, as a drive M100; M200; M300; M400; M401; M500; M550; M600; M601; M700; M800; M801; M900; M1000 that serves to drive movements of components of said unit or module and/or that serves to effect the transport of sheets 02 through said unit or module and/or through at least one operational zone of said unit or module and/or that serves to directly or indirectly drive at least one component of said unit or module that is intended for contact with sheets 02. The drives M100; M200; M300; M400; M401; M500; M550; M600; M601; M700; M800; M801; M900; M1000 of the units 100; 200; 300; 400; 500; 550; 600; 700; 800; 900; 1000 and/or modules 100; 200; 300; 400; 500; 550; 600; 700; 800; 900; 1000 of processing machine 01 are preferably configured as motors M100; M200; M300; M400; M401; M500; M550; M600; M601; M700; M800; M801; M900; M1000, in particular electric motors M100; M200; M300; M400; M401; M500; M550; M600; M601; M700; M800; M801; M900; M1000, more preferably as position-controlled electric motors M100; M200; M300; M400; M401; M500; M550; M600; M601; M700; M800; M801; M900; M1000.

Each unit 100; 200; 300; 400; 500; 550; 600; 700; 800; 900; 1000 or module 100; 200; 300; 400; 500; 550; 600; 700; 800; 900; 1000 preferably has at least one drive control system and/or at least one drive controller associated with the respective at least one drive M100; M200; M300; M400; M401; M500; M550; M600; M601; M700; M800; M801; M900; M1000 of the respective unit 100; 200; 300; 400; 500; 550; 600; 700; 800; 900; 1000 or module 100; 200; 300; 400; 500; 550; 600; 700; 800; 900; 1000. The drive control systems and/or drive controllers of the individual units 100; 200; 300; 400; 500; 550; 600; 700; 800; 900; 1000 or modules 100; 200; 300; 400; 500; 550; 600; 700; 800; 900; 1000 are preferably individually and independently operable. More preferably, the drive control systems and/or drive controllers of the individual units 100; 200; 300; 400; 500; 550; 600; 700; 800; 900; 1000 or modules 100; 200; 300; 400; 500; 550; 600; 700; 800; 900; 1000 are and/or can be linked to one another in terms of circuitry such that a synchronized control and/or regulation of the drives M100; M200; M300; M400; M401; M500; M550; M600; M601; M700; M800; M801; M900; M1000 of some or of all the units 100; 200; 300; 400; 500; 550; 600; 700; 800; 900; 1000 and/or in particular the modules 100; 200; 300; 400; 500; 550; 600; 700; 800; 900; 1000 of the processing machine 01 is and/or can be carried out.

The synchronized control and/or regulation of the drives M100; M200; M300; M400; M401; M500; M550; M600; M601; M700; M800; M801; M900; M1000 of some or of all the units 100; 200; 300; 400; 500; 550; 600; 700; 800; 900; 1000 and/or in particular modules 100; 200; 300; 400; 500; 550; 600; 700; 800; 900; 1000 of the processing machine 01 is preferably carried out and/or monitored by a machine control system of processing machine 01. The synchronized control and/or regulation of the drives M100; M200; M300; M400; M401; M500; M550; M600; M601; M700; M800; M801; M900; M1000 of some or of all the units 100; 200; 300; 400; 500; 550; 600; 700; 800; 900; 1000 and/or in particular modules 100; 200; 300; 400; 500; 550; 600; 700;

800; 900; 1000 of processing machine 01 is preferably carried out using at least one bus system.

The individual units 100; 200; 300; 400; 500; 550; 600; 700; 800; 900; 1000 and/or in particular modules 100; 200; 300; 400; 500; 550; 600; 700; 800; 900; 1000 of processing machine 01 therefore preferably are and/or can be operated synchronized electronically with one another at least with respect to their drives M100; M200; M300; M400; M401; M500; M550; M600; M601; M700; M800; M801; M900; M1000, in particular by means of at least one electronic master axis. For this purpose, an electronic master axis is preferably provided, for example by a higher-level machine control system of processing machine 01. To generate the electronic master axis, the higher-level machine control system uses components of a specific control system and/or a specific controller of a specific unit 100; 200; 300; 400; 500; 550; 600; 700; 800; 900; 1000 or module 100; 200; 300; 400; 500; 550; 600; 700; 800; 900; 1000, for example. Preferably some, and more preferably all of the units 100; 200; 300; 400; 500; 550; 600; 700; 800; 900; 1000 and/or modules 100; 200; 300; 400; 500; 550; 600; 700; 800; 900; 1000 are configured such that they can be used as a master unit 100; 200; 300; 400; 500; 550; 600; 700; 800; 900; 1000 and/or as a master module 100; 200; 300; 400; 500; 550; 600; 700; 800; 900; 1000 that is and/or can be followed by the remaining units 100; 200; 300; 400; 500; 550; 600; 700; 800; 900; 1000 and/or modules 100; 200; 300; 400; 500; 550; 600; 700; 800; 900; 1000 during operation of the processing machine 01. Alternatively or additionally, the individual units 100; 200; 300; 400; 500; 550; 600; 700; 800; 900; 1000 and/or in particular modules 100; 200; 300; 400; 500; 550; 600; 700; 800; 900; 1000 of processing machine 01 are and/or can be synchronized with one another, for example mechanically, at least with respect to their drives M100; M200; M300; M400; M401; M500; M550; M600; M601; M700; M800; M801; M900; M1000. Preferably, however, the individual units 100; 200; 300; 400; 500; 550; 600; 700; 800; 900; 1000 and/or in particular modules 100; 200; 300; 400; 500; 550; 600; 700; 800; 900; 1000 of the processing machine 01 are uncoupled from one another mechanically, at least with respect to their drives M100; M200; M300; M400; M401; M500; M550; M600; M601; M700; M800; M801; M900; M1000.

Regardless of the specific functional configuration of a given unit 100; 200; 300; 400; 500; 550; 600; 700; 800; 900; 1000 or module 100; 200; 300; 400; 500; 550; 600; 700; 800; 900; 1000, said unit 100; 200; 300; 400; 500; 550; 600; 700; 800; 900; 1000 or module 100; 200; 300; 400; 500; 550; 600; 700; 800; 900; 1000 is preferably equipped with at least one transfer means 03, which preferably serves to assist with or carry out the transport of sheets 02 between said unit 100; 200; 300; 400; 500; 550; 600; 700; 800; 900; 1000 or module 100; 200; 300; 400; 500; 550; 600; 700; 800; 900; 1000 and at least one other unit 100; 200; 300; 400; 500; 550; 600; 700; 800; 900; 1000 and/or at least one other module 100; 200; 300; 400; 500; 550; 600; 700; 800; 900; 1000. This preferably applies to some and more preferably to all the units 100; 200; 300; 400; 500; 550; 600; 700; 800; 900; 1000 or modules 100; 200; 300; 400; 500; 550; 600; 700; 800; 900; 1000, and even more preferably to all but one, for example a sheet feeder unit 100. In this context, a transfer means 03 is preferably understood as a means that facilitates and/or carries out a transfer. This also includes means that receive and/or pass on sheets 02. For example, the at least one transfer means 03 is configured as a forward transfer means 03 and/or is positioned upstream of a processing zone of the respective unit 100; 200; 300; 400; 500; 550; 600; 700; 800; 900; 1000 or module 100; 200; 300; 400; 500; 550; 600; 700; 800; 900; 1000 with respect to a transport direction T and/or with regard to the transport path provided for sheets 02. Alternatively or additionally, the at least one transfer means is configured as a rear transfer means and/or is positioned downstream of the processing zone of the respective unit 100; 200; 300; 400; 500; 550; 600; 700; 800; 900; 1000 or module 100; 200; 300; 400; 500; 550; 600; 700; 800; 900; 1000 with respect to the transport direction T and/or with regard to the transport path provided for sheets 02. The at least one transfer means 03 is configured, for example, as a passive transfer means 03, for example as at least one support surface 03 and/or at least one support roller. Alternatively, the at least one transfer means 03 is configured as an active, in particular controlled and/or regulated transfer means 03.

Unless otherwise specified, each of the units 100; 200; 300; 400; 500; 550; 600; 700; 800; 900; 1000 or modules 100; 200; 300; 400; 500; 550; 600; 700; 800; 900; 1000 of processing machine 01 is preferably characterized in that the section of the transport path provided for sheets 02 which is defined by the respective unit 100; 200; 300; 400; 500; 550; 600; 700; 800; 900; 1000 or module 100; 200; 300; 400; 500; 550; 600; 700; 800; 900; 1000 is at least substantially flat and more preferably is completely flat. A substantially flat section of a transport path provided for sheets 02 is understood as a section that has a minimum radius of curvature of at least 2 meters, more preferably at least 5 meters, even more preferably at least 10 meters and more preferably still at least 50 meters. A completely flat section has an infinitely large radius of curvature and is therefore likewise substantially flat and thus likewise has a minimum radius of curvature of at least 2 meters. Unless otherwise specified, each of the units 100; 200; 300; 400; 500; 550; 600; 700; 800; 900; 1000 or modules 100; 200; 300; 400; 500; 550; 600; 700; 800; 900; 1000 of processing machine 01 is preferably characterized in that the section of the transport path provided for sheets 02 which is defined by the respective unit 100; 200; 300; 400; 500; 550; 600; 700; 800; 900; 1000 or module 100; 200; 300; 400; 500; 550; 600; 700; 800; 900; 1000 extends at least substantially horizontally and more preferably exclusively horizontally. This transport path preferably extends in the transport direction T. A substantially horizontally extending transport path provided for sheets 02 means, in particular, that throughout the entire zone of the respective unit 100; 200; 300; 400; 500; 550; 600; 700; 800; 900; 1000 or module 100; 200; 300; 400; 500; 550; 600; 700; 800; 900; 1000, the provided transport path has one or more and/or exclusively directions that deviate no more than 30°, preferably no more than 15° and more preferably no more than 5° from at least one horizontal direction. The direction of the transport path is, in particular, the direction in which sheets 02 are being transported at the point at which the direction is measured. The transport path provided for sheets 02 preferably begins at a point at which the sheets 02 are removed from a feeder pile 104.

Unless otherwise specified, each of the units 100; 200; 300; 400; 500; 550; 600; 700; 800; 900; 1000 or modules 100; 200; 300; 400; 500; 550; 600; 700; 800; 900; 1000 of processing machine 01 is preferably characterized in that the section of a transport path provided for sheets 02, defined by the respective unit 100; 200; 300; 400; 500; 550; 600; 700; 800; 900; 1000 or module 100; 200; 300; 400; 500; 550; 600; 700; 800; 900; 1000, begins at a respective intake height of the respective unit 100; 200; 300; 400; 500; 550; 600; 700; 800; 900; 1000 or module 100; 200; 300; 400;

500; 550; 600; 700; 800; 900; 1000 and/or ends at a respective output height of the respective unit 100; 200; 300; 400; 500; 550; 600; 700; 800; 900; 1000 or module 100; 200; 300; 400; 500; 550; 600; 700; 800; 900; 1000. The intake height and/or the outlet height is preferably measured, in particular in the vertical direction V, from a lower bearing surface, provided as a platform, of the respective unit 100; 200; 300; 400; 500; 550; 600; 700; 800; 900; 1000 or module 100; 200; 300; 400; 500; 550; 600; 700; 800; 900; 1000. Preferably some and more preferably all of the units 100; 200; 300; 400; 500; 550; 600; 700; 800; 900; 1000 or modules 100; 200; 300; 400; 500; 550; 600; 700; 800; 900; 1000 of processing machine 01 are characterized in that the respective intake height of the respective unit 100; 200; 300; 400; 500; 550; 600; 700; 800; 900; 1000 or module 100; 200; 300; 400; 500; 550; 600; 700; 800; 900; 1000 deviates no more than 5 cm, more preferably no more than 1 cm, and even more preferably no more than 2 mm from the same first standard height, and/or in that the respective outlet height of the respective unit 100; 200; 300; 400; 500; 550; 600; 700; 800; 900; 1000 or module 100; 200; 300; 400; 500; 550; 600; 700; 800; 900; 1000 deviates no more than 5 cm, more preferably no more than 1 cm, and even more preferably no more than 2 mm from the same first standard height, and/or in that the respective intake height of the respective unit 100; 200; 300; 400; 500; 550; 600; 700; 800; 900; 1000 or module 100; 200; 300; 400; 500; 550; 600; 700; 800; 900; 1000 deviates no more than 5 cm, more preferably no more than 1 cm, and even more preferably no more than 2 mm from the respective outlet height of the respective unit 100; 200; 300; 400; 500; 550; 600; 700; 800; 900; 1000 or module 100; 200; 300; 400; 500; 550; 600; 700; 800; 900; 1000.

Alternatively or additionally, processing machine 01 is preferably characterized in that it comprises at least one unit 400; 600; 800 configured as a coating unit 400; 600; 800 and/or as a non-impact coating unit 400; 600; 800 and/or as a printing unit 600, and/or in that it includes the transport path provided for the transport of sheets 02, and in that, at least for the at least one coating unit 400; 600; 800 and/or non-impact coating unit 400; 600; 800 and/or printing unit 600, a respective section of the transport path provided for sheets 02, defined by said unit, has a minimum radius of curvature of at least 2 meters and/or, over the entire zone of said coating unit 400; 600; 800 and/or non-impact coating unit 400; 600; 800 and/or printing unit 600, has a direction that deviates no more than 30° from at least one horizontal direction.

Alternatively or additionally, processing machine 01 is preferably characterized in that it has a transport path provided for the transport of sheets 02 and in that for a plurality of the modules 100; 200; 300; 400; 500; 550; 600; 700; 800; 900; 1000 of the sheet-fed printing press 01, a respective section of the transport path provided for sheets 02, defined by the respective module 100; 200; 300; 400; 500; 550; 600; 700; 800; 900; 1000, has a minimum radius of curvature of at least 2 meters and/or, over the entire zone of the respective module 100; 200; 300; 400; 500; 550; 600; 700; 800; 900; 1000, has a direction that deviates no more than 30° from at least one horizontal direction.

Processing machine 01 preferably comprises at least one unit 100, configured as a substrate supply system 100, also called a sheet feeder 100, in particular sheet feeder unit 100, which is further preferably configured as a module 100, in particular as a sheet feeder module 100.

Processing machine 01 preferably comprises at least one unit 200; 550, configured as a conditioning system 200; 550, in particular a conditioning unit 200; 550, which is further preferably configured as a module 200; 550, in particular as a conditioning module 200; 550. Such a conditioning system 200; 550 is configured, for example, as a preprocessing system 200 or as a post-processing system 550. Processing machine 01 preferably comprises at least one unit 200 configured as a preprocessing system 200, in particular as a preprocessing unit 200, which is further preferably configured as a module 200, in particular as a preprocessing module 200, and which is a conditioning system 200. Processing machine 01 preferably comprises at least one unit 550 configured as a post-processing system 550, in particular as a post-processing unit 550, which is further preferably configured as a module 550, in particular as a post-processing module 550, and which is a conditioning system 550.

Processing machine 01 preferably comprises at least one unit 300 configured as an infeed system 300, in particular an infeed unit 300, which is further preferably configured as a module 300, in particular as an infeed module 300. Alternatively, the at least one infeed system 300 is configured as a component of the substrate supply system 100.

Processing machine 01 preferably comprises at least one unit 400; 600; 800 configured as a coating system 400; 600; 800, also called a coating unit 400; 600; 800, which is more preferably configured as a module 400; 600; 800, in particular as a coating module 400; 600; 800. The positioning and/or construction of the at least one coating unit 400; 600; 800 is dependent upon the function and/or the coating method. The at least one coating unit 400; 600; 800 is preferably used to apply at least one respective coating medium over the entire surface and/or a portion of the surface of sheets 02. One example of a coating unit 400; 600; 800 is a primer unit 400, which is used in particular for applying a primer to sheets 02. Another example of a coating unit 400; 600; 800 is a printing unit 600, which is used in particular for applying printing ink and/or ink to sheets 02. A further example of a coating unit 400; 600; 800 is a finish coating unit 800, which is used in particular for applying a finish coating to sheets 02.

Regardless, in particular, of the function of the coating medium that can be applied by coating units 400; 600; 800, said units may differ, preferably in terms of the coating method they use. One example of a coating unit 400; 600; 800 is a forme-based coating unit 400; 600; 800, which has, in particular, at least one fixed and preferably replaceable printing forme. Forme-based coating units 400; 600; 800 preferably operate by a planographic printing method, in particular an offset planographic printing method and/or by an intaglio printing method and/or by a letterpress method, particularly preferably by a flexo printing method. In the latter case, coating unit 400; 600; 800 is accordingly a flexo coating unit 400; 600; 800, for example, in particular a flexo coating module 400; 600; 800. Another example of a coating unit 400; 600; 800 is a plateless or non-impact coating unit 400; 600; 800, which operates in particular without a fixed printing forme. Plateless or non-impact coating units 400; 600; 800 operate, for example, by an ionographic method and/or a magnetographic method and/or a thermographic method and/or by electrophotography and/or laser printing and/or particularly preferably by an inkjet printing method. In the latter case, coating unit 400; 600; 800 is accordingly an inkjet coating unit 400; 600; 800, for example, in particular inkjet coating module 400; 600; 800.

Processing machine 01 preferably comprises at least one unit 400, in particular primer unit 400, configured as a primer system 400, also called primer mechanism 400, which is further preferably configured as module 400, in particular as priming module 400.

Processing machine 01 preferably comprises at least one unit 500, in particular drying unit 500, configured as a drying system 500, which is further preferably configured as module 500, in particular as drying module 500. Alternatively or additionally, for example, at least one drying device 506 is a component of at least one unit 100; 200; 300; 400; 500; 550; 600; 700; 800; 900; 1000 preferably configured as module 100; 200; 300; 400; 500; 550; 600; 700; 800; 900; 1000.

Processing machine 01 preferably comprises at least one unit 600 configured as printing unit 600, which is further preferably configured as module 600, in particular as printing module 600.

Processing machine 01 preferably comprises at least one unit 700, in particular transport unit 700, configured as a transport system 700 or transport means 700, which is further preferably configured as module 700, in particular as transport module 700. Processing machine 01 also or alternatively comprises transport systems 700, for example, as components of other units 100; 200; 300; 400; 500; 550; 600; 700; 800; 900; 1000 and/or modules 100; 200; 300; 400; 500; 550; 600; 700; 800; 900; 1000.

Processing machine 01 preferably comprises at least one unit 800, in particular finish coating unit 800, configured as a finish coating system 800, also called finish coating mechanism 800, which is further preferably configured as module 800, in particular as finish coating module 800.

Processing machine 01 preferably comprises at least one unit 900, in particular shaping unit 900, configured as a shaping system 900, which is further preferably configured as module 900, in particular as shaping module 900.

Processing machine 01 preferably comprises at least one unit 1000, in particular delivery unit 1000, configured as substrate delivery system 1000, also called sheet delivery 1000, which is further preferably configured as module 1000, in particular as delivery module 1000.

Processing machine 01 comprises, for example, at least one unit configured as a post-press processing system, in particular a post-press processing unit, which is further preferably configured as a module, in particular as a post-press processing module.

The transport direction T intended, in particular, for the transport of sheets 02 is a direction T which is preferably oriented at least substantially and more preferably solely horizontally and/or preferably leading from a first unit 100; 200; 300; 400; 500; 550; 600; 700; 800; 900 of processing machine 01 to a last unit 200; 300; 400; 500; 550; 600; 700; 800; 900; 1000 of processing machine 01, in particular from a sheet feeder unit 100 or a substrate supply system 100 to a delivery unit 1000 or a substrate delivery system 1000, and/or which preferably leads in a direction in which the sheets 02 are transported, apart from vertical movements or vertical components of movements, in particular from a first point of contact with a unit 200; 300; 400; 500; 550; 600; 700; 800; 900; 1000 of processing machine 01 located downstream of the substrate supply system 100, or a first point of contact with processing machine 01, to a last point of contact with processing machine 01. Regardless of whether infeed system 300 is an autonomous unit 300 or module 300 or is a component of substrate supply system 100, the transport direction T is preferably the direction T in which a horizontal component includes a direction that is oriented from infeed system 300 toward substrate delivery system 1000.

The working width of processing machine 01 and/or of the at least one coating unit 400; 600; 800 is preferably a dimension extending preferably orthogonally to the intended transport path of sheets 02 through the at least one coating unit 400; 600; 800, more preferably in a transverse direction A. Transverse direction A is preferably a horizontal direction A. Transverse direction A is oriented orthogonally to the intended transport direction T of sheets 02 and/or orthogonally to the intended transport path of sheets 02 through the at least one coating unit 400; 600; 800. The working width of processing machine 01 preferably corresponds to the maximum width a sheet 02 may have and still be processed by processing machine 01, i.e., in particular, the maximum sheet width that can be processed by printing press 01. In this context, the width of a sheet 02 is understood in particular as its dimension in the transverse direction A. This is preferably independent of whether this width of sheet 02 is greater or narrower than the horizontal dimension of sheet 02, orthogonally thereto, which more preferably is the length of said sheet 02. The working width of processing machine 01 is preferably equal to the working width of the at least one coating unit 400; 600; 800, in particular printing unit 600. The transverse direction A is preferably oriented parallel to the axis of rotation of at least one part of a transport means 411; 417; 611; 617; 811; 817 of a coating unit 400; 600; 800. The working width of sheet processing machine 01 is preferably at least 100 cm, more preferably at least 150 cm, even more preferably at least 160 cm, even more preferably at least 200 cm, and more preferably still at least 250 cm.

Processing machine 01 preferably comprises transport means 111; 117; 119; 136; 211; 311; 411; 417; 511; 561; 611; 617; 711; 811; 817; 911; 1011 at one or more locations, said transport means preferably being configured as suction transport means 111; 117; 119; 136; 211; 311; 411; 417; 511; 561; 611; 617; 711; 811; 817; 911; 1011, in particular as a suction belt 111; 117; 119; 136; 211; 311; 411; 417; 511; 561; 611; 617; 711; 811; 817; 911; 1011 and/or as a suction box belt 111; 117; 119; 136; 211; 311; 411; 417; 511; 561; 611; 617; 711; 811; 817; 911; 1011 and/or as a roller suction system 111; 117; 119; 136; 211; 311; 411; 417; 511; 561; 611; 617; 711; 811; 817; 911; 1011 and/or as a suction roller 111; 117; 119; 136; 211; 311; 411; 417; 511; 561; 611; 617; 711; 811; 817; 911; 1011. Such suction transport means 111; 117; 119; 136; 211; 311; 411; 417; 511; 561; 611; 617; 711; 811; 817; 911; 1011 are preferably used for moving sheets 02 forward in a controlled manner. For this purpose, a relative vacuum pressure is preferably used to pull and/or push the sheets 02 against at least one transport surface 718, and a transporting movement of sheets 02 is preferably generated by a corresponding, in particular circulating, movement of the at least one transport surface 718. The vacuum pressure is in particular a vacuum pressure relative to an ambient pressure, in particular relative to an atmospheric pressure.

A suction transport means 111; 117; 119; 136; 211; 311; 411; 417; 511; 561; 611; 617; 711; 811; 817; 911; 1011 is therefore preferably understood as a system that comprises at least one movable transport surface 718, which serves in particular as a counterpressure surface 718 and is movable, for example, at least partially, at least in the transport direction T. Suction transport means 111; 117; 119; 136; 211; 311; 411; 417; 511; 561; 611; 617; 711; 811; 817; 911; 1011 further comprises at least one vacuum pressure chamber 719, which is connected by means of a suction line 721 to at least one vacuum pressure source 733. Vacuum pressure source 733 includes a blower 733, for example. The at least one vacuum pressure chamber 719 has at least one suction inlet 722, which serves to draw the sheets 02 in by suction.

Depending upon the embodiment of the suction transport means 111; 117; 119; 136; 211; 311; 411; 417; 511; 561; 611; 617; 711; 811; 817; 911; 1011 and the size of sheets 02, the sheets 02 are thereby sucked into a position in which they seal off the at least one suction inlet 722 or are merely sucked against a counterpressure surface 718 such that ambient air is still able to pass along sheet 02 and into suction inlet 722. Transport surface 718 has one or more suction openings 723, for example. Suction openings 723 preferably serve to convey a vacuum pressure from suction inlet 722 of vacuum pressure chamber 719 to the transport surface 718, in particular without pressure losses or with very low pressure losses. Alternatively or additionally, suction inlet 722 acts on sheets 02 in such a way that said sheets are sucked against transport surface 718, even though transport surface 718 has no suction openings 723. At least one deflection means 724 is provided, for example, which directly or indirectly ensures a circulating movement of the at least one transport surface 718. The at least one deflection means 724 and/or the transport surface 718 preferably is and/or can be autonomously driven, in particular to provide for movement of the sheets 02.

A first embodiment of a suction transport means 111; 117; 119; 136; 211; 311; 411; 417; 511; 561; 611; 617; 711; 811; 817; 911; 1011 is a suction belt 111; 117; 119; 136; 211; 311; 411; 417; 511; 561; 611; 617; 711; 811; 817; 911; 1011. In this context, a suction belt 111; 117; 119; 136; 211; 311; 411; 417; 511; 561; 611; 617; 711; 811; 817; 911; 1011 is understood as a system having at least one flexible conveyor belt 718; 726, which serves as a transport surface 718. The at least one conveyor belt 718; 726 is preferably deflected by deflection means 724 configured as deflection rollers 724 and/or deflection cylinders 724 and/or is preferably closed, so that continuous circulation is possible. The at least one conveyor belt 718; 726 preferably has a multiplicity of suction openings 723. Over at least a portion of its circulation path, the at least one conveyor belt 718; 726 preferably covers the at least one suction inlet 722 of the at least one vacuum pressure chamber 719. In that case, vacuum pressure chamber 719 is more preferably connected to the ambient environment and/or to sheets 02 only via the suction openings 723 of the at least one conveyor belt 718; 726. Preferably, support means are provided, which prevent the at least one conveyor belt 718; 726 from being drawn too far, or at all, into the vacuum pressure chamber 719 and/or which ensure that transport surface 718 takes on a desired shape, for example forming a planar surface, at least in the region in which its suction openings 723 are connected to vacuum pressure chamber 719. A circulating movement of the at least one conveyor belt 718 then results in a forward movement of transport surface 718, during which sheets 02 are held securely on transport surface 718 precisely in the region in which they are opposite the suction inlet 722, which is covered by the at least one conveyor belt 718; 726 with the exception of suction openings 723.

A second embodiment of a suction transport means 111; 117; 119; 136; 211; 311; 411; 417; 511; 561; 611; 617; 711; 811; 817; 911; 1011 is a suction box belt 111; 117; 119; 136; 211; 311; 411; 417; 511; 561; 611; 617; 711; 811; 817; 911; 1011. A suction box belt 111; 117; 119; 136; 211; 311; 411; 417; 511; 561; 611; 617; 711; 811; 817; 911; 1011 is understood as a system that comprises a plurality of suction boxes 718; 727, each having an outer surface 718 that serves as a transport surface 718. Each of the suction boxes 718; 727 preferably has at least one suction chamber 728. The respective suction chamber 728 is preferably open outward in one direction through at least one flow opening 729. This at least one flow opening 729 preferably serves to conduct a vacuum pressure from the vacuum pressure chamber 719 into the respective suction chamber 728. The at least one flow opening 729 is positioned laterally, for example, or is positioned such that it faces at least intermittently in or opposite a vertical direction V. Each of the suction boxes 718; 727 preferably has a multiplicity of suctioning openings 723. The suction boxes 718; 727 are preferably configured as relatively rigid. The suction boxes 718; 723 are preferably connected to one another flexibly, in particular via at least one connecting means 731. The at least one connecting means 731 is configured, for example, as a tensioning means 731, in particular a belt 731 or band 731, more preferably as a fully circumferential and/or endless connecting means 731. All of the suction boxes 718; 727 are attached, for example, to the same at least one connecting means 731. Alternatively, adjacent suction boxes 718; 717 may also be connected to one another in pairs. The connections result in a suction box belt 111; 117; 119; 136; 211; 311; 411; 417; 511; 561; 611; 617; 711; 811; 817; 911; 1011. This suction box belt 111; 117; 119; 136; 211; 311; 411; 417; 511; 561; 611; 617; 711; 811; 817; 911; 1011, in particular a subset of the suction boxes 718; 727, covers the at least one suction inlet 722 of the at least one vacuum pressure chamber 719, preferably in at least one part of a circulation path of the suction box belt 111; 117; 119; 136; 211; 311; 411; 417; 511; 561; 611; 617; 711; 811; 817; 911; 1011. Further preferably, vacuum pressure chamber 719 is then connected to the ambient environment and/or to sheets 02 only via the suction openings 723 of suction boxes 718; 727.

The at least one suction box belt 111; 117; 119; 136; 211; 311; 411; 417; 511; 561; 611; 617; 711; 811; 817; 911; 1011 is preferably deflected by deflection means 724 configured as deflection rollers 724 and/or deflection cylinders 724 and is preferably closed so that endless circulation is possible. Deflection means 724 cooperate directly with tensioning means 731 and/or drive said means, for example. Each of the suction boxes 718; 727 preferably has a planar transport surface 718, so that a plurality of suction boxes arranged one behind the other form a correspondingly larger planar transport surface 718. A circulating movement of suction boxes 718; 272 then results in a forward movement of the transport surface 718, during which said sheets 02 are held securely on the transport surface 718 precisely in the region in which said sheets are in contact with the suction boxes 718; 722, which are connected tightly to the suction inlet 722. Preferably, guide means 732 are provided, which serve to restrict the movement of the suction boxes 718; 727 to defined regions.

A third embodiment of a suction transport means 111; 117; 119; 136; 211; 311; 411; 417; 511; 561; 611; 617; 711; 811; 817; 911; 1011 is a roller suction system 111; 117; 119; 136; 211; 311; 411; 417; 511; 561; 611; 617; 711; 811; 817; 911; 1011. A roller suction system 111; 117; 119; 136; 211; 311; 411; 417; 511; 561; 611; 617; 711; 811; 817; 911; 1011 is understood as a system in which the at least one transport surface 718 is composed of at least parts of lateral surfaces 718 of a multiplicity of transport rollers 724 and/or transport cylinders 724. The transport rollers 724 and/or transport cylinders 724 each form closed parts of the transport surface 718 that circulate by rotation. The roller suction system 111; 117; 119; 136; 211; 311; 411; 417; 511; 561; 611; 617; 711; 811; 817; 911; 1011 preferably has a multiplicity of suction inlets 722. These suction inlets 722 are preferably arranged at least between adjacent transport rollers 724 and/or transport cylinders 724.

At least one covering mask 734 is provided, for example, which preferably acts as a boundary of the vacuum pressure chamber 719. Covering mask 734 preferably comprises the multiplicity of suction inlets 722. Covering mask 734 preferably forms a substantially planar surface. The transport rollers 724 and/or transport cylinders 724 are preferably arranged such that they are intersected by this planar surface and more preferably protrude only slightly, for example only a few millimeters, beyond this planar surface, in particular in a direction facing away from the vacuum pressure chamber 719. In that case, the suction inlets 722 are preferably configured in the form of a frame, each surrounding at least one of the transport rollers 724 and/or transport cylinders 724. In other words, this means that the transport rollers 724 and/or transport cylinders 724 preferably protrude slightly, for example only a few millimeters, through the suction inlets 722 that penetrate the covering mask 734 which delimits the vacuum pressure chamber 719. Alternatively, some or all of the transport rollers 724 and/or transport cylinders 724 protrude through openings in the covering mask 734 that have no connection to the vacuum pressure chamber 719. In that case, such openings are provided in addition to separate suction inlets 722, for example. A rotating movement of transport rollers 724 and/or transport cylinders 724 then results in a forward movement of the parts of the transport surface 718, with sheets 02 being held securely on the transport surface 718 precisely in the region in which they are opposite the suction inlet 722. One advantage of roller suction systems 111; 117; 119; 136; 211; 311; 411; 417; 511; 561; 611; 617; 711; 811; 817; 911; 1011 is high wear resistance, for example. Of concern, however, is a risk of poorer adhesion between transport rollers 724 and sheets 02, a potentially less accurate infeed, and/or a risk of damage to the contacting surface of sheets 02 due to relatively small, linear bearing surfaces.

A fourth embodiment of a suction transport means 111; 117; 119; 136; 211; 311; 411; 417; 511; 561; 611; 617; 711; 811; 817; 911; 1011 is at least one suction roller 111; 117; 119; 136; 211; 311; 411; 417; 511; 561; 611; 617; 711; 811; 817; 911; 1011. A suction roller 111; 117; 119; 136; 211; 311; 411; 417; 511; 561; 611; 617; 711; 811; 817; 911; 1011 is understood here as a roller whose lateral surface serves as a transport surface 718 and has a multiplicity of suction openings 723, and which has at least one vacuum pressure chamber 719 in its interior, which is connected to at least one vacuum pressure source 733, for example by means of a suction line 721.

At least one cleaning system is preferably provided, which is used for cleaning the respective transport surface 718 of the respective suction transport means 111; 117; 119; 136; 211; 311; 411; 417; 511; 561; 611; 617; 711; 811; 817; 911; 1011. Said cleaning system may be configured as a vacuum system and/or a blower system and/or a stripping system, for example, and/or preferably serves to remove bits of paper and/or dust. The cleaning system is located aligned toward a side of the suction transport means 111; 117; 119; 136; 211; 311; 411; 417; 511; 561; 611; 617; 711; 811; 817; 911; 1011 that faces away from the transport path designated for sheets 02 and/or aligned toward the respective transport surface 718.

Sheet processing machine 01 is preferably characterized in that at least one cleaning system for cleaning at least one transport means 111; 117; 119 of the substrate supply system 100 is provided, and/or in that at least one cleaning system for cleaning at least one transport means 411; 417; 611; 617; 811; 817 of a coating unit 400; 600; 800, in particular a non-impact coating unit 400; 600; 800, is provided, and/or in that at least one cleaning system for cleaning at least one transport means 211 of the preprocessing system 200 is provided, and/or in that at least one cleaning system for cleaning at least one transport means 561 of the post-processing system 550 is provided, and/or in that at least one cleaning system for cleaning at least one transport means 711 of the transport system 700 is provided, and/or in that at least one cleaning system for cleaning at least one transport means 911 of the shaping system 900 is provided, and/or in that at least one cleaning system for cleaning at least one transport means 1011 of the substrate delivery system 1000 is provided.

Regardless of the embodiment of the respective suction transport means 111; 117; 119; 136; 211; 311; 411; 417; 511; 561; 611; 617; 711; 811; 817; 911; 1011, at least two arrangements of the respective suction transport means 111; 117; 119; 136; 211; 311; 411; 417; 511; 561; 611; 617; 711; 811; 817; 911; 1011 are possible, which will be described in the following.

In a first arrangement, a section of the transport path provided for sheets 02, defined by the respective suction transport means 111; 117; 119; 136; 211; 311; 411; 417; 511; 561; 611; 617; 711; 811; 817; 911; 1011, is located below the in particular movable transport surface 718, which serves in particular as a counterpressure surface 718 and which is movable, for example at least partially, at least in the transport direction T. In that case, the respective suction transport means 111; 117; 119; 136; 211; 311; 411; 417; 511; 561; 611; 617; 711; 811; 817; 911; 1011 is configured as upper suction transport means 111; 117; 119; 136; 211; 311; 411; 417; 511; 561; 611; 617; 711; 811; 817; 911; 1011, for example, the suction inlets 722 or suction openings 723 of which, at least when said openings are connected to the at least one vacuum pressure chamber 719, preferably point, at least additionally or solely, downward and/or the suctioning effect of which is directed, preferably at least additionally or solely, upward. In that case, sheets 02 are transported suspended from the suction transport means 111; 117; 119; 136; 211; 311; 411; 417; 511; 561; 611; 617; 711; 811; 817; 911; 1011.

In a second arrangement, a section of the transport path provided for sheets 02, defined by the respective suction transport means 111; 117; 119; 136; 211; 311; 411; 417; 511; 561; 611; 617; 711; 811; 817; 911; 1011, is located above the in particular movable transport surface 718, which serves in particular as a counterpressure surface 718 and which is movable, for example at least partially, at least in the transport direction T. In that case, the respective suction transport means 111; 117; 119; 136; 211; 311; 411; 417; 511; 561; 611; 617; 711; 811; 817; 911; 1011 is configured as a lower suction transport means 111; 117; 119; 136; 211; 311; 411; 417; 511; 561; 611; 617; 711; 811; 817; 911; 1011, for example, the suction inlets 722 or suction openings 723 of which, at least when said openings are connected to the at least one vacuum pressure chamber 719, preferably point, at least additionally or solely, upward and/or the suctioning effect of which is directed, preferably at least additionally or solely, downward. In that case, sheets 02 are transported resting on the suction transport means 111; 117; 119; 136; 211; 311; 411; 417; 511; 561; 611; 617; 711; 811; 817; 911; 1011.

Whether the respective suction transport means 111; 117; 119; 136; 211; 311; 411; 417; 511; 561; 611; 617; 711; 811; 817; 911; 1011 is configured as an upper or as a lower suction transport means 111; 117; 119; 136; 211; 311; 411; 417; 511; 561; 611; 617; 711; 811; 817; 911; 1011 depends, for example, upon whether an upper or a lower main surface of the sheets 02 has been processed in a preceding unit and/or will be processed in a subsequent unit 100; 200; 300; 400; 500; 550; 600; 700; 800; 900; 1000. A transfer point from an upper suction transport means 111; 117; 119; 136; 211; 311; 411; 417; 511; 561; 611; 617; 711; 811; 817; 911; 1011 to a lower suction transport means 111; 117; 119; 136; 211; 311; 411; 417; 511; 561; 611; 617; 711; 811; 817; 911; 1011 or from a lower suction transport means 111; 117; 119; 136; 211; 311; 411; 417; 511; 561; 611; 617; 711; 811; 817; 911; 1011 to an upper suction transport means 111; 117; 119; 136; 211; 311; 411; 417; 511; 561; 611; 617; 711; 811; 817; 911; 1011 can be formed, for example, by the transport path provided for sheets 02 being delimited, at least in a partial region, by both a lower suction transport means 111; 117; 119; 136; 211; 311; 411; 417; 511; 561; 611; 617; 711; 811; 817; 911; 1011 and an upper suction transport means 111; 117. The suction transport means 111; 117; 119; 136; 211; 311; 411; 417; 511; 561; 611; 617; 711; 811; 817; 911; 1011 whose zone of action ends later as viewed in the transport direction T then determines whether sheets 02 will be transported beyond the transfer point in a suspended or a supported position.

Regardless of whether the suction transport means 111; 117; 119; 136; 211; 311; 411; 417; 511; 561; 611; 617; 711; 811; 817; 911; 1011 is embodied as a suction belt 111; 117; 119; 136; 211; 311; 411; 417; 511; 561; 611; 617; 711; 811; 817; 911; 1011 and/or as a suction box belt 111; 117; 119; 136; 211; 311; 411; 417; 511; 561; 611; 617; 711; 811; 817; 911; 1011 and/or as a roller suction system 111; 117; 119; 136; 211; 311; 411; 417; 511; 561; 611; 617; 711; 811; 817; 911; 1011, the at least one vacuum chamber 719 is and/or can be subdivided with respect to the transverse direction A into multiple parts, for example, which preferably are and/or can be sealed off from one another, and/or which can be supplied individually with vacuum pressure. This enables the system to adjust to sheets 02 of different widths, without requiring the intake of an unnecessarily large amount of air. Preferably, however, the suction inlets 722 and/or the suction openings 723 are selected as small enough that a volume of air passing through these openings is very small, even when they are not covered by a sheet 02. In that case, adjustment to the width of the sheets 02 can be dispensed with.

The following are additional configurations for suction transport means 111; 117; 119; 136; 211; 311; 411; 417; 511; 561; 611; 617; 711; 811; 817; 911; 1011. These configurations are particularly advantageous and are preferred in the case of suction transport means 111; 117; 119; 136; 211; 311; 411; 417; 511; 561; 611; 617; 711; 811; 817; 911; 1011 configured in accordance with the first embodiment as a respective suction belt 111; 117; 119; 136; 211; 311; 411; 417; 511; 561; 611; 617; 711; 811; 817; 911; 1011. As long as no contradictions arise, however, the configurations also apply to other embodiments of suction transport means 111; 117; 119; 136; 211; 311; 411; 417; 511; 561; 611; 617; 711; 811; 817; 911; 1011. Sheet-fed printing press 01 preferably has at least one suction transport means 111; 117; 119; 136; 211; 311; 411; 417; 511; 561; 611; 617; 711; 811; 817; 911; 1011 configured as a suction belt 111; 117; 119; 136; 211; 311; 411; 417; 511; 561; 611; 617; 711; 811; 817; 911; 1011. This at least one suction transport means 111; 117; 119; 136; 211; 311; 411; 417; 511; 561; 611; 617; 711; 811; 817; 911; 1011 preferably has at least one, in particular flexible conveyor belt 718; 726, which extends with at least one conveying section of its circulation path parallel to the transport direction T along a section of the transport path provided for sheets 02, in particular over a transport length. The at least one conveyor belt 718; 726 preferably has a multiplicity of suction openings 723. The conveying section is stationary, even when conveyor belt 718; 726 is moving, and in particular is not permanently assigned to any component of conveyor belt 718; 726.

At least two, more preferably at least three, even more preferably at least five, and more preferably still at least ten vacuum pressure chambers 719, which in particular are and/or can be separated from one another with respect to the transport direction T and each of which has at least one suction inlet 722, are preferably arranged one behind the other along the transport path provided for sheets 02. Such separation is understood to include fluidic separation, in particular. This separation is preferably complete, in particular such that a connection exists at most via lines that are connected to a vacuum pressure source 733 and/or via the suction openings 723 of conveyor belt 718; 726 and an ambient atmosphere. The conveying section of the circulation path of the at least one conveyor belt 718; 726 preferably covers at least one suction inlet 722 of some, more preferably of all of these vacuum pressure chambers 719, arranged one behind the other, at least partially, in particular with the exception of respective suction openings 723. This means that multiple vacuum pressure chambers 719 that influence different regions, one behind the other in transport direction T, are assigned to a respective conveyor belt 718; 726. This is to be distinguished, in particular, from multiple conveyor belts arranged at least partially one behind the other.

The vacuum pressure is transmitted substantially only through those suction openings 723 that are in communication with the respective vacuum pressure chamber 719. In contrast to one large vacuum pressure chamber 719, multiple small vacuum pressure chambers 719 can therefore act individually, and in particular can be individually sealed off at least partially from an environment. This sealing is accomplished both by conveyor belt 718; 726 itself and by those components of sheets 02 that cover corresponding suction openings 723. If an insufficient proportion of suction openings 723 is covered, the vacuum pressure will be reduced by inflowing ambient air. This could result in the sheets 02 being inadequately held. This risk exists in the case of small sheets 02 and/or when there are large distances between sheets 02 and/or a first sheet 02 and/or a last sheet 02. Subdividing the chamber into a plurality of vacuum pressure chambers 719 along the conveying section ensures that the vacuum pressure cannot decrease significantly in all areas at the same time. Furthermore, providing a plurality of vacuum pressure chambers 719 with a conveyor belt 718; 716 of the same length allows for smaller vacuum pressure chambers 719. As a result, each suction opening 723 makes up a larger proportion of the total number of suction openings 723 assigned to the respective vacuum pressure chamber 719. Thus, a relatively small number of sealed suction openings 723 is sufficient to keep the vacuum pressure in the respective vacuum pressure chamber 719 at a usable level. This relatively small number can also be achieved with small sheets 02 and/or with large distances between sheets 02 and/or with a first sheet 02 and/or a last sheet 02.

Furthermore, it is not relevant whether the vacuum pressure in a vacuum pressure chamber 719 drops too low, as long as a sheet 02 that is partially in the zone of influence of said chamber is still held by the vacuum pressure of another vacuum pressure chamber 719. This also is achieved by the relatively large number of relatively small vacuum pressure chambers 719. This effect can also be purposefully used to supply a vacuum pressure only in the particular relevant vacuum pressure chambers 719 and to purposefully separate insufficiently covered vacuum pressure chambers 719, at least intermittently, from a corresponding vacuum pressure source. Overall, the suctioning action of suction transport means 111; 117; 119; 136; 211; 311; 411; 417; 511; 561; 611; 617; 711; 811; 817; 911; 1011 may vary along the transport direction T. This enables a savings in terms of pumping power and thus of energy.

Preferably, vacuum pressure can be applied to the individual vacuum pressure chambers 719 individually. In an alternative or additional refinement, the processing machine 01 preferably configured as a sheet-fed printing press 01 is therefore preferably characterized in that at least a first of these at least two vacuum pressure chambers 719 arranged one behind the other is and/or can be connected to at least one first vacuum pressure source 733 via at least one, in particular first suction line 721. In addition, at least one other, in particular second of these at least two vacuum pressure chambers 719 arranged one behind the other is preferably arranged such that it is and/or can be connected via at least one suction line 721, in particular another and/or a second suction line 721, to at least or precisely one other, in particular second vacuum pressure source 733. More preferably, this at least one other of these at least two vacuum pressure chambers 719 arranged one behind the other is arranged such that it is and/or can be connected via the at least one suction line 721 exclusively to the at least one other, in particular second vacuum pressure source 733. The designation of these components as the first or second vacuum pressure chamber 719, the first or second suction line, or the first or second vacuum pressure source 733, etc. is used here merely to distinguish these components from one another and does not in any way relate to the order or arrangement of these components.

In an alternative or additional refinement, the processing machine 01 preferably configured as a sheet-fed printing press 01 is therefore preferably characterized in that at least a first of these at least two vacuum pressure chambers 719 arranged one behind the other is arranged such that it is and/or can be connected to at least one first vacuum pressure source 733 via at least one, in particular first suction line 721 and at least one first controllable and/or regulable valve 737. In that case, it is not necessary to deactivate or fully deactivate vacuum pressure source 733 in order to deactivate a corresponding vacuum pressure chamber 719. Instead, this can be accomplished merely by appropriate actuation of the at least one valve 737. In an alternative or additional refinement, the processing machine 01 preferably configured as a sheet-fed printing press 01 is preferably characterized in that at least a second of these at least two vacuum pressure chambers 719 arranged one behind the other is arranged such that it is and/or can be connected via at least one, in particular second suction line 721 and at least one second controllable and/or regulable valve 737 to the at least one first vacuum pressure source 733. In that case, one vacuum pressure source 733 can be used for multiple vacuum pressure chambers 719, enabling equipment expenditures to be minimized. In an alternative or additional refinement, the processing machine 01 preferably configured as a sheet-fed printing press 01 is preferably characterized in that at least one other and/or second of these at least two vacuum pressure chambers 719 arranged one behind the other is arranged such that it is and/or can be connected via at least one other and/or second suction line 721 and at least one other and/or second controllable and/or regulable valve 737 to at least one other and/or second vacuum pressure source 733.

In an alternative or additional refinement, the processing machine 01 preferably configured as a sheet-fed printing press 01 is preferably characterized in that at least one coating position 409; 609; 809 of at least one coating unit 400; 600; 800 of the sheet-fed printing press 01 is arranged along the conveying section of the at least one conveyor belt 718; 726. This enables particularly high print quality, because a particularly secure positioning of sheets 02 can be achieved, even with small sheets 02, and/or large distances between sheets 02, and/or with a first sheet 02 and/or a last sheet 02. More preferably, at least two, even more preferably at least three, and more preferably still at least four coating positions 409; 609; 809 of at least one coating unit 400; 600; 800 of sheet-fed printing press 01 are arranged along the conveying section of the at least one conveyor belt 718; 726. This enables printing to be optimized in terms of register and/or registration and/or color-to-color register. At least one drying system 500 and/or at least one drying device 506 of sheet-fed printing press 01 is arranged along the conveying section of the at least one conveyor belt 718; 726, for example.

In an alternative or additional refinement, the processing machine 01 preferably configured as a sheet-fed printing press 01 is preferably characterized in that at least two, preferably at least three, more preferably at least five, and even more preferably at least seven vacuum pressure chambers 719 that are and/or can be separated from one another with respect to the transverse direction A are arranged side by side, each having at least one suction inlet 722, each suction inlet being arranged at least partially covered by at least one conveyor belt 718; 726 of the suction transport means 111; 117; 119; 136; 211; 311; 411; 417; 511; 561; 611; 617; 711; 811; 817; 911; 1011. These are a plurality of conveyor belts 781; 726, for example, or preferably one common conveyor belt 718; 726. The sheet-fed printing press 01 is preferably characterized in that at least one of these at least two vacuum pressure chambers 719 arranged side by side is arranged such that it is and/or can be connected via at least one suction line 721 to at least one vacuum pressure source 733, and at least one other of these at least two vacuum pressure chambers 719 arranged side by side is arranged such that it is and/or can be connected via at least one other suction line 721 in particular exclusively to another vacuum pressure source 733.

In an alternative or additional refinement, the processing machine 01 preferably configured as a sheet-fed printing press 01 is preferably characterized in that at least a first of these at least two vacuum pressure chambers 719 arranged side by side is arranged such that it is and/or can be connected to at least one vacuum pressure source 733 via at least one suction line 721 and at least one controllable and/or regulable valve 737.

In an alternative or additional refinement, the processing machine 01 preferably configured as a sheet-fed printing press 01 is preferably characterized in that at least one other of these at least two vacuum pressure chambers 719 arranged side by side is arranged such that it is and/or can be connected via at least one suction line 721 and at least one other controllable and/or regulable valve 737 to said at least one vacuum pressure source 733. Alternatively and/or additionally, sheet-fed printing press 01 is preferably characterized in that at least one other of these at least two vacuum pressure chambers 719 arranged side by side is arranged such that it is and/or can be connected to at least one other vacuum pressure source 733 via at least one suction line 721 and at least one other controllable and/or regulable valve 737.

In an alternative or additional refinement, the processing machine 01 preferably configured as a sheet-fed printing press 01 is preferably characterized in that at least two, more preferably at least three, even more preferably at least five, and more preferably still at least seven vacuum pressure chambers 719 that are and/or can be separated from one another with respect to the transverse direction A are arranged side by side, with the relative positioning of pairs of said chambers with respect to the transport direction T partially overlapping and partially intersecting. Vacuum pressure chambers 719 arranged in this way are also referred to as vacuum pressure chambers 719 arranged offset from one another in the transport direction T. Vacuum pressure chambers 719 that are offset from one another in the transport direction T allow sheets 02 to be held even more effectively relative to conveyor belt 718; 726. In particular, a sheet 02 entering the exposure zone of a subsequent vacuum pressure chamber 719 or leaving the exposure zone of a previous vacuum pressure chamber 719 can remain simultaneously in the exposure zone of another vacuum pressure chamber 719. This ensures that at least one vacuum pressure chamber 719 is always sealed sufficiently to maintain a vacuum pressure that will hold the sheet 02 on the conveyor belt 02. Preferably, sheet-fed printing press 01 is additionally characterized in that at least one of these at least two vacuum pressure chambers 719 arranged offset from one another in transport direction T is arranged such that it is and/or can be connected via at least one suction line 721 to at least one vacuum pressure source 733, and at least one other of these at least two vacuum pressure chambers 719 arranged offset from one another in transport direction T is arranged such that it is and/or can be connected via at least one other suction line 721 in particular exclusively to another vacuum pressure source 733.

In an alternative or additional refinement, the processing machine 01 preferably configured as a sheet-fed printing press 01 is preferably characterized in that at least a first of these at least two vacuum pressure chambers 719 arranged offset from one another in the transport direction T is arranged such that it is and/or can be connected to at least one vacuum pressure source 733 via at least one suction line 721 and at least one controllable and/or regulable valve 737. In an alternative or additional refinement, the processing machine 01 preferably configured as a sheet-fed printing press 01 is preferably characterized in that at least one other of these at least two vacuum pressure chambers 719 arranged offset from one another in the transport direction T is arranged such that it is and/or can be connected via at least one suction line 721 and at least one other controllable and/or regulable valve 737 to said at least one vacuum pressure source 733. In an alternative or additional refinement, the processing machine 01 preferably configured as a sheet-fed printing press 01 is preferably characterized in that at least one other of these at least two vacuum pressure chambers 719 arranged offset from one another in the transport direction T is arranged such that it is and/or can be connected via at least one suction line 721 and at least one other controllable and/or regulable valve 737 in particular exclusively to another vacuum pressure source 733.

In an alternative or additional refinement, the processing machine 01 preferably configured as a sheet-fed printing press 01 is preferably characterized in that at least one valve 737 assigned to a vacuum pressure chamber 719 or a suction line 721 is connected to a machine controller of the sheet processing machine 01 configured in particular as a sheet-fed printing press 01, said machine controller also having access to data relating to the position of at least one sheet 02 and/or to data relating to the rotational position of at least one drive involved in the transport of the at least one sheet 02. In an alternative or additional refinement, the processing machine 01 preferably configured as a sheet-fed printing press 01 is preferably characterized in that at least one vacuum pressure source 733 associated with a vacuum pressure chamber 719 or a suction line 721 is connected to a machine controller of the sheet processing machine 01 configured in particular as a sheet-fed printing press 01, said machine controller also having access to data relating to the position of at least one sheet 02 and/or to data relating to the rotational position of at least one drive involved in the transport of the at least one sheet 02. By accessing these data, it is possible to vacuum pressurize only those vacuum pressure chambers 719 that are covered sufficiently, or soon will be, in order to actually hold one or more sheets 02. The area of activated vacuum pressure chambers 719, i.e. vacuum-pressurized vacuum chambers, can then be moved along with respective sheets 02 and/or can at least partially precede them and/or follow after them a short distance, for example for safety reasons. This allows suctioning power and thus energy to be used only in metered amounts.

Preferred, therefore, is a method for operating a sheet processing machine 01, in particular a sheet-fed printing press 01, in which at least one sheet 02 is transported by means of a suction transport means 111; 117; 119; 136; 211; 311; 411; 417; 511; 561; 611; 617; 711; 811; 817; 911; 1011 configured as a suction belt 111; 117; 119; 136; 211; 311; 411; 417; 511; 561; 611; 617; 711; 811; 817; 911; 1011, which has at least one, in particular flexible conveyor belt 718; 726, which moves with at least one conveying section of its circulation path parallel to the transport direction T along a section of the transport path provided for sheets 02, in particular over a transport length. Preferably at least two, more preferably at least three, even more preferably at least five, and more preferably still at least ten vacuum pressure chambers 719, which in particular are and/or can be separated from one another with respect to the transport direction T and each of which has at least one suction inlet 722, are arranged one behind the other along the transport path provided for sheets 02. Preferably, the conveying section of the circulation path of the at least one conveyor belt 718; 726 at least partially covers at least one suction inlet 722 of multiple and more preferably all of these vacuum pressure chambers 719 arranged one behind the other. The method is preferably characterized in particular by the fact that the respective vacuum pressure of each of the at least two vacuum pressure chambers 719 arranged one behind the other is influenced individually and in a temporally varied manner based at least upon data that characterize the position of the at least one sheet 02 along the conveying section, in particular along the conveying section of the circulation path of the at least one conveyor belt 718; 726.

Preferably, the method is characterized in that the at least one sheet 02 is pulled by vacuum pressure against a conveying surface of a conveyor belt 718; 726 of the suction transport means 111; 117; 119; 136; 211; 311; 411; 417; 511; 561; 611; 617; 711; 811; 817; 911; 1011, said conveyor belt being flexible, in particular, and provided with suction openings 723. The vacuum pressure is preferably determined by the difference between an ambient pressure and a pressure within a respective vacuum pressure chamber 719, the suction inlet 722 of which is covered at least partially by conveyor belt 718; 726. Preferably, the method is characterized in that the at least one sheet 02 is coated in at least one coating unit 400; 600; 800 of the sheet-fed printing press 01 while being transported by means of said suction transport means 111; 117; 119; 136; 211; 311; 411; 417; 511; 561; 611; 617; 711; 811; 817; 911; 1011 configured as a suction belt 111; 117; 119; 136; 211; 311; 411; 417; 511; 561; 611; 617; 711; 811; 817; 911; 1011. More preferably, the method is characterized in that the at least one sheet 02 is printed in at least one printing unit 600 of the sheet-fed printing press 01 while being transported by means of said suction transport means 111; 117; 119; 136; 211; 311; 411; 417; 511; 561; 611; 617; 711; 811; 817; 911; 1011 configured as a suction belt 111; 117; 119; 136; 211; 311; 411; 417; 511; 561; 611; 617; 711; 811; 817; 911; 1011.

As described, processing machine 01, which is configured in particular as a sheet-fed printing press 01, preferably comprises the at least one conveyor belt 718; 726, which further preferably extends with at least one conveying section of its circulation path parallel to the transport direction T along a section of the transport path provided for sheets 02. Preferably, precisely one conveyor belt 718; 726 is arranged with respect to the transverse direction A. As viewed in the transport direction T, multiple conveyor belts may be arranged one behind the other and may form different regions of the transport path provided for sheets 02. The at least one conveyor belt 718; 726 is preferably, although not necessarily, configured as a conveyor belt 718; 726 of a suction transport means 111; 117; 119; 136; 211; 311; 411; 417; 511; 561; 611; 617; 711; 811; 817; 911; 1011 of the sheet-fed printing press 01, configured as a suction belt 111; 117; 119; 136; 211; 311; 411; 417; 511; 561; 611; 617; 711; 811; 817; 911; 1011, in particular with said at least one suction transport means 111; 117; 119; 136; 211; 311; 411; 417; 511; 561; 611; 617; 711; 811; 817; 911; 1011 comprising the at least one conveyor belt 718; 726. As described, the at least one conveyor belt 718; 726 preferably has a multiplicity of suction openings 723. As described, the processing machine 01 preferably configured as a sheet-fed printing press 01 is preferably characterized in that at least one coating position 409; 609; 809 of at least one coating unit 400; 600; 800 of the sheet-fed printing press 01 is arranged along the conveying section of the at least one conveyor belt 718; 726. More preferably, at least two, even more preferably at least three, and more preferably still at least four coating positions 409; 609; 809 of at least one coating unit 400; 600; 800 of sheet-fed printing press 01 are arranged along the conveying section of the at least one conveyor belt 718; 726. At least one drying system 500 and/or at least one drying device 506 of sheet-fed printing press 01 is arranged along the conveying section of the at least one conveyor belt 718; 726, for example.

In an alternative or additional refinement, the processing machine 01 preferably configured as a sheet-fed printing press 01 is preferably characterized in that at least one belt alignment means 738 of the at least one conveyor belt 718; 726 is arranged in contact with the at least one conveyor belt 718; 726, and more preferably in that the position of the at least one conveyor belt 718; 7126 with respect to the transverse direction A can be adjusted by adjusting the position of the at least one belt alignment means 738 relative to at least one, in particular stationary frame 427; 431; 508; 627; 631; 827; 831; 744 of sheet-fed printing press 01. This enables a gradual drifting, for example, of the at least one conveyor belt 718; 726 with respect to the transverse direction A to be compensated for at least partially and preferably completely, in particular while said at least conveyor belt 718; 726 is moving for the purpose of transporting sheets 02.

The at least one belt alignment means 738 is preferably configured as at least one belt alignment roller 738, more preferably as at least one belt alignment roller 738 whose rotational axis 742 is variable in terms of its orientation. This alters, in particular, the angle between the axis of rotation 742 of said belt alignment roller 738 and the axial direction A, in particular with respect to the magnitude and/or the position in space of said angle. For example, the at least one belt alignment means 738 is pivotable about an alignment axis, the direction of which has at least one component oriented orthogonally to the transverse direction A. The operating principle of belt alignment means 738 is demonstrated particularly clearly by such a belt alignment roller 738, for example. When belt alignment means 738 is placed in a skewed position, various parts of conveyor belt 718; 726 must travel different distances, depending upon their position relative to the transverse direction A, for the at least one conveyor belt 728 to complete a full revolution. As a result, the at least one conveyor belt 738 is subjected to force with respect to the transverse direction A and is moved accordingly with respect to the transverse direction A while it is executing its circulating movement. This controlled movement is preferably generated only to compensate for unwanted movements with respect to the transverse direction A that have occurred previously and/or otherwise.

In an alternative or additional refinement, the processing machine 01 preferably configured as a sheet-fed printing press 01 is preferably characterized in that the at least one belt alignment means 738 has at least one radial bearing 739, the rotational axis 742 of which is displaceable, at least with respect to a compensation direction W, at least relative to at least one, in particular stationary frame 427; 431; 508; 627; 631; 827; 831; 744 of sheet-fed printing press 01. Preferably, the at least one radial bearing 739 is linearly displaceable at least in and/or opposite the compensation direction W. At least one such radial bearing 739 is at least one radial bearing 739 that enables the at least one belt alignment roller 738 to rotate about its rotational axis 742, for example. More preferably, the at least one belt alignment means 738 has at least two radial bearings 739, arranged spaced apart in the transverse direction A, the rotational axes 742 of which are arranged displaceably, at least with respect to a compensation direction W, at least relative to one another and/or independently of one another and/or relative to at least one, in particular stationary frame 427; 431; 508; 627; 631; 827; 831; 744 of sheet-fed printing press 01. This occurs, for example, by an uneven displacement of radial bearings 739 of belt alignment roller 738. For example, the at least two radial bearings 739 are linearly displaceable at least in and/or opposite the adjustment direction W. It is also possible, however, for at least two belt alignment means 738 to be provided, for example, which are configured, for example, as rollers and are arranged offset or side by side with respect to the transverse direction A, and which are movable independently of one another with respect to the adjustment direction W. Preferred, however, is the case in which precisely one belt alignment means 738, in particular configured as belt alignment roller 738, is provided and the at least two radial bearings 739 are both assigned to this same belt alignment means 738.

In an alternative or additional refinement, the processing machine 01 preferably configured as a sheet-fed printing press 01 is preferably characterized in that a reference plane is a plane having a normal vector oriented parallel to the transverse direction A, and an adjustment tangent 743 is a tangent 743 to a contacting segment of a line of intersection of the at least one conveyor belt 718; 726 with the reference plane, and the contacting segment is a segment in which contact exists between the at least one conveyor belt 718; 726 and the at least one belt alignment means 738, and the adjustment direction W is oriented parallel to adjustment tangent 743. In that case, the position with respect to the transverse direction A of the at least one conveyor belt 718; 726 can be influenced particularly precisely, in particular without unduly impacting the tension of the at least one conveyor belt 718; 726. More preferably, adjustment direction W runs parallel to a bisector between an approaching direction, in which components of the at least one conveyor belt 718; 726 are moving when they reach the at least one belt alignment means 738 and/or in which an approaching part of the at least one conveyor belt 718; 726 extends, and a departing direction, in which components of the at least one conveyor belt 718; 726 are moving when they leave the at least one belt alignment means 738 and/or in which a departing part of the at least one conveyor belt 718; 726 extends. A deflection angle is preferably the angle by which conveyor belt 718; 726 is deflected between a first and a last contact with the at least one belt alignment means 738. Preferably, the deflection angle is a maximum of 180°, more preferably a maximum of 120°, even more preferably a maximum of 90°, and more preferably still a maximum of 60°.

In an alternative or additional refinement, the processing machine 01 preferably configured as a sheet-fed printing press 01 is preferably characterized in that the at least one belt alignment means 738 has at least one alignment drive 741. This enables the position of the at least one conveyor belt 718; 726 with respect to the transverse direction A to be influenced in a remotely controlled and/or automated fashion. The at least one belt alignment means 738 is preferably configured to be controlled and/or regulated by means of a computer system, with said computer system being a higher-level machine controller of the sheet-fed printing press 01, for example, or at least being connected in terms of circuitry to the higher-level machine controller of the sheet-fed printing press 01. Alternatively, said computer system is independent of the higher-level machine controller of the sheet-fed printing press 01. The at least one alignment drive 741 is configured as an electric motor 741 and/or as a pneumatic cylinder 741 and/or as a hydraulic cylinder 741 and/or as a linear drive 741, for example. At least one sensor is arranged to detect the position of the at least one conveyor belt 716; 726 with respect to the transverse direction A, for example. Signals from said at least one sensor can then be made available, for example, to a press operator and/or can be used to regulate and/or control the at least one alignment drive 741.

In an alternative or additional refinement, the processing machine 01 preferably configured as a sheet-fed printing press 01 is preferably characterized in that the at least one belt alignment means 738 is in contact with only the underside of the at least one conveyor belt 718; 726, said underside being a surface of the at least one conveyor belt 718; 726 which is opposite a conveying surface 718 of the at least one conveyor belt 718; 726, which is provided for contact with sheets 02. This ensures that only forces resulting from paths of different lengths act on the conveyor belt, while wear and tear on the lateral edge of the at least one conveyor belt 718; 726 is largely avoided.

In an alternative or additional refinement, the processing machine 01 preferably configured as a sheet-fed printing press 01 is preferably characterized in that at least one tensioning means 736 for adjusting and/or maintaining in particular a mechanical tension of conveyor belt 718; 726, in particular of suction belt 718; 726, is provided, and in particular is arranged in contact with said conveyor belt 718; 726. As such a tensioning means 736, for example, at least one deflection roller 736 is provided, the axis of rotation of which is displaceably disposed. The at least one tensioning means 736 is preferably displaceable in and/or opposite at least one tensioning direction. All of the components of the at least one tensioning means 736 that are in contact with the at least one conveyor belt 718; 726 are movable together linearly, for example. The at least one tensioning means 736 has at least two bearings, for example, in particular radial bearings, which are arranged so as to be movable parallel to one another orthogonally to the transverse direction A. At least one tensioning drive is provided, for example, by means of which the at least one tensioning means 736 can be displaced. The at least one tensioning drive is configured, for example, as at least electric motor and/or as at least one hydraulic cylinder and/or as at least one pneumatic cylinder and/or as a linear drive.

Figure 22A:
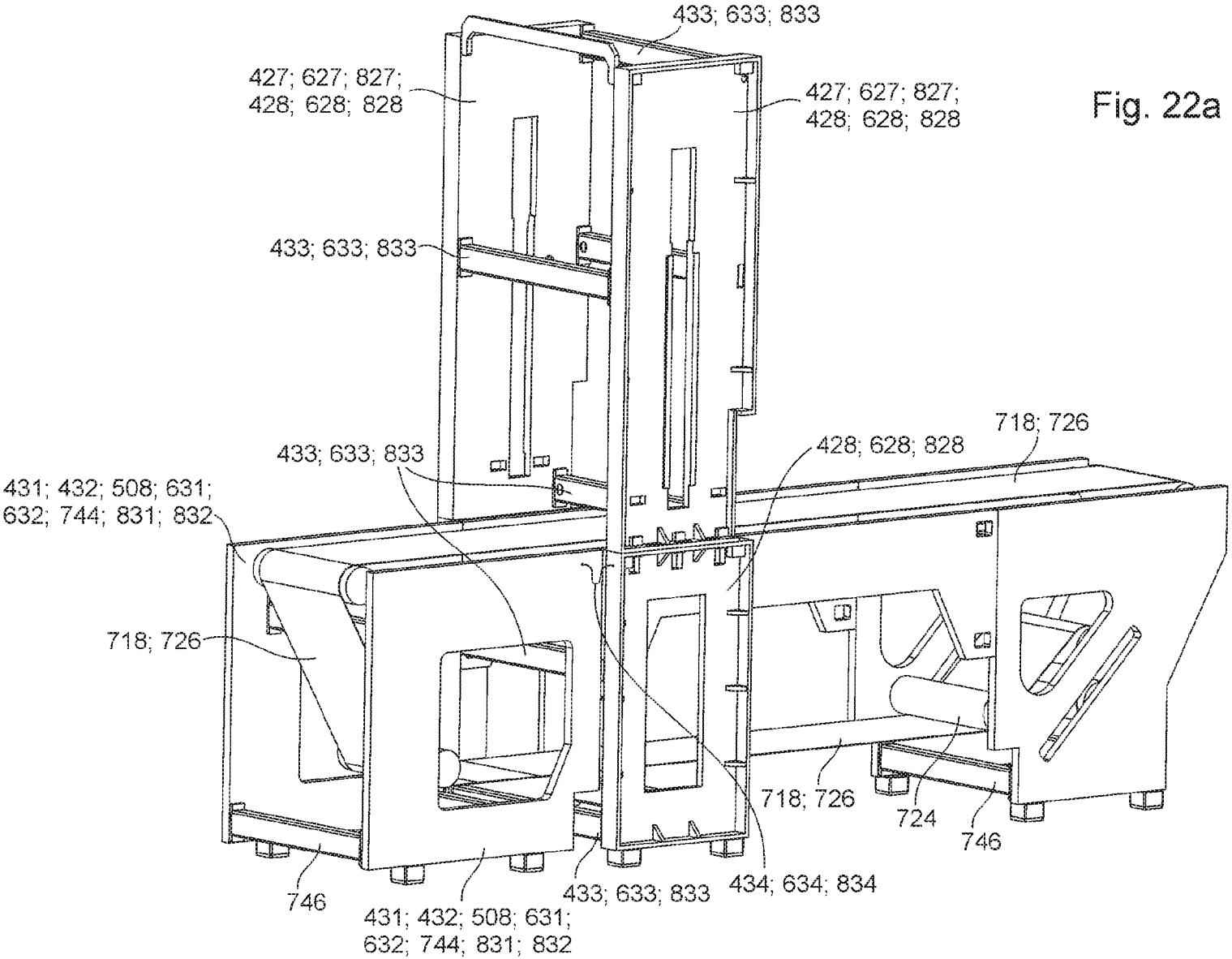
FIG. 22*a* shows a schematic diagram of a first and a second frame of a coating unit in a perspective view, in which in the interest of clarity, print heads are not shown.
Figure 22B:
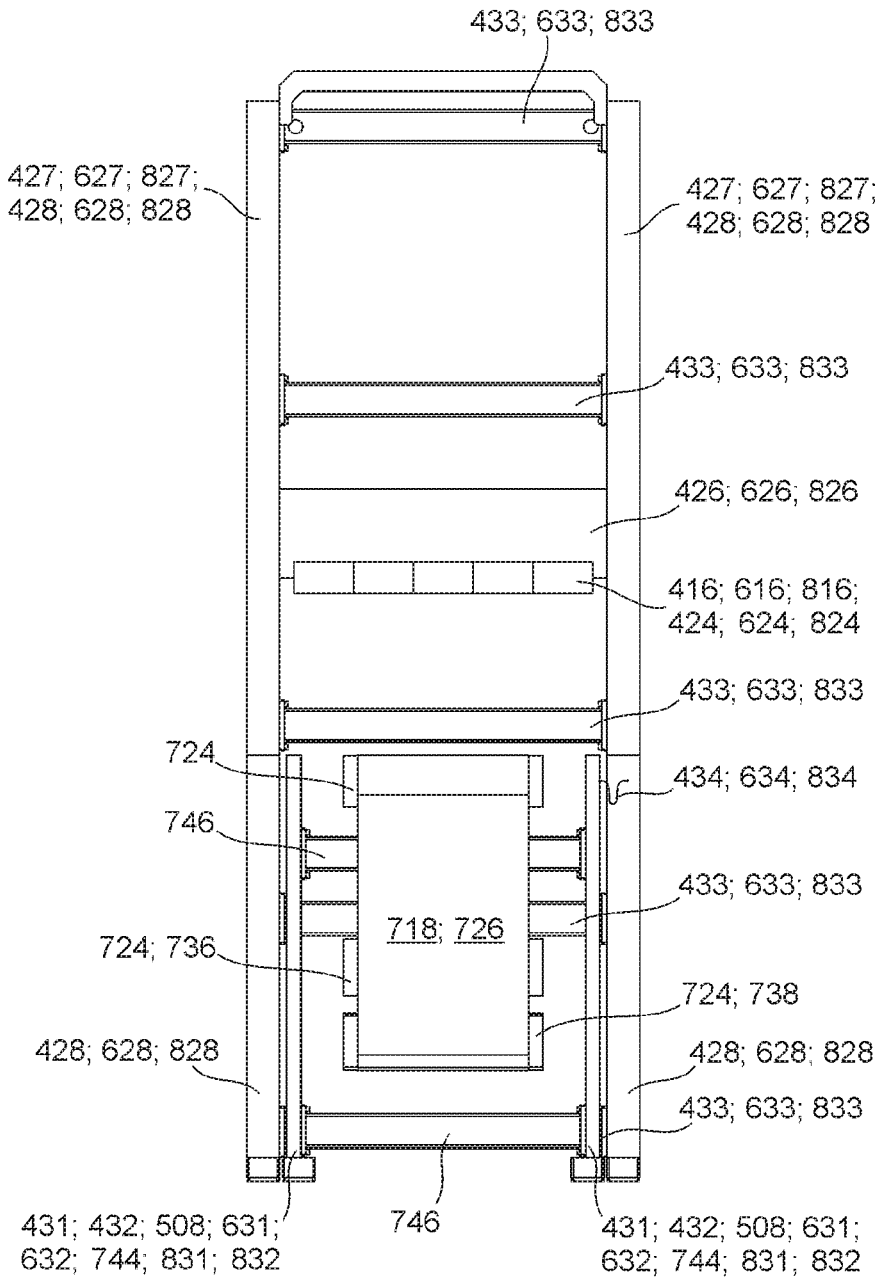
FIG. 22*b* shows a schematic diagram of a first and a second frame of a coating unit with print heads and a positioning device, viewed in the transport direction.
Figure 22C:
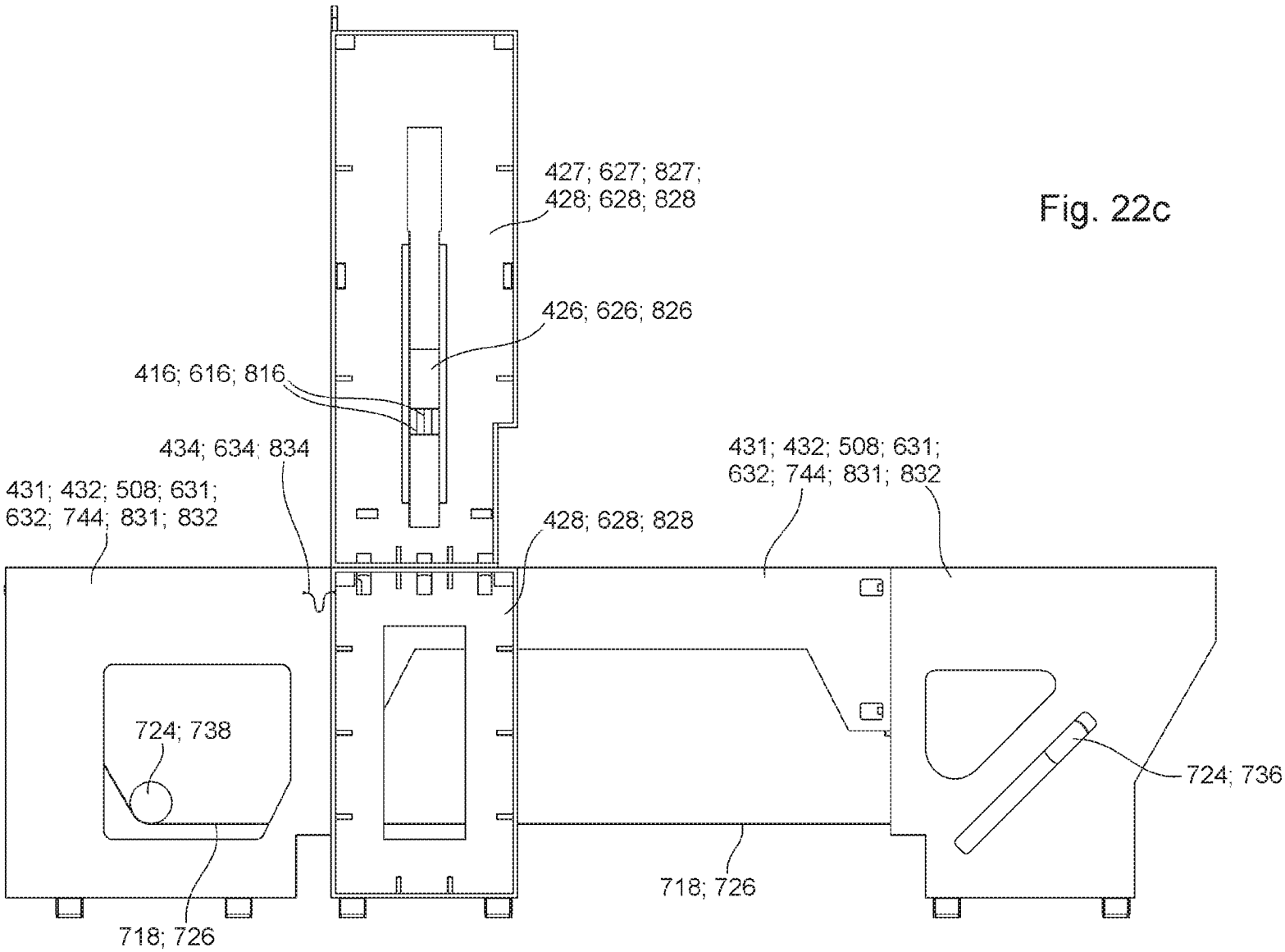
FIG. 22*c* shows a schematic diagram of a first and a second frame of a coating unit with print heads and a positioning device, viewed in the transverse direction.
Figure 23:
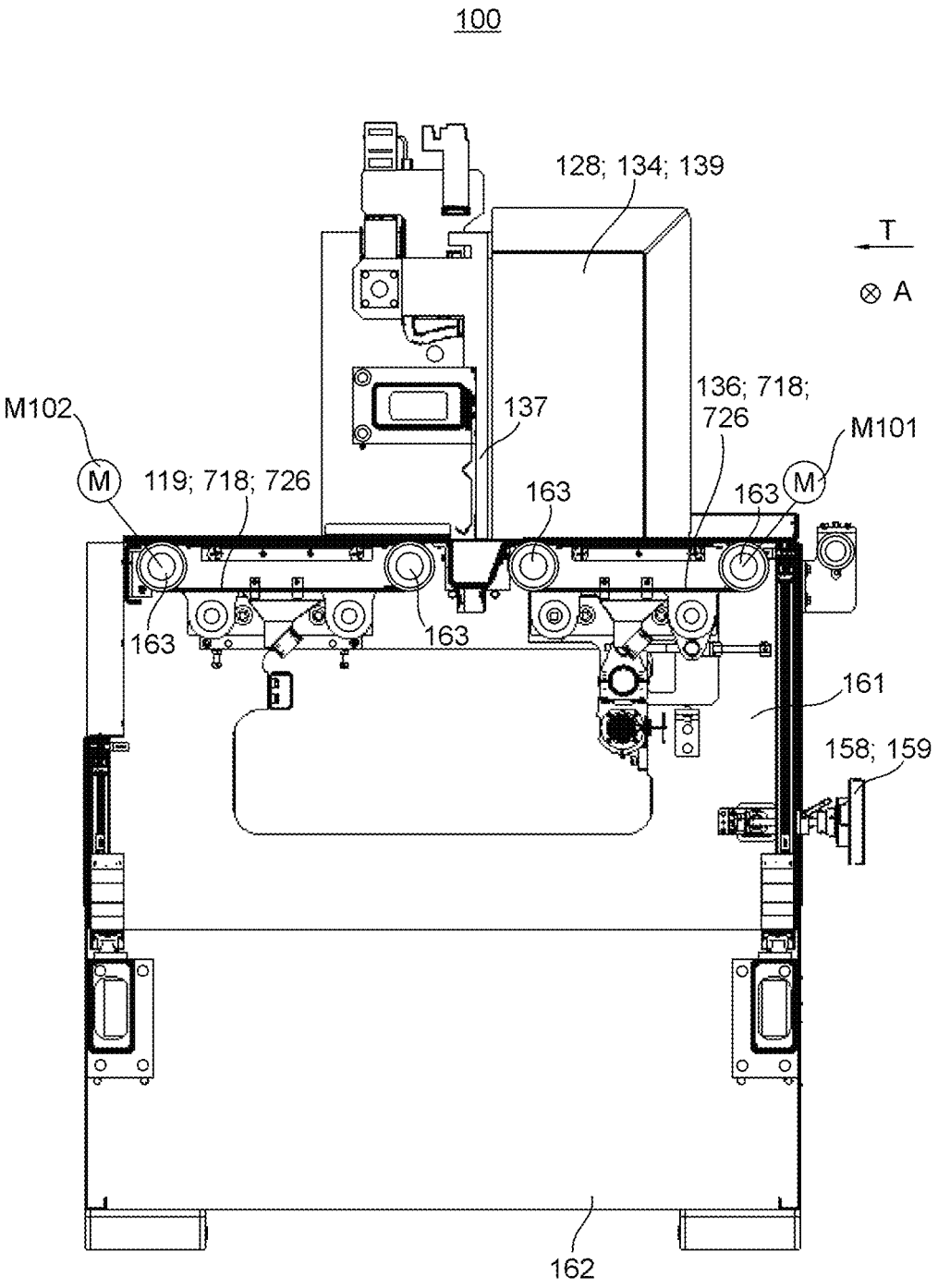
FIG. 23 shows a schematic diagram of a sheet feeder unit in the transverse direction.
Figure 24:
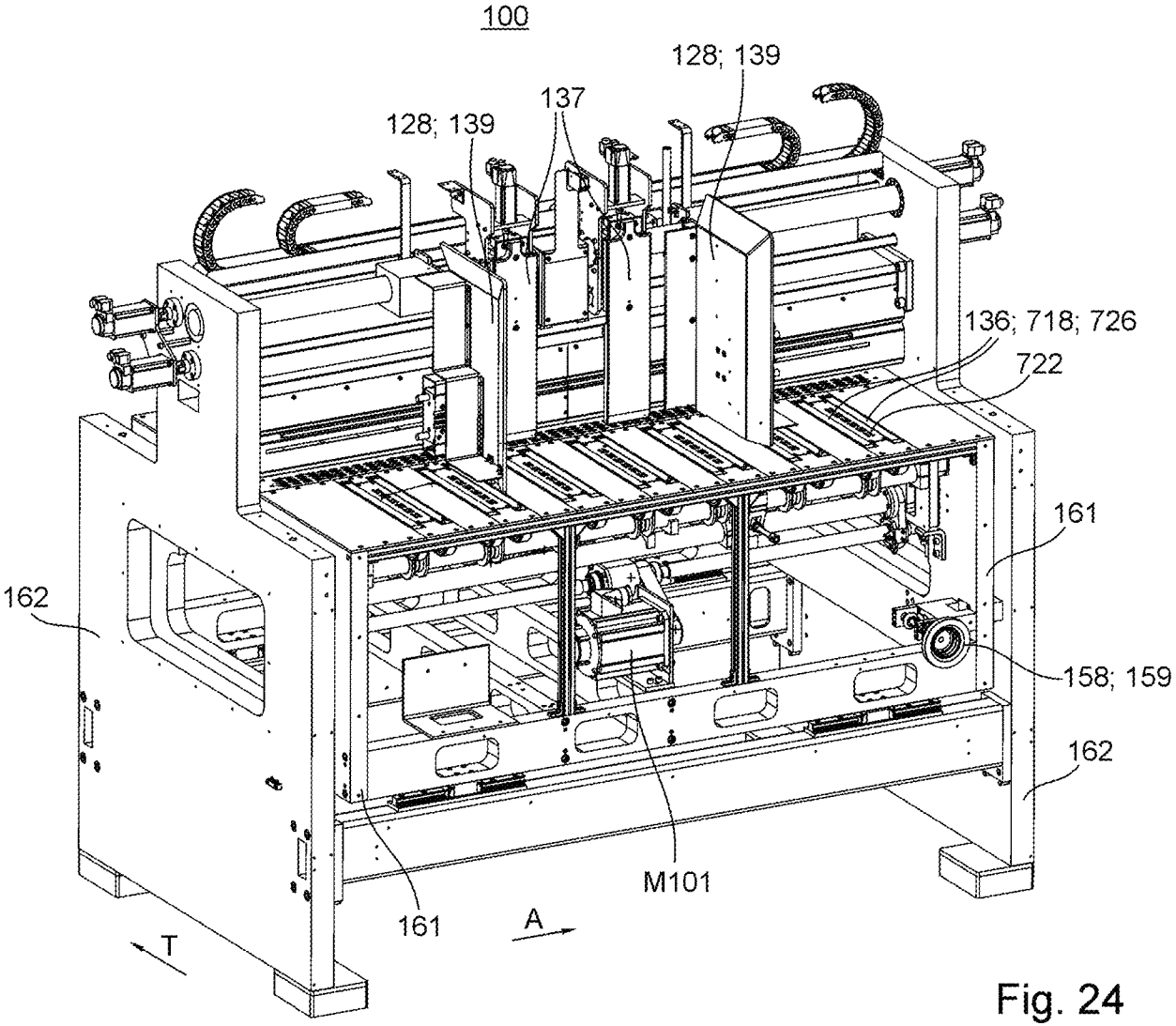

In an alternative or additional refinement, the processing machine 01 preferably configured as a sheet-fed printing press 01 is preferably characterized in that the sheet-fed printing press 01 has at least one coating unit 400; 600; 800 configured as a non-impact coating unit 400; 600; 800, and the sheet-fed printing press 01 has at least one conveyor belt 718; 726, which extends with at least one conveying section of its circulation path parallel to a transport direction T along a section of a transport path provided for sheets 02, and along the conveying section of the at least one conveyor belt 718; 726, at least one coating position 409; 609; 809 of at least one coating unit 400; 600; 800 of the sheet-fed printing press 01, determined in particular by at least one print head 416; 616; 816, as seen in FIGS. 22*b* and 22*c* is provided. The at least one coating unit 400; 600; 800 thus preferably has at least one print head 416; 616; 816. The at least one print head 416; 616; 816 is preferably arranged connected to at least one first frame 427; 627; 827, as shown in FIGS. 22*a* and 22*b*, of the at least one coating unit 400; 600; 800, more preferably to at least one lateral wall 428, 628, 828 of the at least one first frame 427; 627; 827 of the at least one coating unit 400; 600; 800, and even more preferably to at least two lateral walls 428, 628, 828 of the at least one first frame 427; 627; 827 of the at least one coating unit 400; 600; 800. This connection may be direct, for example, but is preferably indirect. For example, the at least one print head 416; 616; 816 is arranged connected to the at least one first frame 427; 627; 827 via at least one positioning device 426; 626; 826 and/or at least one other component.

The first frame 427; 627; 827 is preferably the frame 427; 627; 827 of the coating unit 400; 600; 800 or coating module 400; 600; 800. The first frame 427; 627; 827 preferably has at least two lateral walls 428; 628; 828, in particular spaced apart from one another with respect to the transverse direction A. More preferably, the at least one print head 416; 616; 816 is arranged between the at least two lateral walls 428; 628; 828 of the first frame 427; 627; 827 with respect to the transverse direction A.

In an alternative or additional refinement, the processing machine 01 preferably configured as a sheet-fed printing press 01 is preferably characterized in that the at least one conveyor belt 718; 726 is arranged connected via at least one deflection means 724 and at least one radial bearing to at least one second frame 431; 508; 631; 831; 744, more preferably to at least one lateral support 432; 632; 832 of the second frame 431; 508; 631; 831; 744, and even more preferably to at least two lateral supports 432; 632; 832 of the second frame 431; 508; 631; 831; 744, as seen in FIGS. 22*a*, 22*b* and 22*c*. The second frame 431; 508; 631; 831; 744 is, for example, a frame 431; 508; 631; 831; 744 of an additional unit 500; 700 or module 500; 700, for example a frame of a drying unit 500 or a drying module 500 or of a transport unit 700 or transport module 700. Alternatively, the second frame 431; 508; 631; 831; 744 is a second frame 431; 631; 831 and/or sub-frame 431; 631; 831 of the coating unit 400; 600; 800 or coating module 400; 600; 800, for example. The second frame 431; 508; 631; 831; 744 preferably has at least two lateral supports 432; 632; 832, in particular spaced apart from one another with respect to the transverse direction A. More preferably, the at least one conveyor belt 718; 726 is arranged at least partially between the at least two lateral supports 432; 632; 832 of the second frame 431; 508; 631; 831; 744 with respect to the transverse direction A. Preferably, the second frame 431; 508; 631; 831; 744 and in particular the lateral supports 432; 632; 832 thereof lie between the lateral walls of the at least one first frame 427; 627; 827 with respect to the transverse direction A.

In an alternative or additional refinement, the processing machine 01 preferably configured as a sheet-fed printing press 01 is preferably characterized in that the at least one first frame 427; 627; 827, with the exception of at least one installation surface that is different from the at least one first frame 427; 627; 827 and the at least one second frame 431; 508; 631; 831; 744, is arranged in contact with, i.e., connected to, the second frame 431; 508; 631; 831; 744 at most via flexible connections 435, 634, 834, as depicted schematically in FIGS. 22*a*, 22*b* and 22*c*. Said at least one installation surface is preferably an installation surface beneath the at least one coating unit 400; 600; 800 and/or beneath the sheet-fed printing press 01 and/or beneath the at least one first frame 427; 627; 827 and/or beneath the at least one second frame 431; 508; 631; 831; 744. This means, in particular, that although the at least one conveyor belt 718; 726 can be associated with the coating module 400; 600; 800 or coating unit 400; 600; 800, it is preferably nevertheless supported by the second frame 431; 508; 631; 831; 744 and to that extent is arranged mechanically decoupled from the first frame 427; 627; 827. The at least one installation surface is preferably at least one surface that acts as a supporting surface that supports from the bottom upward and/or that supports the at least one coating unit 400; 600; 800 and/or the sheet-fed printing press 01 and/or the at least one first frame 427; 627; 827 and/or the at least one second frame 431; 508; 631; 831; 744. The at least one installation surface is, for example, a floor of a building or a component of a sufficiently stable and low-vibration substructure.

In an alternative or additional refinement, the processing machine 01 preferably configured as a sheet-fed printing press 01 is preferably characterized in that the second frame 431; 508; 631; 831; 744 has at least two lateral supports 432; 632; 832, in particular spaced apart from one another with respect to the transverse direction A, and in that the at least one conveyor belt 718; 726 is arranged at least partially between the at least two lateral supports 432; 632; 832 of the second frame 431; 508; 631; 831; 744 with respect to the transverse direction A and/or at least one of the at least two lateral supports 432; 632; 832 is arranged connected via at least one cross member 746 of the second frame 431; 508; 631; 831; 744 to at least one other of the at least two lateral supports 432; 632; 832 of the second frame 431; 508; 631; 831; 744.

Such cross members 746 of the second frame 431; 508; 631; 831; 744 serve in particular to stabilize the second frame 431; 508; 631; 831; 744. They are preferably configured for optimized stability and are therefore arranged in different positional relationships to the at least one conveyor belt 718; 726. For example, at least one such cross member 746 of the second frame 431; 508; 631; 831; 744 is arranged at least partially vertically below at least one section of the at least one conveyor belt 718; 726, configured in particular as a conveying section. Alternatively or additionally, at least one such cross member 746 of the second frame 431; 508; 631; 831; 744 is preferably arranged at least partially vertically below at least one section of the at least one conveyor belt 718; 726, which section is arranged at least partially vertically below a further section of said at least one conveyor belt 718; 726, configured in particular as a conveying section. Alternatively or additionally, at least one such cross member 746 of the second frame 431; 508; 631; 831; 744 is arranged at least partially vertically above at least one section of the at least one conveyor belt 718; 726. Alternatively or additionally, at least one such cross member 746 of the second frame 431; 508; 631; 831; 744 is arranged at least partially vertically above at least one section of the at least one conveyor belt 718; 726, configured in particular as a conveying section, which is arranged at least partially vertically above a further section of said at least one conveyor belt 718; 726. Alternatively or additionally, at least one such cross member 746 of the second frame 431; 508; 631; 831; 744 is arranged at least partially vertically above at least one section of the at least one conveyor belt 718; 726 and at least partially vertically below a further section of said at least one conveyor belt 718; 726, configured in particular as a conveying section.

In an alternative or additional refinement, the processing machine 01 preferably configured as a sheet-fed printing press 01 is preferably characterized in that the first frame 427; 627; 827 has at least two lateral walls 428; 628; 828, in particular spaced apart from one another with respect to the transverse direction A, and in that the at least one print head 416; 616; 816 is arranged at least partially between the at least two lateral walls 428; 628; 828 of the first frame 427; 627; 827 with respect to the transverse direction A and/or at least one of the at least two lateral walls 428; 628; 828 of the first frame 427; 627; 827 is arranged connected via at least one cross member 433; 633; 833 of the first frame 427; 627; 827 to at least one other of the at least two lateral walls 428; 628; 828 of the first frame 427; 627; 827.

Such cross members 433; 633; 833 of the first frame 427; 627; 827 serve in particular to stabilize the first frame 427; 627; 827. They are preferably configured for optimized stability and are therefore arranged in different positional relationships to the at least one conveyor belt 718; 726. For example, at least one such cross member 433; 633; 833 of the first frame 427; 627; 827 is arranged at least partially vertically below at least one section of the at least one conveyor belt 718; 726, configured in particular as a conveying section. Alternatively or additionally, at least one such cross member 433; 633; 833 of the first frame 427; 627; 827 is preferably arranged at least partially vertically below at least one section of the at least one conveyor belt 718; 726, which section is arranged at least partially vertically below a further section of said at least one conveyor belt 718; 726, configured in particular as a conveying section. Alternatively or additionally, at least one such cross member 433; 633; 833 of the first frame 427; 627; 827 is preferably located at least partially vertically above at least one section of the at least one conveyor belt 718; 726, in particular configured as a conveying section. Alternatively or additionally, at least one such cross member 433; 633; 833 of the first frame 427; 627; 827 is preferably arranged at least partially vertically above at least one section of the at least one conveyor belt 718; 726, configured in particular as a conveying section, which section is arranged at least partially vertically above a further section of said at least one conveyor belt 718; 726. Alternatively or additionally, at least one such cross member 433; 633; 833 of the first frame 427; 627; 827 is preferably arranged at least partially vertically above at least one section of the at least one conveyor belt 718; 726 and at least partially vertically below a further section of said at least one conveyor belt 718; 726, configured in particular as a conveying section.

In an alternative or additional refinement, the processing machine 01 preferably configured as a sheet-fed printing press 01 is preferably characterized in that a print head assembly 424; 624; 824 connected directly or indirectly to the side walls 428; 628; 828 of the first frame 427; 627; 827 is arranged at least partially vertically above at least one section of the at least one conveyor belt 718; 726, in particular configured as a conveying section. In an alternative or additional refinement, the processing machine 01 preferably configured as a sheet-fed printing press 01 is preferably characterized in that at least one section of the at least one conveyor belt 718; 726, in particular configured as a conveying section, passes through an opening that is delimited at least partially by at least one print head assembly 424; 624; 824 and at least partially by at least one cross member 433; 633; 833 of the first frame 427; 627; 827 and at least partially by the side walls 428; 628; 828 of the first frame 427; 627; 827. The boundaries of said opening preferably lie within a spatial area that is delimited by two planes, the normal vectors of which point in the transport direction T and which are arranged spaced no more than 50 cm apart and more preferably no more than 25 cm apart.

In an alternative or additional refinement, the processing machine 01 preferably configured as a sheet-fed printing press 01 is preferably characterized in that at least one drive M100; M200; M300; M400; M401; M500; M550; M600; M601; M700; M800; M801; M900; M1000 of the conveyor belt 718; 726 is arranged connected at least partially directly or indirectly and rigidly to the second frame 431; 508; 631; 831; 744. Due to the separation of the frames 427; 627; 827; 431; 508; 631; 831; 744, said at least one drive M100; M200; M300; M400; M401; M500; M550; M600; M601; M700; M800; M801; M900; M1000 is then preferably decoupled from the first frame 427; 627; 827 such that movements of said drive M100; M200; M300; M400; M401; M500; M550; M600; M601; M700; M800; M801; M900; M1000 and/or movements of the at least one conveyor belt 718; 726 have no impact or only very little impact on print quality, particularly in the case of a non-impact printing unit 400; 600; 800.

In an alternative or additional refinement, the processing machine 01 preferably configured as a sheet-fed printing press 01 is preferably characterized in that at least one energy output device 501; 502; 503 of at least one drying system 500 and/or at least one drying device 506 is arranged aligned toward a section of the at least one conveyor belt 718; 726, and in that said at least one energy output device 501; 502; 503 is connected rigidly or via a positioning device 424; 624; 824 to the first frame 427; 627; 827 or to the second frame 431; 508; 631; 831; 744 or to a third frame, which is different from the first frame 427; 627; 827 and the second frame 431; 508; 631; 831; 744.

Preferably, the sheet-fed printing press 01 is alternatively or additionally characterized in that at least one module 100 configured as a substrate supply system 100 is provided upstream of the at least one priming module 400 and/or upstream of the at least one non-impact printing module 600 along the transport path provided for sheets 02. Preferably, sheet-fed printing press 01 is alternatively or additionally characterized in that at least one cleaning system 201 for sheets 02 is located upstream of the at least one priming module 400 and/or upstream of the at least one non-impact printing module 600 along the transport path provided for sheets 02.

In the following, various embodiments and/or possible configurations of the at least one substrate supply system 100 will be described. Here, various combinations of individual configurations are possible. Substrate supply system 100 is preferably configured as separate from other units 200; 300; 400; 500; 550; 600; 700; 800; 900; 1000, provided no contradictions result. Piles 104 are supplied to the substrate supply system 100, manually and/or by means of an automated system, for example, in particular in the form of piles 104 preferably arranged on carrier units 113. Such carrier units 113 are pallets 113, for example. Piles 104 that are or have been supplied as such to the substrate supply system 100 are also referred to as feeder piles 104, for example. The carrier units 113 or pallets 113 preferably have correspondingly aligned grooves, for example for the engagement of pile carriers, in particular for releasing sheets 02 and/or piles 104 from the carrier units 113 or pallets 113.

The at least one substrate supply system 100 preferably serves to singulate sheets 02 of a pile 104 or partial pile 106 and more preferably to feed said sheets, singulated, to one or more units 200; 300; 400; 500; 550; 600; 700; 800; 900 downstream. The at least one substrate supply system 100 has at least one pile turning device 101 or sheet turning device, for example. Pile turning device 101 preferably serves to turn a pile 104 or partial pile 106 comprising at least a plurality of sheets 02, as a complete unit. Turning the sheets 02 is useful, for example, when two opposing main surfaces of the sheets 02 are different from one another and when subsequent processing is to take place on a specific one of these main surfaces. This is the case, regardless of whether the sheets 02 are turned individually or whether the pile 104 is turned as a complete unit, or whether partial piles 106 are turned. This applies, for example, when the sheets 02 have already been processed before being collected to form the pile 104 and/or when the sheets 02 have main surfaces that are distinguished from one another. Such distinguishable main surfaces are formed, for example, during the production of corrugated cardboard sheets 02.

A pile holding area 102 is an area 102, in particular a spatial area 102, in which the pile 104 that will be subdivided for the subsequent processing of its sheets 02 is located, at least temporarily, at least during operation of the processing machine 01. The pile holding area 102 preferably encompasses the entire spatial area provided for location of such a pile 104, in particular regardless of whether the pile 104 takes up less space than is available, for example because its sheets 02 have already been partially singulated or have a format which is smaller than the maximum possible format. This pile 104 is preferably the feeder pile 104. Thus, the pile holding area 102 is preferably the spatial area 102 that is provided, at least during operation of the processing machine 01, for the positioning of at least one pile 104 configured as feeder pile 104, for the subdivision thereof. The at least one pile turning device 101 is located upstream of the pile holding area 102, for example, with respect to a transport path provided for the sheets 02. In that case, pile 104 can be turned as a complete unit, before being supplied for further processing by processing machine 01, and in particular subdivided. Alternatively or additionally, at least one pile turning device 101 is located downstream of the pile holding area 102 with respect to the transport path provided for sheets 02. In that case, pile turning device 101 is preferably configured as a partial pile turning device 101.

A partial pile separator 103 is provided, for example, which serves to separate an upper partial pile 106, in particular, from the pile 104 located in the pile holding area 102. A partial pile 103 preferably contains more than one sheet 02. The partial pile separator 103 is configured, for example, as a partial pile pushing system 103 and/or as a partial pile drawing system.

A partial pile 106 containing a plurality of sheets 02 is removed from pile 104 as follows, for example. First, pile 104 is brought to the height at which the topmost sheet 02 of pile 104 is at the removal height. A partial pile pushing system 103 is then moved toward pile 104, in particular in the transport direction T, until it comes into contact with at least one sheet 02 of the pile 104. This at least one sheet 02 is the bottommost sheet 02 of partial pile 106, for example. The partial pile pushing system 103 is then moved even further, thereby moving the at least one sheet 02 that is in contact with it, and preferably any sheets 02 located above it. These moving sheets 02 are thus moved, in particular pushed, together as a partial pile 106 preferably in the transport direction T.

This partial pile 106 is then fed first to the partial pile turning device 101, for example. The partial pile turning device 101 has at least one transport means 107, for example, which is preferably configured as at least one conveyor belt 107, more preferably at least two conveyor belts 107. Transport means 107 is preferably pivotable at least partially about a pivot axis 108, which is more preferably oriented horizontally and/or orthogonally to the intended transport direction T and/or parallel to the transverse direction A. The at least two conveyor belts 107 can be moved toward one another, for example, in particular with respect to the vertical direction V. This allows the partial pile 106 to be held, in particular clamped, between the two conveyor belts 107 and to pivot together with said conveyor belts about pivot axis 108, in particular about essentially 180°. To introduce the partial pile 106 into the partial pile turning device 101 and/or to move the partial pile 106 out of the partial pile turning device 101, at least one of the at least two conveyor belts 107 is preferably activated. Each of these can be operated in two directions, for example, enabling them to initiate the transport of the partial pile 106 independently of the current pivot position of transport means 107.

Regardless of whether or not a pile turning device 101 or a partial pile turning device 101 is provided, substrate supply system 100 preferably comprises at least one singulating system 109 or sheet singulating system 109. Optionally, a plurality of singulating systems 109 may be provided, in particular spaced from one another and/or one behind the other with respect to the transport direction T. In that case, one singulating system 109 is used for the at least partial singulation of sheets 02, for example, and another singulating system is used for a subsequent full singulation of sheets 02. This at least one singulating system 109 or sheet singulating system 109 is located, for example, downstream of the partial pile turning system 101 with respect to the transport path provided for sheets 02. If no partial pile turning system 101 is provided, after partial pile 106 is created, it is preferably fed immediately to singulating system 109 or sheet singulating system 109. More particularly, if no partial pile separator 103 is provided and/or if no partial piles 106 are produced, the singulating system 109 or sheet singulating system 109 preferably acts directly on a respective pile 104. This pile 104 is the feeder pile 104, for example, which is more preferably located in the pile holding area 102. In that case, the at least one singulating system 109 is configured, for example, as a removal system 114.

The at least one singulating system 109 or sheet singulating system 109 preferably at least partially singulates the sheets 02 of the pile 104 or partial pile 106. In at least one embodiment, the at least one singulating system 109 or sheet singulating system 109 singulates the sheets 02 of the pile 104 or partial pile 106 from below, and in at least one other embodiment, it singulates the sheets from above.

In a first embodiment of a sheet singulating system 109, a partial or full singulation of the sheets 02 of pile 104 or of partial pile 106 from below is carried out, for example, by the pile 104 or partial pile 106, which is resting on at least one lower translational element 111, in particular a lower transport means 111, being transported in particular continuously, for example in the transport direction T, and running at least partially up against a barrier 112, which allows only a lower portion of the pile 104 or partial pile 106 to pass, for example, only one sheet 02 or two sheets 02 or a few sheets 02. At least the bottommost sheet 02 in each case is thereby preferably transported further continuously by means of the at least one lower translational element 111, in particular in the transport direction T, while other sheets 02 are initially held back, and only after at least the bottommost sheet 02 has been transported away are the other sheets able to drop downward until they are themselves in a position in which they can pass through below the barrier 112. The height of barrier 112 is preferably adapted to the thickness of the sheets 02 and/or to a desired type of singulation. As a height-adjustable barrier 112, for example, a weir 112 is used, which is preferably configured as a plate 112. If sheets 02 are to be singulated fully, the height below the barrier is preferably greater than the thickness of the sheets 02 but less than twice the thickness of the sheets 02. If an incomplete singulation, for example in the form of a shingled stream of sheets 02, is sufficient, the height below the barrier is preferably correspondingly greater than twice the thickness of the sheets 02 but less than four times the thickness of the sheets 02, for example. The entire pile 104 is thereby singulated or incompletely singulated, i.e. shingled, in particular if no partial pile separator 103 is provided. Preferably, however, pile 104 is subdivided successively by means of the partial pile separator 103 into partial piles 106, which are then transported further in a turned or unturned position, and are then singulated or incompletely singulated, i.e. shingled.

The lower translational element 111 is configured, for example, as a suction transport means 111, in particular as a suction belt 111 and/or suction box belt 111 and/or roller suction system 111. Preferably, however, in this case at least one relatively simple conveyor belt 111 that has no suction system is used as the lower translational element 111. A respective partial pile 106 is preferably fed by the partial pile turning device 101 to the lower translational element 111, and said partial pile is at least partially singulated by means of the barrier 112 and converted to a stream of singulated or shingled sheets 02, arranged on the at least one lower translational element 111. At this point, a precise positioning of the sheets 02 is preferably not yet necessary, since this precise positioning preferably is not generated until later, in a subsequent processing step by means of at least one additional singulating system 109 and/or by means of an infeed system 300. Said at least one infeed system 300 is configured as part of the substrate supply system 100 or as autonomous.

In a second embodiment of a sheet singulating system 109, the sheets 02 of the pile 104 or partial pile 106, more particularly the sheets of a storage pile or infeed pile, are singulated from below, for example, in that the pile 104 or partial pile 106 or the storage pile or infeed pile is stored in a storage device 134, and at least one acceleration means, in particular primary acceleration means 136, is brought into contact with the bottommost sheet 02 of the pile 104 or partial pile 106 or storage pile or infeed pile in each case, at times that are preferably selected in a controlled and/or regulated manner, and/or acts on this bottommost sheet 02 in a controlled and/or regulated manner. In the foregoing and in the following, when singulation from below by means of this sheet singulating system 109 is described, this refers to a storage pile configured as an infeed pile. This is the case regardless of whether another, for example partial singulation from below or from above has already taken place, or whether this infeed pile has been otherwise preprocessed or was introduced as a complete unit directly into storage device 134 when it was first fed into the substrate supply system 100.

In an alternative or additional refinement, the processing machine 01 preferably configured as a sheet-fed printing press 01 is preferably characterized in that a respective section of the transport path provided for sheets 02, which section is defined by the at least one primary acceleration means 136, has a minimum radius of curvature measuring at least 2 meters and/or having a direction that deviates no more than 30° from at least one horizontal direction and/or from the transport direction T over the entire range of the respective primary acceleration means 136.

The processing machine 01 preferably configured as sheet-fed printing press 01 and in particular the substrate supply system 100 preferably comprises at least one storage device 134 for at least one stored pile of sheets 02. Storage device 134 is preferably positioned downstream of the pile holding area 102 with respect to the transport path provided for sheets 02. Two storage piles are provided, for example, one of which is configured as an infeed pile and one as a buffer pile. Sheets 02 taken from a first pile 104, configured, for example, as feeder pile 104, can preferably be fed, in particular from above, by means of substrate supply system 100 to storage device 134 and in particular to the at least one storage pile. The at least one storage device 134 preferably includes the at least one singulating system 109 that acts from below, which is configured to remove the bottommost sheet 02 individually in each case from a storage pile and in particular from an infeed pile. This bottommost sheet 02 in each case is preferably the bottommost sheet 02 of a storage pile containing a plurality of sheets 02. This at least one singulating system 109 that acts from below is therefore preferably configured as singulating and/or capable of singulating a storage pile and in particular an infeed pile from below.

Storage device 134 preferably has at least one front stop 137, which is preferably configured as a front wall 137 and/or preferably serves as a front lay mark 127. Alternatively or additionally, a separate front lay mark 127 is provided. Front stop 137 preferably prevents any unwanted movement of each sheet 02 in the transport direction T before it has become the bottommost sheet 02 in the infeed pile. Front stop 137 preferably prevents any tilting or other collapse of the at least one storage pile, in particular the infeed pile and/or the buffer pile, located in the storage device 134.

Storage device 134 preferably has at least one lateral stop 139, preferably configured as a lateral wall 139. More preferably, lateral stops 139 are arranged on both sides of storage device 134 with respect to the transverse direction A. Alternatively or additionally, at least one separate side lay mark 128 is provided. The at least one lateral stop preferably prevents any unwanted movement of each sheet 02 in and/or opposite the transverse direction A before it becomes the bottommost sheet 02 in the infeed pile. The at least one side stop 139 preferably prevents any tilting or other collapse of the at least one storage pile, in particular the infeed pile and/or the buffer pile, located in the storage device 134. Storage device 134 preferably has at least one rear stop 141, preferably configured as rear wall 141. The at least one rear stop 141 is located upstream of the at least one storage pile with respect to the transport direction T and preferably prevents any unwanted movement of each sheet 02 opposite the transport direction T before it becomes the bottommost sheet 02 in the infeed pile. Rear stop 141 preferably prevents any tilting or other collapse of the at least one storage pile, in particular the infeed pile and/or the buffer pile, located in the storage device 134.

Singulating system 109 preferably has at least one acceleration means, in particular primary acceleration means 136, in particular for accelerating the bottommost sheet 02 in each case of the at least one storage pile or infeed pile, more preferably in the transport direction T. The at least one primary acceleration means 136 is preferably located beneath the at least one storage pile, more preferably beneath the at least one infeed pile and even more preferably also further beneath the at least one buffer pile. The at least one primary acceleration means 136 is configured, for example, as at least one transport roller 136 and/or as at least one conveyor belt 136 and/or as at least one suction transport means 136, in particular suction belt 136 and/or suction box belt 136 and/or roller suction system 136 and/or suction gripper 136 and/or suction roller 136, and/or preferably has at least one conveyor belt 718; 726. The description relating to the suction transport means in the foregoing and in the following preferably applies accordingly. A plurality of primary acceleration means 136 are provided, for example, in particular in the form of a plurality of transport rollers 136 and/or a plurality of conveyor belts 136; 718, 726 and/or a plurality of suction transport means 136. For example, a plurality of primary acceleration means 136 are arranged one behind the other with respect to the transport direction T. Alternatively or additionally, the at least one primary acceleration means 136 has at least two, more preferably at least three, even more preferably at least five, and more preferably still at least seven transport surfaces 718, in particular conveyor belts 718; 726, which are separated from one another with respect to the transverse direction A by gaps. The at least two, preferably at least three, even more preferably at least five, and more preferably still at least seven transport surfaces 718 and/or conveyor belts 718; 726 of the at least one primary acceleration means 136, which are separated from one another with respect to the transverse direction A by gaps, can preferably be driven by means of a common primary drive M101.

At least one spacer 144; 144.1; 144.2 is preferably provided. The at least one spacer 144; 144.1; 144.2 preferably serves to keep the at least one primary acceleration means 136 at a distance from any sheet 02, at least temporarily and/or in a controlled and/or regulated manner. For example, one sheet 02 or multiple sheets 02 or a pile of sheets 02 lie at least intermittently on the at least one spacer 144; 144.1; 144.2. The at least one primary acceleration means 136 and the at least one spacer 144; 144.1; 144.2 are preferably arranged movably relative to one another, at least with respect to the vertical direction V, in particular by vertical mobility of the at least one spacer 144; 144.1; 144.2 and/or by vertical mobility of the at least one primary acceleration means 136. The at least one spacer 144; 144.1; 144.2 is configured, for example, as at least one bearing surface, provided with recesses, for sheets 02, and/or the primary acceleration means 136 protrude at least partially and/or at least intermittently upward through and out of the recesses. The total of the respective bearing surfaces may be smaller than the total surface area of the recesses.

In a holding position, the respective bottommost sheet 02 of the infeed pile rests on the spacer 144; 144.1; 144.2 without touching the primary acceleration means 136. When the at least one spacer 144; 144.1; 144.2 is then lowered and/or the at least one primary acceleration means 136 is raised, the respective bottommost sheet 02 of the infeed pile comes into contact with the corresponding at least one primary acceleration means 136. By the appropriate actuation of the at least one primary acceleration means 136, said sheet 02 is moved forward in the transport direction T. At the moment when the at least one primary acceleration means 136 comes into contact with the bottommost sheet 02 of the infeed pile, said acceleration means is preferably stationary, and is then accelerated, thereby accelerating said sheet 02 at the same time. Preferably, the at least one primary acceleration means 136 is itself accelerated at least temporarily while a respective sheet 02 is being accelerated, in particular from a stationary state to the first speed v1. The at least one primary acceleration means 136 is preferably decelerated and in particular is halted once it has moved out of contact with said sheet 02.

Alternatively, in particular with appropriate actuation of the primary acceleration means 136, the at least one spacer 144; 144.1; 144.2 can be omitted. Preferably, only the at least one primary acceleration means 136 which is in contact with what is currently the bottommost sheet 02 of the infeed pile is actuated. Primary acceleration means 136 that are not in contact with any sheet 02 or are already in contact with the next sheet 02 are then preferably first halted. Primary acceleration means 136 that are already out of contact with what is currently the bottommost sheet 02 of the infeed pile are preferably first halted and/or kept or moved out of contact with the next sheet 02. In the case of a suction transport means 136, for example, sections of a suction device can be switched off selectively.

The at least one primary acceleration means 136, alone or in cooperation with at least one additional, in particular secondary, acceleration means 119, preferably serves to accelerate precisely one sheet 02 at a time that has preferably already been aligned with respect to the transport direction T and/or the transverse direction A. This acceleration is carried out, for example, from a temporary stationary state and/or to a processing speed and/or coating speed and/or printing speed at which at least one sheet 02 is transported, at this and/or at a later time, through at least one additional unit 200; 300; 400; 500; 550; 600; 700; 800; 900; 1000 or module 200; 300; 400; 500; 550; 600; 700; 800; 900; 1000, where it is processed, more particularly is transported through the at least one non-impact coating unit 400; 600; 800, where it is preferably coated. Optionally, this acceleration may be carried out in combination with additional, in particular secondary acceleration means 119. By means of the at least one primary acceleration means 136 and/or the at least one secondary acceleration means 119, a respective sheet 02 can thus be accelerated from a stationary state and/or from a first speed v1 to a second speed v2, while at the same time at least one other sheet 02 is being transported at a processing speed and/or coating speed and/or printing speed through the at least one additional unit 200; 300; 400; 500; 550; 600; 700; 800; 900; 1000 or module 200; 300; 400; 500; 550; 600; 700; 800; 900; 1000, in particular non-impact coating unit 400; 600; 800, and more preferably processed there, in particular coated and/or printed.

The first speed v1 is preferably a different speed from the processing speed and/or coating speed and/or printing speed. The second speed v2 is preferably equal to the processing speed and/or coating speed and/or printing speed. At least one outgoing transport means 119 of the substrate supply system 100 is preferably located downstream of the at least one primary acceleration means 136 with respect to the transport direction T. Said transport means is configured, for example, as at least one transport cylinder 119 or at least one pair of transport cylinders 119 or as at least one suction transport means 119. This at least one outgoing transport means 119 is likewise an acceleration means 119, for example, in particular the at least one secondary acceleration means 119. The at least one secondary acceleration means 119 is preferably configured as a suction transport means 119 and/or the at least one secondary acceleration means 119 preferably has at least one conveyor belt 718; 726. For example, the at least one secondary acceleration means 119 has at least two, more preferably at least three, more preferably at least five, and even more preferably at least seven transport surfaces 718, in particular conveyor belts 718; 726, which are separated from one another with respect to the transverse direction A by gaps. The at least two, preferably at least three, even more preferably at least five, and more preferably still at least seven transport surfaces 718 and/or conveyor belts 718; 726 of the at least one secondary acceleration means 119, which are separated from one another with respect to the transverse direction A by gaps, can preferably be driven by means of a common secondary drive M102.

In an alternative or additional refinement, the processing machine 01 preferably configured as a sheet-fed printing press 01 is preferably characterized in that a respective section of the transport path provided for sheets 02, which section is defined by the at least one secondary acceleration means 119, has a minimum radius of curvature measuring at least 2 meters and/or having a direction that deviates no more than 30° from at least one horizontal direction and/or from the transport direction T over the entire range of the respective primary acceleration means 119.

The at least one front stop 137 and/or the at least one front lay mark 127 preferably serves to align the sheets 02 of the infeed pile. For example, the at least one front stop 137 and/or the at least one front lay mark 127 is at least intermittently arranged such that it acts on at least the second sheet 02 from the bottom of the infeed pile and/or is out of contact with the bottommost sheet 02 of the infeed pile in each case. Alignment occurs, for example, when the sheet 02 lying on top of the bottommost sheet 02 is pressed against the at least one front stop 137 and/or the at least one front lay mark 127 by the transport of the bottommost sheet 02 and is thereby aligned before said top sheet itself comes into contact with the at least one, in particular primary acceleration means 136, which at that time is further preferably stationary. The surface of the at least one front stop 137 that is provided for contact with sheet 02 is preferably oriented opposite the transport direction T. At least one pressing element and/or deflecting element is provided, for example, which causes the sheet 02 to butt up against front stop 137 and/or front lay mark 127 and which is configured, for example, as at least one brush. In this way, the sheets 02 always come into contact with the at least one acceleration means 136 in a defined position and can be further transported via said acceleration means in a precisely known position.

The position of the at least one front stop 137 in terms of the vertical direction V is preferably adjustable. The height of the at least one front stop 137 and/or the at least one front lay mark 127 is preferably adjustable, allowing it to be adapted to different thicknesses of sheets 02. During a processing operation of sheet processing machine 02, a passage gap delimited at least upwardly by the at least one front stop 137 is preferably larger than the thickness of a respective one of the sheets 02 to be processed and smaller than twice the thickness of a respective one of the sheets 02 to be processed. Alternatively or additionally, the at least one front stop 137 and/or the at least one front lay mark 127 is disposed such that it can be moved, for example, in particular pivoted, so as to open up the transport path provided downstream for the bottommost sheet 02 only when said sheet has been aligned by contact with said at least one front stop 137 and/or said at least one front lay mark 127. Preferably, sheet feeder unit 100 has at least one front stop 137 which is arranged along the transport path provided for sheets 02, between the at least one primary acceleration means 136 and the at least one secondary acceleration means 119. If substrate supply system 100 has at least one front lay mark 127 and/or at least one front stop 137, for example, the infeed system 300 is preferably a component of the substrate supply system 100 and more preferably is a component of the singulating system 109.

Adjustment to different widths of sheets 02 to be processed is preferably possible. In this context, the width of a sheet 02 is understood in particular as its dimension in the transverse direction A. The sheet processing machine 01 preferably configured as a sheet-fed printing press 01 is characterized, for example, in that the sheet feeder module 100 has at least one suction transport means 119; 136; 311, in particular for transporting sheets 02 in a transport direction T and/or configured as a suction belt 119; 136; 311, and said at least one suction belt 119; 136; 311 has at least three conveyor belts 119; 136; 718; 726 arranged side by side and spaced from one another in a transverse direction A, and more preferably, at least one displacement means 158; 159 is provided, by means of which at least one of the at least three conveyor belts 119; 136; 718; 726 can be displaced, in particular as a whole and/or linearly and/or without pivoting movement, sideways, in and/or opposite the transverse direction A, which is horizontal and/or orthogonal, in particular, to the transport direction T. Preferably, the at least one primary acceleration means 136 is configured as a suction belt 119; 136; 311 having these characteristics and/or the at least one secondary acceleration means 119 is configured as a suction belt 119; 136; 311 having these characteristics. The at least one lateral stop and/or the at least one side lay mark 128 is preferably provided in that the lateral stops 139, in particular lateral walls 139, are movable with respect to the transverse direction A, and can be arranged adjusted, in particular, to the width of sheets 02. This enables the sheets 02 to slide along side walls 139 during the preferably downward-directed movement of said sheets, induced by the removal of the respectively bottommost sheet 02, and enables said sheets to be moved into and/or held in an aligned position. Regions of acceleration means 119; 136 and/or conveyor belts 119; 136; 718; 726 that lie beyond the width of a sheet 02 currently being processed can be covered by means of at least one protective cover. This at least one protective cover is configured, for example, as at least one telescoping plate. Alternatively, at least one active movement of sheets 02, in particular actuated by a drive, against at least one lateral stop 139 is provided, for example, in the case of a sheet 02 which is substantially stationary and/or is stationary at least with respect to the transport direction T. Lateral alignment is carried out, for example, before and/or during and/or after the acceleration of sheets 02 with respect to the transport direction T. Alternatively or in addition to mechanical front stops 137 and/or side stops 139, appropriate position sensors are provided, which move and/or halt the movement of a respective sheet 02 in the respective direction using a correspondingly precise drive and/or move beneath said sheet during its transport movement for the purpose of aligning said sheet.

In an alternative or additional refinement, the processing machine 01 preferably configured as sheet-fed printing press 01 is preferably configured in that the sheet processing machine 01 comprises at least two units 100; 600 configured as modules 100; 600, and in that further preferably, the at least two modules 100; 600 each have at least one uniquely dedicated drive M100; M101; M102; M103; M600; M601, and in that at least one of the at least two modules 100 is a sheet feeder module 100 configured as a substrate supply system 100, and in that the substrate supply system 100 has at least one primary acceleration means 136 having a primary drive M101; M103 of the substrate supply system 100 and has at least one secondary acceleration means 119 having a secondary drive M102 of the substrate supply system 100, said secondary acceleration means being located downstream of the at least one primary acceleration means 136 in the transport direction T along a transport path provided for the transport of sheets 02, and in that at least one additional drive M200; M300; M400; M500; M550; M600; M700; M800; M900; M1000, which is different from the primary drive M101; M103 of substrate supply system 100 and from the secondary drive M102 of substrate supply system 100, is associated with at least one additional module 200; 300; 400; 500; 550; 600; 700; 800; 900; 1000, for the transport of sheets 02. More preferably, primary drive M101; M103 and secondary drive M102 and the at least one additional drive M200; M300; M400; M500; M550; M600; M700; M800; M900; M1000 are each configured as a position-controlled electric motor M100; M200; M300; M400; M500; M550; M600; M700; M800; M900; M1000. Further preferably, a drive controller of the primary drive M101; M103 is different from a drive controller of secondary drive M102, and a drive controller of the at least one additional drive M600 is different from the drive controller of primary drive M101; M103 and different from the drive controller of secondary drive M102. In an alternative or additional refinement, the processing machine 01 preferably configured as a sheet-fed printing press 01 is preferably characterized in that the drive controller of primary drive M101; M103 and the drive controller of secondary drive M102 are connected by circuitry to a machine controller of sheet processing machine 01, and more preferably in that the drive controller of primary drive M101; M103 and the drive controller of secondary drive M102 and the drive controller of the at least one additional drive M600 are connected by circuitry to the machine controller of sheet processing machine 01.

The at least one additional module 200; 300; 400; 500; 550; 600; 700; 800; 900; 1000 is preferably configured as a coating module 400; 600; 800 and/or printing module 600 and/or as a non-impact coating module 400; 600; 800 and/or non-impact printing module 600, and/or preferably has at least one print head 416; 616; 816 and/or inkjet print head 416; 616; 816.

In an alternative or additional refinement, the processing machine 01 preferably configured as a sheet-fed printing press 01 is preferably characterized in that at least one sheet sensor 164 of substrate supply system 100 is arranged aligned toward the provided transport path for the purpose of detecting a respective leading edge and/or a respective trailing edge of respective sheets 02. In an alternative or additional refinement, the processing machine 01 preferably configured as a sheet-fed printing press 01 is preferably characterized in that the at least one sheet sensor 164 is located downstream of the at least one primary acceleration means 136 and/or downstream of the at least one front stop 137 and/or upstream of the at least one secondary acceleration means 119 with respect to the transport direction T. Alternatively or additionally, the processing machine 01 preferably configured as a sheet-fed printing press 01 is preferably characterized in that the at least one sheet sensor 164 is located in the region of the at least one secondary acceleration means 119 and/or downstream of the at least one secondary acceleration means 119 with respect to the transport direction T.

In an alternative or additional refinement, the processing machine 01 preferably configured as a sheet-fed printing press 01 is preferably characterized in that the at least one secondary acceleration means 119 is configured as a suction transport means 119 and is located exclusively below the transport path provided for sheets 02, and/or in that the at least one primary acceleration means 136 is configured as a suction transport means 136 and is arranged exclusively below the transport path provided for sheets 02, and/or in that the at least one primary acceleration means 136 is located below a storage area 134 provided for storing a pile of sheets 02, and/or in that the at least one primary acceleration means 136 is movable, in particular as a complete unit, with respect to a vertical direction V by means of at least one vertical drive.

Adjustment to different lengths of sheets 02 to be processed is preferably possible. In this context, the length of a sheet 02 is understood, in particular, as its dimension in the transport direction T and/or its horizontal dimension oriented orthogonally to the transverse direction A. Adjustment is preferably accomplished in that the at least one front stop 137 and/or more preferably the at least one rear stop 141 is and/or can be moved with respect to the transport direction T and is and/or can be positioned adjusted in particular to the length of the sheets 02. Changing the position of the rear stop 141 changes the position of the starting edge of storage device 134 with respect to the transport direction T, for example. To compensate for this, in particular, a transport means 111 located upstream of storage device 134 with respect to the transport direction T is preferably configured as variable in terms of its effective length with respect to the transport direction T. For this purpose, said transport means 111 has, for example, a first number of transport elements or conveyor belts, the active area of which is invariable. These are configured as conveyor belts, for example. Said transport means 111 preferably additionally has a second number of transport elements, for example, the active area of which is variable. These are configured, for example, as transport elements and/or conveyor belts that are displaceable as a complete unit, at least with respect to the transport direction T. Appropriate displacement of the displaceable transport elements in and/or opposite the transport direction T results in a modified effective length of the totality of transport elements that are invariable in terms of their active area and transport elements that are variable in terms of their active area.

Alternatively or additionally, substrate supply system 100 is characterized in that the substrate supply system 100 has at least one transport means 119 located downstream of the storage device 134 with respect to the transport direction T, which transport means is configured as variable in terms of its effective length with respect to transport direction T.

The at least one buffer pile serves in particular to ensure a continuous supply of sheets 02. Corrugated cardboard sheets 02, in particular, are relatively thick, i.e. have relatively great dimensions in the vertical direction V. This enables piles 104 of corrugated cardboard sheets 02 to be processed very quickly by singulation. For an uninterrupted supply of sheets 02 to processing machine 01, a buffering of sheets 02, which can be processed at least partially while feeder pile 104 is being replaced or renewed, is therefore advantageous. For this purpose, sheets 02 are preferably conveyed from the feeder pile 104 to the buffer pile at least partially at a greater speed than the speed at which they are conveyed later and/or at a greater speed than the speed at which other sheets 02 are conveyed and/or coated at the same time in processing machine 01 and in particular in the coating unit 400; 600; 800 thereof. During the renewal of feeder pile 104, the buffer pile decreases and is refilled again afterward, while sheets 02 are removed from said buffer pile, in particular from the bottom, and fed to the infeed pile, preferably at a uniform rate, in particular by means of the at least one metering element. The at least one transport means 111 located upstream of the storage device 134 and in particular downstream of feeder pile 104 and/or downstream of a main pile carrier provided for said feeder pile 104 with respect to transport direction T can preferably be operated at a respective time at a speed that is different from, and more preferably is at least intermittently higher than a coating speed or printing speed at which sheets 02 are transported through the at least one coating unit 400; 600; 800 at said time. In substrate supply system 100, a drive M100 associated with said transport means 111 can preferably be operated independently of a drive M400; M600; M800 associated with coating unit 400; 600; 800.

Sheets 02 are preferably fed to storage device 134 from above. More preferably, these sheets 02 are fed to storage device 134 fully singulated or at least partially singulated. Sheets 02 are preferably fed to storage device 134 by first being removed from a feeder pile 104. For this purpose, sheets 02 are fully or partially singulated.

This singulation of sheets before being fed into storage device 134 is carried out as described, for example, from below, in particular by means of a lower transport means 111, on which the sheets 02, in the form of a pile 104 or preferably a partial pile 106, run at least partially up against barrier 112 and are thereby singulated or partially singulated, i.e. shingled, depending upon the setting of the barrier 112. This results in an overlapped shingling, i.e. a shingling in which a subsequent sheet 02 is arranged partially on top of a sheet 02 preceding it. The sheets 02 are then conveyed by means of transport means 111 until they enter storage device 134 at the end of said transport means. This preferably involves the sheets 02 being dropped into a chute of storage device 134. This chute is formed, for example, by the at least one front stop 137 and/or the at least one rear stop 141 and/or the at least one lateral stop. Preferably, at least one pressure cylinder 146 and/or pressure roller 146 is provided, which presses the sheets 02 against the transport means 111 that is immediately upstream of the chute. This enables the sheets 02 to be fed to the chute in a controlled manner. The cross-sectional area of the chute is preferably downwardly decreasing. This enables the sheets 02 to be aligned, in particular with respect to the transport direction T and/or with respect to the transverse direction A, as the sheets 02 are being dropped. Each dropping sheet 02 then becomes the topmost sheet 02 of the subsequent storage pile in sequence, which is preferably the buffer pile.

An alternative at least partial singulation of the sheets 02 of the pile 104 configured, in particular, as feeder pile 104 or of a partial pile 106 from above is preferably carried out in that with each removal of a sheet 02, the main body of pile 104 remains at least substantially unchanged with respect to the transport direction T and is merely raised continuously or gradually where appropriate. In this case, the main body of pile 104 is preferably made up of all the sheets 02 of the pile 104 that have not yet been removed. Substrate supply system 100 preferably has at least one removal system 114 which acts or is capable of acting from above on sheets 02 of pile 104. The at least one removal system 114 is preferably capable of picking up and further transporting the topmost sheet 02 of pile 104 in each case. The at least one removal system 114 has, for example, at least one handling element 116 preferably configured as a lifting element 116 and/or holding element 116, which is preferably configured as at least one lifting sucker 116 and/or at least one separating sucker 116 and/or at least one transporting sucker 116. The at least one lifting element 116 can preferably be moved with at least one component in particular upward in the vertical direction V, and downward opposite the vertical direction V. At least one blower device, not shown, is preferably provided, in particular upstream of removal system 114 with respect to the transport direction T. Said blower device serves, for example, to facilitate the separation of the topmost sheet 02 from the sheet 02 beneath it. Removal system 114 further preferably has at least one upper translational element 117. The at least one upper translational element 117 preferably serves at least to move the sheets 02 in the intended transport direction T, for example up to a further, in particular outgoing, transport means 119 of the substrate supply system 100 or up to a further unit 200; 300; 400; 500; 550; 600; 700; 800; 900; 1000 or up to a transport means 111 that leads to storage device 134. The further transport means 119 of substrate supply system 100 preferably ensures the further transport of sheets 02, in particular in the transport direction T and/or up to an outlet 121 of substrate supply system 100.

The at least one handling element 116, in particular lifting element 116 and/or holding element 116, is located, for example, on the at least one upper translational element 117 and can be moved together with said translational element, in particular in and opposite the vertical direction V and/or in and opposite the transport direction T. In that case, removal system 114 is configured, for example, as a known sheet separator 114. Such a sheet separator 114 picks up the topmost sheet 02, in particular by suction, then preferably raises it at least slightly and moves it at least also in the intended direction of transport T until it enters an area of influence of another system, which continues the transport of said sheet. Such a sheet separator 114 is characterized, for example, in that its upper translational element 117 executes an oscillating movement and/or moves at least and preferably precisely once per sheet 02 in the transport direction T and then reverses and moves at least and preferably precisely once per sheet 02 opposite the transport direction T.

Alternatively, the at least one upper translational element 117 can be operated and/or moved separately from the at least one handling element 116, in particular lifting element 116 and/or holding element 116. The at least one upper translational element 117 is configured, for example, as transport means 117, in particular as suction transport means 117 and preferably as suction belt 117 and/or suction box belt 117 and/or roller suction system 117, the suction inlets 722 or suction openings 724 of which preferably point at least also or only downward and/or the suction effect of which is preferably directed at least also or only upward. In that case, removal system 114 is characterized by the fact that the upper translational element 117 executes a circulating movement. The at least one lifting element 116 can then preferably be moved far enough upward that a sheet 02 held by it comes into contact with the at least one upper translational element 117 or at least enters into the processing region thereof far enough that when the at least one lifting element 116 is subsequently deactivated, the sheet can be held by the at least one upper translational element 117. For example, the at least one lifting element 116 can be moved upward far enough that each region of the at least one lifting element 116 that is intended as a contact region between the at least one lifting element 116 and the sheet 02 is located as high as or higher than each region of the at least one upper translational element 117 that is intended as a contact region between the at least one upper translational element 117 and the sheet 02. This region intended as a contact region is the transport surface 718 or counterpressure surface 718 of the upper translational element 117, for example.

In one embodiment, the at least one lifting element 116 can be moved upward far enough that a sheet 02 being held by said element enters into contact with the at least one upper translational element 117, in particular with the transport surface 718 or counterpressure surface 718 thereof, and can be transported at least in the transport direction T by the at least one upper translational element 117, while the at least one lifting element 116 at least also ensures that the sheet 02 is drawn against the at least one upper transport element 117. In that case, the at least one lifting element 116, at least in its raised position, acts as part of the at least one upper translational element 117, for example, more preferably without itself being movable in the transport direction T. This is preferably the case, in particular, when the at least one upper translational element 117 is configured as a roller suction system 117. Alternatively, however, this is also the case if the at least one upper translational element 117 is configured as a suction belt 117 and/or as a suction box belt 117.

Depending upon the mode of operation, a stream of fully singulated sheets 02 or a stream of shingled sheets 02 overlapping one another can be produced. This is dependent, for example, upon the ratio of the average transport speed of the sheets 02 in the transport direction T to the frequency with which the sheets 02 are removed from the pile 104.

Independently of additional configurations of the at least one substrate supply system 100, said system preferably comprises at least one outgoing transport means 119, which is further preferably configured as suction transport means 119 and/or as at least one transport roller 119 or at least one pair of transport rollers 119 which together form a transport nip, and/or as at least one pair of conveyor belts 119 which together form a transport nip. The outgoing transport means 119 serves, for example, to discharge sheets 02 from the substrate supply system 100, in particular up to an outlet 121 of the substrate supply system 100. At least one pressure cylinder 122 and/or pressure roller 122 that cooperates in particular with the outgoing transport means 119 is provided, for example.

Regardless of whether singulation is carried out from above and/or from below, substrate supply system 100 preferably has, in particular, at least one drive M100 or motor M100, in particular electric motor M100 or position-controlled electric motor M100, dedicated uniquely to it, which is further preferably positioned such that it drives and/or is capable of driving at least one transport means 111; 117; 119 of the substrate supply system 100. In particular if at least one acceleration means 119; 136 is provided, the substrate supply system 100 preferably comprises at least one first, in particular additional drive M101; M103 or motor M101; M103, in particular electric motor M101; M103 or position-controlled electric motor M101; M103, which is further preferably positioned such that it drives and/or is capable of driving at least one acceleration means 119; 136 of the substrate supply system 100. The substrate supply system 100 preferably has at least one primary acceleration drive M101, which further preferably is configured, in particular, as a position-controlled electric motor M101 and/or which is positioned such that it drives and/or is capable of driving at least one first acceleration means 136. The at least one first, in particular additional drive M101; M103 is also referred to as the primary drive M101; M103 or primary acceleration drive M101; M103 of the substrate supply system 100. Substrate supply system 100 preferably has, for example, at least one second additional drive M102 or motor M102, in particular electric motor M102 or position-controlled electric motor M102, dedicated uniquely to it, which is more preferably positioned such that it drives and/or is capable of driving at least one outgoing transport means 119 and/or at least one transport means 119 or secondary acceleration means 119 of substrate supply system 100 that acts and/or is capable of acting on sheets 02 downstream of the at least one, in particular primary acceleration means 136. Preferably, at least the first additional drive M101; M103 and/or at least the second additional drive M102 can be driven independently of other drives M100; M101; M102; M103 of the substrate supply system.

Substrate supply system 100, which is preferably configured as unit 100 and/or as module 100, is preferably additionally or alternatively characterized in that the section of the transport path provided for sheets 02, defined by the substrate supply system 100, ends at an outlet height of the substrate supply system 100. This section of the transport path provided for sheets 02 and preferably the entire transport path provided for sheets 02 preferably begins with the singulation of sheets 02. The outlet height of substrate supply system 100 preferably deviates no more than 5 cm, more preferably no more than 1 cm, and even more preferably no more than 2 mm from the first standard height.

In an alternative or additional refinement, the processing machine 01 preferably configured as a sheet-fed printing press 01 is preferably characterized in that it comprises at least one unit 100; 300, which has at least one suction transport means 119; 136; 311, configured as suction belt 119; 136; 311, for transporting sheets 02 in a transport direction T. Alternatively or additionally, said at least one suction belt 119; 136; 311 has at least three conveyor belts 119; 136; 718; 726 arranged side by side and spaced apart with respect to a transverse direction A, with at least one displacement means 158; 159 being provided, by means of which at least one of the at least three conveyor belts 119; 136; 718; 726 can be displaced sideways in and/or opposite the transverse direction A, in particular can be displaced sideways in an adjustable manner and/or relative to at least one in particular stationary frame 162 of said at least one unit 100; 300. Thus, the at least three conveyor belts 119; 136; 718; 726 arranged side by side are preferably not only arranged offset with respect to the transverse direction A, but, proceeding from a respective one of these at least three conveyor belts 119; 136; 718; 726, at least one other of the at least three conveyor belts 119; 136; 718; 726 is arranged in and/or opposite the transport direction A.

The displaceability of at least one conveyor belt 119; 136; 718; 726 enables an adaptation to the width and/or the position of sheets 02 to be processed. If multiple conveyor belts 119; 136; 718; 726 are arranged side by side, various situations arise depending upon the width of the sheets 02 and the position of the conveyor belts 119; 136; 718; 726. Ideally, the ends of the sheets 02 with respect to the transverse direction A each lie on a conveyor belt 119; 136; 718; 726. However, since gaps and particularly suction inlets 722 are arranged in each case between conveyor belts 119; 136; 718; 726 with respect to transverse direction A, for example, various risks exist. For one, an end of a respective sheet 02 with respect to the transverse direction A may lie over a suction inlet 722, for example, and may then be pulled at least partially into the suction inlet 722 by the negative pressure. This might result in a bending of the respective sheet 02, which can in turn lead to problems and/or inaccuracies in the transport and/or further processing of sheets 02. Furthermore, there is a risk that a sheet 02, the end of which with respect to the transverse direction A rests on a conveyor belt 119; 136; 718; 726 by only a very short distance, for example two millimeters or less, might be pulled by that end into a suction inlet 722, and might thereby come into contact laterally with the conveyor belt 119; 136; 718; 726 and might be displaced with respect to the transverse direction A as a result.

Figure 25A:
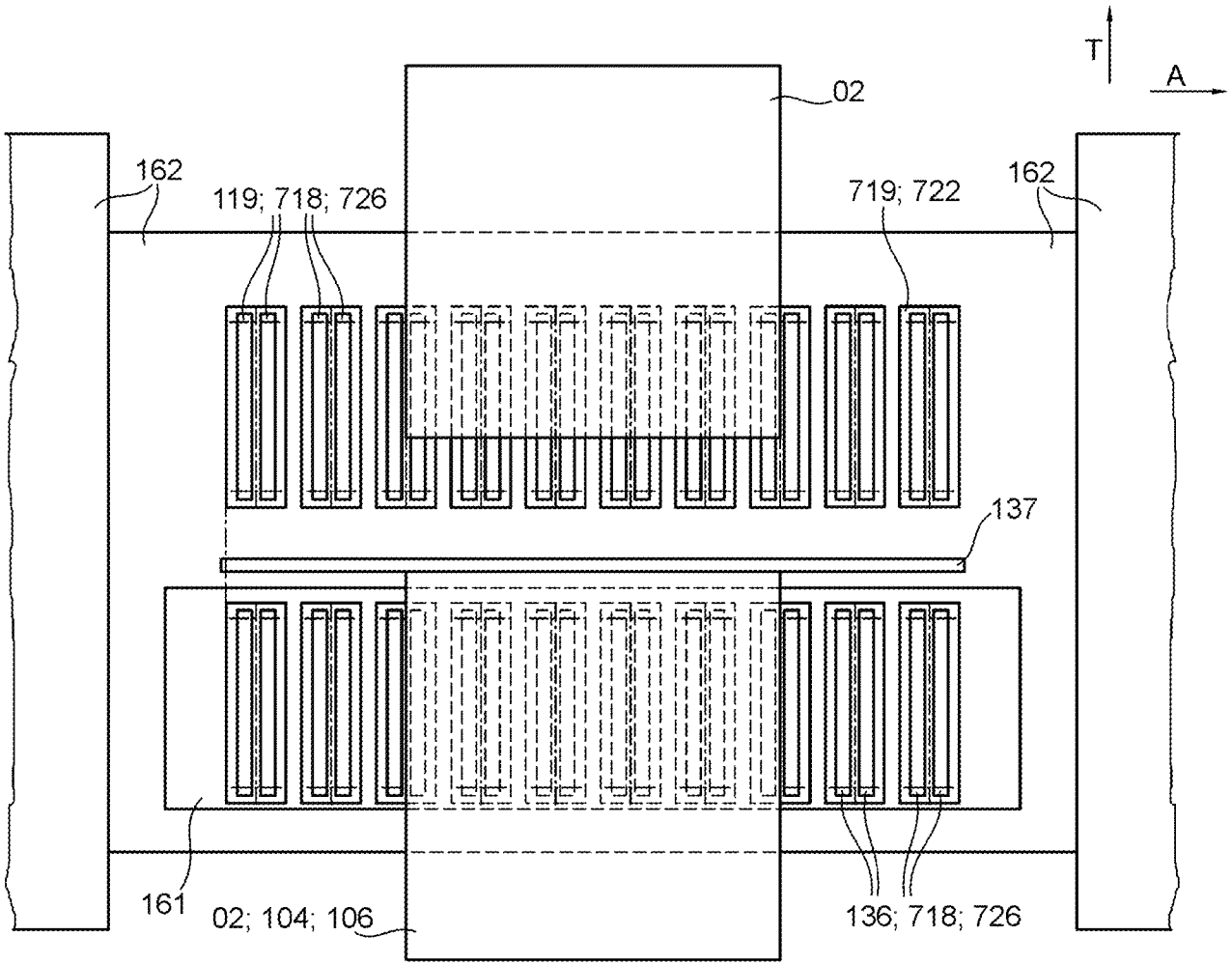
FIG. 25*a* shows a schematic, perspective diagram of a sheet feeder unit according to FIG. 23, as viewed from above.
Figure 25B:
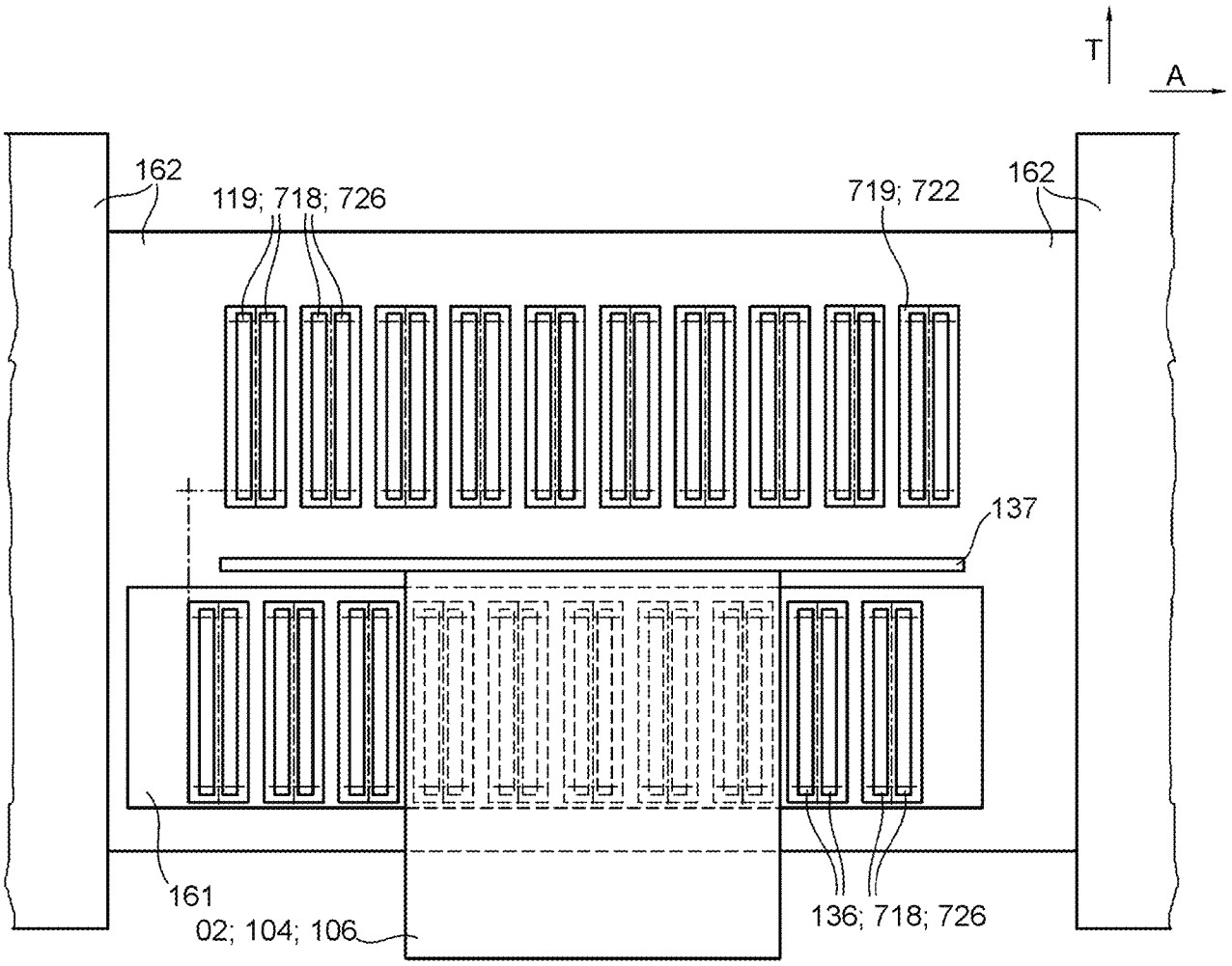
FIG. 25*b* shows a schematic, perspective diagram of a sheet feeder unit, viewed from above according to FIG. 25*a*, with conveyor belts displaced with respect to the transverse direction.

The displaceability of at least one conveyor belt 119; 136; 718; 726 enables such situations to be avoided or at least mitigated, for example by displacing at least one conveyor belt 119; 136; 718; 726 or preferably multiple or more preferably all of the side-by-side conveyor belts 119; 136; 718; 726 with respect to the transverse direction A, thereby creating advantageous conditions in the region of the ends of sheets 02 with respect to the transverse direction A. This enables sheets 02 of different widths to each be handled optimally. In particular, conveyor belts 119; 136; 718; 726 can then be arranged asymmetrically relative to the center of the respective unit 100; 300, at least temporarily, allowing sheets 02 to be transported in a centered position regardless of their width. The position of the at least one conveyor belt 119; 136; 718; 726 is preferably adjusted before the start of a processing operation and, for example, once per processing order, or only when processing sheets 02 whose width differs from the width of sheets 02 processed previously. (In FIGS. 25*a* and 25*b*, a set of conveyor belts 119; 136; 718; 726 in various positions is shown by way of example.)

In an alternative or additional refinement, the sheet processing machine 01 preferably configured as a sheet-fed printing press 01 is preferably characterized in that the at least one unit 100; 300 has at least one lateral stop 139, which in particular is stationary during operation of the sheet processing machine 01, and/or has at least one side lay mark 128, which in particular is stationary during operation of the sheet processing machine 01, for the alignment of sheets 02 with respect to the transverse direction A. Said at least one lateral stop 139 and/or said at least one side lay mark 128 is preferably adjustable in terms of its position with respect to the transverse direction A and/or is preferably used for the alignment of sheets 02 with respect to the transverse direction A. Said lateral stop or said side lay mark is therefore preferably stationary, in particular during operation of sheet processing machine 01. Preferably, the at least one lateral stop 139, which is arranged fixed in position in particular during operation of sheet processing machine 01 and is used for the alignment of sheets 02 with respect to the transverse direction A, is adjustable in terms of its position with respect to the transverse direction A, independently of the position of the at least three conveyor belts 119; 136; 718; 726 with respect to the transverse direction A, and/or the at least one side lay mark 128, which is arranged fixed in position in particular during operation of sheet processing machine 01 and is used for the alignment of sheets 02 with respect to the transverse direction A, is adjustable in terms of its position with respect to the transverse direction A, independently of the position of the at least three conveyor belts 119; 136; 718; 726 with respect to the transverse direction A. The at least one unit 100; 300 has, for example, at least two lateral stops 139 embodied as described and/or at least two side lay marks 128 embodied as described for the alignment of sheets 02 with respect to the transverse direction A. In particular, the at least one lateral stop 139 and/or the at least one side lay mark 128 are preferably arranged such that they are movable and/or adjustable relative to a frame 162 of the at least one unit 100; 300, which is further preferably arranged fixed in place. The at least three side-by-side conveyor belts 119; 136; 718; 726 are preferably arranged at least partially alongside the at least one lateral stop 139 and/or the at least one side lay mark 128 in the transverse direction A. The at least one unit 100; 300 is preferably configured as at least one sheet feeder unit 100 and/or as at least one infeed unit 300. Alternatively, the at least one unit 100; 300 is configured as a conditioning unit 200; 550 and/or as a coating unit 400; 600; 800 and/or as a transport unit 700 and/or as a shaping system 900 and/or as a substrate delivery system 1000.

In an alternative or additional refinement, the sheet processing machine 01 preferably configured as a sheet-fed printing press 01 is preferably characterized in that the at least one unit 100; 300 has at least one front stop 137 for sheets 02, which is preferably arranged spaced from the at least three conveyor belts 119; 136; 718; 726 by a distance measuring less than a maximum length of sheets 02 to be processed. Further preferably, the at least one front stop is at least one front stop 137 for sheets 02 that is arranged fixed in place and/or is height-adjustable during operation of sheet processing machine 01. The at least three conveyor belts 119; 136; 718; 726 are preferably arranged at least partially upstream of the at least one front stop 137 with respect to the transport direction T.

In an alternative or additional refinement, the sheet processing machine 01 preferably configured as a sheet-fed printing press 01 is preferably characterized in that the at least one unit 100; 300 has at least one transport assembly 136; 161; 163; 718; 726, which is movable with respect to the transverse direction A, and in that said at least one transport assembly 136; 161; 163; 718; 726 comprises at least one of the at least three conveyor belts 119; 136; 718; 726 and at least two deflection means 163, associated with said at least one of the at least three conveyor belts 119; 136; 718; 726, and at least one support frame 161, which are preferably arranged such that they are movable jointly with respect to the transverse direction A, and in that said at least one transport assembly 136; 161; 163; 718; 726 is arranged such that it is displaceable by means of the at least one displacement means 158; 159, in and/or opposite the transverse direction A. More preferably, said transport assembly 136; 161; 163; 718; 726 comprises multiple and even more preferably all of the conveyor belts 119; 136; 718; 726 of the at least one suction belt 119; 136; 311 of said unit 100; 300. The at least one displacement means 158 preferably has at least one manual drive 159 and/or at least one electric drive 159 and/or at least one pneumatic drive 159 and/or at least one hydraulic drive 159. As a manual drive 159, at least one handwheel is provided, for example.

In an alternative or additional refinement, the sheet processing machine 01 preferably configured as a sheet-fed printing press 01 is preferably characterized in that the at least three conveyor belts 119; 136; 718; 726 are arranged in an invariable position relative to one another with respect to the transverse direction A and/or are spaced at a constant distance from one another. In an alternative or additional refinement, the sheet processing machine 01 preferably configured as a sheet-fed printing press 01 is preferably characterized in that the transport assembly 136; 161; 163; 718; 726, which is movable with respect to the transverse direction A, has at least one motor M101; M102 for driving the at least three conveyor belts 119; 136; 718; 726 with respect to the transport direction T, and/or in that the transport assembly 136; 161; 163; 718; 726, which is movable with respect to the transverse direction A, has at least one motor M101; M102 for driving the at least three conveyor belts 119; 136; 718; 726 of the at least one first suction belt 119; 136; 311 with respect to the transport direction T and at least one additional motor M101; M102 for driving the at least three conveyor belts 119; 136; 718; 726 of the at least one additional suction belt 119; 136; 311, which are arranged downstream of the first suction belt 119; 136; 311 with respect to the transport direction T, with respect to the transport direction T, and/or in that the transport assembly 136; 161; 163; 718; 726, which is movable with respect to the transverse direction A, has at least one vacuum pressure chamber 719 of at least one conveyor belt 119; 136; 718; 726. Particularly preferably, all of the components of the respective at least one suction belt 119; 136; 311 of said unit 100; 300 are components of the transport assembly 136; 161; 163; 718; 726 and/or are displaceable jointly with respect to the transverse direction A. As described, transverse direction A is a direction A that extends horizontally and/or is oriented orthogonally to the intended transport direction T of sheets 02 through the at least one unit 100; 300 and preferably through the at least one coating unit 400; 600; 800.

In an alternative or additional refinement, the sheet processing machine 01 preferably configured as a sheet-fed printing press 01 is preferably characterized in that the at least one unit 100; 300 has at least two suction transport means 119; 136; 311 configured as suction belts 119; 136; 311 for transporting sheets 02 in a transport direction T, which are arranged one behind the other with respect to the transport direction T and which are designated as the first suction belt 119; 136; 311 and as the additional suction belt 119; 136; 311, for example. In an alternative or additional refinement, the sheet processing machine 01 preferably configured as a sheet-fed printing press 01 is preferably characterized in that each of said at least two suction belts 119; 136; 311 has at least three conveyor belts 119; 136; 718; 726 arranged side by side and spaced from one another with respect to the transverse direction A. Thus, the respective at least three conveyor belts 119; 136; 718; 726 arranged side by side are preferably not only arranged offset with respect to the transverse direction A, but, proceeding from a respective one of these at least three conveyor belts 119; 136; 718; 726, at least one other of the at least three conveyor belts 119; 136; 718; 726 is arranged in and/or opposite the transport direction A. This enables a multi-stage acceleration of sheets 02 on particularly secure suction belts 119; 136; 311, each having multiple adjustable conveyor belts 119; 136; 718; 726. In an alternative or additional refinement, the sheet processing machine 01 preferably configured as a sheet-fed printing press 01 is preferably characterized in that at least one, in particular respective displacement means 158; 159 is provided, by means of which at least one of the at least three conveyor belts 119; 136; 718; 726 associated with at least one of these suction belts 119; 136; 311 is displaceable sideways, in particular is displaceable sideways in an adjustable manner, in and/or opposite the transverse direction A. In an alternative or additional refinement of the sheet processing machine 01 preferably configured as a sheet-fed printing press 01, said at least two suction belts 119; 136; 311 can preferably be operated and/or accelerated independently of one another with respect to transporting movements in the transport direction T.

In an alternative or additional refinement, the sheet processing machine 01 preferably configured as a sheet-fed printing press 01 is preferably characterized in that from the set of the at least one suction belt 119; 136; 311, at least one, for example the at least one first suction belt 119; 136; 311 is configured as a primary acceleration means 136 of the singulating system 109 of the at least one unit 100; 300, and/or in that at least one, more preferably at least one other or one additional suction belt 119; 136; 311 from the set of the at least one suction belt 119; 136; 311 is configured as a secondary acceleration means 119 of a singulating system 109 of the at least one unit 100; 300.

The sheets 02 are fed by the substrate supply system 100 directly to an infeed system 300, for example, which may also be part of the substrate supply system 100, for example. Alternatively, the sheets 02 are first supplied to at least one preprocessing system 200.

Preferably, at least one preprocessing system 200 is located downstream of a substrate supply system 100 and/or upstream of at least one coating unit 400; 600; 800 with respect to the intended transport path. The at least one preprocessing system 200 preferably comprises at least one processing means 201. The at least one processing means 201 is configured, for example, as a calender 201 and/or as a wetting system 201 and/or as a discharge system 201 and/or as an inerting system 201 and/or as a cleaning system 201 and/or as a deburring system 201 and/or as an inspection system 201. A cleaning system 201 is configured, for example, as a vacuum system 201 and/or as a blower system 201 and/or as a stripping system 201 and/or preferably serves to remove bits of paper and/or dust. An inspection system 201 comprises, for example, at least one and preferably multiple, in particular at least two, sensors, in particular optical sensors, which are embodied, for example, as cameras and/or are preferably arranged such that they are mechanically movable, in particular in the transverse direction A. Such sensors may be used, for example, to detect the alignment of incoming sheets 02, in particular for further processing. Alternatively or additionally, these sensors serve to detect and/or verify the dimensions of the sheets 02, for example for comparison with order data. Processing means 201 is located, for example, within another unit 100; 300; 400; 500; 550; 600; 700; 800; 900; 1000 or module 100; 300; 400; 500; 550; 600; 700; 800; 900; 1000, in particular aligned toward and/or acting and/or capable of acting on the provided transport path. Preferably, however, preprocessing system 200 is configured as an autonomous unit 200 and more preferably as a module 200.

Preprocessing system 200 preferably has at least one transport means 211, further preferably configured as suction transport means 211. The description relating to suction transport means in the foregoing and in the following preferably applies accordingly. Preprocessing system 200 preferably has at least one drive M200 or motor M200, in particular electric motor M200 or position-controlled electric motor M200, dedicated uniquely to it, which is further preferably positioned such that it drives and/or is capable of driving the at least one transport means 211. Preprocessing system 200 comprises at least one pressure roller 202 or pressure cylinder 202, for example, by means of which a force can be exerted on sheets 02, pressing them against the at least one transport means 211. Preprocessing system 200 preferably comprises at least one transfer means 03 for sheets 02. The section of the transport path provided for sheets 02 that is defined by preprocessing system 200 is preferably substantially flat and more preferably completely flat and is preferably configured extending substantially horizontally and more preferably exclusively horizontally.

Preferably, the preprocessing system 200 preferably configured as unit 200 and/or as module 200 is alternatively or additionally characterized in that the section of the transport path provided for sheets 02 that is defined by the preprocessing system 200 begins at an intake height of preprocessing system 200 and/or ends at an outlet height of preprocessing system 200. Preferably, preprocessing system 200 is characterized in that this intake height of preprocessing system 200 deviates no more than 5 cm, more preferably no more than 1 cm, and even more preferably no more than 2 mm from the first standard height, and/or in that the outlet height of preprocessing system 200 deviates no more than 5 cm, more preferably no more than 1 cm, and even more preferably no more than 2 mm from the first standard height, and/or in that the respective intake height of preprocessing system 200 deviates no more than 5 cm, more preferably no more than 1 cm, and even more preferably no more than 2 mm from the outlet height of preprocessing system 200.

Sheets 02 are accelerated gradually by means of substrate supply system 100 and/or by means of at least one infeed system 300, for example. At least one primary acceleration means 136 and at least one secondary acceleration means 119 are provided for this purpose, for example. The primary acceleration means 136 preferably accelerates each of the sheets 02 to a first speed v1 and the secondary acceleration means 119 preferably accelerates each of the sheets 02 later to a second speed v2, for example the processing speed or printing speed, and optionally intermediately to an even higher third speed v3. As a result of this, no acceleration means 119; 136 has to be accelerated and decelerated between an idle state and the second speed v2 or even the third speed v3. Undesirably high accelerations are eliminated. Instead, it is sufficient for the primary acceleration means 136 to be accelerated and decelerated between an idle state and the first speed v1, for example. In one embodiment, the second acceleration means 119 is accelerated to the second speed v2 or even to the third speed v3, and is then decelerated again to a minimum speed. This minimum speed is preferably equal to the first speed v1. Alternatively, this minimum speed may be greater than the first speed v1. In that case, sheets 02 are accelerated during a transfer between primary acceleration means 136 and secondary acceleration means 119 by a relative speed between secondary acceleration means 119 and sheet 02 and by the corresponding friction, at least until they are moving at the second speed v2. The sheets 02 are thus carried along and thereby accelerated. In an alternative embodiment, secondary acceleration means 119 is operated constantly at the second speed v2 and the acceleration of sheets 02 to the second speed v2 is carried out entirely as described via the relative speed and corresponding friction. Optionally, additional acceleration means may be provided.

Preferably, a processing machine 01 configured, in particular, as a sheet-fed printing press 01 is characterized in that the sheet-fed printing press 01 comprises at least two units 100; 600 configured as modules 100; 600 and in that more preferably, each of the at least two modules 100; 600 has at least one drive M100; M101; M102; M103; M600; M601 dedicated uniquely to it. Alternatively or additionally, sheet-fed printing press 01 is preferably characterized in that at least one of the at least two modules 600 is configured as a non-impact coating module 400; 600; 800. Alternatively or additionally, sheet-fed printing press 01 is preferably characterized in that at least one of the at least two modules 500 is configured as a drying module 500.

Alternatively or additionally, the processing machine 01 configured in particular as a sheet-fed printing press 01 is preferably characterized in that at least one and in particular at least one additional of the at least two modules 100; 200; 300; 400; 500; 550; 600; 700; 800; 900; 1000 has at least one drying system 500 or drying device 506. This drying system 500 or drying device 506 preferably has at least one energy output device 501; 502; 503 configured as a hot air source 502. Preferably, the processing machine 01 configured in particular as a sheet-fed printing press 01 is alternatively or additionally characterized in that as at least one additional of the at least two modules 400; 600; 800, at least one coating module 400; 800 is provided, which is configured as a priming module 400 and/or as a finish coating module 800 and which has a drying system 500 or drying device 506 dedicated uniquely to it. For example, the processing machine 01 configured in particular as sheet-fed printing press 01 is alternatively or additionally characterized in that as the at least one additional module 400, at least one coating module 400 configured as priming module 400 is provided, which is equipped with its own drying system 500 or drying device 506, said drying system 500 or drying device 506 having at least one energy output device 501; 502; 503 configured as a hot air source 502, and/or in that as the at least one additional module 800, at least one coating module 800 configured as a finish coating module 800 is provided, which is equipped with its own drying system 500 or drying device 506, said drying system 500 or drying device 506 having at least one energy output device 501; 502; 503 configured as a hot air source 502.

The at least one additional of the at least two modules 100; 200; 300; 400; 500; 550; 600; 700; 800; 900; 1000, for example priming module 400, preferably has a frame 427; 627; 827. The drying system 500 or drying device 506 of said module is preferably rigidly connected directly or indirectly to said frame 427; 627; 827. For example, at least one counterpressure means 408; 608; 808 of the at least one additional of the at least two modules 100; 200; 300; 400; 500; 550; 600; 700; 800; 900; 1000, for example the priming module 400, is arranged directly or indirectly connected to said frame 427; 627; 827. Preferably, drying system 500 or drying device 506 of the at least one additional of the at least two modules 100; 200; 300; 400; 500; 550; 600; 700; 800; 900; 1000, for example the priming module 400, is connected to a base or an installation surface beneath the sheet-fed printing press 01 solely via the frame 427; 627; 827 of the at least one additional of the at least two modules 100; 200; 300; 400; 500; 550; 600; 700; 800; 900; 1000, for example the priming module 400, and/or via mechanically flexible connections. An exposure zone of the drying system 500 or drying device 506 of the at least one additional of the at least two modules 100; 200; 300; 400; 500; 550; 600; 700; 800; 900; 1000, for example the priming module 400, is preferably disposed downstream, with respect to the transport path provided for sheets 02, of an application position 418 of the at least one additional of the at least two modules 100; 200; 300; 400; 500; 550; 600; 700; 800; 900; 1000, for example, the priming module 400. A transport means 417, in particular suction transport means 417, provided for the transport of sheets 02 through an exposure zone of the drying system 500 or drying device 506 of the at least one additional of the at least two modules 100; 200; 300; 400; 500; 550; 600; 700; 800; 900; 1000, for example, the priming module 400, is preferably located downstream of a counterpressure means 408 of said at least one additional of the at least two modules 100; 200; 300; 400; 500; 550; 600; 700; 800; 900; 1000, for example, said priming module 400, with respect to the transport path provided for sheets 02. A transport means 417, in particular suction transport means 417, provided for the transport of sheets 02 through an exposure zone of drying system 500 or drying device 506 of the at least one additional of the at least two modules 100; 200; 300; 400; 500; 550; 600; 700; 800; 900; 1000, for example, the priming module 400, can preferably be driven by means of a drive M400; M401; M600; M601; M800; M801 of the at least one additional of the at least two modules 100; 200; 300; 400; 500; 550; 600; 700; 800; 900; 1000, for example, the priming module 400.

In reference generally to a coating module 400; 600; 800 configured as a priming module 400 and/or as a printing module 600 and/or as a finish coating module 800, this preferably means that the coating module 400; 600; 800 configured as a priming module 400 and/or as a printing module 600 and/or as a finish coating module 800 preferably has a frame 427; 627; 827, to which the drying system 500 or drying device 506 of said module is directly or indirectly rigidly connected, and to which, further preferably, at least one counterpressure means 408; 608; 808 of the coating module 400; 600; 800 configured as a priming module 400 and/or as a printing module 600 and/or as a finish coating module 800 is directly or indirectly connected. Preferably, drying system 500 or drying device 506 of the coating module 400; 600; 800 configured as priming module 400 and/or as printing module 600 and/or as finish coating module 800 is connected to a base or to an installation surface beneath the sheet-fed printing press 01 solely via the frame 427 of said coating module 400; 600; 800, which is configured as priming module 400 and/or as printing module 600 and/or as finish coating module 800, and/or via mechanically flexible connections. An exposure zone of drying system 500 or drying device 506 of the coating module 400; 600; 800 configured as a priming module 400 and/or as a printing module 600 and/or as a finish coating module 800 is preferably located downstream of an application position 418; 618; 818 of the coating module 400; 600; 800 configured as a priming module 400 and/or as a printing module 600 and/or as a finish coating module 800, with respect to the transport path provided for sheets 02. A transport means 417; 617; 817, in particular suction transport means 417; 617; 817, provided for the transport of sheets 02 through an exposure zone of the drying system 500 or drying device 506 of the coating module 400; 600; 800 configured as a priming module 400 and/or as a printing module 600 and/or as a finish coating module 800 is preferably located downstream of a counterpressure means 408; 608; 808 of said coating module 400; 600; 800 embodied as a priming module 400 and/or as a printing module 600 and/or as a finish coating module 800, with respect to the transport path provided for sheets 02. A transport means 417; 617; 817, in particular suction transport means 417; 617; 817, provided for the transport of sheets 02 through an exposure zone of the drying system 500 or drying device 506 of the coating module 400; 600; 800 embodied as a priming module 400 and/or as a printing module 600 and/or as a finish coating module 800, can preferably be driven by means of a drive M400; M401; M600; M601; M800; M801 of the coating module 400; 600; 800 embodied as a priming module 400 and/or as a printing module 600 and/or as a finish coating module 800.

A rigid connection in this context is understood as a connection that prevents any uncontrolled relative movements. It is nevertheless provided, for example, that by means of at least one mechanism and/or at least one drive, a relative movement that can be selectively initiated is possible, for example for moving the drying system 500 or drying device 506 away from the transport path provided for sheets 02.

Preferably, the sheet-fed printing press 01 is alternatively or additionally characterized in that at least one of the at least two modules 100 is configured as a substrate supply system 100 and/or in that at least one of the at least two modules 600 is configured as a printing module 600. Preferably, the sheet-fed printing press 01 is alternatively or additionally characterized in that the substrate supply system 100 comprises at least one primary acceleration means 136 having a primary drive M101; M103 or primary acceleration drive M101; M103 of the substrate supply system 100 and at least one secondary acceleration means 119 having a secondary drive M102 or secondary acceleration drive M102 of the substrate supply system 100, located downstream of the at least one primary acceleration means 136 along a transport path provided for sheets 02, and in that the at least one primary acceleration means 136 is located beneath a storage area 134 provided for storage of a pile of sheets 02. Such a pile comprises more than one sheet 02. The primary drive M101; M103 of the at least one primary acceleration means 134 of the substrate supply system 100 is also called the primary acceleration drive M101; M103 of the substrate supply system 100. The secondary drive M102 of the at least one secondary acceleration means 119 of the substrate supply system 100 is also called the secondary acceleration drive M102 of the substrate supply system 100.

Preferably, the sheet-fed printing press 01 is alternatively or additionally characterized in that a drive M600 for the transport of sheets 02 that is different from the primary drive M101; M103 of the substrate supply system 100 and the secondary drive M102 of the substrate supply system 100 is associated with the at least one printing module 600. The positioning of primary drive M101; M103 and secondary drive M102 enables the independent movement of acceleration means 119; 136 and thus a staged acceleration as described above.

Preferably, the sheet-fed printing press 01 is alternatively or additionally characterized in that the sheet-fed printing press 01 comprises at least three units 100; 200; 300; 400; 500; 550; 600; 700; 800; 900; 1000 configured as modules 100; 200; 300; 400; 500; 550; 600; 700; 800; 900; 1000 and in that each of the at least three modules 100; 200; 300; 400; 500; 550; 600; 700; 800; 900; 1000 has at least one drive M100; M101; M102; M103; M200; M300; M400; M401; M500; M550; M600; M601; M700; M800; M801; M900; M1000 dedicated uniquely to it.

Preferably, the sheet-fed printing press 01 is alternatively or additionally characterized in that the sheet-fed printing press 01 comprises a plurality of units 600 configured as printing modules 600, each of which has a drive M600 dedicated uniquely to it. Preferably, the sheet-fed printing press 01 is alternatively or additionally characterized in that the at least one printing module 600 is configured as a printing module 600 that applies coating medium from above. Preferably, the sheet-fed printing press 01 is alternatively or additionally characterized in that the at least one printing module 600 is configured as a non-impact coating unit 600 and/or as an inkjet printing unit 600. Preferably, the sheet-fed printing press 01 is alternatively or additionally characterized in that, by means of the at least one primary acceleration means 136, sheets 02 are and/or can be accelerated to a first speed v1, and in that, by means of the at least one secondary acceleration means 119, sheets 02 are and/or can be accelerated in particular from the first speed v1 to a second speed v2, which is higher than the first speed v1, or even to a third speed v3, which is even higher than the second speed v2, after which said sheets are decelerated to the second speed v2.

Preferably, the sheet-fed printing press 01 is alternatively or additionally characterized in that a drive controller of the primary drive M101; M103 is different from a drive controller of the secondary drive M102 and in that the drive controller of the drive M600 of the printing module 600 is different from the drive controller of the primary drive M101; M103 and different from the drive controller of the secondary drive M102. Preferably, the sheet-fed printing press 01 is alternatively or additionally characterized in that the second speed v2 is a printing speed for the transport of sheets 02 through the at least one printing unit 600. Preferably, the sheet-fed printing press 01 is alternatively or additionally characterized in that a drive controller of the primary drive M101; M103 and a drive controller of the secondary drive M102, which is different from that of the primary drive, and a drive controller of the drive M600 of the printing module 600, which is different from that of the secondary drive, are connected by circuitry to a machine controller of the sheet-fed printing press 01. Preferably, the sheet-fed printing press 01 is alternatively or additionally characterized in that the at least one primary acceleration means 136 is configured as at least one acceleration means 136 that acts in each case on the bottommost sheet 02 of a pile.

Figure 14A:
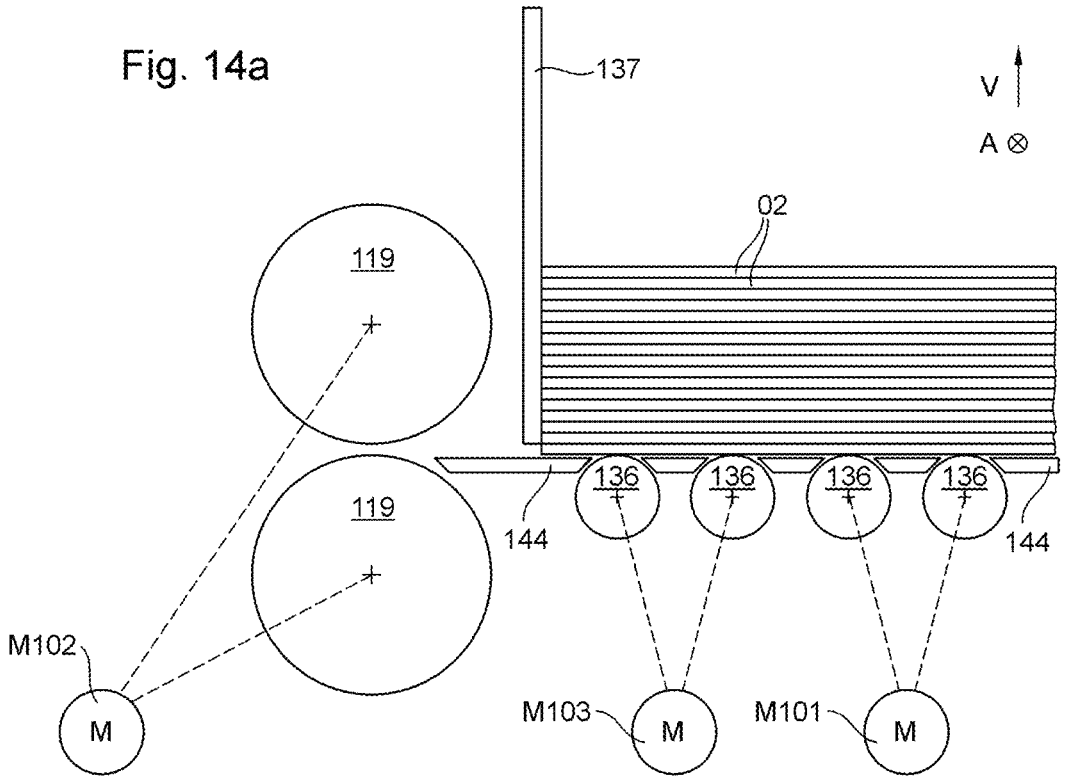
FIG. 14*a* shows a schematic diagram of primary and secondary acceleration means, in which a plurality of primary drives are provided.
Figure 16A:
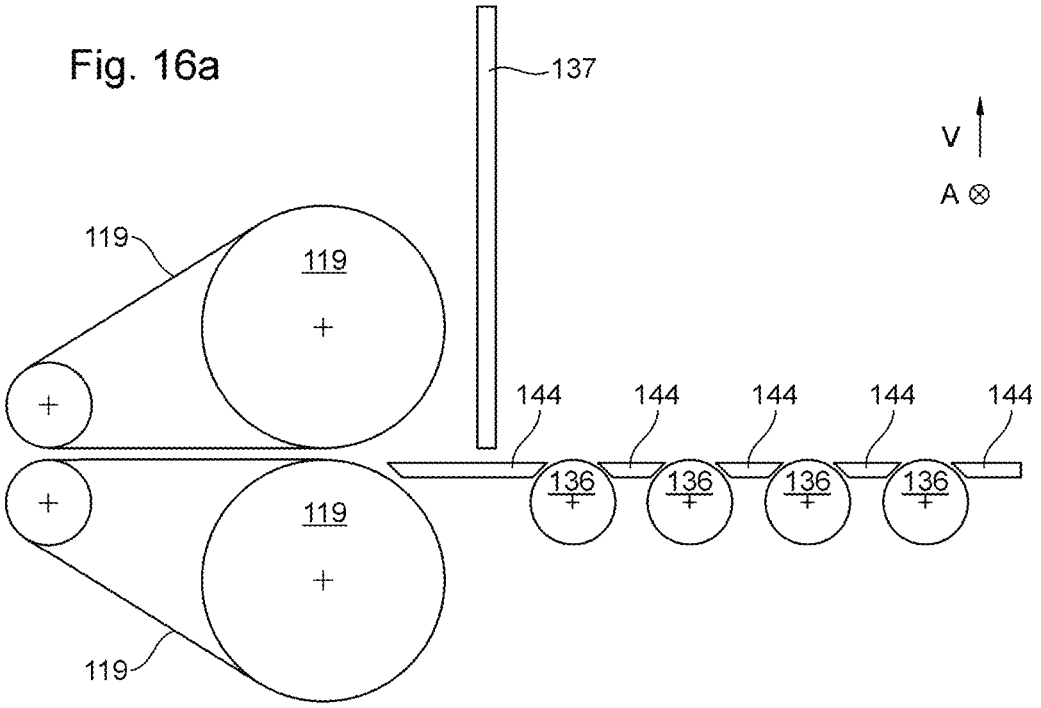
FIG. 16*a* shows a schematic diagram of primary and secondary acceleration means, in which a pair of conveyor belts that together form a transport nip is provided as the secondary acceleration means.
Figure 16B:
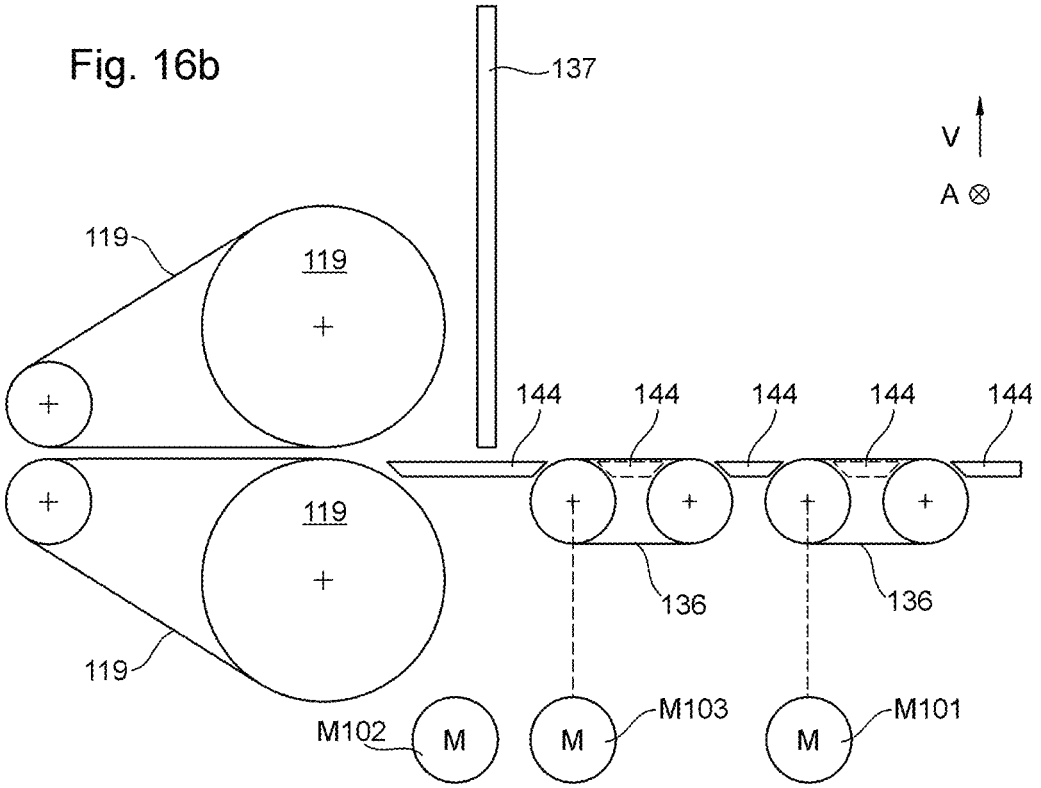
FIG. 16*b* shows a schematic diagram of primary and secondary acceleration means, in which at least one conveyor belt and/or at least one conveying means configured as a suction belt is provided as primary acceleration means.
Figure 16C:
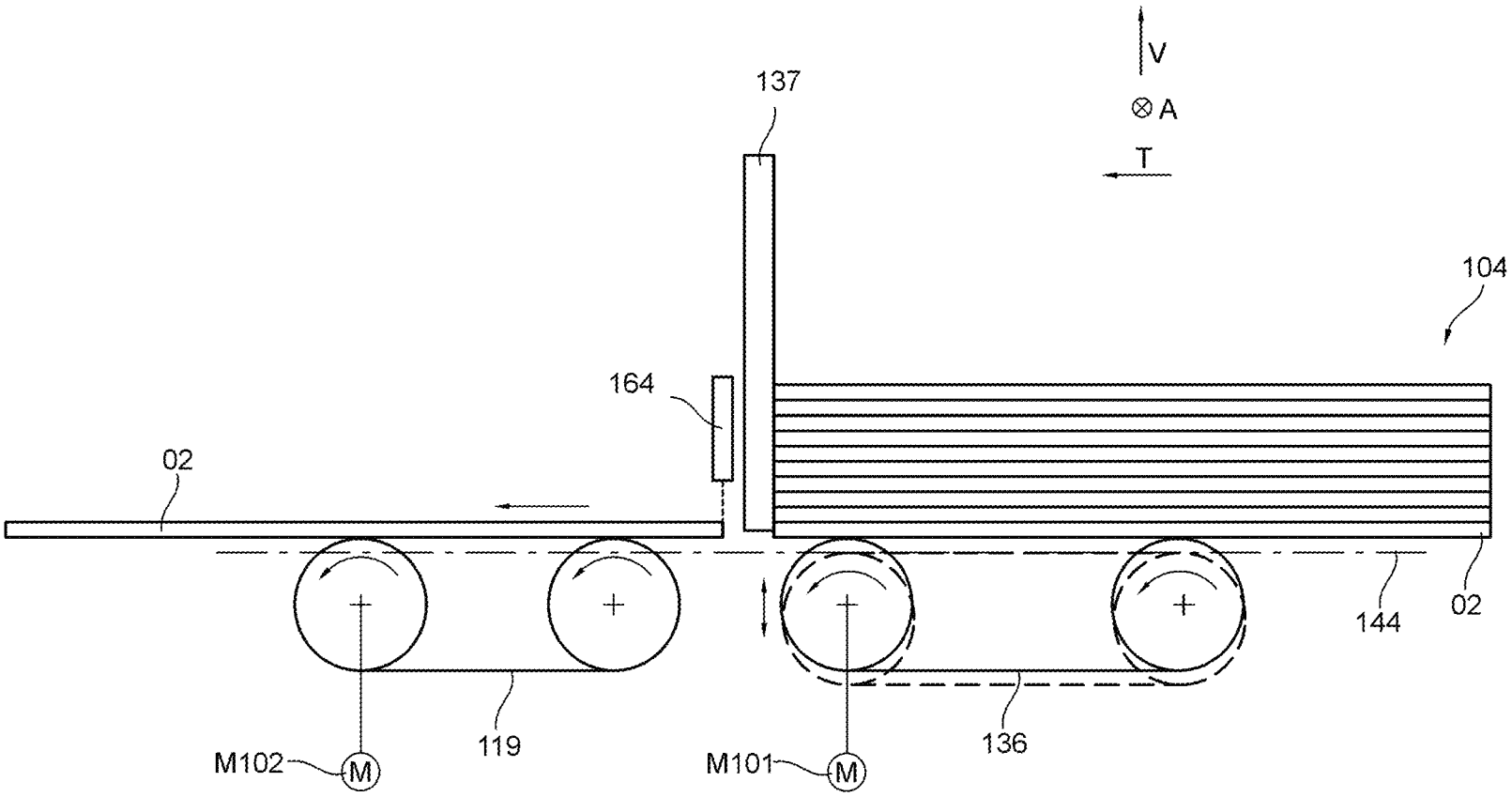
FIG. 16*c* shows a schematic diagram of primary and secondary acceleration means, each of which is configured as at least one conveyor belt and/or at least one conveying means configured as a suction belt.
Figure 17A:
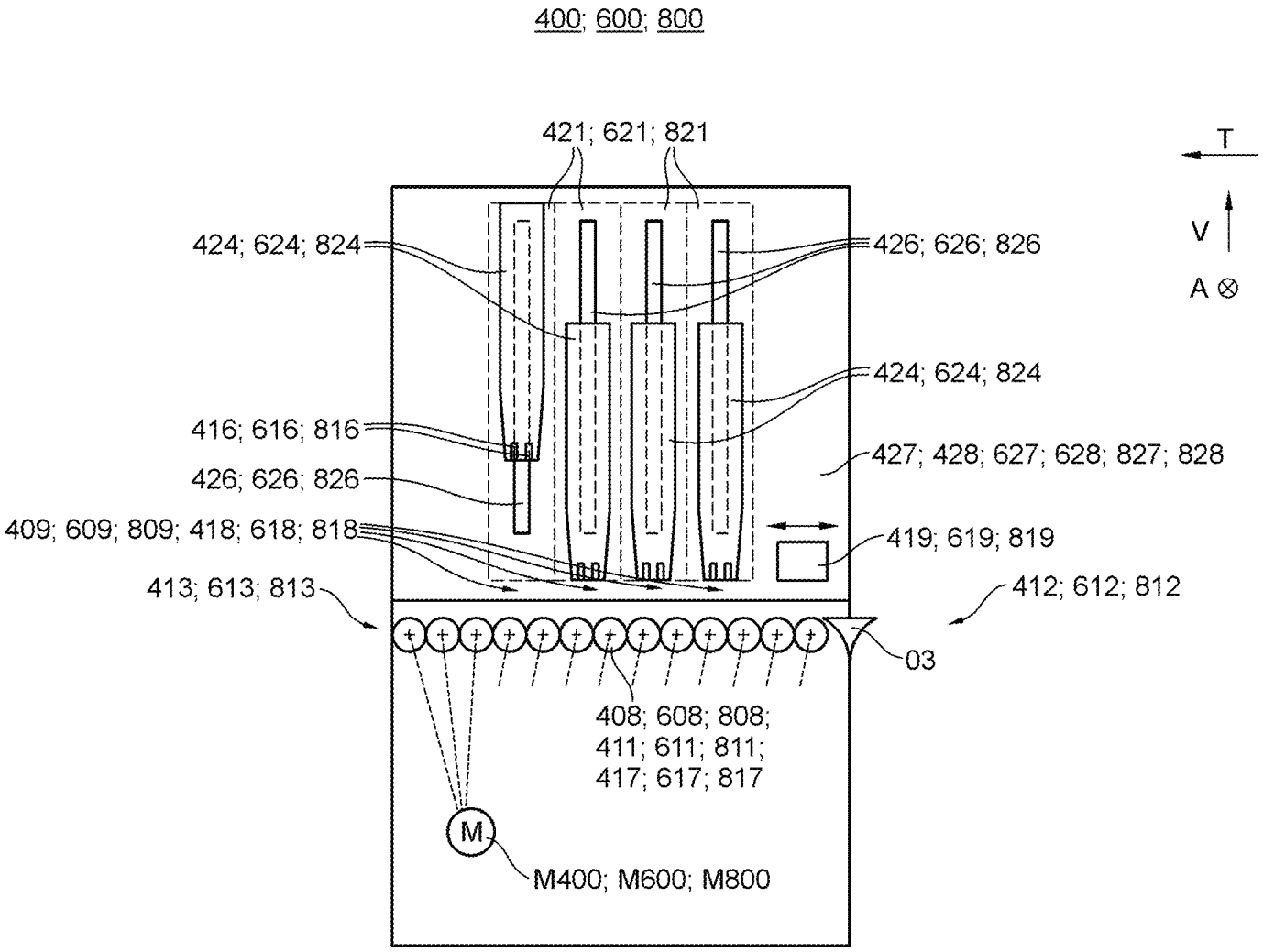
FIG. 17*a* shows a schematic diagram of a non-impact coating unit configured as a module, having four receiving units occupied by print head assemblies.
Figure 17B:
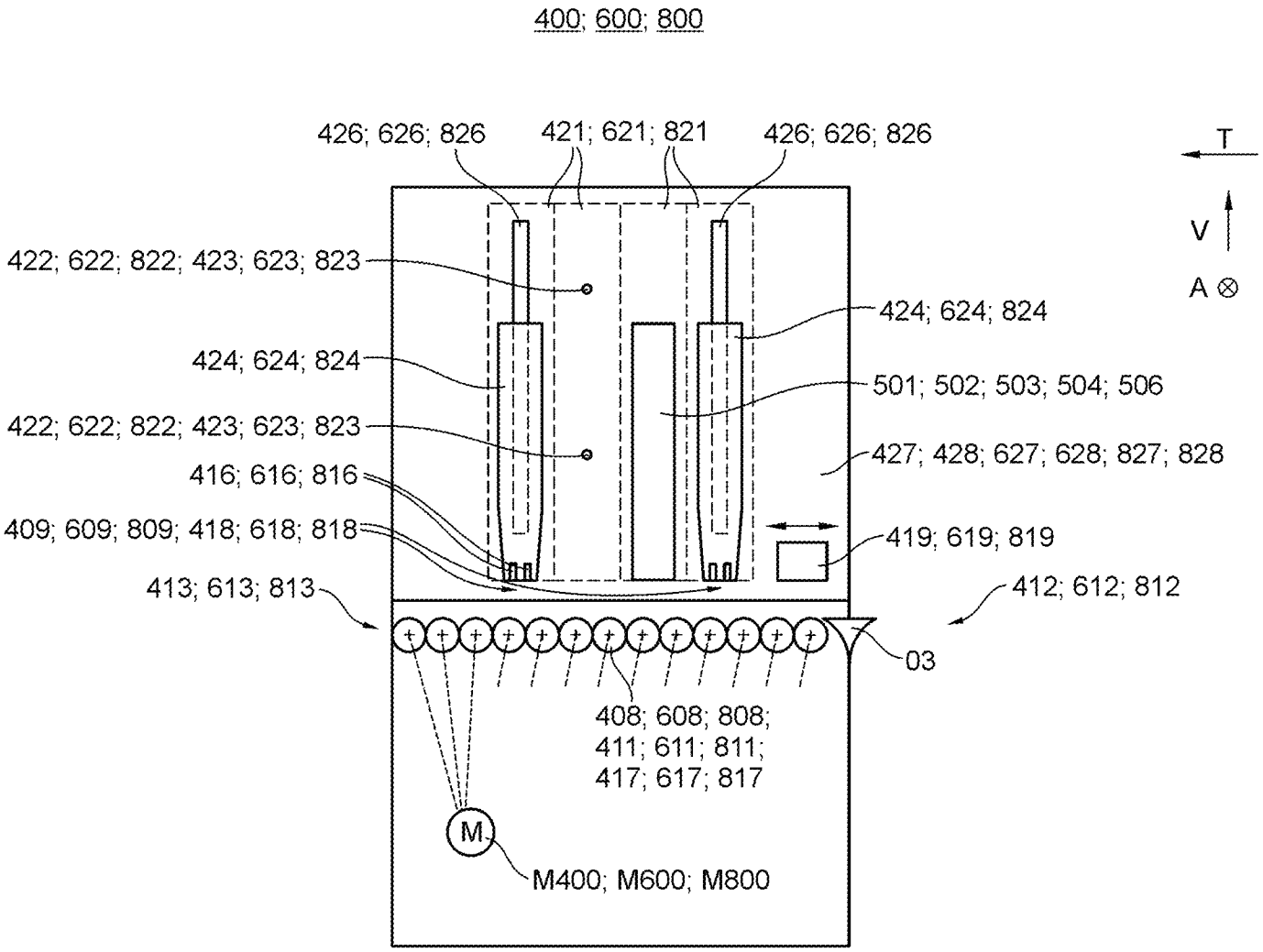
FIG. 17*b* shows a schematic diagram of a non-impact coating unit configured as a module having four receiving units, of which two are occupied by print head assemblies, one is occupied by a dryer assembly, and one is unoccupied.
Figure 17C:
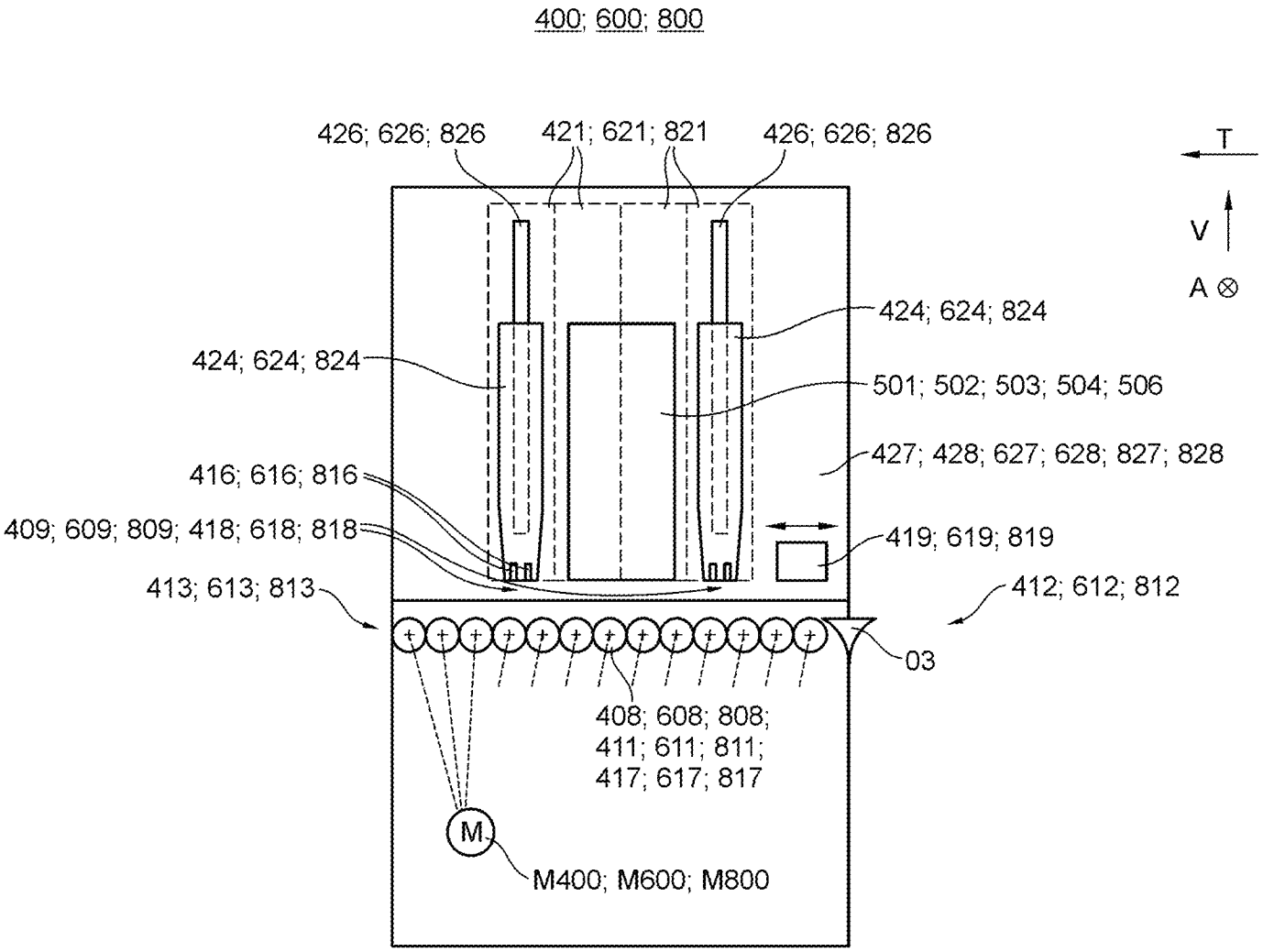
FIG. 17*c* shows a schematic diagram of a non-impact coating unit configured as a module having four receiving units, of which two are occupied by print head assemblies and two are occupied by a dryer assembly.
Figure 17D:
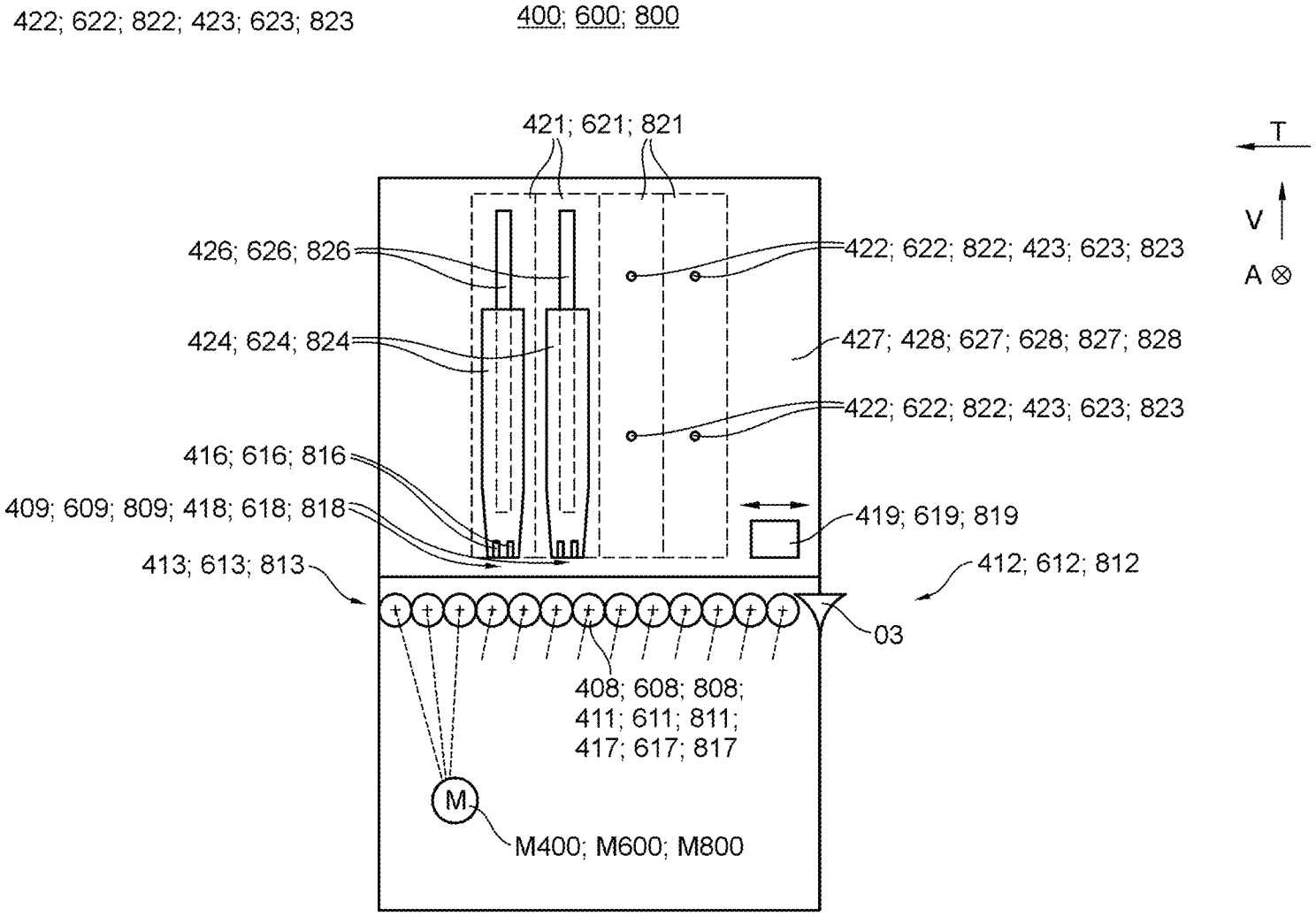
FIG. 17*d* shows a schematic diagram of a non-impact coating unit configured as a module having four receiving units, of which two are occupied by print head assemblies and two are unoccupied.

Preferably, the sheet-fed printing press 01 is alternatively or additionally characterized in that as the at least one primary acceleration means 136, a plurality of subsets of primary acceleration means 136 are provided, which can be operated at least intermittently at sheet speeds that differ from subset to subset and/or each of which has at least one respective primary drive M101; M103 associated only with that respective subset of acceleration means 136. Each such subset may have one primary acceleration means 136 or multiple primary acceleration means 136. (Examples of this are shown in FIGS. 14*a* and 16*b*.)

Figure 14B:
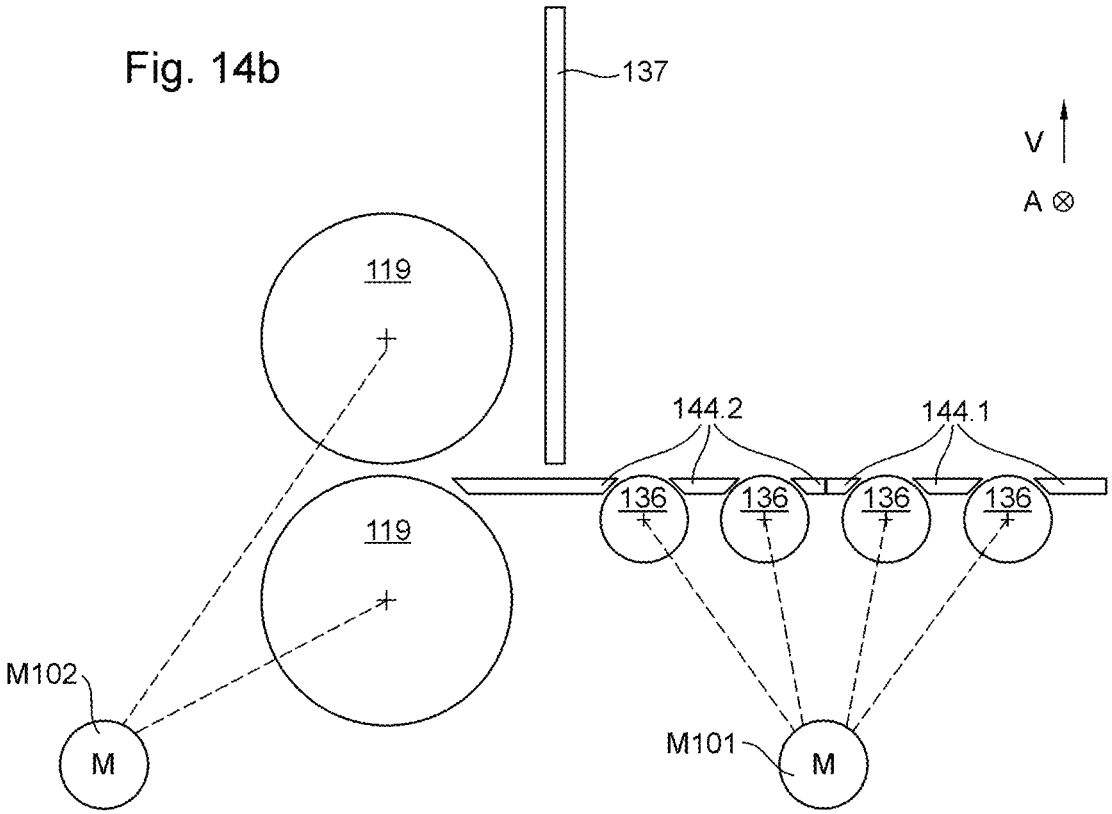
FIG. 14*b* shows a schematic diagram of primary and secondary acceleration means, in which a plurality of different spacers are provided.

Preferably, the sheet-fed printing press 01 is alternatively or additionally characterized in that a plurality of spacers 144.1; 144.2, for example at least one first spacer 144.1 and at least one second spacer 144.2, are arranged to be movable independently of one another at least with respect to the vertical direction V. For example, the at least one first spacer 144.1 and/or the at least one second spacer 144.2 is/are configured as at least one bearing surface provided with recesses, and/or the primary acceleration means 136 protrude at least partially and/or at least intermittently upward through the recesses. (An example of this is shown in FIG. 14*b*.)

Preferably, the sheet-fed printing press 01 is alternatively or additionally characterized in that the drives M101; M102; M103 of the acceleration means 119; 136 of the substrate supply system 100, provided for the movement of sheets 02 along their designated transport path, can be operated independently of such drives that drive at least the vertical relative movement of the primary acceleration means 136 and the at least one spacer 144; 144.1; 144.2 or the spacers 144; 144.1; 144.2, in particular the movements of the at least one spacer 144; 144.1; 144.2 or the spacers 144; 144.1; 144.2.

Preferably, the sheet-fed printing press 01 is alternatively or additionally characterized in that the at least one primary acceleration means 136 is embodied as at least one transport roller 136 and/or as at least one conveyor belt 136 and/or as at least one suction transport means 136 and/or as at least one suction belt 136 and/or as at least one suction box belt 136 and/or as at least one roller suction system 136 and/or as at least one suction gripper 136 and/or as at least one suction roller 136. Preferably, the sheet-fed printing press 01 is alternatively or additionally characterized in that the at least one secondary acceleration means 119 is configured as at least one outgoing transport means 119 of the substrate supply system 100 and/or as at least one transport roller 119 and/or as at least one pair of transport rollers 119 that together form a transport nip and/or as at least one suction transport means 119 and/or as at least one pair of conveyor belts 119 that together form a transport nip. In particular, at least one pair of conveyor belts 119 that together form a transport nip can reduce the risk of the sheets 02 becoming too severely compressed and/or deformed. (Examples are shown in FIG. 16*a* and FIG. 16*b*.) This enables a gentle processing of sheets 02, particularly in the case of corrugated cardboard sheets 02. For example, at least one replaceable assembly is provided, which comprises the at least one secondary acceleration means 119. In that case, for example, at least one pair of transport rollers 119 that together form a transport nip can be exchanged easily and as required for at least one pair of conveyor belts 119 that together form a transport nip.

Figure 15:
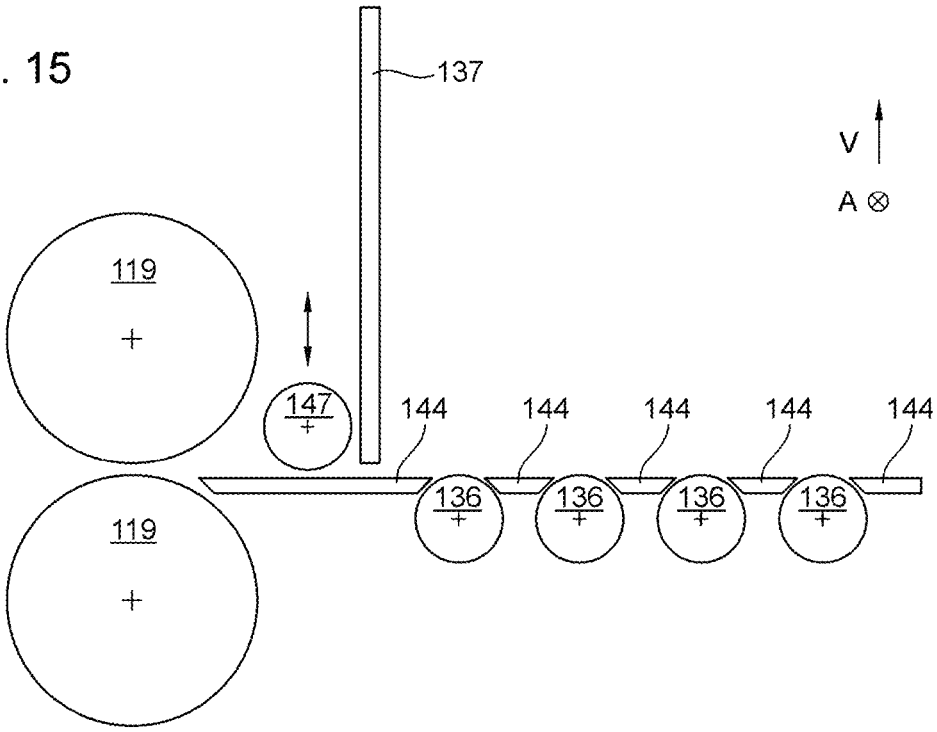
FIG. 15 shows a schematic diagram of primary and secondary acceleration means, in which an auxiliary system for detecting improperly conveyed and/or incorrectly supplied sheets for the purpose of sorting out sheets and/or for holding sheets back and/or pushing sheets back is provided.

Preferably, the sheet-fed printing press 01 is alternatively or additionally characterized in that at least one auxiliary system 147 for detecting improperly conveyed and/or incorrectly provided sheets 02 and/or at least one auxiliary system 147 for sorting out sheets 02 and/or at least one auxiliary system 147 for holding and/or for pushing sheets 02 back is provided. (This is illustrated by way of example in FIG. 15.) This at least one auxiliary system 147 is preferably located between the at least one primary acceleration means 136 and the at least one secondary acceleration means 119 with respect to the transport path provided for sheets 02. If the auxiliary system 147 is configured as an auxiliary system 147 for detecting improperly conveyed and/or incorrectly provided sheets 02, it serves, for example, to identify double sheets and/or to identify sheets 02 that have protruding parts. If such protruding parts come into contact with a print head 416; 616; 816, for example, they might damage said print head 416; 616; 816.

An auxiliary system 147 for sorting out sheets 02 comprises, for example, a suction device and/or a transport diverter. Such an auxiliary system 147 for sorting has at least one compression means 148; 149, for example, by means of which sheets 02 can be compressed, in particular heightwise, and/or is configured as a compression system 147. In this way, corresponding damage to print heads 416; 616; 816 can be avoided, even if a sheet 02 initially contains protruding parts. Although the corresponding sheets 02 are destroyed in the process, for example, they can preferably be rejected by means of the transport diverter.

In an alternative or additional refinement, the sheet processing machine 01 preferably configured as a sheet-fed printing press 01 is preferably characterized in that at least one sensor 153, in particular configured as a protrusion sensor 153 for detecting at least one spatial extension of sheets 02, is arranged along the transport path provided for the transport of sheets 02. The at least one protrusion sensor 153 is configured, for example, as an optical sensor and/or as a light barrier and/or as an ultrasonic sensor and/or as a capacitive sensor and/or as an inductive sensor and/or as a magnetic sensor. The at least one protrusion sensor 153 preferably detects the height of a sheet 02 lying flat and being transported beneath said sensor. If a part of sheet 02, in particular a part of the leading end of sheet 02, projects too far upward, this will be detected by the at least one protrusion sensor 153. Particularly in the case of multilayer sheets 02, such as corrugated cardboard sheets 02, protruding areas may exist along cut edges, for example due to glue joints that have been cut off and as a result of soft individual layers. Such protruding areas might have undesirable consequences, in particular damage to print heads 416; 616; 816. Contact between print heads 416; 616; 816 and sheets 02 is therefore potentially damaging and should be avoided at all cost. Sheet processing machine 01 preferably has at least one non-impact coating unit 400; 600; 800 and/or at least one print head 416; 616; 816 or inkjet print head 416; 616; 816. Preferably, therefore, a compression system 147 is provided, in particular an auxiliary system 147 configured as a compression system 147. Said compression system 147 is located, for example, in the region of a coating unit 400; 600; 800, to prevent the presence between compression system 147 and print heads 416; 616; 816 of any regions in which the shape of sheet 02 is negatively altered.

Preferably, in particular downstream of a detection zone of said at least one protrusion sensor 153 along the transport path provided for the transport of sheets 02, at least one compression system 147 is preferably provided, which further preferably includes at least one first compression member 148 and at least one second compression member 149 and even more preferably at least one force element 151. The at least one first compression member 148 is preferably movable, in particular at least with respect to the vertical direction V and/or toward the at least one second compression member 149. The at least one second compression member 149 is preferably configured as a counterpressure member 149 and more preferably is stationary with the exception of any rotational movements. The at least one first compression member 148 is configured in particular as a rotatably arranged roller 148, and/or the at least one second compression member 149 is configured in particular as a rotatably arranged roller 149, for example. The respective direction of rotation of each of said respective rollers 148; 149 is preferably oriented such the region closest to sheet 02 moves parallel to sheet 02, more particularly not antiparallel thereto. A component that performs other functions, for example at least one conveyor belt 718; 726 and/or at least one vacuum pressure chamber 719, may also serve as the at least one second compression member 149. The axis of rotation of the at least one first compression member 148 is preferably displaceable.

In an alternative or additional refinement, the sheet processing machine 01 preferably configured as a sheet-fed printing press 01 is preferably characterized in that the at least one first compression member 148 is arranged so as to be movable by means of the at least one force element 151 out of a pass-through position and up to the at least one second compression member 149 into a compression position, with the at least one force element 151 further preferably being prestressed when the first compression member 148 is in the pass-through position. This enables a particularly rapid response to the detection of a sheet 02 to be compressed. The at least one compression system 147 preferably has at least one retention device 152, which can be switched at least between a retention state and a release state and which, in the retention state, is disposed to prevent movement of the at least one first compression member 148 from its pass-through position into its compression position. The tension is thereby maintained. In this context, tension is understood in particular as a state in which the body in question will tend to automatically change its shape in order to reach a state of lower energy. For example, the at least one force element 151 has at least one spring and/or at least one magnet and/or at least one electromagnet and/or at least one spring plate. The at least one retention device 152 preferably has at least one trigger drive 157, which further preferably is configured as a pneumatic cylinder and/or as a hydraulic cylinder and/or as an electromagnet and/or as an electric motor. The at least one retention device 152 preferably has at least one stop member 156, which more preferably can be moved by means of the at least one trigger drive 157. By activating the trigger drive 157, stop member 156 can then be moved, and the path of the at least one first compression member 148 from its pass-through position up to the at least one second compression member 149 into its compression position.

In an alternative or additional refinement, the sheet processing machine 01 preferably configured as a sheet-fed printing press 01 is preferably characterized in that sheet processing machine 01 has at least one conveyor belt 718; 726, which extends with at least one conveying section of its circulation path parallel to a transport direction T along a section of the transport path provided for sheets 02, and in that the at least one conveyor belt 718; 726 is arranged at least partially between the at least one first compression member 148 and the at least one second compression member 149. In any case, when the first compression member 748 is disposed in the compression position while at the same time, sheet 02 is located between the first compression member 748 and the second compression member 749, contact preferably exists between the at least one conveyor belt 718; 726 and the at least one second compression member 149. At least one coating position 409; 609; 809 of at least one coating unit 400; 600; 800 of sheet-fed printing press 01 is preferably located along the conveying section of the at least one conveyor belt 718; 726. The detection zone of said at least one protrusion sensor 153 is preferably located along the conveying section of the at least one conveyor belt 718; 726.

A compression zone 154 is preferably the zone, defined by the at least one first and the at least one second compression member 148; 149, in particular the spatial area in which the shortest distance between the at least one first compression member 148 on one hand and the second compression member 149 and/or the at least one conveyor belt 718; 726 on the other hand is smaller than the thickness of the sheets 02 to be transported. A distance, measured along the transport path provided for sheets 02, between the compression zone 154 defined by the at least one first and the at least one second compression member 148; 149 on one hand and the at least one coating position 409; 609; 809 on the other hand is preferably no more than 200 cm, more preferably no more than 100 cm, even more preferably no more than 50 cm, even more preferably no more than 20 cm, and more preferably still no more than 10 cm. A distance, measured along the transport path provided for sheets 02, between the detection zone of said at least one protrusion sensor 153 on one hand and the compression zone 154 defined by the at least one first and the at least one second compression member 148; 149 on the other is preferably no more than 200 cm, more preferably no more than 100 cm, even more preferably no more than 50 cm, even more preferably no more than 20 cm, and more preferably still no more than 10 cm.

In an alternative or additional refinement, the sheet processing machine 01 preferably configured as a sheet-fed printing press 01 is preferably characterized in that at least one tensioning drive is provided, by means of which the at least one first compression member 148 can be moved out of the compression position, in particular away from the at least one second compression member 149, and into the pass-through position. In that case, it is not absolutely necessary for sheet processing machine 01 to be stopped when a sheet 02 has been compressed; instead, it can continue to run, for example without interruption, once compression system 147 has been re-tensioned. Preferably, sheet processing machine 01 has at least one transport diverter and/or ejection means and/or waste diverter for sheets 02, which is located downstream of the at least one compression system 147 with respect to the transport path provided for the transport of sheets 02. This enables compressed sheets 02 to be disposed of in a simple manner.

In an alternative or additional refinement, the sheet processing machine 01 preferably configured as a sheet-fed printing press 01 is preferably characterized in that the at least one protrusion sensor 153 is connected by circuitry directly or indirectly to the at least one retention device 152, and/or in that the at least one protrusion sensor 153 is connected by circuitry to a machine controller of sheet processing machine 01, to which the at least one retention device 152 is also connected by circuitry. Automated protection by means of the compression system 147 is thereby enabled.

Figure 21A:
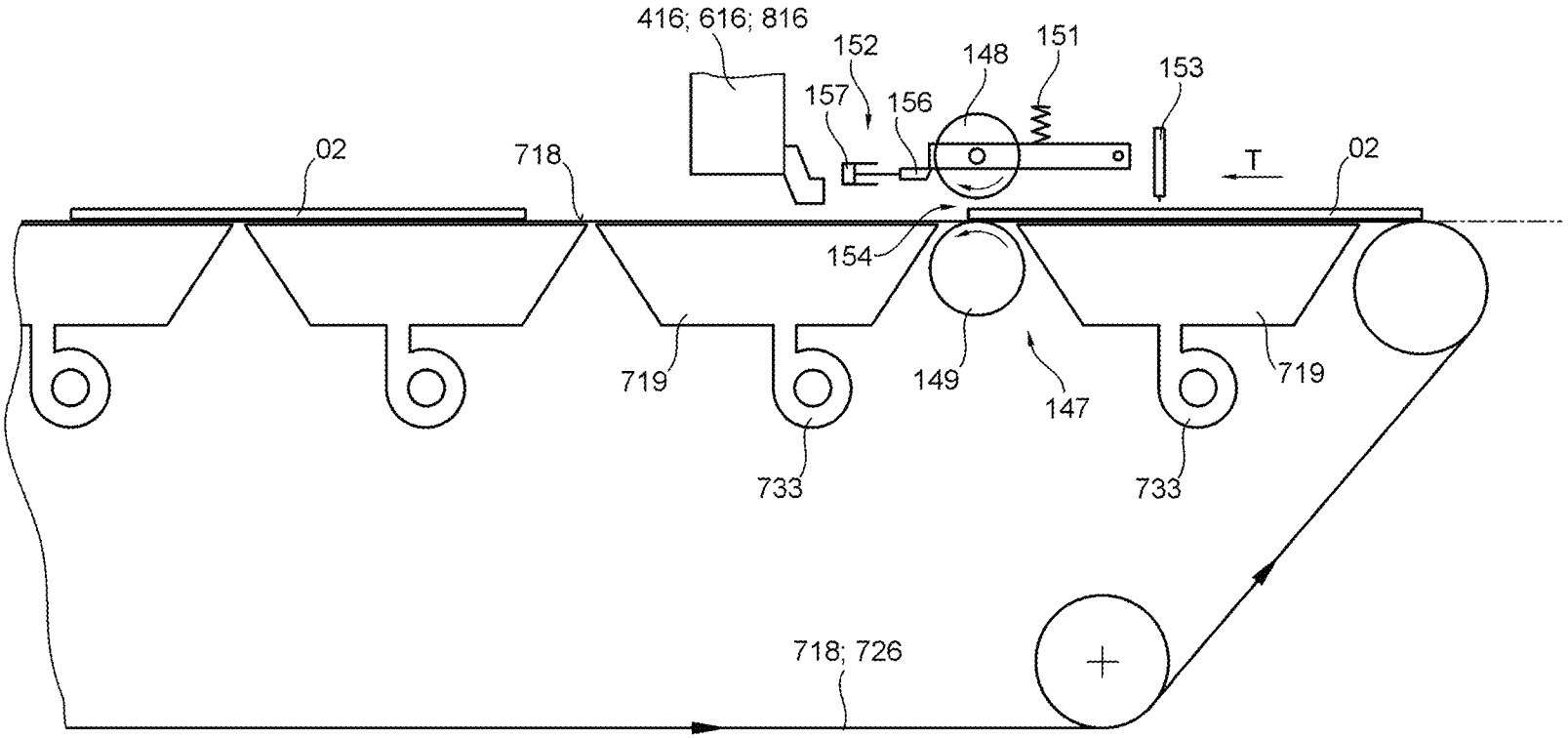
FIG. 21*a* shows a schematic diagram of a transport means having a conveyor belt and a compression system, in which a compression member is arranged in a pass-through position.
Figure 21B:
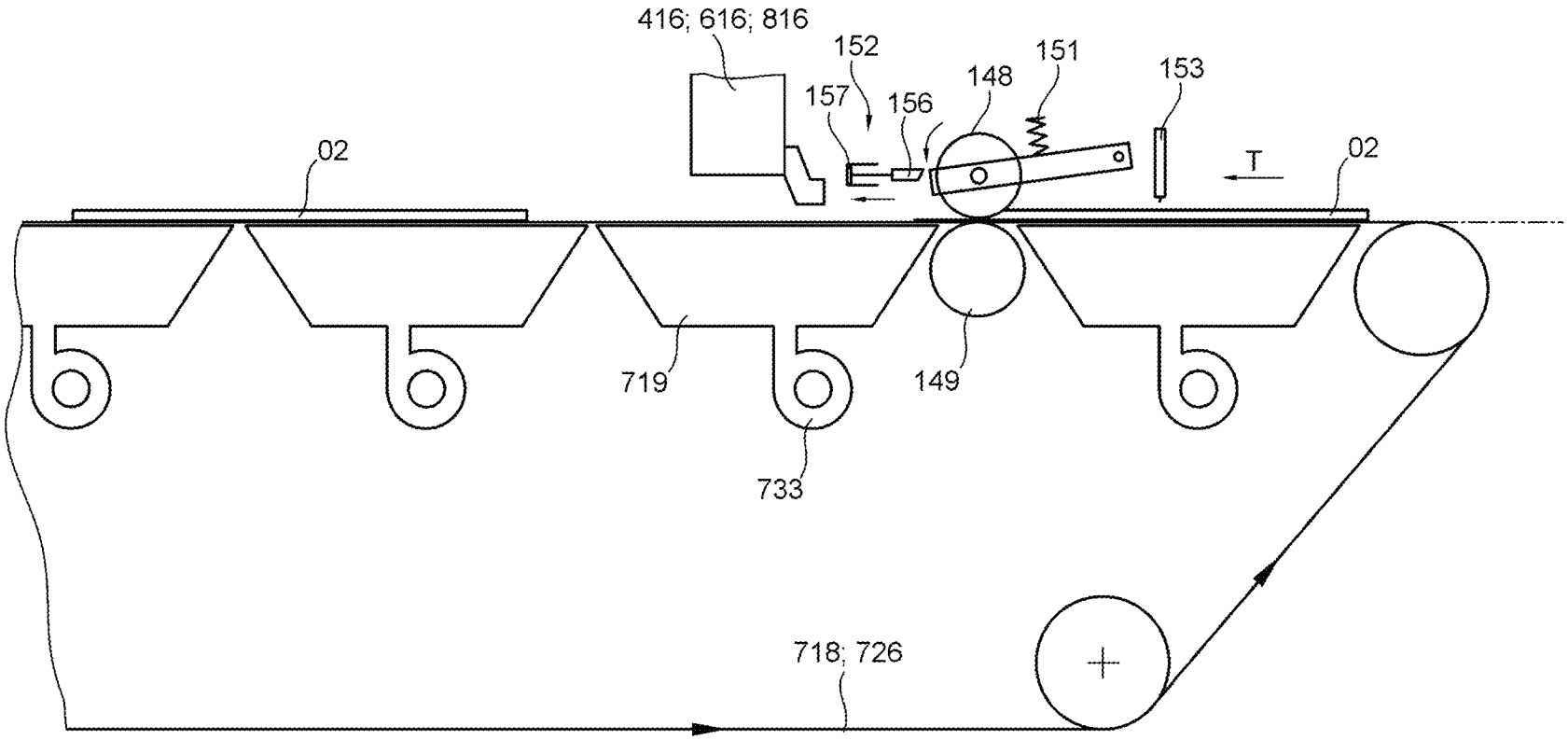
FIG. 21*b* shows a schematic diagram according to FIG. 21*a*, but with a compression member arranged in a compression position.

When an upward protruding component of a sheet 02 is detected by means of the at least one protrusion sensor 153, retention device 152 is deactivated and the at least one first compression member 148 presses the sheet 02 against the at least one second compression member 149 and/or against the at least one conveyor belt 718; 726, thereby compressing sheet 02, and in particular avoiding damage to print heads 416; 616; 816 as a result. (By way of example, FIG. 21*a* schematically shows a compression system 147 with compression member 148 in the pass-through position, and FIG. 21*b* shows a compression system 147 with compression member 148 in the compression position.)

An auxiliary system 147 for holding and/or for pushing sheets 02 back comprises, for example, a suction device and/or a pushing means. Such a suction device secures a corresponding sheet 02, for example, thereby preventing it from being transported further and potentially causing damage. Such a pushing device is configured, for example, as a cylinder and/or roller and/or brush and is disposed such that it rotates and/or is capable of rotating. The direction of rotation is selected such that a force exerted by the pushing device, for example by way of friction, is oriented opposite the transport direction of the sheet 02 and/or opposite its intended transport path. Processing machine 01 is halted, for example, when an improperly conveyed sheet 02 is detected and/or has been held and/or forced back by means of the auxiliary system 147 for holding and/or pushing sheets 02 back.

In an alternative or additional refinement, the sheet processing machine 01 preferably configured as a sheet-fed printing press 01 is preferably characterized in that the at least one primary acceleration means 136 is at the same time configured as a sheet alignment means for alignment with respect to the transverse direction A and/or with respect to a pivot position, and/or in that the at least one secondary acceleration means 119 is at the same time configured as a sheet alignment means for alignment with respect to the transverse direction A and/or with respect to a pivot position. For adjusting the pivot position, the respective acceleration means 119; 134 is divided at least partially with respect to the transverse direction A, for example, into at least two parts, which are and/or can be driven at different relative speeds. For adjusting the position with respect to the transverse direction A, the respective acceleration means 119; 134 is movable, for example, at least partially in and/or opposite the transverse direction A, in particular while it is in contact with a sheet 02.

Preferably, sheet-fed printing press 01 is alternatively or additionally characterized by the fact that a module 100; 600 is understood as a respective unit 100; 600 or an assembly of a plurality of units 100; 600 that has at least one controllable and/or regulable drive M100; M101; M102; M103; M600 dedicated uniquely to it and/or has at least one transfer means 03 for sheets 02 and/or at least one section of a transport path provided for the transport of sheets 02, which begins and/or ends without deviation, or with a deviation of no more than 5 cm, at a first standard height which is the same for a plurality of modules 100; 600, and/or is configured as an autonomously functioning module 100; 600 and/or as a machine unit or functional assembly that is produced and/or installed as a separate entity.

Preferred is a method for operating a processing machine 01 preferably configured as a sheet-fed printing press 01, in which sheets 02 coming from a pile 104 are singulated, and in which each of the sheets 02 is accelerated to a first speed v1 by means of at least one by a primary acceleration means 136, driven by a primary drive M101; M103, of a substrate supply system 100, and the primary drive M101; M103 is further preferably configured as a position-controlled electric motor M101; M103. Afterward, each of the sheets 02 is preferably accelerated to a second speed v2 by means of at least one secondary acceleration means 119, driven by a secondary drive M102, of substrate supply system 100, the secondary drive M102 further preferably being configured as a position-controlled electric motor M102. The second speed v2 is at least as great as the first speed v1, for example, and more preferably is greater than the first speed v1. In an alternative or additional refinement, the method is preferably characterized in that each of the sheets 02 is then accelerated by means of said at least one secondary acceleration means 119 to a third speed v3, which is greater than the second speed v2, and in that afterward, each of the sheets 02 is decelerated, in particular by means of said at least one secondary acceleration means 119, back to the second speed v2. It is not necessary for sheets 02 to be held at the second speed v2 before being accelerated to the third speed v3. For example, a steady monotonic increase in the sheet speed from the first speed v1 to the third speed v3 is also possible. Sheets 02 are preferably transported along a transport path from substrate supply system 100 to at least one additional module 200; 300; 400; 500; 550; 600; 700; 800; 900; 1000 of sheet processing machine 01, in particular to a printing module 600. Each of sheets 02 is preferably then transported by means of at least one drive M100; M200; 300; M400; M500; M550; M600; M700; M800; M900; 1000 of the at least one additional module 200; 300; 400; 500; 550; 600; 700; 800; 900; 1000, in particular printing module 600, at a processing speed, in particular a printing speed, through the respective additional module 200; 300; 400; 500; 550; 600; 700; 800; 900; 1000, in particular printing module 600, and during said transport is processed, in particular printed, in said respective additional module 200; 300; 400; 500; 550; 600; 700; 800; 900; 1000, in particular printing module 600. The processing speed, in particular the printing speed, is preferably equal to the second speed v2.

Preferred in particular is thus a method in which sheets 02 are transported along a transport path from substrate supply system 100 to at least one printing module 600, and in which each of sheets 02 is then transported at a printing speed through the respective printing module 600 by means of at least one drive M600 of the at least one printing module 600, and during said transport is printed in said respective printing module 600, and in which the first speed v1 is lower than the printing speed.

Preferably, the method is alternatively or additionally characterized in that the printing speed is equal to the second speed v2 and/or in that the second speed v2 is greater than the first speed v1. Preferably, the method is alternatively or additionally characterized in that each of the sheets 02 is in contact at least at one point in time with both primary acceleration means 136 and secondary acceleration means 119. Preferably, the method is alternatively or additionally characterized in that a deceleration of the at least one primary acceleration means 136 does not cause a deceleration of the respective sheet 02 accelerated immediately previously by means of said primary acceleration means 136.

The method is alternatively or additionally characterized, for example, by the fact that a deceleration of the at least one secondary acceleration means 119 does not cause any deceleration of the respective sheet 02 accelerated immediately previously by means of said secondary acceleration means 119. However, to close a gap between sheets 02, an acceleration followed by a deceleration of a respective subsequent sheet 02 is preferably carried out by means of the at least one secondary acceleration means 119. The method is preferably alternatively or additionally characterized in that the at least one secondary acceleration means 119 is itself accelerated at least temporarily while a respective sheet 02 is accelerated from the first speed v1 to the second speed v2 and/or to the third speed v3, and is itself decelerated while a respective sheet 02 is decelerated from the third speed v3 to the second speed v2.

In an alternative or additional refinement, the method is preferably characterized in that at least one sheet sensor 164 detects the trailing edge of a preceding sheet 02 and generates a trailing edge signal, and in that at least one sheet sensor 164 detects the leading edge of a subsequent sheet 02 and generates a leading edge signal, and in that the acceleration and/or the deceleration of the respective, in particular subsequent sheet 02 is controlled and/or regulated by means of the at least one secondary acceleration means 119, factoring in the trailing edge signal and the leading edge signal. The method is alternatively or additionally characterized, for example, in that the at least one primary drive M101; M103 and the at least one secondary drive M102, are operated in synchronization with one another, in particular factoring in the trailing edge signal and/or the leading edge signal and/or in particular by means of the machine controller of sheet processing machine 02, such that a gap between a preceding sheet 02 and a subsequent sheet 02 is reduced and/or adjusted to a value that is within a predefined tolerance range around a target value. For example, a primary acceleration profile for the at least one primary acceleration means 136 and/or the primary drive M101; M103 thereof is stored, and/or a secondary acceleration profile for the at least one secondary acceleration means 119 and/or the secondary drive M102 thereof is stored. Preferably, the primary acceleration profile and/or further preferably the secondary acceleration profile is modified on the basis of signals from the at least one sheet sensor 164.

Figure 26A:
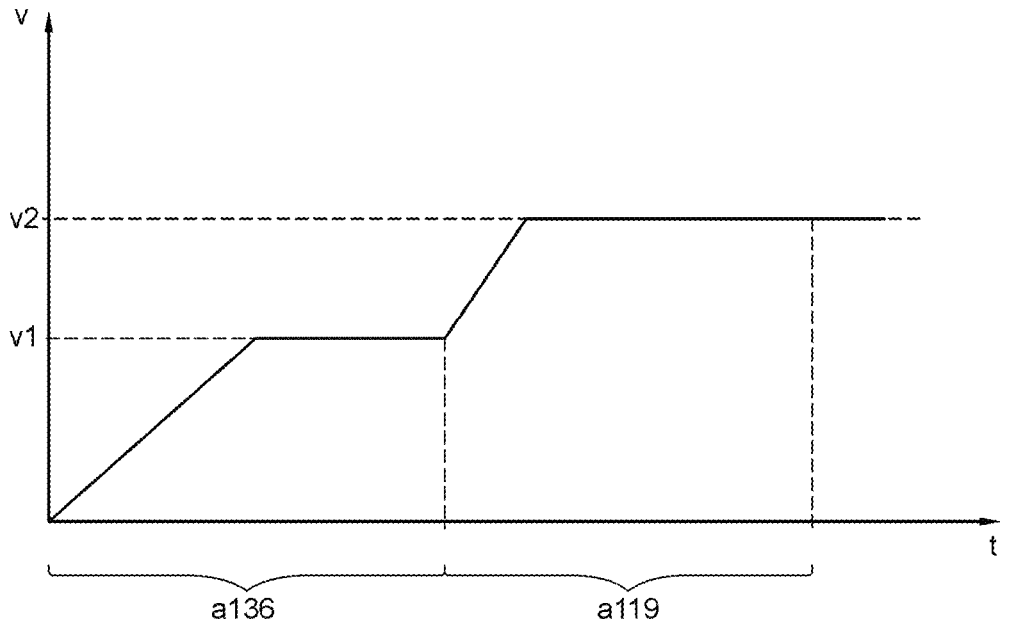
FIG. 26*a* shows a schematic diagram of a first exemplary profile of a speed at which a sheet is transported, plotted over time.
Figure 26B:
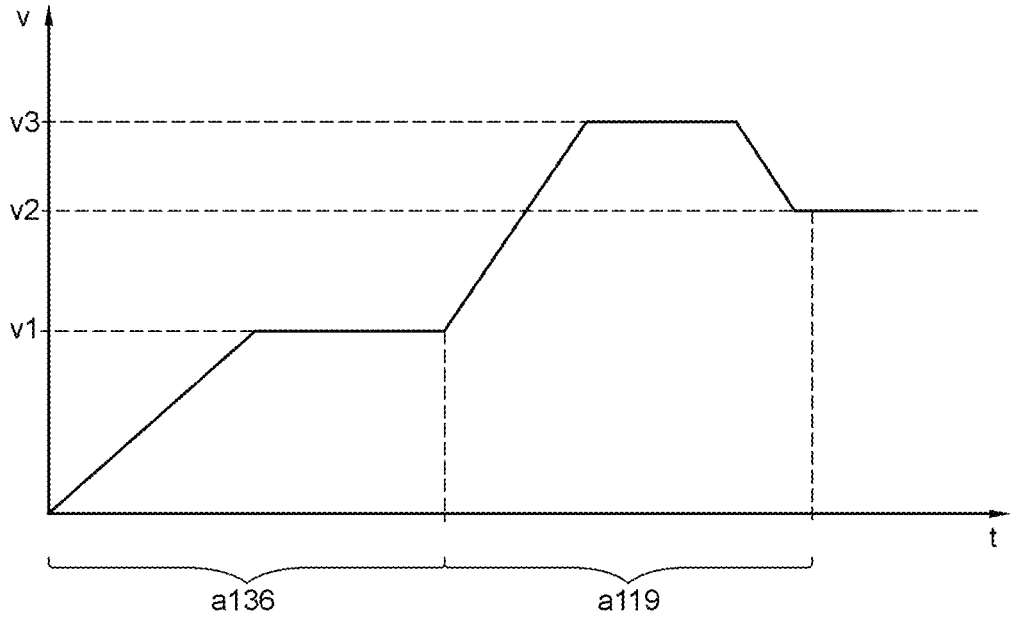
FIG. 26*b* shows a schematic diagram of a second exemplary profile of a speed at which a sheet is transported, plotted over time.

FIG. 26*a* shows, by way of example, a schematic profile of a transport speed of a sheet 02, which is first accelerated over a segment a136 to a first speed v1 by means of the at least one primary acceleration means, and is then accelerated over a segment a119 to a second speed v2 by means of the at least one secondary acceleration means 119. FIG. 26*b* shows, by way of example, a schematic profile of a transport speed of a sheet 02, which is first accelerated over a segment a136 to a first speed v1 by means of the at least one primary acceleration means, and is then accelerated over a segment a119 to a third speed v3 by means of the at least one secondary acceleration means 119, and thereafter is decelerated to a second speed v2.

Once a respective sheet 02 has been passed on, the respective acceleration means 119; 136 is preferably decelerated again. The method is preferably characterized in that the at least one primary acceleration means 136 is decelerated, at least temporarily, while the at least one secondary acceleration means 119 and in particular also at least one sheet 02 is being accelerated, and/or in that the at least one secondary acceleration means 119 is decelerated, at least temporarily, while the at least one primary acceleration means 136 and in particular also at least one sheet 02 is being accelerated. Preferably, the method is characterized in that the at least one secondary acceleration means 119 is always operated at a speed v1; v2; v3 not equal to zero as long as said acceleration means is in contact with a sheet 02, and/or in that during a portion of a processing operation of sheet processing machine 01 in which at least three sheets 02 are singulated and accelerated, the at least one secondary acceleration means 119 is always operated at a speed v1; v2; v3 not equal to zero.

The method is preferably alternatively or additionally characterized in that the first speed v1 is at least 10%, more preferably at least 20%, and even more preferably at least 30% lower than the printing speed, and/or in that the first speed v1 amounts to at least 20%, preferably at least 30%, and more preferably at least 40% of the second speed v2, and/or in that the first speed v1 amounts to at most 80%, preferably at most 70%, and more preferably at most 60% of the second speed v2, and/or in that the third speed v3 is at least 10%, more preferably at least 20%, even more preferably at least 30%, and more preferably still at least 50% higher than the second speed v2.

Preferably, the method is alternatively or additionally characterized by the fact that the sheets 02 are printed in the at least one printing module 600 from above.

Preferably, the method is alternatively or additionally characterized by the fact that the sheets 02 are printed in the at least one printing module 600 from above by means of a non-impact printing method and/or by means of an inkjet printing method.

Preferably, the method is alternatively or additionally characterized by the fact that the substrate supply system 100 is configured as a module 100 of the sheet-fed printing press 01.

Preferably, the method is alternatively or additionally characterized in that the at least one primary acceleration means 136 is brought into contact with the sheets 02 on the underside of each sheet 02, in particular exclusively on the underside of each sheet, and/or in that the at least one secondary acceleration means 119 has at least one transport nip in which the sheets 02 are at least partially located while the at least one secondary acceleration means 119 is accelerating them to the second speed v2 and/or to the third speed v3, and/or is decelerating them to the second speed v2.

Preferably, the method is alternatively or additionally characterized in that during acceleration by means of the at least one primary acceleration means 136, a displacement of the respective sheet 02 with respect to the transverse direction A and/or a pivoting movement of the respective sheet 02 about a pivot axis that extends orthogonally to the transverse direction A and/or an adjustment of a phase position of the respective sheet 02 relative to at least one downstream component of the sheet-fed printing press 01 for transporting the sheets 02 takes place. Preferably, the method is alternatively or additionally characterized in that during acceleration by means of the at least one secondary acceleration means 119, a displacement of the respective sheet 02 with respect to the transverse direction A and/or a pivoting movement of the respective sheet 02 about a pivot axis that extends orthogonally to the transverse direction A and/or an adjustment of a phase position of the respective sheet 02 relative to at least one downstream component of the sheet-fed printing press 01 transporting the sheets 02 takes place. An adjustment of a phase position is understood, in particular, to mean that the movement of the sheet 02 along its transport path and the movement of the downstream component of the sheet-fed printing press 01 transporting the sheets 02 are synchronized with one another such that a predefined point on the sheet 02, for example the leading end thereof, enters into contact with a predefined point on the component transporting the sheet 02. For example, a movement of the sheet 02 along its transport path is positively and/or negatively accelerated and/or the component for transporting the sheet 02 is accelerated positively and/or negatively, in particular prior to its contact with said sheet 02.

Preferably, the method is alternatively or additionally characterized in that the respective sheet 02 is aligned with respect to its position along the transport path, for example relative to a preceding sheet 02 and/or relative to a phase position of a component of the sheet processing machine 01, by means of the at least one secondary acceleration means 119. Thus, for example, conveyance at a briefly increased speed and/or conveyance at a briefly reduced speed can influence this relative position. In that case, for example, the at least one primary acceleration means 136 accelerates the sheets to the processing speed and/or the printing speed, and the at least one secondary acceleration means 119 then performs only the fine alignment.

If, as described, multiple subsets of primary acceleration means 136 are provided as the at least one primary acceleration means 136, for example, the method is preferably alternatively or additionally characterized in that the subsets of primary acceleration means 136 execute different sequences of movements from one another. For example, at first the bottommost sheet 02 of a pile is in contact with acceleration means 136 of a plurality of the subsets. These subsets are then preferably accelerated synchronously at first, thereby moving said sheet 02 forward. Over time, the movement of said sheet 02 moves said sheet 02 out of contact with the first primary acceleration means 136 on the transport path of sheet 02 and subsequently out of contact with additional primary acceleration means 136. In a movement cycle of the primary acceleration elements 136 with respect to a sheet 02, at least the first primary acceleration means 136 with respect to the transport path of the sheet 02 is preferably decelerated and/or halted earlier than the last primary acceleration means 136 with respect to the transport path of the sheet 02. This prevents a subsequent sheet 02 from coming into contact with a primary acceleration means 136 that is moving at all or is moving too rapidly even though this subsequent sheet 02 is not yet supposed to be moving along the transport path at all. Thus, for example, some or all of the primary acceleration means 136 are always stopped as soon as a first sheet 02 is moved out of contact with them, and all of the primary acceleration means 136 are subsequently accelerated again collectively in a movement cycle related to a subsequent sheet 02.

If, as described, a plurality of spacers 144.1; 144.2 are arranged such that they are movable independently of one another, at least with respect to the vertical direction V, for example, the method is preferably alternatively or additionally characterized in that at first, the respective bottommost sheet 02 of the corresponding pile rests on a first spacer 144.1 with respect to the intended transport path for said sheet 02 and on a second spacer 144.2 with respect to the intended transport path for said sheet 02, without touching the primary acceleration means 136. At that time, said spacers 144.1; 144.2 are in their respective holding positions. The first spacer 144.1 and the second spacer 144.2 are then preferably lowered, thereby establishing contact between the bottommost sheet 02 and primary acceleration means 136. Primary acceleration means 136 accelerate the sheet along its transport path. The first spacer 144.1 along the intended transport path is then first raised, so that the sheet 02 that is initially the bottommost sheet is moved out of contact with at least one of the primary acceleration means 136. This prevents a subsequent sheet 02 from coming into contact with a primary acceleration means 136 that is moving at all or is moving too rapidly even though said subsequent sheet 02 is not yet supposed to be moving along the transport path at all. Thus, for example, some or all of the spacers 144; 144.1; 144.2 are always raised as soon as a first sheet 02 moves out of contact with them or is close to moving out of contact with them, and all of the spacers 144; 144.1; 144.2 are subsequently lowered again collectively in a movement cycle related to a subsequent sheet 02.

Preferably, at least one infeed system 300 is located downstream of a substrate supply system 100 and/or upstream of at least one coating unit 400; 600; 800 with respect to the provided transport path. The at least one infeed system 300 preferably serves to align sheets 02 as precisely as possible. This ensures that a subsequent processing of sheets 02 is carried out as precisely as possible relative to the sheets 02 and thus also relative to processes performed previously on the sheets 02. Depending upon the configuration and/or operation of the substrate supply system 100, the sheets 02 are preferably supplied to infeed system 300 in a shingled arrangement or singulated, for example. Preferably, the sheets 02 leave the infeed system 300 fully singulated.

Infeed system 300 preferably has at least one alignment means 301. The alignment means 301 comprises, for example, at least one alignment cylinder 302 and/or alignment roller 302, in particular drivable and/or driven, which is rotatable about a horizontal axis of rotation, for example, and which is pivotable about a pivot axis that is oriented in particular parallel to a vertical direction. Alternatively or additionally, the alignment cylinder 302 and/or alignment roller 302 is configured as movable, for example, partially or as a complete unit, in the transverse direction A, in particular for the purpose of moving sheets 02 in the transverse direction A and then moving itself back again. Infeed system 300 comprises at least one pressure roller or pressure cylinder, for example, by means of which a force can be exerted to force sheets 02 against said alignment cylinder 302 and/or alignment roller 302. By pivoting the alignment cylinder 302 and/or alignment roller 302 and/or by moving the alignment cylinder 302 and/or alignment roller 302 in the transverse direction A, the position of the respective sheet 02 can thereby be influenced, for example. Alternatively or additionally, alignment means 301 is equipped, for example, with a plurality of drivable and/or driven alignment cylinders 302 and/or alignment rollers 302, which are arranged offset relative to one another in the transverse direction A, for example. By actuating these alignment cylinders 302 and/or alignment rollers 302 differently, for example, sheets 02 can be pivoted about an axis that is oriented, for example, parallel to a vertical direction and/or to a direction orthogonal to the main surfaces of at least one sheet 02. With such alignment rollers 302 and/or alignment cylinders 302 that are pivotable and/or movable with respect to transverse direction A, for example, an infeed system 300 can be realized which operates without contact between sheets 02 on one side and front lay marks 127 and/or side lay marks on the other.

Alternatively or additionally, alignment means 301 has at least one stop, for example, also referred to as a mark 127. For example, alignment means 301 has at least one front lay mark 127 and/or at least one side lay mark. By moving the sheets against this front lay mark 127 and/or along this side lay mark, the respective sheet 02 is forced into a defined and known position, from which it can then be transported further.

The at least one infeed system 300 includes at least one inspection system 303, for example. This at least one inspection system 303 serves, for example, to detect the position of the respective sheet 02, for example, so that said position can subsequently be selectively adjusted, and/or so that information regarding the position of the respective sheet 02 can be used in subsequent units 200; 400; 500; 550; 600; 700; 800; 900; 1000. For example, information thus obtained is used to align the sheets 02 without stops and/or during further transport. The inspection system 303 comprises, for example, at least one and preferably a plurality of optical sensors, in particular, which are embodied, for example, as cameras and/or are preferably disposed such that they are movable mechanically, in particular in the transverse direction A.

Infeed system 300 preferably has at least one transport means 311, which is further preferably configured as a suction transport means 311. The description relating to suction transport means in the foregoing and in the following preferably applies accordingly. Infeed system 300 preferably has at least one drive M300 or motor 300, in particular electric motor M300 or position-controlled electric motor M300, dedicated uniquely to it, which is further preferably located such that it drives and/or is capable of driving the at least one transport means 311. For example, infeed system 300 has at least one pressure roller or pressure cylinder, by means of which a force can be exerted on sheets 02, pressing them against the at least one transport means 311. Infeed system 300 preferably comprises at least one transfer means 03 for sheets 02. The section of the transport path provided for sheets 02 that is defined by infeed system 300 is preferably substantially flat and more preferably completely flat and is preferably configured extending substantially horizontally and more preferably exclusively horizontally.

Preferably, the infeed system 300 preferably configured as unit 300 and/or module 300 is alternatively or additionally characterized in that the section of the transport path provided for sheets 02, which is defined by infeed system 300, begins at an intake height of infeed system 300 and/or ends at an outlet height of infeed system 300. Preferably, infeed system 300 is characterized in that this intake height of infeed system 300 deviates no more than 5 cm, more preferably no more than 1 cm, and even more preferably no more than 2 mm from the first standard height, and/or in that the outlet height of infeed system 300 deviates no more than 5 cm, more preferably no more than 1 cm, and even more preferably no more than 2 mm from the first standard height, and/or in that the intake height of infeed system 300 deviates no more than 5 cm, more preferably no more than 1 cm, and even more preferably no more than 2 mm from the outlet height of infeed system 300.

In the following, details of a coating unit 400; 600; 800, configured by way of example as a primer unit 400, will be described. This description applies similarly to other embodiments of the coating unit 400; 600; 800, in particular to printing units 600 and finish coating units 800, provided no contradictions result.

As described, for example, at least one coating unit 400 configured as priming system 400 or priming unit 400 is provided. The at least one priming unit 400 preferably serves to apply a coating medium embodied as a primer onto the sheets 02. This application involves a full-surface application or a partial application, for example, depending upon the processing order. The primer facilitates, for example, the subsequent processing of the sheets 02, for example the application of at least one additional coating medium, in particular in the form of printing ink, and/or at least one additional coating medium, in particular in the form of ink, and/or at least one additional coating medium, in particular in the form of a finish coating.

In the following, details of a coating unit 400; 600; 800 configured by way of example as a flexo coating unit 400; 600; 800 will be described. This description applies similarly to other embodiments of the coating unit 400; 600; 800, provided no contradictions result. This flexo coating unit 400; 600; 800 is represented by way of example as a priming unit 400. The description can be applied similarly to printing units 600 and finish coating units 800, provided no contradictions result.

The flexo coating unit 400; 600; 800 preferably has at least one coating medium reservoir 401; 601; 801. In the case of a priming unit 400, the coating medium reservoir 401; 601; 801 is more preferably a primer reservoir 401 and/or in the case of a printing unit 600, said reservoir is a printing ink reservoir 601 or ink reservoir 601, and/or in the case of a finish coating unit 800 said reservoir is a finish coating reservoir 801. The flexo coating unit 400; 600; 800 preferably includes at least one application cylinder 402; 602; 802, which serves to apply coating medium to sheets 02 and is intended, in particular, for contact with sheets 02. The application cylinder 402; 602; 802 is configured, for example, as forme cylinder 402; 602; 802, and in the case of a priming unit 400 it is configured as a priming forme cylinder 402, in particular, and/or in the case of a printing unit 600 it is configured as a printing ink forme cylinder 602 or ink forme cylinder 602, and/or in the case of a finish coating unit 800 is configured as a finish coating forme cylinder 802. On the forme cylinder 402; 602; 802, at least one removable covering in the form of at least one removable coating forme, in particular priming forme or printing forme or finish coating forme, preferably is and/or can be arranged. This covering serves to define the areas in which coating medium is to be transferred, and where applicable, in which coating medium will not be transferred. The respective covering is and/or can be positioned, and preferably is and/or can be secured, preferably by means of at least one corresponding holding means, in particular clamping means and/or tensioning means, on a lateral surface of the application cylinder 402; 602; 802.

For supplying the forme cylinder 402; 602; 802 and/or the coating forme with coating medium, in particular, at least one supply roller 403; 603; 803 is preferably provided, which is further preferably configured as an anilox roller 403; 603; 803 and/or which has a saucer structure on its lateral surface and preferably is and/or can be placed in contact with the forme cylinder 402; 602; 802. Alternatively, between supply roller 403; 603; 803 and application cylinder 402; 602; 802, at least one additional transfer roller for coating medium may also be provided. In the case of a priming unit 400, for example, the supply roller 403; 603; 803 is configured as a primer supply roller 403, and/or in the case of a printing unit 600 said supply cylinder is configured as a printing ink supply roller 603 or an ink supply roller 603, and/or in the case of a finish coating unit 800 said supply roller is configured as a finish coating supply roller 803. At least one intermediate reservoir 404; 604; 804 for coating medium is preferably in contact and/or in operative connection with the supply roller 403; 603; 803. Said intermediate reservoir is preferably configured as a chamber doctor blade 404; 604; 804. Thus, at least one chamber doctor blade 404; 604; 804 is preferably in contact and/or in operative connection with the supply roller 403; 603; 803, which is configured in particular as anilox roller 403; 603; 803. The intermediate reservoir 404; 604; 804 preferably configured as chamber doctor blade 404; 604; 804 is preferably connected via at least one supply line 406; 606; 806, and more preferably also via at least one drain line 407; 607; 807, to the at least one coating medium reservoir 401; 601; 801. The supply line 406; 606; 806 and/or the drain line 407; 607; 807 is preferably in operative connection with at least one pump device. Preferably, a device for the assisted and/or automated and/or semi-automated installation and/or removal of the supply roller 403; 603; 803 is provided.

At least one counterpressure means 408; 608; 808 is preferably provided, which serves as a counter-bearing for the application of the coating medium to the sheets 02. The at least one counterpressure means 408; 608; 808 is embodied, for example, as impression cylinder 408; 608; 808. Alternatively, the at least one counterpressure means 408; 608; 808 is embodied as a counterpressure belt. The transport path provided for sheets 02 preferably extends between the forme cylinder 402; 602; 802 and the counterpressure means 408; 608; 808, in particular impression cylinder 408; 608; 808. Forme cylinder 402; 602; 802, on one side, and counterpressure means 408; 608; 808 on the other together preferably form at least one coating position 409; 609; 809, which, in particular in the case of a priming unit 400, is embodied as a priming position 409, and/or in the case of a printing unit 600 is embodied as a print position 609 and/or in the case of a finish coating unit 800 is embodied as finish coating position 809. The axis of rotation of impression cylinder 408; 608; 808 preferably extends at least intermittently and more preferably perpetually parallel to the transverse direction A.

Coating unit 400; 600; 800 is configured, for example, as a coating unit 400; 600; 800 that applies a coating from above and/or is capable of applying a coating from above, or alternatively is configured, for example, as a coating unit 400; 600; 800 that applies a coating from below and/or is capable of applying a coating from below. The choice is preferably based upon the way in which other units of the processing machine 01 are configured and/or arranged and/or upon which side of the sheets 02 will be processed.

If coating unit 400; 600; 800 is configured both as a coating unit 400; 600; 800 that applies a coating from above and/or is capable of applying a coating from above and as a flexo coating unit 400; 600; 800, the counterpressure means 408; 608; 808 is preferably located below the application cylinder 402; 602; 802 and/or at least partially below the supply roller 403; 603; 803, and/or the application cylinder 402; 602; 802 is preferably located above the counterpressure means 408; 608; 808 and/or at least partially below the supply roller 403; 603; 803, and/or the supply roller 403; 603; 803 is preferably located at least partially above the application cylinder 402; 602; 802 and/or at least partially above the counterpressure means 408; 608; 808. If coating unit 400; 600; 800 is configured both as a coating unit 400; 600; 800 that applies a coating from below and/or is capable of applying a coating from below and as a flexo coating unit 400; 600; 800, the counterpressure means 408; 608; 808 is preferably located above the application cylinder 402; 602; 802 and/or at least partially above the supply roller 403; 603; 803, and/or the application cylinder 402; 602; 802 is preferably located below the counterpressure means 408; 608; 808 and/or at least partially above the supply roller 403; 603; 803, and/or the supply roller 403; 603; 803 is preferably located at least partially below the application cylinder 402; 602; 802 and/or at least partially below the counterpressure means 408; 608; 808.

Supply roller 403; 603; 803 is preferably arranged such that it can be thrown off of and/or moved up to the application cylinder 402; 602; 802. For this purpose, a corresponding first displacement mechanism, in particular a lifting mechanism, is preferably provided. During this movement, supply roller 403; 603; 803 is preferably moved while the rotational axis of the application cylinder 402; 602; 802 remains unchanged. Preferably, however, application cylinder 402; 602; 802 can also be thrown off of and/or moved up to counterpressure means 408; 608; 808, in particular impression cylinder 408; 608; 808, more preferably jointly with supply roller 403; 603; 803. For this purpose, a corresponding second displacement mechanism, in particular a lifting mechanism, is preferably provided, which more preferably is capable of moving an assembly that comprises both the application cylinder 402; 602; 802 and the supply roller 403; 603; 803, and more preferably also comprises the first displacement mechanism.

At least one diagonal register adjustment device is preferably provided, in particular as a component of the respective coating unit 400; 600; 800. The at least one diagonal register adjustment device comprises, for example, at least one and more preferably two rotary bearings, in particular radial bearings, which are preferably displaceable with respect to the transport direction T intended for sheets 02, and which serve to rotatably mount the application cylinder 402; 602; 802. If said at least one rotary bearing is moved with at least one component in or opposite the transport direction T, or if these two rotary bearings are moved at least with different components in or opposite the transport direction T, an inclined position of the rotational axis of the application cylinder 402; 602; 802 will result. This results in a more inclined transfer of coating medium onto the sheet or sheets 02 than before, and the angular position can preferably be selectively influenced. Alternatively or additionally, the at least one diagonal register adjustment device preferably has at least one positioning device located on the application cylinder 402; 602; 802, by means of which the position of the covering relative to the lateral surface of the application cylinder 402; 602; 802 is and/or can be fixed. For example, the at least one diagonal register adjustment device has at least one pivotable suspension rail for coverings, in which the at least one covering is and/or can be suspended, for example, by means of a suspension arm, in particular a leading suspension arm. The at least one diagonal register adjustment device can preferably be operated automatically.

The coating unit 400; 600; 800 preferably has at least one incoming transport means 411; 611; 811. The at least one incoming transport means 411; 611; 811 is preferably located upstream of a first coating position 409; 609; 809 of the respective coating unit 400; 600; 800 along the transport path provided for sheets 02 and/or with respect to the transport direction T. The at least one incoming transport means 411; 611; 811 serves, for example, to feed sheets 02 at least to the first coating position 409; 609; 809, in particular from an intake 412; 612; 812 into the coating unit 400; 600; 800. The at least one incoming transport means 411; 611; 811 thus serves, for example, to feed sheets 02 to the priming position 409, in particular from an intake 412 into the priming unit 400, and/or to feed sheets 02 to the print position 609, in particular from an intake 612 into the printing unit 600, and/or to feed sheets 02 to the finish coating position 809, in particular from an intake 812 into the finish coating unit 800. The at least one incoming transport means 411; 611; 811 is preferably embodied as a suction transport means 411; 611; 811, in particular as a suction belt 411; 611; 811 and/or as a suction box belt 411; 611; 811 and/or as a roller suction system 411; 611; 811. The description relating to suction transport means in the foregoing and in the following preferably applies accordingly.

The at least one incoming transport means 411; 611; 811 is configured, for example, as an upper suction transport means 411; 611; 811, the suction inlets or suction openings of which preferably point at least substantially downward and/or the suction effect of which is preferably directed at least substantially upward. Alternatively or additionally, the at least one incoming transport means 411; 611; 811 is configured as a lower suction transport means 411; 611; 811, the suction openings or suction openings of which preferably point at least substantially upward and/or the suction effect of which is preferably directed at least substantially downward. The choice is dependent, for example, upon upstream units and/or upon the mode of operation of the coating unit 400; 600; 800. Alternatively, coating unit 400; 600; 800 is configured, for example, without incoming transport means. In that case, a unit disposed stream of said coating unit is preferably configured such that sheets 02 can be transferred directly to the coating position 409; 609; 809. This is possible, for example, if the unit arranged upstream of said coating unit is configured as a transport system 700, in particular a transport unit 700 or a transport module 700.

Coating unit 400; 600; 800 preferably comprises at least one outgoing transport means 417; 617; 817. The at least one outgoing transport means 417; 617; 817 is preferably disposed downstream of the coating position 409; 609; 809 along the transport path provided for sheets 02 and/or with respect to the transport direction T. The at least one outgoing transport means 417; 617; 817 serves, for example, to convey sheets 02 away from the coating position 409; 609; 809, in particular to an outlet 413; 613; 813 of the coating unit 400; 600; 800 and/or after a processing of the respective sheet 02 in the coating unit 400; 600; 800. The at least one outgoing transport means 417; 617; 817 therefore serves, for example, to convey sheets 02 away from the priming position 409, in particular to an outlet 413 of the primer unit 400, and/or to convey sheets 02 away from the print position 609, in particular to an outlet 613 of the printing unit 600, and/or to convey sheets 02 away from the finish coating position 809, in particular to an outlet 812 of finish coating unit 800. The at least one outgoing transport means 417; 617; 817 is preferably embodied as a suction transport means 417; 617; 817, in particular as a suction belt 417; 617; 817 and/or as a suction box belt 417; 617; 817 and/or as a roller suction system 417; 617; 817. The description relating to suction transport means in the foregoing and in the following preferably applies accordingly.

The at least one outgoing transport means 417; 617; 817 is configured, for example, as an upper suction transport means 417; 617; 817, the suction inlets or suction openings of which preferably point at least substantially downward and/or the suction effect of which is preferably directed at least substantially upward. Alternatively or additionally, the at least one outgoing transport means 417; 617; 817 is configured as a lower suction transport means 417; 617; 817, the suction inlets or suction openings of which preferably point at least substantially upward and/or the suction effect of which is preferably directed at least substantially downward. The choice is dependent, for example, upon whether the coating unit 400; 600; 800 is configured as a coating unit 400; 600; 800 that applies a coating from above and/or is capable of applying a coating from above or as a coating unit 400; 600; 800 that applies a coating from below and/or is capable of applying a coating from below. A coating unit 400; 600; 800 that applies a coating from above and/or is capable of applying a coating from above preferably has an outgoing transport means 417; 617; 817 configured as a lower suction transport means 417; 617; 817, and/or a coating unit 400; 600; 800 that applies a coating from below and/or is capable of applying a coating from below preferably has an outgoing transport means 417; 617; 817 configured as an upper suction transport means 417; 617; 817. This preferably prevents a freshly applied coating from being damaged by the outgoing transport means 417; 617; 817. Alternatively, coating unit 400; 600; 800 is formed, for example, without outgoing transport means. In that case, a unit located downstream of said coating unit is preferably configured such that sheets 02 can be transferred directly from the coating position 409; 609; 809. This is possible, for example, if the unit located downstream of said coating unit is configured as a transport system 700 or transport means 700, in particular a transport unit 700 or a transport module 700.

Coating units 400; 600; 800 configured as flexo coating units 400; 600; 800 each have, for example, precisely one coating position 409; 609; 809. For application of a plurality of different coating media, an appropriate multiple number of flexo coating units 400; 600; 800, in particular flexo printing units 600, are preferably provided.

For example, each of the at least one coating units 400; 600; 800 configured as a flexo coating unit 400; 600; 800 has associated with it at least one, in particular integrated, drying system 500 or drying device 506 dedicated uniquely to it. Said drying system or device is aligned, for example, toward the at least one outgoing transport means 417; 617; 817 of said respective coating unit 400; 600; 800 configured as a flexo coating unit 400; 600; 800.

In the following, details regarding a coating unit 400; 600; 800 configured as a non-impact coating unit 400; 600; 800, in particular a non-impact coating module 400; 600; 800, i.e., for example, as a jet coating unit 400; 600; 800, in particular as an inkjet coating unit 400; 600; 800 and/or jet coating module 400; 600; 800, in particular as inkjet coating module 400; 600; 800, will be provided. Insofar as this does not result in contradictions, what has been described can be applied similarly to other embodiments of the coating unit 400; 600; 800, in particular to other non-impact printing units 600. The jet coating unit 400; 600; 800 preferably has at least one print head 416; 616; 816. The at least one print head 416; 616; 816 is configured, for example, as an inkjet print head 416; 616; 816.

The jet coating unit 400; 600; 800 will be described in the context of a jet printing unit 600, in particular an inkjet printing unit 600 and/or jet printing module 600, by way of example. However, the same applies similarly to a jet primer unit 400, in particular jet priming module 400, and/or a jet finish coating unit 800, in particular jet finish coating module 800.

The at least one jet coating unit 400; 600; 800, in particular inkjet printing unit 600, of processing machine 01 in turn preferably has at least one coating position 409; 609; 809, in particular print position 609. In this context, a coating position 409; 609; 809, in particular print position 609, including in the case of a non-impact coating unit 400; 600; 800, is preferably understood as an entire region in which contact between a respective coating medium, in particular ink, and a respective sheet 02 is or can be produced. The term coating position 409; 609; 809, in particular print position 609, is also used when the coating medium is applied to the sheet 02 without contact between sheet 02 and a component that transfers the coating medium, for example by freely moving coating medium, for example flying droplets of coating medium, striking the sheet 02. A coating position 409; 609; 809, in particular print position 609, preferably encompasses all the areas intended for the impact of a specific coating medium assigned in particular to that coating position 409; 609; 809, in particular print position 609, on the sheet 02. In the case of a printing unit 600 that operates by the inkjet printing method, for example, a print position 609 comprises all the areas that are intended for impact of a black ink, for example, on a first side of the sheet 02.

The at least one coating unit 400; 600; 800, in particular printing unit 600, preferably has a plurality of coating positions 409; 609; 809, in particular print positions 609, to each of which a respective coating medium is assigned, for example at least four coating positions 409; 609; 809, in particular print positions 609, preferably at least five coating positions 409; 609; 809, in particular print positions 609, more preferably at least six coating positions 409; 609; 809, in particular print positions 609, and even more preferably at least seven coating positions 409; 609; 809, in particular print positions 609.

Coating units 400; 600; 800 configured as non-impact coating units 400; 600; 800, in particular inkjet coating units 400; 600; 800, thus preferably each have at least a plurality of coating positions 409; 609; 809, in particular at least four, preferably at least five, more preferably at least six and even more preferably at least seven. Only one such coating unit 400; 600; 800 is then required for the application of multiple different coating media, for example. Alternatively, an appropriate plural number of non-impact coating units 400; 600; 800, in particular non-impact printing units 600, are provided.

Particularly in non-impact coating units 400; 600; 800, in particular in jet coating units 400; 600; 800 such as inkjet printing units 600, for example, water-based coating media and/or wax-based coating media and/or UV-curing coating media are used, for example. Any dryer units 500 that may be provided are preferably configured as adapted to the corresponding coating medium, and thus have energy sources in the form of infrared radiation sources and/or UV radiation sources and/or hot air sources and/or electron beam sources, for example.

Each coating position 409; 609; 809, in particular print position 609, preferably has at least one application position 418; 618; 818. Each application position 418; 618; 818 is preferably assigned to at least one image-producing device 416; 616; 816, in particular at least one print head 416; 616; 816 and more preferably at least one row of print heads. Each application position 418; 618; 818 preferably extends in the transverse direction A, more preferably over the entire working width of the processing machine 01. In the case of an inkjet printing machine 01, the at least one image producing device 416; 616; 816 is preferably configured as at least one print head 416; 616; 816, in particular one inkjet print head 416; 616; 816. The at least one coating unit 400; 600; 800 preferably has at least two print heads 416; 616; 816. For example, the at least one coating unit 400; 600; 800 is characterized in that the at least two print heads 416; 616; 816 are configured as print heads 416; 616; 816 formed for a non-impact printing process, and more preferably in that the at least two print heads 416; 616; 816 are configured as inkjet print heads 416; 616; 816. Image-producing devices 416; 616; 816 such as print heads 416; 616; 816 typically have limited dimensions, in particular in the transverse direction A. This results in a limited area of the sheet 02 onto which coating medium can be applied by a respective print head 416; 616; 816. A plurality of image-producing devices 416; 616; 816 or print heads 416; 616; 816 are therefore typically arranged one behind the other in the transverse direction A. Such print heads 416; 616; 816 arranged one behind the other in the transverse direction A are referred to as a print head row. Print head rows may be either discontinuous or continuous. In the exceptional case of a print head 416; 616; 816 extending over the entire working width, said print head should likewise be regarded as a print head row, in particular as a continuous print head row.

A plurality of application positions 418; 618; 818 are associated with at least one coating medium, for example, such that, for example, two continuous rows or two double rows of print heads 416; 616; 816 eject or are capable of ejecting the same coating medium. This is useful, for example, for increasing the resolution of a printed image and/or for increasing the speed of a coating process. This plurality of application positions 418; 618; 818 then together form the coating position 409; 609; 809, in particular the print position 609, associated with that coating medium. A resolution with respect to transverse direction A is preferably 1200 dpi (1200 dots per inch). The resolution with respect to transport direction T can be influenced by the number of print heads 416; 616; 816 arranged one behind the other and/or by the transport speed of the sheets 02.

A coating unit 400; 600; 800 comprises, for example, only one coating position 409; 609; 809, in particular print position 609, for the color black, for example. Preferably, however, the at least one coating unit 400; 600; 800 has a plurality of coating positions 409; 609; 809, in particular print positions 609, as described. Spatially, the coating positions 409; 609; 809, in particular print positions 609, may be immediately adjacent to one another or may be spaced apart from one another, for example separated by color. The term coating position 409; 609; 809, in particular print position 609, is also meant to include a section that contains a plurality of successive application positions 418; 618; 818 of the same color, e.g. without interruption by another color. However, if one or more application positions 418; 618; 818 of one color is/are separated by at least one or more application positions 418; 618; 818 of at least one other color along the transport path provided for sheets 02, then in this sense said application positions act as two different coating positions 409; 609; 809, in particular print positions 609. In the case of only one coating position 409; 609; 809, in particular print position 609, said position acts as both the first and the last coating position 409; 609; 809, in particular print position 609, of the relevant coating unit 400; 600; 800. In the case of an indirect inkjet printing process, for example, a coating position 409; 609; 809, in particular print position 609, is an area of contact between a transfer body and the respective sheet 02.

The jet coating unit 400; 600; 800 has at least one counterpressure means 408; 608; 808, for example, however said counterpressure means preferably does not serve to clamp the sheets 02, but only to hold them in position. At least one such counterpressure means 408; 608; 808 is configured, for example, as a counterpressure belt 408; 608; 808 and/or as a transport means 411; 417; 611; 617; 811; 817, in particular suction transport means 411; 417; 611; 617; 811; 817. With particular preference, the jet coating unit 400; 600; 800, as viewed in the direction of transport T, has only one transport means 411; 417; 611; 617; 811; 817, which is further preferably configured as suction transport means 411; 417; 611; 617; 811; 817 and which at the same time is configured to act as incoming transport means 411; 611; 811 and/or as counterpressure means 408; 608; 808 and/or as outgoing transport means 417; 617; 817.

If coating unit 400; 600; 800 is configured as jet coating unit 400; 600; 800, it is preferably likewise configured as a coating unit 400; 600; 800 that applies a coating from above and/or is capable of applying a coating from above, in particular due to the configurations of print heads 416; 616; 816 that are typically used. In that case, the print heads 416; 616; 816 are preferably located above the transport path provided for sheets 02 and/or above the counterpressure means 408; 608; 808 configured, for example, as transport means 411; 417; 611; 617; 811; 817. If suitable print heads 416; 616; 816 are used, however, the jet coating unit 400; 600; 800 may also be configured, in principle, as a coating unit 400; 600; 800 that applies a coating from below and/or is capable of applying a coating from below.

Preferably, sheet-fed printing press 01 is alternatively or additionally characterized in that at least one non-impact coating unit 400; 600, 800 or non-impact coating module 400; 600; 800 has at least two, more preferably at least three, and even more preferably at least four receiving units 421; 621; 821 arranged one behind the other along a transport path provided for sheets 02 and identical to one another structurally with respect to at least one coupling device 422; 622; 822, each receiving unit being configured to optionally accommodate one standard assembly 424; 504; 624; 824 configured as at least one print head assembly 424; 624; 824 or as at least one dryer assembly 504.

Preferred is a system comprising at least one sheet-fed printing press as described in the foregoing and/or in the following, and at least one standard assembly 424; 504; 624; 824 configured as a print head assembly 424; 624; 824 as described in the foregoing and/or in the following, and at least one standard assembly 424; 504; 624; 824 configured as a dryer assembly 504 as described in the foregoing and/or in the following.

At least one of the receiving units 421; 621; 821 is preferably occupied by at least one and more preferably by precisely one standard assembly 424; 504; 624; 824 configured as a print head assembly 424; 624; 824. Alternatively or additionally, preferably at least one of the receiving units 421; 621; 821, in particular at least one other of the receiving units, is occupied by at least one and more preferably by precisely one standard assembly 424; 504; 624; 824 configured as a dryer assembly 504. In that case, one dryer assembly 504 occupies the space of one receiving unit 421; 621; 821 or the space of multiple receiving units 421; 621; 821, for example. The sheet-fed printing press 01 is thus alternatively or additionally characterized, for example, in that at least two of the receiving units 421; 621; 821 are occupied by a drying device 506 that extends over at least a part of each of said at least two receiving units 421; 621; 821. Alternatively or additionally, at least one of the receiving units 421; 621; 821, in particular at least one other of the receiving units, is preferably unoccupied, i.e. free.

The standard assemblies 424; 504; 624; 824 can preferably be arranged alternatively to one another in the receiving units 421; 621; 821. In particular, either a print head assembly 424; 624; 824 or a dryer assembly 504 can preferably be arranged, freely selected, in each of the receiving units 421; 621; 821. Preferably, the sheet-fed printing press 01 is alternatively or additionally characterized in that the standard assemblies 424; 504; 624; 824 are all identical to one another structurally with respect to at least one geometric parameter. This at least one geometric parameter is, for example, the width of an available installation space and/or the arrangement of elements that serve to secure the respective standard assembly 424; 504; 624; 824.

Preferably, the sheet-fed printing press 01 is alternatively or additionally characterized in that each of the receiving units 421; 621; 821 is assigned at least one spatial area, which extends in particular continuously at least over a working width of the at least one non-impact coating unit 400; 600; 800 or non-impact coating module 400; 600; 800, in particular between lateral walls 428; 628; 828 of a frame 427; 627; 827 of the at least one non-impact coating unit 400; 600; 800 or non-impact coating module 400; 600; 800, and which is available or serves to accommodate a standard assembly 424; 504; 624; 824 configured as at least one print head assembly 424; 624; 824 or as at least one dryer assembly 504.

The respective receiving unit 421; 621; 821 consists, for example, of threaded bores in a standardized arrangement and embodiment in lateral walls 428; 628; 828 of a frame 427; 627; 827 of the at least one non-impact coating unit 400; 600; 800 or non-impact coating module 400; 600; 800, and the space held open therebetween for print heads 416; 616; 816 or dryer devices 506, for example. Preferably, the sheet-fed printing press 01 is alternatively or additionally characterized in that the at least one coupling device 422; 622; 822 has at least three, and more preferably at least four coupling seatings 423; 623; 823 assigned to the frame 427; 627; 827 of the at least one non-impact coating unit 400; 600; 800 or non-impact coating module 400; 600; 800, which coupling seatings are arranged in pairs that define standard relative spacing distances, and in that each of the provided standard assemblies 424; 504; 624; 824, in particular, has at least three and more preferably at least four coupling elements, which are arranged in pairs, in particular with respect to respective contact points, at the standard relative spacing distances from one another defined by the coupling seatings 423; 623; 823, and which are more preferably configured as respective counterparts to said coupling seatings 423; 623; 823. The coupling seatings 423; 623; 823 are configured, for example, as bores and/or recesses and/or bolts and/or screws and/or support surfaces and/or stops. The coupling seatings 423; 623; 823 are each arranged in pairs, defining relative standard spacings, for example, by respectively provided contact points.

Preferably, the sheet-fed printing press 01 is alternatively or additionally characterized in that the at least one standard assembly 424; 504; 624; 824 configured as a print head assembly 424; 624; 824 has at least one row of print heads 416; 616; 816 extending in the transverse direction A, in particular over the entire working width of the at least one non-impact coating unit 400; 600; 800 or non-impact coating module 400; 600; 800. Preferably, the sheet-fed printing press 01 is alternatively or additionally characterized in that the at least one standard assembly 424; 504; 624; 824 configured as a print head assembly 424; 624; 824 has at least two rows of print heads 416; 616; 816 extending in the transverse direction A, in particular over the entire working width of the at least one non-impact coating unit 400; 600, 800 or non-impact coating module 400; 600; 800, and in that zones of action of these at least two rows of print heads 416; 616; 816 are arranged one behind the other with respect to the transport path provided for sheets 02.

Preferably, the sheet-fed printing press 01 is alternatively or additionally characterized in that a total of at least four and more preferably precisely four rows of print heads 416; 616; 816 are arranged extending in the transverse direction A, and in that zones of action of these at least four rows of print heads 416; 616; 816 are arranged one behind the other with respect to the transport path provided for sheets 02. Preferably, the sheet-fed printing press 01 is alternatively or additionally characterized in that a total of at least eight, and more preferably precisely eight rows of print heads 416; 616; 816 are arranged extending in the transverse direction A and in that zones of action of these at least eight rows of print heads 416; 616; 816 are arranged one behind the other with respect to the transport path provided for sheets 02. Preferably, sheet-fed printing press 01 is alternatively or additionally characterized in that at least one of the non-impact coating modules 600 is configured as a printing module 600 and/or is configured as an inkjet coating module 600 and/or has at least one inkjet print head 416; 616; 816.

Assemblies 424; 624; 824 that are not configured as standard assemblies, but that comprise a plurality of print heads 416; 616; 816 that are arranged such that they are movable collectively and/or that together form a print head row or a double row of print heads 416; 616; 816 are also referred to as print head assemblies 424; 624; 824. Assemblies 504 that are not configured as standard assemblies, but that comprise energy output devices 501; 502; 503 or other elements that are arranged such that they are movable collectively and/or that together form a drying device 506 are also referred to as dryer assemblies 504.

Preferably, at least one print head 416; 616; 816 is and/or can be connected to at least one positioning device 426; 626; 826, in particular to at least one positioning device 426; 626; 826 for positioning the at least one print head 416; 616; 816 and/or at least one print head assembly 424; 624; 824. More preferably, the at least one print head 416; 616; 816 is permanently connected to the at least one positioning device 426; 626; 826 and can be separated from the at least one positioning device 426; 626; 826 only for purposes of assembly and/or disassembly and/or for replacement of the at least one print head 416; 616; 816.

Preferably, sheet-fed printing press 01 is alternatively or additionally characterized in that at least one standard assembly 424; 504; 624; 824 configured as a print head assembly 424; 624; 824 or one print head assembly 424;

624; 824 not configured as a standard assembly 424; 624; 824 has at least one positioning device 426; 626; 826, by means of which at least all of the print heads 416; 616; 816 of said respective print head assembly 424; 624; 824 are arranged such that they are movable, in particular collectively, relative to a frame 427; 627; 827 of the at least one non-impact coating unit 400; 600, 800 or non-impact coating module 400; 600; 800, more particularly are arranged such that they are movable at least with respect to a vertical direction V and/or by at least 0.5 cm, more preferably by at least 2 cm, and even more preferably by at least 10 cm. Preferably, all of the print heads 416; 616; 816 of a respective print head assembly 424; 624; 824 can be positioned by means of the positioning device 426; 626; 826 of said respective print head assembly 424; 624; 824 at least either in one respective assigned printing position or in at least one respective assigned idle position.

Preferably, the at least one print head 416; 616; 816 can be arranged, in particular by means of the at least one positioning device 426; 626; 826, in at least one idle position and more preferably in at least two different idle positions. The at least one idle position is embodied, for example, as at least one maintenance position and/or as at least one installation position. A maintenance position is preferably a position in which the at least one print head 416; 616; 816 can be maintained, for example, cleaned and/or aligned and/or stored in a state in which it is secured in particular against soiling and/or drying out, in particular without the at least one print head 416; 616; 816 from the sheet-fed printing press 01 and/or the respective non-impact coating unit 400; 600, 800 or non-impact coating module 400; 600; 800. An installation position is preferably a position in which the at least one print head 416; 616; 816 is removed from the sheet-fed printing press 01 and/or the respective non-impact coating unit 400; 600, 800 or non-impact coating module 400; 600; 800 and/or can be inserted into the sheet-fed printing press 01 and/or the respective non-impact coating unit 400; 600, 800 or non-impact coating module 400; 600; 800. In the installation position, in particular, more space is preferably available for a press operator to reach the at least one print head 416; 616; 816, while in the maintenance position preferably only enough space is available for a press operator to carry out internal, in particular automatic processes within the sheet-fed printing press 01, for example cleaning a nozzle surface of at least one print head 416; 616; 816.

The distance between a respective print head 416; 616; 816 and a respective conveyor belt 718; 726 is preferably shorter when the respective print head 416; 616; 816 is disposed in the respective printing position than when the respective print head 416; 616; 816 is disposed in the respective idle position, and more particularly is shorter when the respective print head 416; 616; 816 is disposed in the respective printing position than when the respective print head 416; 616; 816 is disposed in the respective maintenance position, and/or is shorter when the respective print head 416; 616; 816 is disposed in the respective printing position than when the respective print head 416; 616; 816 is disposed in the respective installation position, and/or is shorter when the respective print head 416; 616; 816 is disposed in the respective maintenance position than when the respective print head 416; 616; 816 is disposed in the respective installation position.

In one embodiment, the at least one positioning device 426; 626; 826 has at least one positioning guide and more preferably a plurality of positioning guides, and even more preferably one positioning guide per movable print head assembly 424; 624; 824 and/or per movable standard assembly 424; 504; 624; 824. Standard assemblies 504 configured as a dryer assembly 504 and/or a dryer assembly 504 not configured as a standard assembly 504, for example, likewise have a positioning device. In a preferred embodiment of the at least one positioning device 426; 626; 826, the at least one positioning device 426; 626; 826 has at least one linear positioning guide, preferably configured as a rail, and more preferably has a plurality of positioning guides, in particular four, preferably configured as rails, and even more preferably has at least one positioning guide, preferably configured as a rail, per movable print head assembly 424; 624; 824 and/or per movable dryer assembly 504 and/or per movable standard assembly 424; 504; 624; 824. More preferably, two positioning guides configured as rails are provided per movable print head assembly 424; 624; 824 and/or per movable dryer assembly 504 and/or per movable standard assembly 424; 504; 624; 824, in particular one rail at each end of the respective print head assembly 424; 624; 824 and/or dryer assembly 504 and/or standard assembly 424; 504; 624; 824 with respect to the transverse direction A. Preferably, and in particular if the at least one positioning guide is configured as at least one rail, the adjustment path of the respective print head assembly 424; 624; 824 and/or dryer assembly 504 and/or standard assembly 424; 504; 624; 824 is linear.

The respective positioning device 426; 626; 826 and/or the respective positioning guide is in contact, for example, with the respective lateral wall 428; 628; 828 of the frame 427; 627; 827 and/or with at least one respective coupling seating 423; 623; 823. Alternatively, at least one additional component is located between each positioning device 426; 626; 826 and/or positioning guide on one side and each side wall 428; 628; 828 and/or each coupling seating 423; 623; 823 on the other. This respective at least one other component then preferably belongs to the respective print head assembly 424; 624; 824 and/or dryer assembly 504 and/or standard assembly 424; 504; 624; 824. This respective at least one other component is configured as a frame, for example, and is in contact with the two lateral walls 428; 628; 828 of the frame 427; 627; 827 that are opposite one another with respect to the transverse direction A. A connection is thus preferably produced via this respective at least one other component between the two lateral walls 428; 628; 828 of the frame 427; 627; 827 that are opposite one another with respect to the transverse direction A, independently of the movable components of the respective print head assembly 424; 624; 824 and/or dryer assembly 504 and/or standard assembly 424; 504; 624; 824.

Independently of the arrangement of standard assemblies 423; 504; 624; 824, in particular, at least one cleaning device 419; 619; 819 preferably is and/or can be assigned to at least one nozzle of the at least one print head 416; 616; 816; 412. The at least one cleaning device 419; 619; 819 is preferably arranged movably along at least one deployment path between at least one parked position and at least one operational position, in particular by means of at least one transport device. With a plurality of cleaning devices 419; 619; 819, each cleaning device 419; 619; 819 is preferably assigned its own deployment path, its own parked position and its own operational position. The deployment path preferably extends substantially or fully orthogonally to the transverse direction A, and more preferably extends substantially or fully horizontally. An optional component of the respective deployment path of the at least one cleaning device 419; 619; 819 in the transverse direction A is preferably no more than 50%, more preferably no more than 20%, even more preferably no more than 10% and more preferably still no more than 2% of the width, measured in the transverse direction A, of the working area of the non-impact coating unit 400; 600; 800 or non-impact coating module 400; 600; 800 and/or is no more than 50%, more preferably no more than 20%, even more preferably no more than 10%, and more preferably still no more than 2% of the working width of the sheet-fed printing press 01, defined by the maximum sheet width that can be processed by the sheet-fed printing press 01.

The at least one positioning device 426; 626; 826 preferably has at least one positioning drive and more preferably has a plurality of positioning drives, and even more preferably has one positioning drive per movable print head assembly 424; 624; 824 and/or per movable dryer assembly 504 and/or per movable standard assembly 424; 504; 624; 824. For example, one positioning drive is assigned to each positioning guide. The at least one positioning drive is embodied, for example, as at least one electric motor and/or as at least one hydraulic cylinder and/or preferably as at least one pneumatic cylinder. Preferably, the at least one positioning drive is arranged such that it can move the at least one print head 416; 616; 816 alternatively into its printing position or its maintenance position or its installation position and more preferably can hold it there. Preferably, the at least one positioning drive is embodied as at least one electric motor, for example as at least one stepped motor and/or is connected to at least one threaded spindle.

In the at least one maintenance position, at least one cleaning device 419; 619; 819 preferably is and/or can be assigned to at least one nozzle of the at least one print head 416; 616; 816; 412, and further preferably, the at least one cleaning device 419; 619; 819 is and/or can be positioned at least partially opposite at least one nozzle of the at least one print head 416; 616; 816; 412 with respect to the ejection direction of said at least one nozzle.

The position of this respective at least one nozzle when print head 416; 616; 816 is in the at least one printing position preferably differs with respect to the transverse direction A from the position of this respective at least one nozzle when print head 416; 616; 816 is in the at least one maintenance position and/or installation position by no more than 50%, more preferably no more than 20%, even more preferably no more than 10%, and more preferably still no more than 2% of the width, measured in the transverse direction A, of a working zone of the respective print head assembly 424; 624; 824 and/or by no more than 50%, more preferably no more than 20%, even more preferably no more than 10%, and more preferably still no more than 2% of the working width of sheet-fed printing press 01 and/or of the respective non-impact coating unit 400; 600; 800 or non-impact coating module 400; 600; 800, defined by the maximum sheet width that can be processed by sheet-fed printing press 01 and/or by the respective non-impact coating unit 400; 600, 800 or non-impact coating module 400; 600; 800.

When the print head 416; 616; 816 is in the at least one maintenance position, at least one maintenance device 419; 619; 819 and/or cleaning device 419; 619; 819 preferably is and/or can be positioned between at least one nozzle of the at least one print head 416; 616; 816; 412 and the area of the transport path provided for sheets 02 that is closest to said at least one nozzle.

Preferably, the sheet-fed printing press is alternatively or additionally characterized in that the at least one non-impact coating unit 400; 600, 800 or non-impact coating module 400; 600; 800 has at least one maintenance device 419; 619; 819 and/or cleaning device 419; 619; 819 for print heads 416; 616; 816, which is arranged movably along a deployment path between a parked position and an operational position. The maintenance device 419; 619; 819 is configured, for example, as a cover and/or as a cleaning device 419; 619; 819.

The at least one cleaning device 419; 619; 819 preferably has an extension that is greater than 10 cm, more preferably greater than 15 cm, in each spatial direction. Preferably, the at least one cleaning device 419; 619; 819 has an extension in the transverse direction A that is at least as great as the working zone of the respective associated print head assembly 424; 624; 824 in the transverse direction A. Preferably, the at least one cleaning device 419; 619; 819 has an extension in the direction of transport of sheets 02 that is at least as great as the working zone of the respective associated print head assembly 424; 624; 824 in the direction of transport of sheets 02. In this way, all the nozzles of all the print heads 416; 616; 816 of the respective print head assembly 424; 624; 824 can preferably be cleaned in a single operation.

Preferably, each maintenance position of at least one print head 416; 616; 816 is assigned a unique operational position of at least one cleaning device 419; 619; 819. Preferably, the at least one cleaning device 419; 619; 819 is embodied as at least one protective cover 419; 619; 819, more preferably, an enclosed volume can be delimited by means of the together with the at least one print head 416; 616; 816; 412. Preferably, for a total of four print head assemblies 424; 624; 824 of one non-impact coating unit 400; 600, 800 or non-impact coating module 400; 600; 800, a total of four cleaning devices 419; 619; 819 are provided, each having at least one area that serves and/or can be used as a protective cover, which also serves as a cleaning area.

When the at least one print head 416; 616; 816 is disposed in the printing position, at least one nozzle of said at least one print head 416; 616; 816 is preferably located below the deployment path, along which the at least one cleaning device 419; 619; 819 is preferably arranged movably between the at least one parked position and the at least one operational position, preferably by means of the at least one transport device. When the at least one print head 416; 616; 816 is in the idle position, said at least one nozzle is preferably located above said deployment path.

For cleaning the at least one nozzle surface of the at least one print head 416; 616; 816, the at least one cleaning device 419; 619; 819 is provided. The at least one cleaning device 419; 619; 819 preferably has at least one non-impact coating unit 400; 600, 800 or cleaning module and preferably has at least one collecting device, in particular collecting trough. Preferably, the at least one cleaning module is arranged movably relative to the at least one collecting device. The at least one cleaning device 419; 619; 819 is preferably disposed movably as a whole relative to the at least one print head 416; 616; 816, in particular when the cleaning device 419; 619; 819 is located and remains in the maintenance position.

The section of the transport path provided for sheets 02, defined by the coating unit 400; 600; 800 or coating module 400; 600; 800, is preferably configured as substantially flat and more preferably as completely flat and is preferably configured as extending substantially and more preferably exclusively horizontally. This is preferably true for every embodiment of the coating unit 400; 600; 800, i.e. in particular even if it is embodied as a flexo coating unit 400; 600; 800 and/or as a non-impact coating unit 400; 600; 800.

The coating system 400; 600; 800 preferably configured as a unit 400; 600; 800 and/or as a module 400; 600; 800 is preferably alternatively or additionally characterized in that the section of the transport path provided for sheets 02, which is defined by the coating system 400; 600; 800, begins at an intake height of the coating system 400; 600; 800 and/or ends at an outlet height of the coating system 400; 600; 800. Preferably, coating system 400; 600; 800 is characterized in that this intake height of coating system 400; 600; 800 deviates no more than 5 cm, more preferably no more than 1 cm, and even more preferably no more than 2 mm from the first standard height, and/or in that the outlet height of coating system 400; 600; 800 deviates no more than 5 cm, more preferably no more than 1 cm, and even more preferably no more than 2 mm from the first standard height, and/or in that the intake height of the coating system 400; 600; 800 deviates no more than 5 cm, more preferably no more than 1 cm, and even more preferably no more than 2 mm from the outlet height of the coating system 400; 600; 800.

Regardless of whether the coating unit 400; 600; 800 is configured as a flexo coating unit 400; 600; 800 and/or a jet coating unit 400; 600; 800, coating unit 400; 600; 800 preferably has at least one drive M400; M401; M600; M601; M800; M801 or motor M400; M401; M600; M601; M800; M801 dedicated uniquely to it, preferably configured, in particular, as a position-controlled electric motor. In the case of a configuration as a flexo coating unit 400; 600; 800, the coating unit 400; 600; 800 preferably has at least one additional drive M401; M601; M801 or auxiliary drive M401; M601; M801, which is assigned at least to the application cylinder 402; 602; 802 or forme cylinder 402; 602; 802. The at least one auxiliary drive M401; M610; M801 preferably drives at least this application cylinder 402; 602; 802 or forme cylinder 402; 602; 802 independently of a main drive M400; M600; M800 of the coating unit 400; 600; 800 and/or is preferably capable of such independent driving. In that case, the main drive is M400; M600; M800 is preferably assigned at least to the counter-pressure means 408; 608; 808, and more preferably also to optionally provided incoming and/or outgoing transport means 411; 611; 811; 417; 617; 817, in particular independently of whether the coating unit 400; 600; 800 is embodied as flexo coating unit 400; 600; 800 or as non-impact coating unit 400; 600; 800 or as jet coating unit 400; 600; 800.

Regardless of whether the coating unit 400; 600; 800 is embodied as flexo coating unit 400; 600; 800 and/or non-impact coating unit 400; 600; 800 and/or jet coating unit 400; 600; 800, coating unit 400; 600; 800 preferably has at least one transfer means 03, which preferably serves to support and/or carry out the transport of the sheets 02 between the coating unit 400; 600; 800, in particular coating module 400; 600; 800 on the one side and at least one other unit 100; 200; 300; 500; 550; 700; 900; 1000 and/or at least one other module 100; 200; 300; 500; 550; 700; 900; 1000 on the other side. For example, the at least one transfer means 03 is configured as a forward transfer means 03 and/or is located upstream of the coating position 409; 609; 809 and/or upstream of the at least one incoming transport means 411; 611; 811 with respect to the transport direction T and/or with respect to the transport path provided for sheets 02. Alternatively or additionally, the at least one transfer means is configured as a rear transfer means and/or is located downstream of the coating position 409; 609; 809 and/or downstream of the at least one outgoing transport means 417; 617; 817 with respect to the transport direction T and/or with respect to the transport path provided for sheets 02.

For example, the coating unit 400; 600; 800 has at least one pressure roller or pressure cylinder, by means of which a force can be applied to sheets 02, pressing them against the at least one transport means 411; 611; 811; 417; 617; 817. The sheets 02 can thereby be held precisely in position, in particular during a transfer between units 100; 200; 300; 400; 500; 550; 600; 700; 800; 900; 1000.

Preferably, downstream of at least one coating system 400; 600; 800 and more preferably immediately following at least one coating unit 400; 600; 800, at least one drying system 500 and/or drying device 506 is provided. The at least one drying system 500 and/or drying device 506 preferably serves to fix coating medium on sheets 02. Depending upon the coating medium, different drying methods are preferred. Drying system 500 and/or drying device 506 preferably has at least one energy output device 501; 502; 503. For example, at least one energy output device 501 configured as an infrared radiation source 501 is provided. Alternatively or additionally, at least one energy output device 502 configured as a hot air source 502 is provided. Alternatively or additionally, at least one energy output device 503 configured as a UV radiation source 503 is provided. Alternatively or additionally, at least one energy output device configured as an electron beam source is provided. At least one region is at least also provided, for example, in which exposure zones of different energy output devices 501; 502; 503 overlap. Alternatively or additionally, at least one region is provided, with each such region lying in the exposure zone of only one type of energy output device 501; 502; 503. Preferably, at least one air supply line and/or at least one air discharge line is provided, connected in particular to the at least energy output device 501; 502; 503 and/or as a component of the at least one drying system 500 and/or drying device 506. In this way, water vapor and/or solvent and/or saturated air can be led away and/or optionally treated.

The at least one drying system 500 has at least one frame 508, for example. The at least one drying system 500 has at least one transport means 511, for example, which is further preferably configured as a suction transport means 511.

The description relating to suction transport means in the foregoing and in the following preferably applies accordingly. Drying system 500 preferably has at least one drive M500 or motor M500, in particular electric motor M500 or position-controlled electric motor M500, dedicated uniquely to it, which is further preferably positioned such that it drives and/or is capable of driving the at least one transport means 511. Drying system 500 preferably has at least one transfer means 03 for sheets 02. The section of the transport path provided for sheets 02 that is defined by drying system 500 is preferably substantially flat and more preferably completely flat and is preferably configured extending substantially horizontally and more preferably exclusively horizontally. Alternatively or in addition to at least one separate drying system 500, for example, at least one coating unit 400; 600; 800 or a plurality of coating units 400; 600; 800 or each coating unit 400; 600; 800 each has at least one dedicated, in particular integrated drying system 500 or drying device 506 assigned to it. Such an assignment is understood, in particular, to mean that the drying system 500 or drying device 506 of the respective coating unit 400; 600; 800 is disposed upstream of any application position 418; 618; 818 of each coating unit 400; 600; 800 downstream of said respective coating unit 400; 600; 800 with respect to the transport path provided for sheets 02.

For example, sheet-fed printing press 01 is characterized in that at least one post-drying system 507 is provided, which has at least one air outlet opening arranged at least partially aligned with the transport path provided for sheets 02. The at least one post-drying system 507 preferably serves to reuse heat contained in air that has previously been used for drying sheets. In this process, for example, air that has been transported away from sheets 02 is conducted back toward sheets 02 and/or delivers its heat by means of a heat exchanger to air that is in turn conducted toward sheets 02. Preferably, the at least one post-drying system 507 is characterized in that, for the purpose of energy transmission and/or gas transmission by means of at least one gas line and/or at least one heat exchanger, at least one air supply line of said at least one post-drying system 507 is connected to at least one air discharge line of at least one drying system 500 or drying device 506 located upstream with respect to the transport direction T.

Preferably, the sheet-fed printing press 01 is alternatively or additionally characterized in that, along the transport path provided for sheets 02, upstream of the at least one non-impact coating module 600; 800 preferably configured as a printing module 600, at least one priming module 400 of the sheet-fed printing press 01 is located. The at least one priming module 400 is configured, for example, as a flexo coating module 400 or preferably as a non-impact coating module 400.

Preferably, the sheet-fed printing press 01 is alternatively or additionally characterized in that along the transport path provided for sheets 02, in particular downstream of an application position 418 of the at least one priming module 400 and/or downstream of the at least one priming module 400 and/or upstream of at least one application position 618 of the at least one non-impact coating module 600 and/or upstream of the at least one non-impact coating module 600 and/or upstream of each non-impact coating module 600 configured as a printing module 600, at least one drying device 506 is provided, in particular aligned toward the transport path provided for sheets 02. This at least one drying device 506 is, for example, a component of a drying module 500 which is different from and preferably independent of the at least one non-impact coating module 400; 600; 800 and the priming module 400. Alternatively, this at least one drying device 506 is disposed integrated, for example, into the at least one priming module 400.

For example, in a preferred embodiment of the sheet-fed printing press 01, at least one drying device 506 is integrated into the at least one priming module 400 and at least one drying system 500 and/or drying device 506 and/or energy output device 501; 502; 504 located downstream of the priming module 400 with respect to the transport path provided for sheets 02 is arranged aligned toward the transport path provided for sheets 02 only downstream of at least one application position 618 of the at least one non-impact printing unit 600, preferably configured as a non-impact printing module 600, with respect to the provided transport path. For example, the at least one non-impact printing unit 600 configured as a non-impact printing module 600 has at least one drying device 506 and/or at least one energy output device 501; 502; 504, which is arranged aligned toward the provided transport path downstream of at least one application position 618 of said at least one non-impact printing unit 600 preferably configured as non-impact printing module 600 and upstream of at least one other application position 618 of said at least one non-impact printing unit 600 preferably configured as a non-impact printing module 600, with respect to the transport path provided for sheets 02. Thus, an intermediate drying of one or more inks of one or more colors is possible prior to the application of at least one additional ink, in particular of a different color.

Figure 18A:
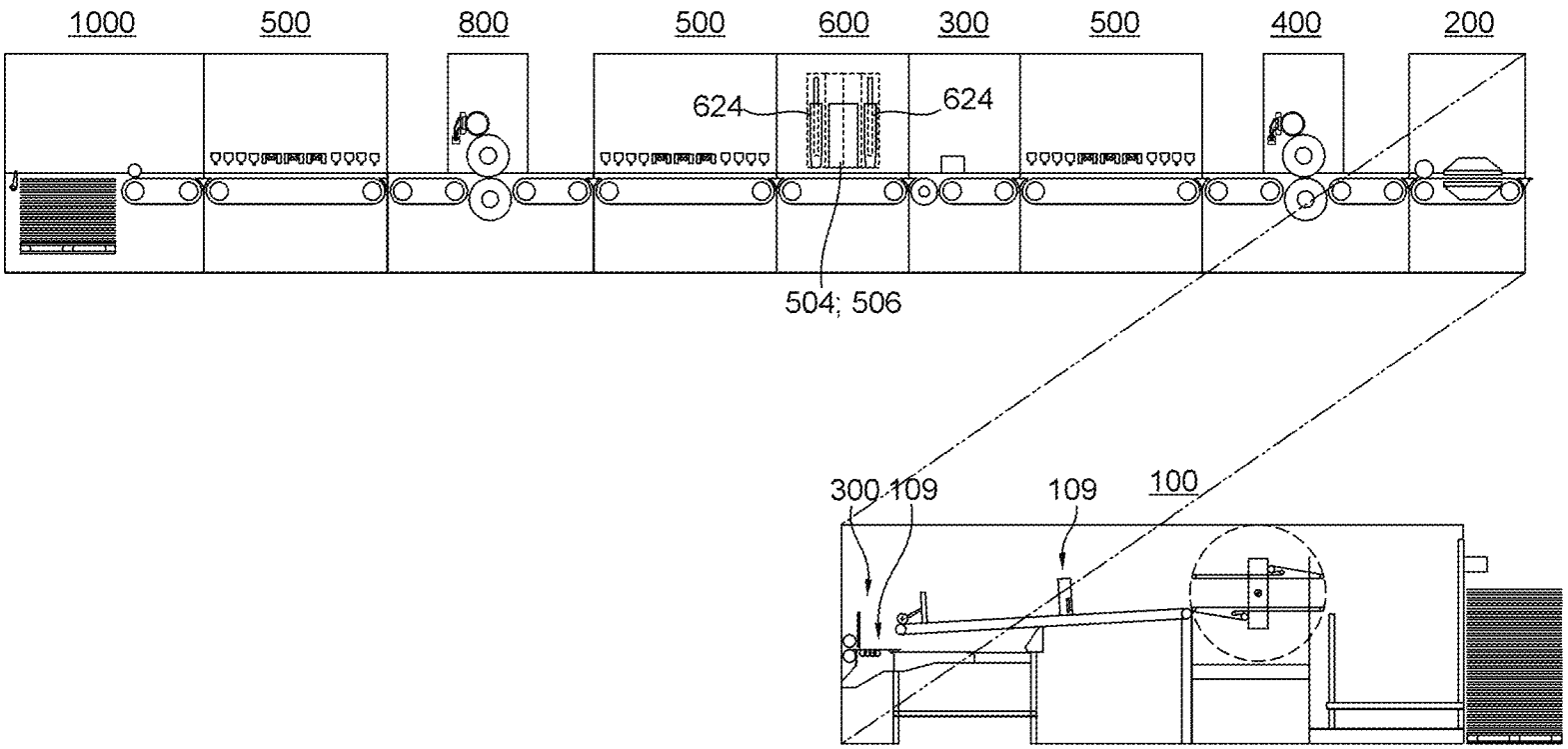
FIG. 18*a* shows a schematic diagram of an exemplary processing machine having one printing module with a dryer assembly between print head assemblies.
Figure 18B:
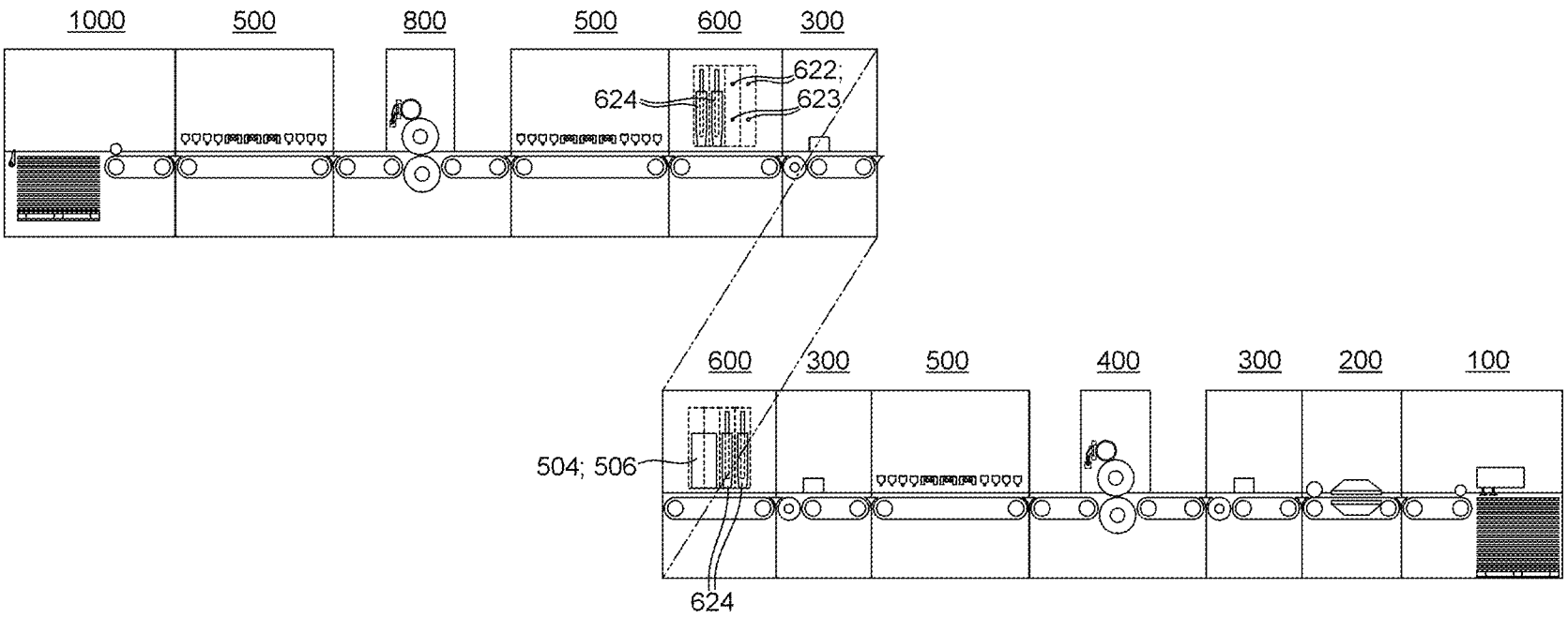
FIG. 18*b* shows a schematic diagram of an exemplary processing machine having two printing modules, in which print head assemblies and a dryer assembly are arranged in the first printing module and only print head assemblies are arranged in the second printing module.
Figure 18C:
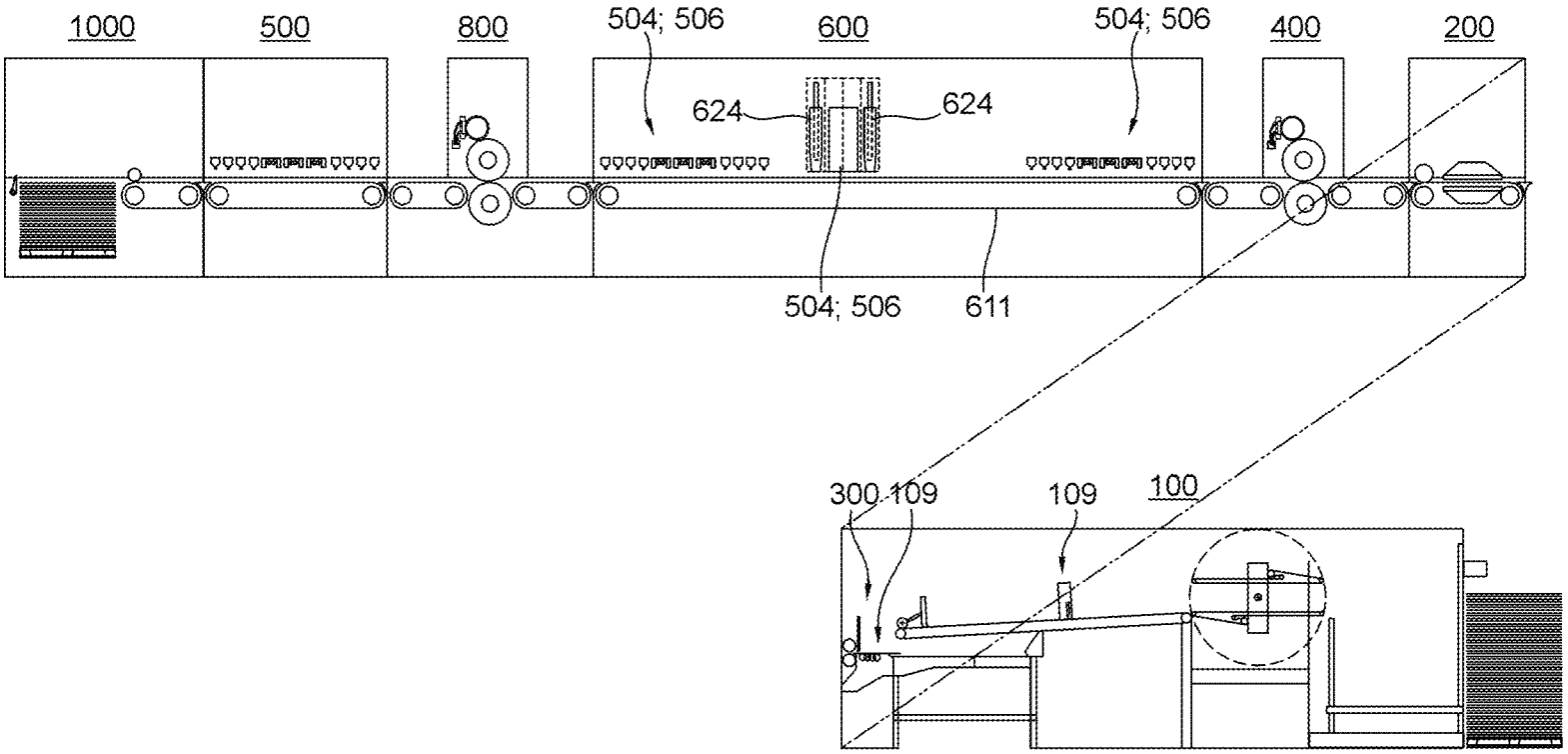
FIG. 18*c* shows a schematic diagram of an exemplary processing machine having one printing module, which comprises a dryer assembly between print head assemblies and a drying device upstream of each application position of the printing module and a continuous transport means of the printing module.
Figure 18D:
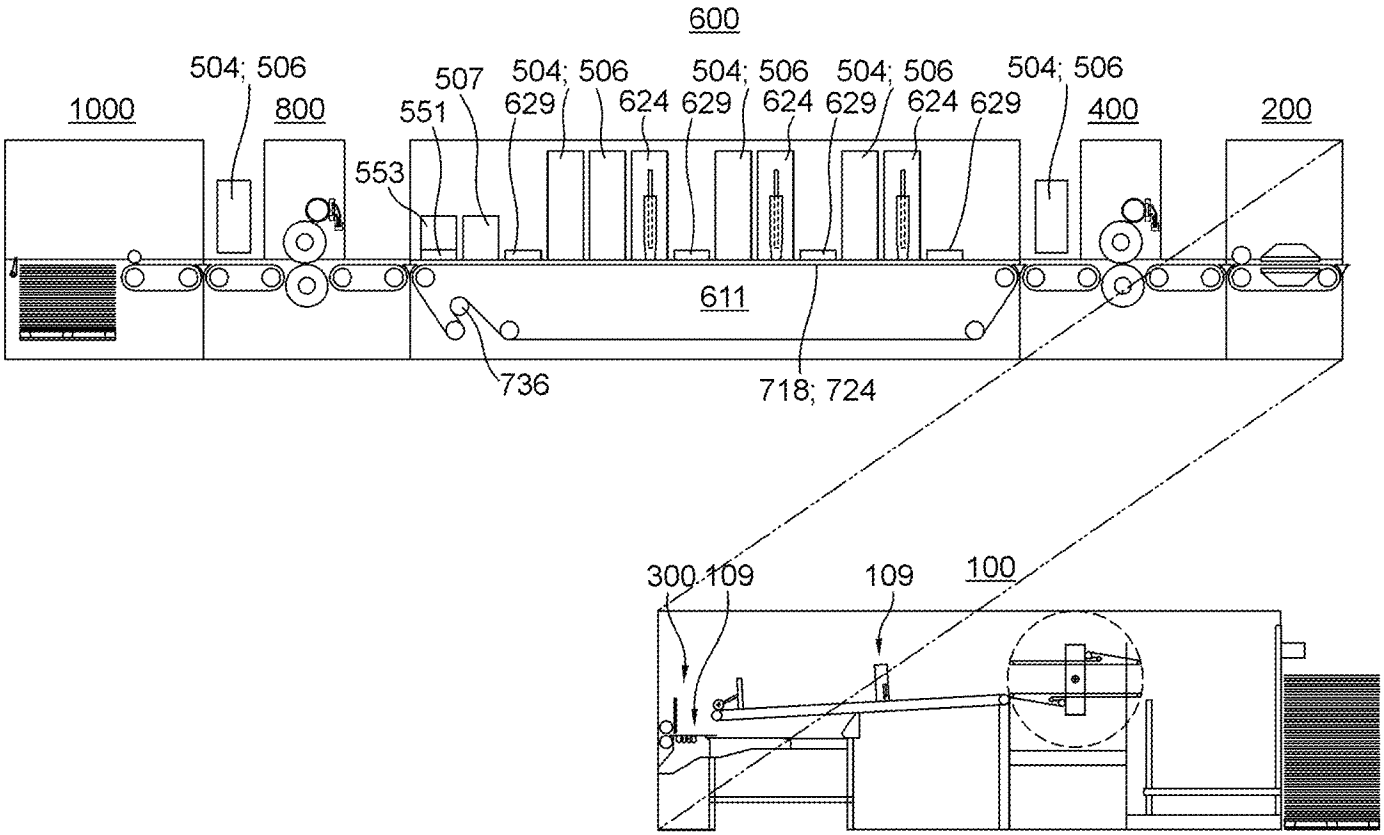
FIG. 18*d* shows a schematic diagram of an exemplary processing machine having a transport means, toward which print heads and drying devices are directed.
Figure 19A:
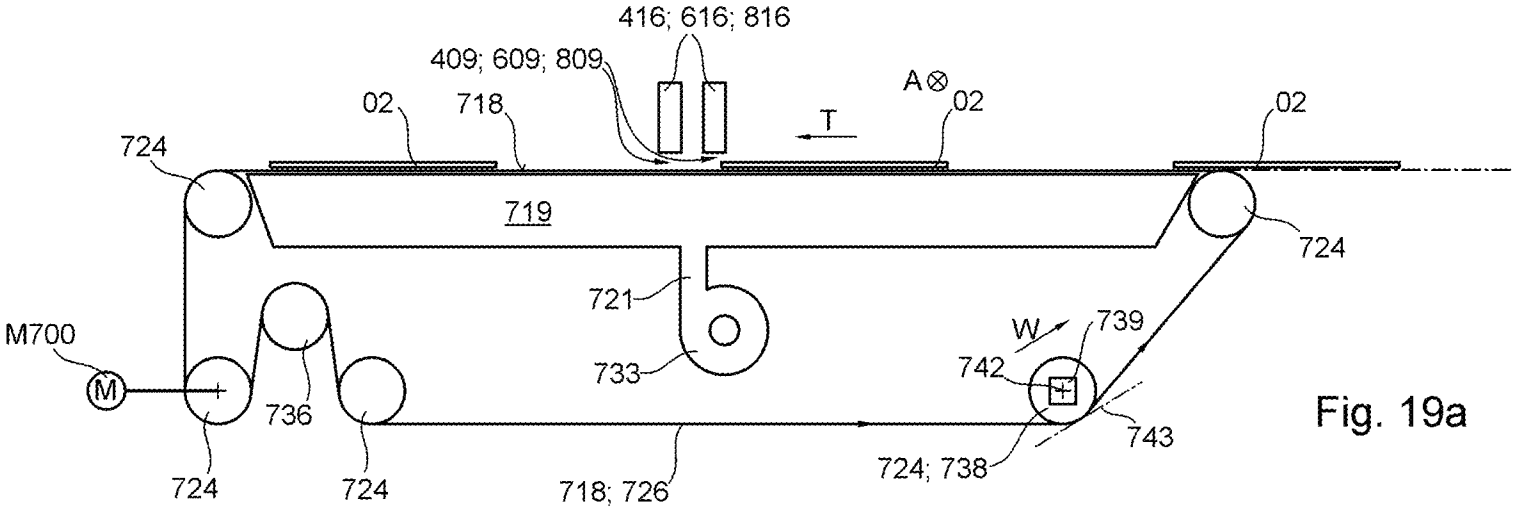
FIG. 19*a* shows a schematic diagram of a suction transport means configured as a suction belt and having a vacuum pressure chamber in the transport direction.
Figure 19B:
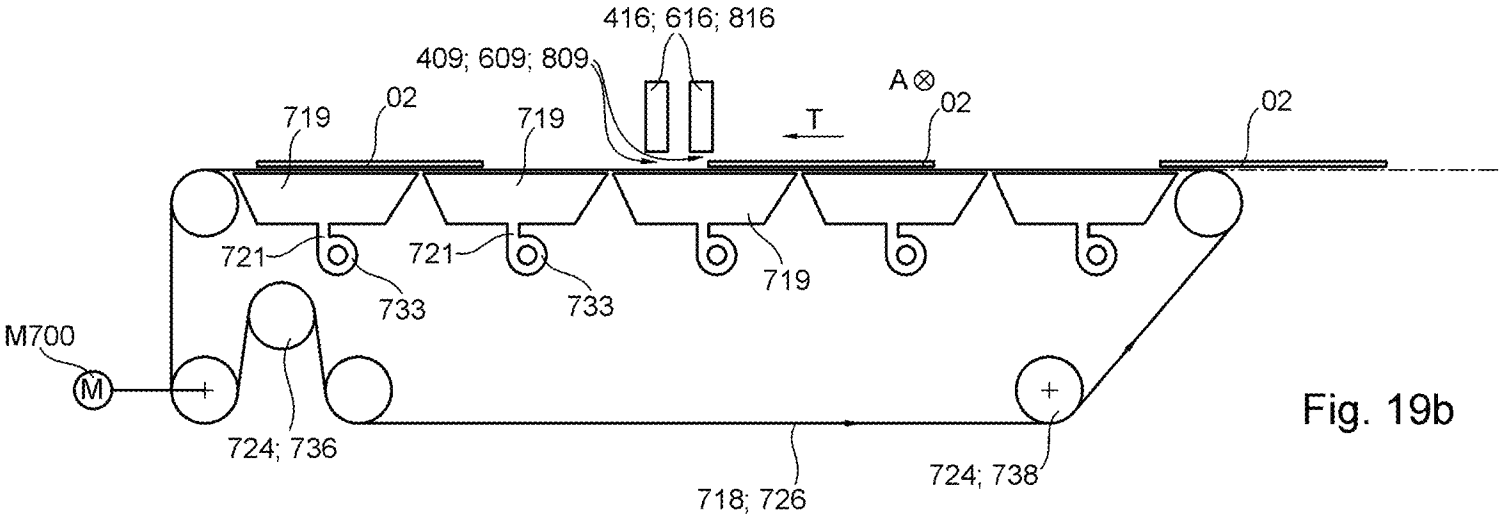
FIG. 19*b* shows a schematic diagram of a suction transport means configured as a suction belt and having a plurality of vacuum pressure chambers arranged one behind the other in the direction of transport, and having a plurality of vacuum pressure sources.
Figure 19C:
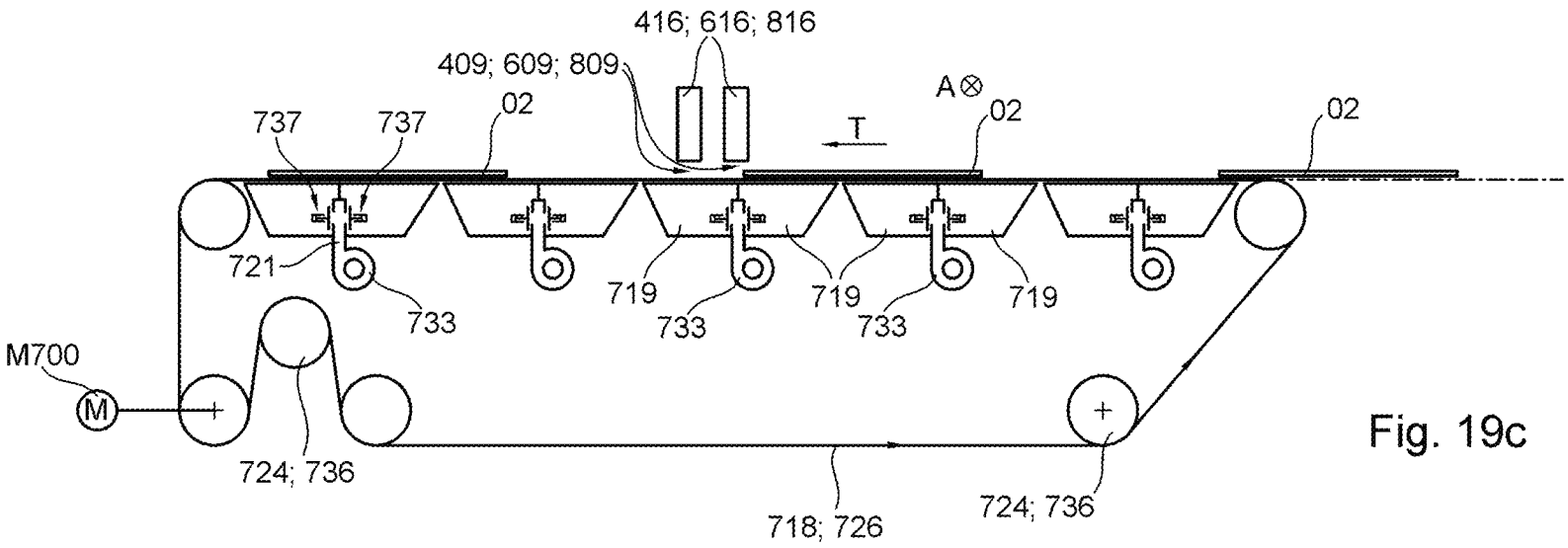
FIG. 19*c* shows a schematic diagram of a suction transport means configured as a suction belt and having a plurality of vacuum pressure chambers arranged one behind the other in the direction of transport, and having a plurality of vacuum pressure sources and valves.
Figure 20:
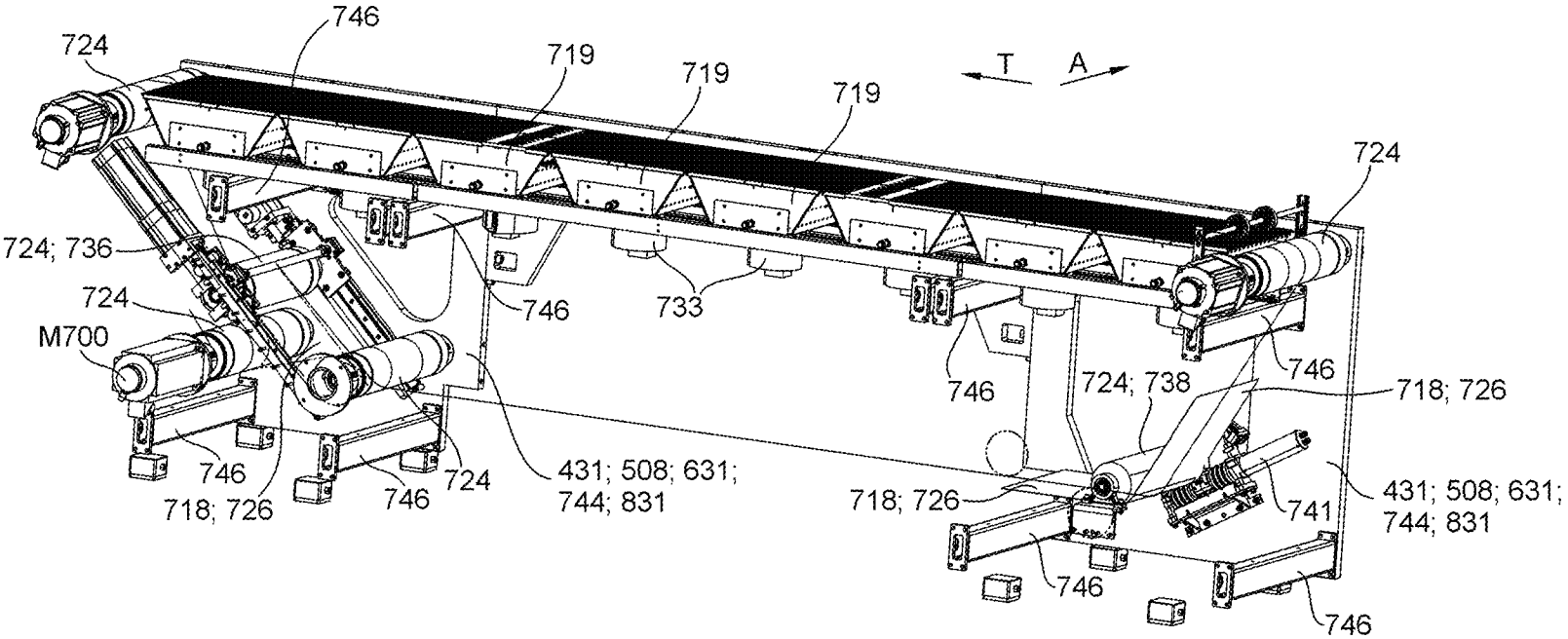
FIG. 20 shows a schematic diagram of a conveyor belt having belt alignment means and tensioning means.

For example, the at least one printing module 600 then preferably has at least one transport means 611, which is further preferably configured as a suction transport means 611 and/or suction belt 611 and/or suction box belt 611 and/or roller suction system 611. This at least one transport means 611 then preferably extends through along the transport path provided for sheets 02, beneath the at least one first application position 618 of printing module 600 and beneath at least one drying system 506 of the printing module 600, located downstream of said at least one application position 618, and more preferably extends through beneath each additional application position 618 of printing module 600, in particular located downstream, and more preferably beneath each additional drying device 506 and/or energy output device 501; 502; 504 of printing module 600, in particular located downstream, regardless of whether said drying device 506 and/or energy output device 501; 502; 504 of printing module 600 is located between application positions 618 of printing module 600 or downstream of the last application position 618 of printing module 600. Preferably, exactly one such described transport means 611 is located along the transport path and, with respect to the transverse direction A, a plurality of such transport means 611 are arranged side by side or more preferably likewise exactly one such transport means 611 is/are provided. This respective transport means 611 thus preferably extends beneath all the application positions 618 of printing module 600 and beneath all drying devices 506 of printing module 600 that are located between application positions 618 of printing module 600 and more preferably beneath all drying devices 506 of printing module 600 that are located downstream of all the application positions 618 of printing module 600. (Such a printing module is shown in FIG. 18*d*, by way of example.) Preferably, sheet-fed printing press 01 is alternatively or additionally characterized in that a printing module 600 is provided, and said printing module 600 has a continuous transport means 611, in particular suction transport means 611 and/or suction belt 611 and/or suction box belt 611 and/or roller suction system 611, along the transport path provided for sheets 02, toward which transport means at least four rows of print heads 616 extending in the transverse direction A are arranged aligned one behind the other along the transport path provided for sheets 02 and toward which at least one drying device 506 and/or at least one energy output device 501; 502; 504 is aligned, downstream of said print heads, along the transport path provided for sheets 02. In addition, between the at least four rows of print heads 616 extending in the transverse direction A, at least one additional drying device 506 and/or at least one energy output device 501; 502; 504 is preferably located, aligned toward said continuous transport means 611.

Alternatively or additionally, the at least one non-impact coating unit 600 and/or non-impact printing unit 600 and/or the sheet-fed printing press 01 is preferably characterized in that the conveyor belt 718; 726 of the at least one suction belt 611 of the non-impact coating system 600 has a width, measured in the transverse direction A, of at least 30 cm, preferably at least 50 cm, even more preferably at least 100 cm and more preferably still at least 150 cm. This enables sheets 02 of corresponding width to be transported precisely and enables a wide working width of the sheet-fed printing press 01 to be achieved.

Alternatively or additionally, the at least one non-impact coating unit 600 and/or non-impact printing unit 600 and/or the sheet-fed printing press 01 is preferably characterized in that the non-impact coating module 600 has at least one and preferably precisely one transport means 611 configured as a suction belt 611, and in that the at least one non-impact coating module 600 has at least one platform 629 for at least one press operator, which is and/or can be located, at least intermittently, vertically above the suction belt 611 and in particular above the conveyor belt 718; 726 of the suction belt 611. This at least one platform 629 is rigidly or pivotably disposed, for example. This at least one platform 629 enables the print heads 416; 616; 816, for example, to be accessed conveniently, even with wide working widths and/or large dimensions of the non-impact coating unit 600.

Alternatively or additionally, the at least one non-impact coating unit 600 and/or non-impact printing unit 600 and/or the sheet-fed printing press 01 is preferably characterized in that the non-impact coating module 600 has at least one and preferably precisely one transport means 611 configured as a suction belt 611, and/or in that at least one tensioning means 736 is provided for adjusting and/or maintaining a mechanical tension, in particular, of the conveyor belt 718; 726, in particular of the suction belt 611, said tensioning means being disposed, in particular, in contact with said conveyor belt 718; 726. As such a tensioning means 736, for example, at least one deflecting roller 736 is provided, the axis of rotation of which is displaceably disposed. This enables the corresponding operating conditions to be adjusted precisely during operation and/or when replacing the conveyor belt 718; 726.

Alternatively or additionally, the at least one non-impact coating unit 600 and/or non-impact printing unit 600 and/or the sheet-fed printing press 01 is preferably characterized in that at least one post-drying system 507 is provided, which has at least one air outlet opening which is arranged aligned, at least partially, toward the at least one and preferably precisely one transport means 611, embodied as suction belt 611, of the non-impact printing module 600. More preferably, at least one air supply line of said at least one after-drying system 507 is connected to at least one air discharge line for the purpose of energy transmission and/or gas transmission by means of at least one gas line and/or at least one heat exchanger, said air discharge line preferably being an air discharge line of at least one drying system 500 or drying device 506 located upstream with respect to the transport path provided for sheets 02 and/or with respect to the transport direction T of the suction belt 611. The at least one air outlet opening arranged aligned at least partially toward the at least one and preferably precisely one transport means 611, embodied as suction belt 611, of the non-impact printing module 600 is preferably arranged aligned toward a region of the transport means 611, embodied as suction belt 611, of the non-impact printing module 600, said region being located downstream of an exposure zone of at least one other dryer device 506 of said non-impact printing module 600 and/or being located downstream of at least one and more preferably downstream of each application position 618 of the non-impact printing module 600.

Alternatively or additionally, in a further possible embodiment, the at least one non-impact coating unit 400; 600; 800 or non-impact printing module 600, preferably embodied as non-impact coating unit 400; 600; 800 or non-impact printing unit 600, has at least one drying device 506 and/or at least one energy output device 501; 502; 504, which is located upstream of each application position 418; 618; 818 of said respective at least one non-impact coating unit 400; 600; 800 or non-impact printing unit 600, preferably embodied as non-impact coating module 400; 600; 800 or non-impact printing module 600, with respect to the transport path provided for sheets 02, and is aligned toward the provided transport path. For example, the at least one non-impact printing unit 600 embodied as non-impact printing module 600 has at least one drying device 506 and/or at least one energy output device 501; 502; 504, which is located upstream, with respect to the transport path provided for sheets 02, of each application position 618 of said at least one non-impact printing unit 600, preferably embodied as non-impact printing module 600, and aligned toward the provided transport path. By means of this drying device 506 and/or at least one energy output device 501; 502; 504, coating medium applied by the preferably provided priming module 400 can then be dried, in particular before ink is applied by means of the printing module 600. For example, the at least one printing module 600 then preferably has at least one transport means 611, which is further preferably embodied as a suction transport means 611 and/or suction belt 611 and/or suction box belt 611 and/or roller suction system 611. This at least one transport means 611 then preferably extends through along the transport path provided for sheets 02 beneath the at least one drying device 506 and/or energy output device 501; 502; 504 located upstream of each application position 618 of the printing module 600 and beneath at least one and preferably each application position 618 of the printing module 600, and more preferably beneath each additional drying device 506 and/or energy output device 501; 502; 504 of the printing module 600, regardless of whether said drying device 506 and/or energy output device 501; 502; 504 of the printing module 600 is located between application positions 618 of printing module 600 or downstream of a last application position 618 of the printing module 600. Preferably, exactly one such described transport means 611 is located along the transport path and, with respect to the transverse direction A, a plurality of such transport means 611 are arranged side by side or likewise exactly one such transport means 611 is/are provided. This respective transport means 611 thus preferably extends beneath a drying device 506 that follows priming unit 400 and beneath all application positions 618 of printing module 600 and beneath all drying devices 506 of printing module 600 that are located between application positions 618 of printing module 600 and more preferably beneath all drying devices 506 of printing module 600 that are located downstream of all the application positions 618 of printing module 600. (Such a printing module is shown in FIG. 18*c*, by way of example.) Preferably, the sheet-fed printing press 01 is alternatively or additionally characterized in that a printing module 600 is provided, and said printing module 600 comprises, along the transport path provided for sheets 02, a continuous transport means 611, in particular suction transport means 611 and/or suction belt 611 and/or suction box belt 611 and/or roller suction system 611, toward which, along the transport path provided for sheets 02, at least one drying device 506 and/or at least one energy output device 501; 502; 504 is arranged aligned, upstream of each application position 618 of the printing module, and toward which, downstream thereof, at least four rows of print heads 616 extending in the transverse direction A are arranged one behind the other along the transport path provided for sheets 02, and toward which, downstream thereof, at least one additional drying device 506 and/or at least one energy output device 501; 502; 504 is arranged aligned, along the transport path provided for sheets 02. In addition, between the at least four rows of print heads 616 extending in the transverse direction A, at least one additional drying device 506 and/or at least one energy output device 501; 502; 504 is located, aligned toward this continuous transport means.

Preferably, the sheet-fed printing press 01 is alternatively or additionally characterized in that, along the transport path provided for sheets 02, downstream of the at least one non-impact coating module 400; 600, at least one finish coating module 800 of the sheet-fed printing press 01 is provided. The at least one finish coating module 800 is configured, for example, as a flexo coating module 800 or preferably as a non-impact coating module 800. Preferably, the sheet-fed printing press 01 is characterized alternatively or additionally in that at least one drying device 506 is located downstream of an application position 618 of the at least one non-impact coating module 600 embodied as non-impact printing module 600 and upstream of the at least one finish coating module 800, along the transport path provided for sheets 02, in particular aligned toward the transport path provided for sheets 02. This at least one drying device 506 is, for example, a component of a drying module 500 that is different from the at least one non-impact printing module 600 and the at least one finish coating module 800, in particular an autonomous drying module. Alternatively, this at least one drying device 506 is arranged integrated, for example, into the at least one non-impact printing module 600.

Preferably, the sheet-fed printing press 01 is alternatively or additionally characterized in that at least one drying device 506 is located downstream of an application position 818 of the at least one finish coating module 800 along the transport path provided for sheets 02, in particular aligned toward the transport path provided for sheets 02. This at least one drying device 506 is, for example, a component of a drying module 500 that is different from the at least one finish coating module 800, and in particular is autonomous. Alternatively, this at least one drying device 506 is arranged integrated, for example, into the at least one finish coating module 800.

At least one system for intermediate drying is preferably provided for multicolor printing. Preferably, the sheet-fed printing press 01 is alternatively or additionally characterized in that at least one first application position 618 provided for colored coating medium of at least one non-impact coating module 400; 600; 800 is located along the transport path provided for sheets 02, followed by an exposure zone of at least one drying device 506 assigned to the first application position 618, followed by at least one additional application position 618 provided for colored coating medium of at least one non-impact coating module 400; 600; 800, followed by an exposure zone of at least one additional drying device 506 assigned to the additional application position 618. In that case, the colored coating medium, which is assigned to the first application position 618, preferably has a different color from the colored coating medium that is assigned to the additional application position 618.

Preferably, sheet-fed printing press 01 is alternatively or additionally characterized in that this first application position 618 is associated with a first non-impact coating module 600 configured as the first printing module 600 and in that this additional application position 618 is associated with the same first non-impact coating module 600 configured as the first printing module 600. Preferably, sheet-fed printing press 01 is alternatively or additionally characterized in that the drying device 506 assigned to the first application position 618 occupies a receiving unit 421; 621; 821 of the first printing module 600. Preferably, sheet-fed printing press 01 is alternatively or additionally characterized in that the drying device 506 assigned to the additional application position 618 occupies a receiving unit 421; 621; 821 of the first printing module 600. In another embodiment, sheet-fed printing press 01 is alternatively or additionally characterized in that the drying device 506 assigned to the first application position 618 is a component of a drying module 500, which is different from the first printing module 600.

Sheet-fed printing press 01 is alternatively or additionally characterized, for example, in that the first application position 618 is associated with a first non-impact coating module 600 configured as the first printing module 600, and in that the additional application position 618 is associated with an additional non-impact coating module 600, which is configured as an additional printing module and is different from the first printing module 600.

Preferably, sheet-fed printing press 01 is alternatively or additionally characterized in that the drying device 506 associated with the additional application position 618 occupies a receiving unit 421; 621; 821 of an additional printing module 600 that is different from the first printing module 600. Alternatively, the sheet-fed printing press 01 is characterized in that the drying device 506 associated with the additional application position 618 is a component of a drying module 500 that is different from the additional printing module 600.

Preferably, the sheet-fed printing press 01 is alternatively or additionally characterized in that, along the transport path provided for sheets 02, first an application position 618 for coating medium of the color cyan is provided, followed downstream by an application position 618 for coating medium of the color magenta, followed downstream by an application position 618 for coating medium of the color black, followed downstream by an application position 618 for coating medium of the color yellow.

Preferably, the sheet-fed printing press 01 is alternatively or additionally characterized in that, along the transport path provided for sheets 02, at least one inspection system 551 is provided downstream of an application position 618 of the at least one printing module 600 and/or upstream of an application position 818 of the at least one finish coating module 800.

The at least one drying system 500 and/or drying device 506 is configured, for example, as a drying system 500 and/or drying device 506 that acts and/or is capable of acting from above. The at least one drying system 500 and/or drying device 506 is additionally or alternatively configured, for example, as a drying system 500 and/or drying device 506 that acts and/or is capable of acting from below. The choice is preferably based upon the way in which other units 100; 200; 300; 400; 550; 600; 700; 800; 900; 1000 of processing machine 01 are constructed and/or arranged and/or upon which side of sheets 02 will be processed. The at least one transport means 511 is then configured accordingly as the upper suction transport means 511 or as the lower suction transport means 511, for example.

Preferably, the drying system 500 preferably configured as unit a 500 and/or a module 500 is alternatively or additionally characterized in that the section of the transport path provided for sheets 02 that is defined by the drying system 500 begins at an intake height of the drying system 500 and/or ends at an output height of the drying system 500. Drying system 500 is preferably characterized in that this intake height of drying system 500 deviates by no more than 5 cm, more preferably no more than 1 cm, and even more preferably no more than 2 mm from the first standard height, and/or in that the outlet height of drying system 500 deviates by no more than 5 cm, more preferably no more than 1 cm, and even more preferably no more than 2 mm from the first standard height, and/or in that the intake height of drying system 500 deviates by no more than 5 cm, more preferably no more than 1 cm, and even more preferably no more than 2 mm from the outlet height of preprocessing system 200.

The at least one drying system 500 or drying device 506 has, for example, at least one cooling system 551 and/or at least one inspection system 551 and/or at least one rewetting system 551. Alternatively, a separate post-processing unit 550 is provided for this purpose.

For example, at least one post-processing system 550 is provided, preferably downstream of at least one coating system 400; 600; 800 and/or downstream of at least one drying system 500 and/or downstream of at least one drying device 506 with respect to the transport path provided for sheets 02. The at least one post-processing system 550 preferably provided preferably has at least one processing means 551. This at least one processing means 551 is configured, for example, as a wetting system 551, in particular a rewetting system 551, and/or as a cooling system 551 and/or as a discharge system 551 and/or as an inerting system 551 and/or as a cleaning system 551 and/or as a deburring system 551 and/or as an inspection system 551. A cleaning system 551 is configured, for example, as a vacuum system 551 and/or a blower system 551 and/or as a stripping system 551.

An inspection system 551 comprises, for example, at least one and preferably multiple, in particular at least two, sensors, in particular optical sensors, which is/are embodied, for example, as cameras and/or is/are positioned such that they are movable, preferably mechanically, in particular in the transverse direction A. Using at least one such sensor, for example, a printed area of a respective sheet 02 can be captured, for example an entire printed area of the respective sheet 02, in particular for an examination of print quality. For example, register marks can be detected by means of at least one such sensor or sensors. Register marks that are arranged on the sheet 02 and have further preferably been applied to the sheets 02 beforehand by means of at least one and in particular by a plurality of the coating units 400; 600; 800 are preferably detected by means of these sensors. The register marks can also be applied to the sheets 02 partially or fully outside of the processing machine 01 or coating machine 01. In particular for evaluating the functioning of the processing machine 01, however, the register marks are produced at least partially and more preferably entirely within the processing machine 01. The sensors are preferably adjusted to the dimensions of the sheets 02 and/or to a position which is dependent upon the processing, in particular upon the printed image, in particular with respect to the transverse direction A. Thus, the register mark does not have to be printed at the same location on the sheets 02 for each print order. Once the register marks have been detected, the resulting position information is preferably analyzed. Further preferably, information as to how at least one setting variable of the processing machine 01 is to be adjusted is derived from this analysis. This at least one setting variable is, for example, the position with respect to the circumferential direction of at least one application cylinder 402; 602; 802, in particular relative to other application cylinders 402; 602; 802, and/or the position with respect to the transverse direction A of at least one application cylinder 402; 602; 802, in particular relative to other application cylinders 402; 602; 802, and/or the inclination of a coating forme, in particular relative to the transverse direction A, and/or an actuation and/or position of at least one print head 416; 616; 816. In this way, the circumferential register and/or the page register and/or the diagonal register can be detected and/or adjusted. Processing means 551 is located, for example, within another unit 100; 200; 300; 400; 500; 600; 700; 800; 900; 1000 or module 100; 200; 300; 400; 500; 600; 700; 800; 900; 1000, in particular aligned toward and/or acting on and/or capable of acting on the provided transport path. This additional unit 600 or module 600 is, for example, the printing unit 600 or printing module 600 or coating unit 600 or coating module 600 or non-impact coating unit 600 or non-impact coating module 600. The inspection system 551 preferably has at least one CCD sensor 553 and/or at least one CMOS sensor 553. The inspection system 551 and in particular the at least one sensor 553 of the inspection system 551 is preferably arranged aligned toward the transport means 611, in particular the suction belt 611 of the coating module 600, in particular non-impact coating module 600 and/or the conveyor belt 718; 724 of the suction belt 611 of the coating module 600, in particular non-impact coating module 600. Preferably, the inspection system 551 is arranged aligned toward a part of the transport means 611, in particular of suction belt 611, in particular of the conveyor belt 718; 724 of the suction belt 611 of the non-impact coating module 600, which is located downstream, with respect to the transport path provided for sheets 02, of the at least one post-drying system 507 and/or the air outlet opening thereof, arranged aligned toward the at least one and preferably precisely one transport means 611 of the non-impact printing module 600 configured in particular as suction belt 611. Alternatively or additionally, however, the at least one post-processing system 550 is configured, for example, as an autonomous unit 550 and more preferably as an autonomous module 550.

Post-processing system 550 preferably has at least one transport means 561, which is further preferably configured as a suction transport means 561. The description relating to suction transport means in the foregoing and in the following preferably applies accordingly. Post-processing system 550 preferably has at least one drive M550 or motor 550, in particular electric motor M550 or position-controlled electric motor M550, dedicated uniquely to it, which is further preferably positioned such that it drives and/or is capable of driving the at least one transport means 561. For example, post-processing system 550 has at least one pressure roller 552 or pressure cylinder 552, by means of which a force can be exerted on sheets 02, pressing them against the at least one transport means 561. The post-processing system 550 preferably has at least one transfer means 03 for sheets 02. The section of the transport path provided for sheets 02 that is defined by post-processing system 550 is preferably substantially flat and more preferably completely flat and is preferably configured extending substantially horizontally and more preferably exclusively horizontally.

Preferably, post-processing system 550, which is preferably configured as a unit 550 and/or a module 550, is alternatively or additionally characterized in that the section of the transport path provided for sheets 02 that is defined by the post-processing system 550 begins at an intake height of post-processing system 550 and/or ends at an outlet height of post-processing system 550. Preferably, post-processing system 550 is characterized in that this intake height of post-processing system 550 deviates by no more than 5 cm, more preferably no more than 1 cm, and even more preferably no more than 2 mm from the first standard height, and/or in that the outlet height of post-processing system 550 deviates by no more than 5 cm, more preferably no more than 1 cm, and even more preferably no more than 2 mm from the first standard height, and/or in that the intake height of post-processing system 550 deviates by no more than 5 cm, more preferably no more than 1 cm and even more preferably no more than 2 mm from the outlet height of post-processing system 550.

As described, at least one printing system 600, in particular at least one printing unit 600, is preferably provided, for example in addition to at least one priming unit 400 and/or at least one finish coating unit 800. The preferably provided at least one printing system 600 is a coating system 600. The description relating to coating units 400; 600; 800 in the foregoing and in the following applies accordingly to the at least one printing system 600. A drying system 500, more preferably configured as described above, is preferably located downstream of the coating system 600 configured as printing system 600.

If the at least one coating system 400; 600; 800 and/or another unit 100; 200; 300; 500; 550; 900; 1000 does not itself have sufficient transport options, for example, and/or for the purpose of bridging distances, at least one autonomous transport device 700 is preferably provided, which is configured, for example, as a transport unit 700 or as a transport module 700. The at least one transport system 700 that is preferably provided serves, for example, to transport sheets 02, in particular between additional units 100; 200; 300; 400; 500; 550; 600; 800; 900; 1000 and/or modules 100; 200; 300; 400; 500; 550; 600; 800; 900; 1000. The at least one transport system 700 has, for example, at least one frame 744. The at least one transport system 700 preferably has at least one transport means 711, which is further preferably configured as a suction transport means 711. The description relating to suction transport means in the foregoing and in the following preferably applies accordingly. Transport system 700 preferably has at least one drive M700 or motor M700, in particular electric motor M700 or position-controlled electric motor M700, dedicated uniquely to it, which is further preferably positioned such that it drives and/or is capable of driving the at least one transport means 711. For example, transport system 700 has at least one pressure roller or pressure cylinder, by means of which a force can be exerted on sheets 02, pressing them against the at least one transport means 711.

The at least one transport system 700 is located, for example, within another unit 100; 200; 300; 400; 500; 550; 600; 800; 900; 1000 or module 100; 200; 300; 400; 500; 550; 600; 800; 900; 1000, in particular for the purpose of transporting sheets 02 up to and/or away from their specific systems. For example, transport means in other units 100; 200; 300; 400; 500; 550; 600; 800; 900; 1000 or modules 100; 200; 300; 400; 500; 550; 600; 800; 900; 1000 can be partially or entirely dispensed with if transport systems 700 disposed between said units or modules ensure the transport of sheets 02. In one example, a plurality of flexo coating units 400; 600; 800 are provided, which do not have their own transport means, but between each of which an autonomous transport system 700 is located. Transport system 700 preferably has at least one transfer means 03 for sheets 02. The section of the transport path provided for sheets 02 that is defined by transport system 700 is preferably substantially flat and more preferably completely flat and is preferably configured extending substantially horizontally and more preferably exclusively horizontally.

Preferably, the transport system 700 preferably configured as a unit 700 and/or a module 700 is alternatively or additionally characterized in that the section of the transport path provided for sheets 02 that is defined by the transport system 700 begins at an intake height of the transport system 700 and/or ends at an outlet height of the transport system 700. Preferably, transport system 700 is characterized in that this intake height of transport system 700 deviates by no more than 5 cm, more preferably no more than 1 cm, and even more preferably no more than 2 mm from the first standard height, and/or in that the outlet height of transport system 700 deviates by no more than 5 cm, more preferably no more than 1 cm, and even more preferably no more than 2 mm from the first standard height, and/or in that the intake height of transport system 700 deviates by no more than 5 cm, more preferably no more than 1 cm, and even more preferably no more than 2 mm from the outlet height of transport system 700.

As described, at least one finish coating system 800, in particular at least one finish coating unit 800, is preferably provided, for example in addition to at least one priming unit 400 and/or at least one printing unit 600. The at least one preferably provided finish coating system 800 is a coating system 800. The description relating to coating units 400; 600; 800 in the foregoing and in the following applies accordingly to the at least one finish coating system 800. A drying system 500, more preferably configured as described above, is preferably located downstream of the coating system 800 configured as finish coating system 800.

Preferably, at least one shaping system 900 is provided, in particular downstream of at least one coating system 400; 600; 800 and/or at least one drying system 500. The preferably provided at least one shaping system 900 preferably has at least one shaping means 901, in particular at least one shaping cylinder 901. The at least one shaping means 901 is configured, for example, as a die-cutting means 901, in particular as a die-cutting cylinder 901. Die-cutting enables parts of the sheets 02, for example usable blanks, to be separated at least partially, for example cut out and/or cut away, from other parts of the sheets 02, for example connecting surfaces. Alternatively or additionally, the at least one shaping means 901 is configured, for example, as a creasing means 901, in particular a creasing cylinder 901. Creasing allows predetermined bending points to be generated, for example, to produce folding cartons. Alternatively or additionally, the at least one shaping means 901 is configured, for example, as a perforating means 901, in particular a perforating cylinder 901. Perforating allows regions of the sheets 02 that are intended for later separation to be generated. Alternatively or additionally, the at least one shaping means 901 is configured, for example, as a stripping means 901, in particular a stripping cylinder 901. Stripping can be used to assist with the separation of areas of sheets 02 that have preferably already been partially separated from one another, for example by clearing punched holes and/or by stripping usable blanks from the sheets 02, in particular from their respective attachments to preferably printed sheets. At least one disposal system 903 is preferably provided for the removal of waste material produced during die-cutting and/or stripping. Alternatively or additionally, the at least one shaping system 900 preferably has at least one shaping means 901 configured as a laminating system 901. Alternatively or additionally, the at least one shaping system 900 preferably has at least one shaping means 901 configured as a flat-bed die-cutting system 901.

Preferably, the at least one shaping system 900 preferably has at least one counterpressure means 902, in particular at least one impression cylinder 902. Said impression cylinder serves as a counter-bearing for the sheets 02, while the at least one shaping means 901 acts on the sheets 02. Preferably, the at least one shaping means 901 and the at least one counterpressure means 902 are arranged at least partially one above the other. In a first embodiment of the at least one shaping system 900, the at least one shaping means 901 is located at least partially above the transport path provided, in particular, for sheets 02, and/or above the at least one counterpressure means 902. In that case, shaping means 901 is configured as a shaping means 901 that acts from above. The processing of the sheets 02 by means of this at least one shaping means 901 is then preferably carried out from above. The at least one counterpressure means 902 is then preferably located below the transport path provided in particular for sheets 02. In a second embodiment of the at least one shaping system 900, the at least one shaping means 901 is located at least partially below the transport path provided, in particular, for sheets 02, and/or below the at least one counterpressure means 902. In that case, shaping means 901 is configured as a shaping means 901 that acts from below. The processing of the sheets 02 by means of this at least one shaping means 901 is then preferably carried out from below. The at least one counterpressure means 902 is then preferably located above the transport path provided in particular for sheets 02. Whether the first or the second embodiment of the shaping device 900 is used is dependent, for example, on further processing operations that take place before and/or after that, and/or upon the use of the products. Preferably, the at least one shaping means 901 acts on the sheets 02 from a side other than the side acted on by the at least one coating unit 400, 600; 800, for example, in order to minimize undesirable deformation of the main surface area of the sheets 02 bearing the printed image during a die-cutting operation.

The at least one shaping means 901 is configured, for example, as at least partially replaceable, in particular to enable different shapes of the products from order to order. One example of this is exchangeable blades on a die-cutting cylinder 901. For this purpose, for example, the shaping means 901 configured in particular as a shaping cylinder 901 can be thrown off of the counterpressure means 902, which is preferably configured as impression cylinder 902, and/or can be equipped with interchangeable coverings, in particular partial shells. Alternatively or additionally, counterpressure means 902 can be thrown off of shaping means 901 in order to facilitate a change of the coverings. For example, at least one format-variable shaping system 900 is provided, which enables a particularly effective processing of different sheet formats. For this purpose, shaping means 901 and/or transport means 911 that can be accelerated in particular relative to other units 100; 200; 300; 400; 500; 550; 600; 700; 800; 1000, and/or shaping means 901 that operate without contact may be used.

Counterpressure means 902, in particular impression cylinder 902, is provided, for example, with a surface, in particular a lateral surface, that is made of rubber and/or is arranged movably in the transverse direction A. This movement enables wear to be made more uniform, thereby extending service life. Preferably, at least one maintenance system is provided, which is configured in particular as a grinding device and can be thrown, at least intermittently, against the surface, in particular the lateral surface.

The at least one shaping system 900 preferably has at least one transport means 911, which is further preferably configured as a suction transport means 911. The description relating to suction transport means in the foregoing and in the following preferably applies accordingly. The at least one shaping system 900 preferably has at least one drive M900 or motor M900, in particular electric motor M900 or position-controlled electric motor M900, dedicated uniquely to it, which is further preferably positioned such that it drives and/or is capable of driving the at least one transport means 911. The at least one shaping system 900 has at least one pressure roller or pressure cylinder, for example, by means of which a force can be exerted on sheets 02, pressing them against the at least one transport means 911. The at least one shaping system 900 preferably has at least one transfer means 03 for sheets 02. The section of the transport path provided for sheets 02 that is defined by the at least one shaping system 900 is preferably substantially flat and more preferably completely flat and is preferably configured extending substantially horizontally and more preferably exclusively horizontally.

The shaping system 900 preferably configured as a unit 900 and/or module 900 is alternatively or additionally characterized in that the section of the transport path provided for sheets 02 that is defined by shaping system 900 begins at an intake height of shaping system 900 and/or ends at an outlet height of shaping system 900.

Preferably, shaping system 900 is characterized in that this intake height of shaping system 900 deviates by no more than 5 cm, more preferably no more than 1 cm, and even more preferably no more than 2 mm from the first standard height, and/or in that the outlet height of shaping system 900 deviates by no more than 5 cm, more preferably no more than 1 cm, and even more preferably no more than 2 mm from the first standard height, and/or in that the intake height of shaping system 900 deviates by no more than 5 cm, more preferably no more than 1 cm, and even more preferably no more than 2 mm from the outlet height of shaping system 900. The at least one shaping system 900 is configured as at least one die-cutting module 900, for example.

Preferably, at least one substrate delivery system 1000 is provided, in particular as the last unit 1000 or module 1000 along the provided transport path. Substrate delivery system 1000 preferably has at least one stacking system 1001, which serves, in particular, to feed processed sheets 02 and/or usable blanks that have been die-cut and/or stripped out of the sheets 02 to a delivery pile 1002. Stacking system 1001 has at least one transport means 1011, for example, which is configured, for example, as a suction transport means 1011 or as a simple conveyor belt 1011. The description relating to suction transport means in the foregoing and in the following preferably applies accordingly. Substrate delivery system 1000 preferably has at least one drive M1000 or motor M1000, in particular electric motor M1000 or position-controlled electric motor M1000, dedicated uniquely to it, which is further preferably positioned such that it drives and/or is capable of driving the at least one transport means 1011. Substrate delivery system 1000 has at least one pressure roller 1001; 1003 or pressure cylinder 1001; 1003, for example, by means of which a force can be exerted on sheets 02, pressing them against the at least one transport means 1011. The at least one pressure roller 1001; 1003 or pressure cylinder 1001; 1003 is preferably part of the stacking system 1001 and serves to reliably transport sheets 02 to delivery pile 1002. At least one positioning means 1001; 1004 is preferably provided, which serves in particular to stack the sheets 02 or usable blanks in an ordered manner onto delivery pile 1002. The at least one positioning means 1001; 1004 is configured, for example, as a delivery stop 1001; 1004 that is movable in particular in a controlled and/or regulated manner, and/or as part of the stacking system 1001. Preferably, at least one ejection device is provided, for example for ejecting waste sheets before they reach delivery pile 1002.

Delivery pile 1002 is preferably formed on a carrier unit 1006 configured, for example, as a pallet 1006, and/or can preferably be transported away automatically, for example by means of a transport system 1007 that transports one or more carrier units 1006 and is equipped, for example, with at least one conveyor belt 1008 and/or transport rollers 1008. Preferably, at least one lifting mechanism 1009 is provided, by means of which the delivery pile 1002 and/or a lower end of the delivery pile 1002 and/or at least one transport unit 1006 can be positioned at different heights. This enables a delivery height at which an upper end of the delivery pile 1002 is positioned while said pile is being formed to be held substantially constant, for example. The delivery height is at the same time the outlet height of substrate delivery system 1000, for example. Alternatively or additionally, at least one transport means 1011 situated upstream of the delivery pile 1002 of the substrate delivery system 1000 is arranged movably, for example pivotably, so that sheets 02 delivered in succession can be delivered selectively to ever higher delivery levels.

Preferably, the substrate delivery system 1000 preferably configured as unit 1000 and/or module 1000 is alternatively or additionally characterized in that the section of the transport path provided for sheets 02, defined by the substrate delivery system 1000, begins at an intake height of the substrate delivery system 1000 and/or ends at a respective output height of the substrate delivery system 1000. The outlet height of substrate delivery system 1000 is, for example, the height at which contact of respective sheets 02 with delivery pile 1002 is provided. As the delivery pile 1002 is lowered during stacking, the outlet height of the substrate delivery system 1000 remains constant, for example. Preferably, substrate delivery system 1000 is characterized in that the respective intake height of substrate delivery system 1000 deviates by no more than 5 cm, more preferably no more than 1 cm, and even more preferably no more than 2 mm from the first standard height, and/or in that the outlet height of substrate delivery system 1000 deviates by no more than 5 cm, more preferably no more than 1 cm, and even more preferably no more than 2 mm from the first standard height, and/or in that the intake height of substrate delivery system 1000 deviates by no more than 5 cm, more preferably no more than 1 cm, and even more preferably no more than 2 mm from the outlet height of substrate delivery system 1000.

Figure 2A:
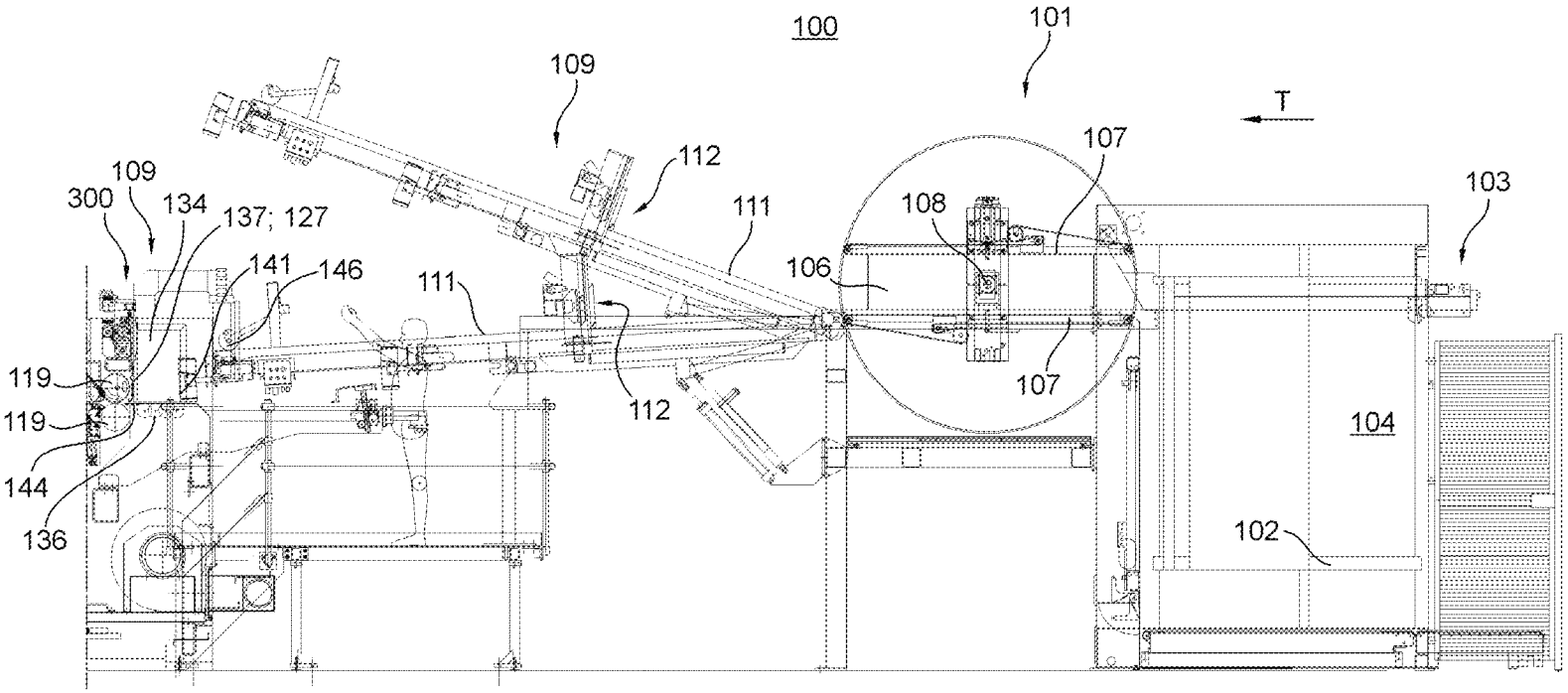
FIG. 2*a* shows a first section of a schematic diagram of an exemplary processing machines having a plurality of modules configured as flexo coating modules and an alternative sheet feeder unit.
Figure 2B:
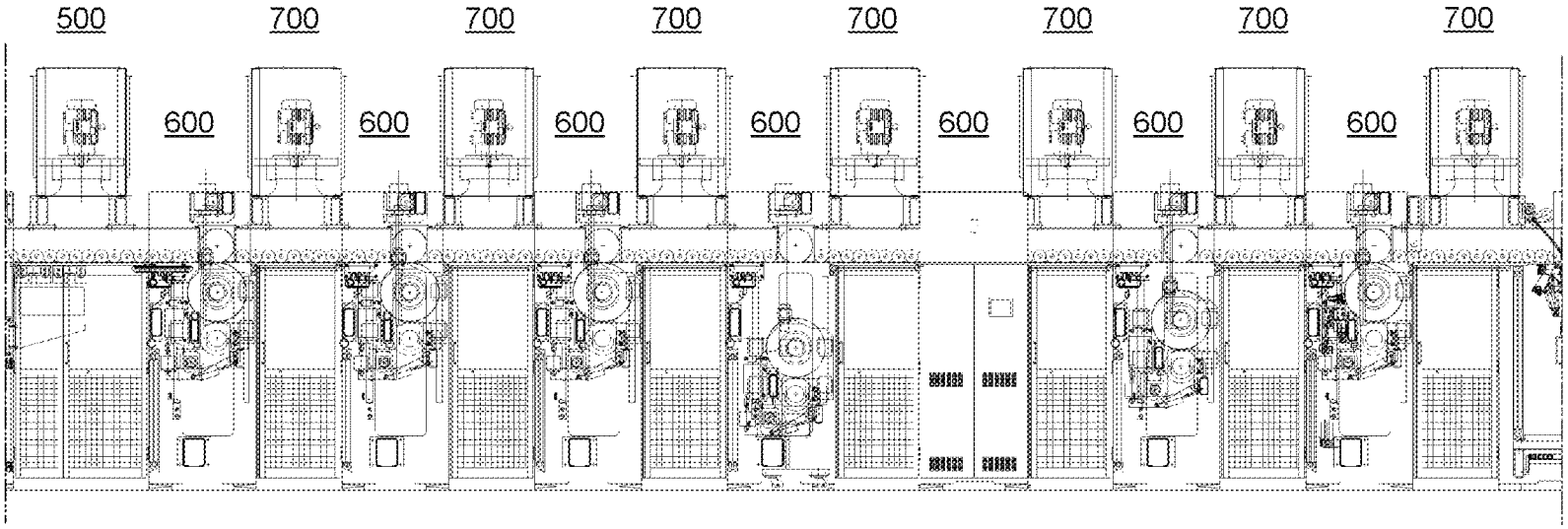
FIG. 2*b* shows a second section of the schematic diagram of the exemplary processing machines according to FIG. 2*a;*
Figure 2C:
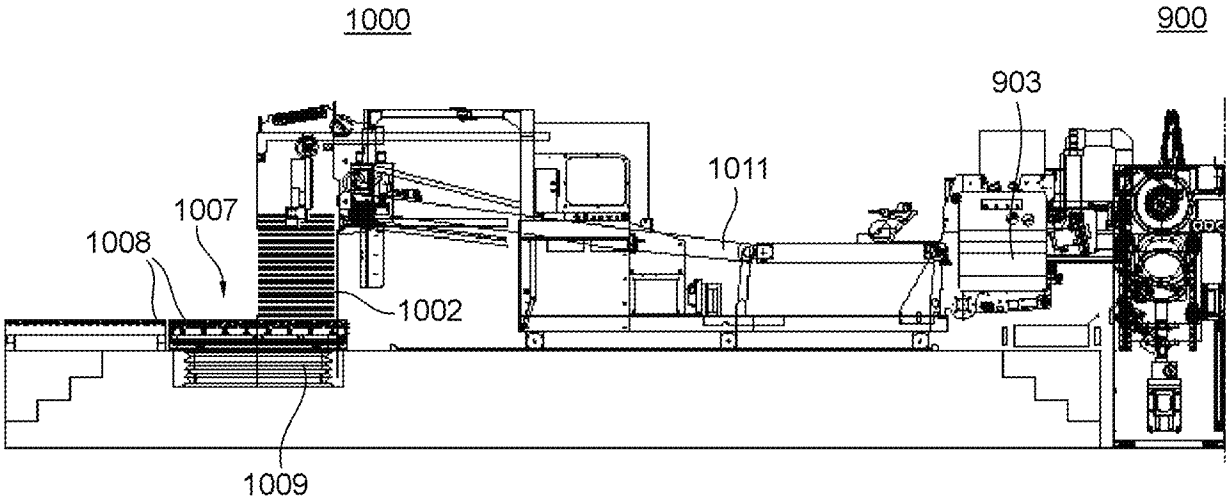
FIG. 2*c* shows a third section of the schematic diagram of the exemplary processing machines according to FIG. 2*a;*
Figure 3:
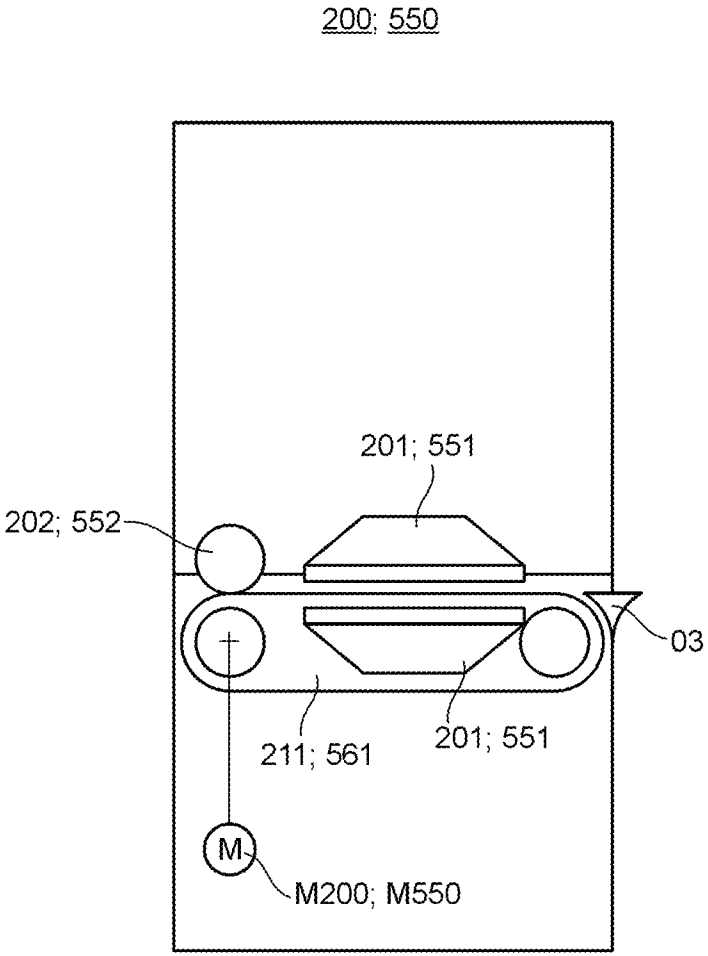
FIG. 3 shows a schematic diagram of a conditioning unit.
Figure 4:
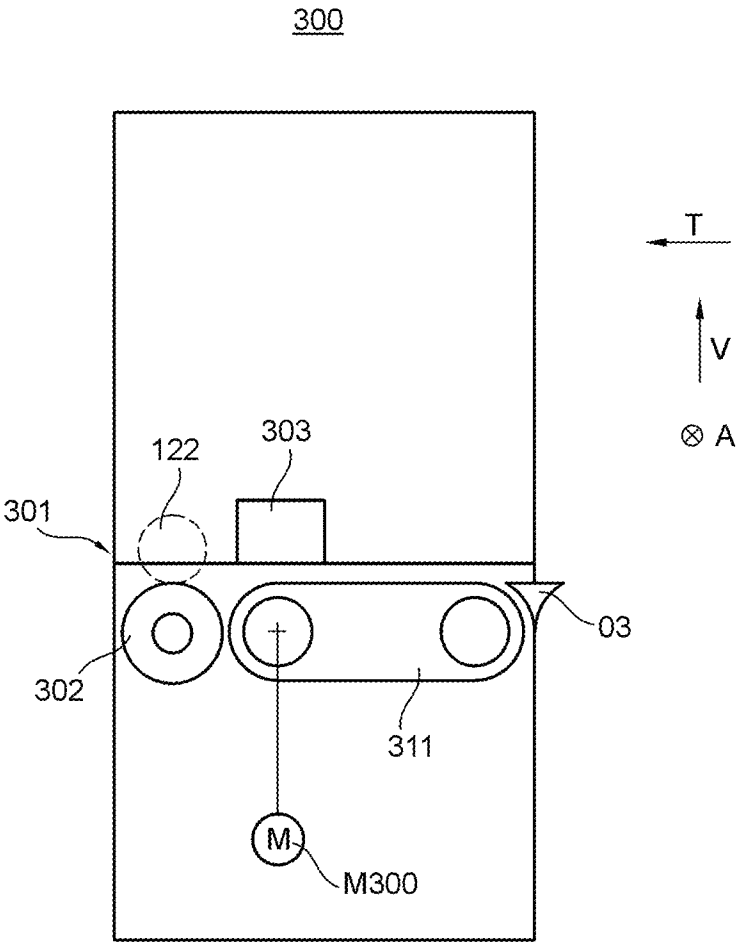
FIG. 4 shows a schematic diagram of an infeed unit.
Figure 5A:
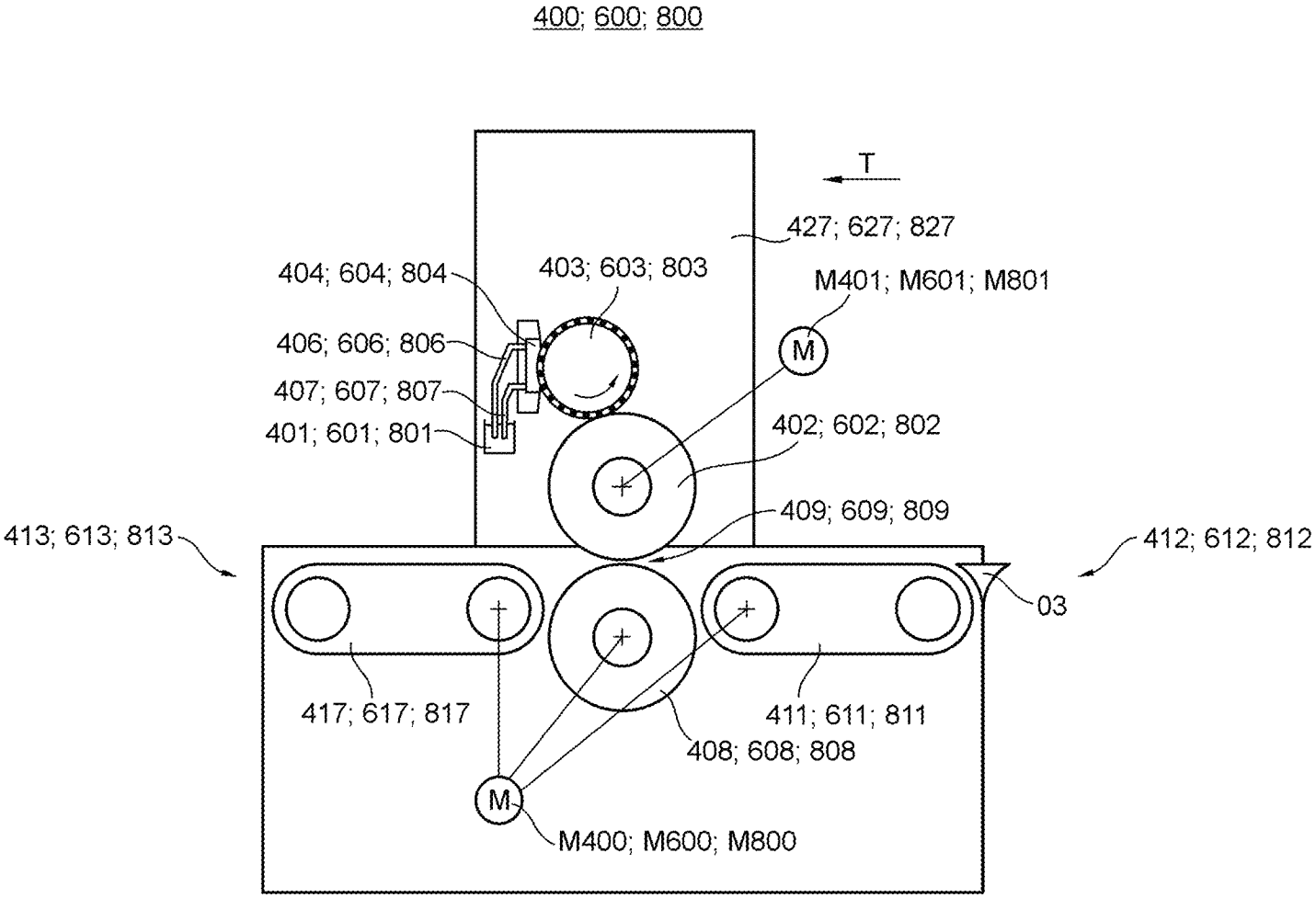
FIG. 5*a* shows a schematic diagram of a coating unit configured as a flexo coating unit that applies a coating from above, with incoming transport means and outgoing transport means.
Figure 5B:
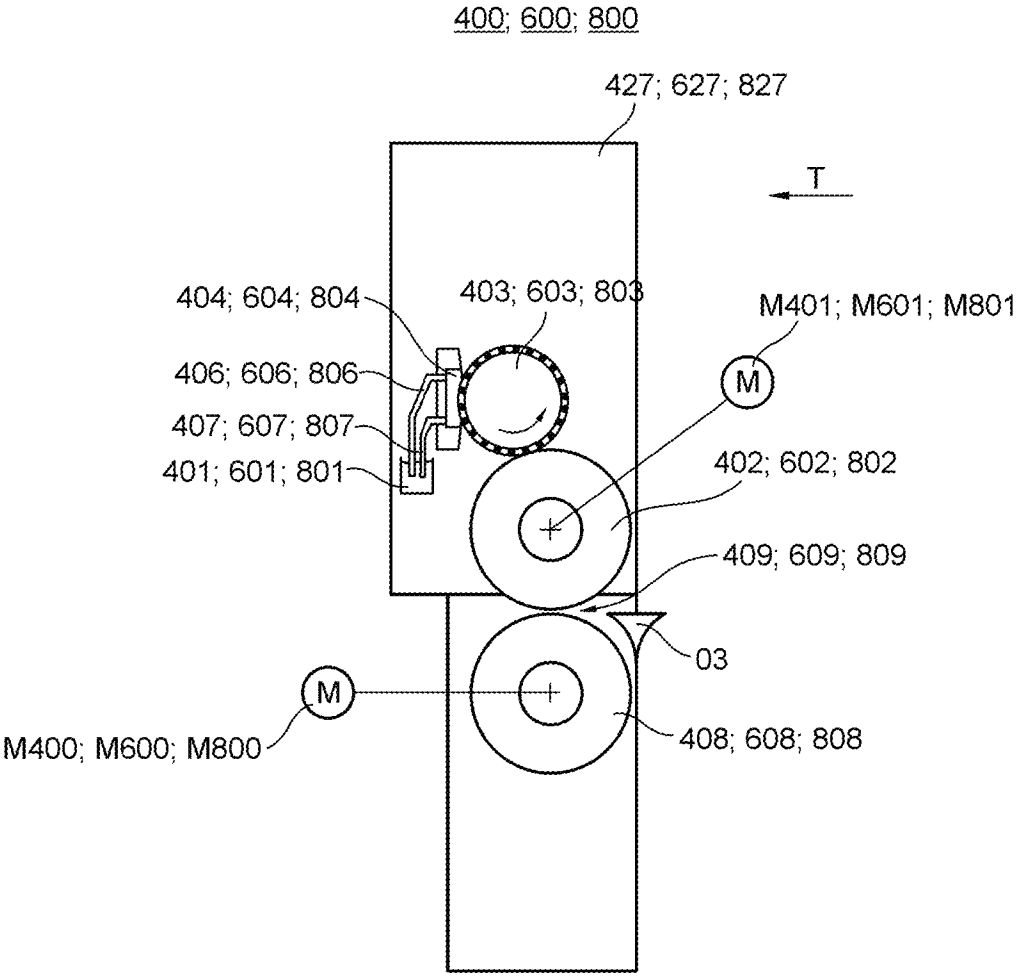
FIG. 5*b* shows a schematic diagram of a coating unit configured as a flexo coating unit that applies a coating from above.
Figure 5C:
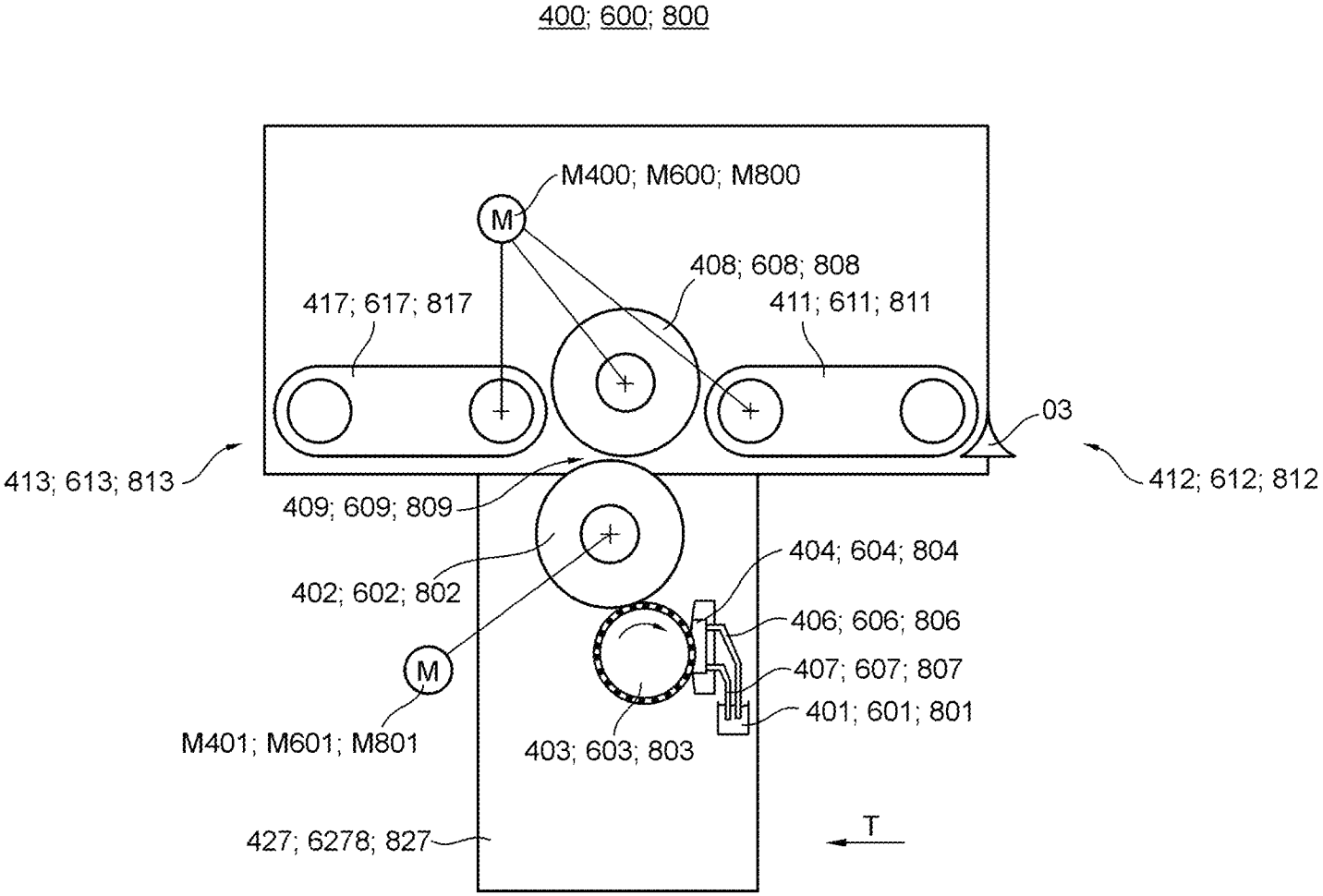
FIG. 5*c* shows a schematic diagram of a coating unit configured as a flexo coating unit that applies a coating from below, with incoming transport means and outgoing transport means.
Figure 5D:
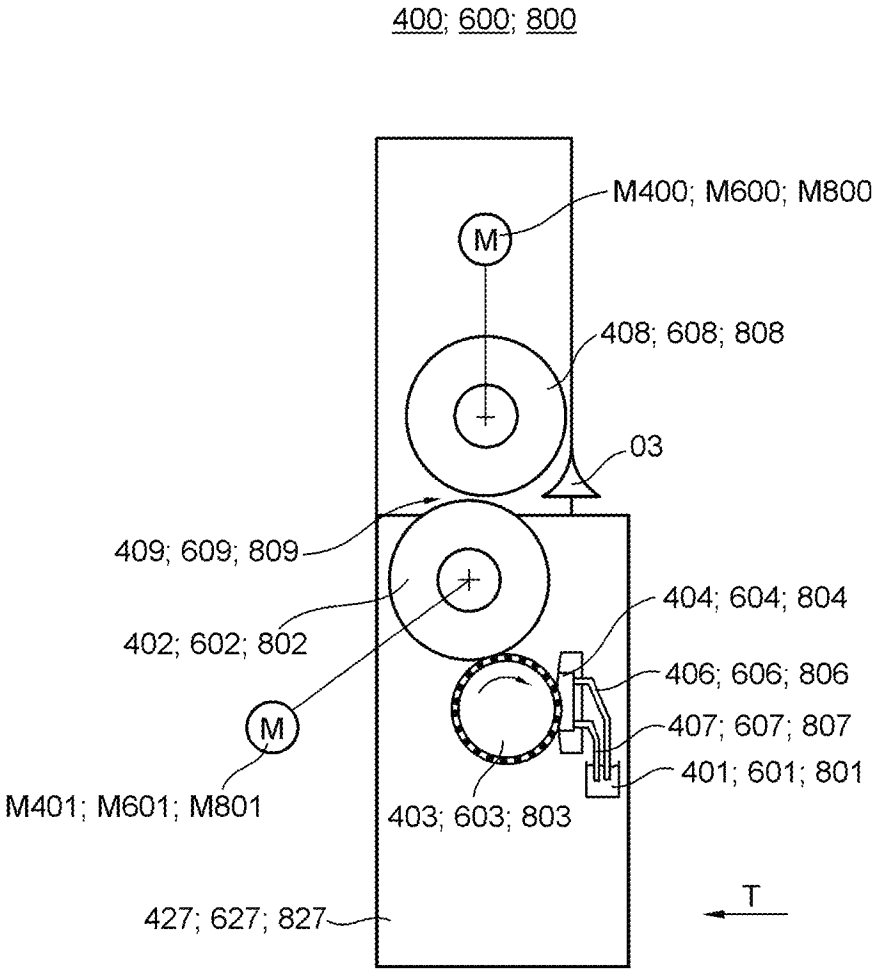
FIG. 5*d* shows a schematic diagram of a coating unit configured as a flexo coating unit that applies a coating from below.
Figure 6:
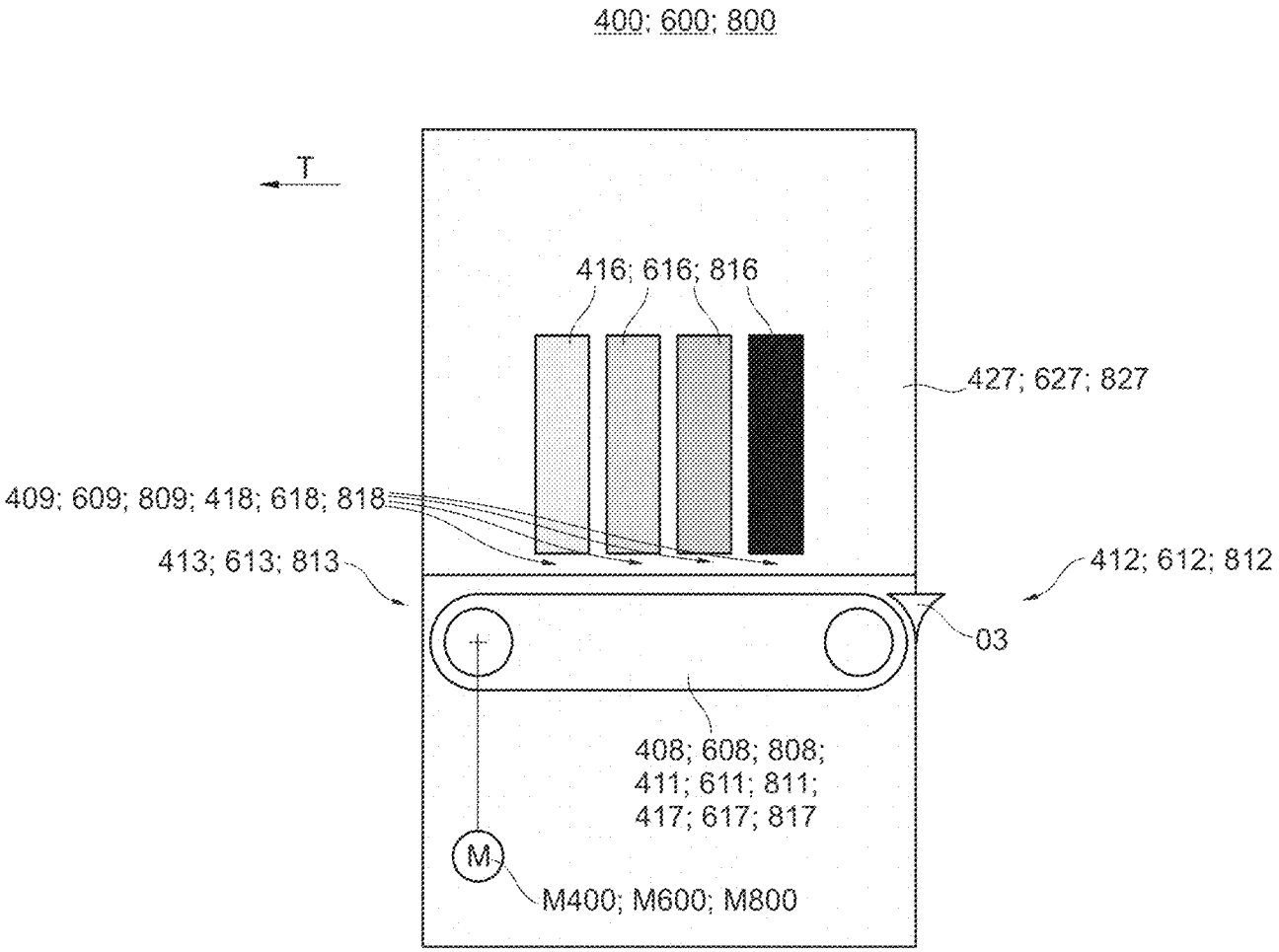
FIG. 6 shows a schematic diagram of a coating unit configured as a non-impact coating unit that applies a coating from above.
Figure 7:
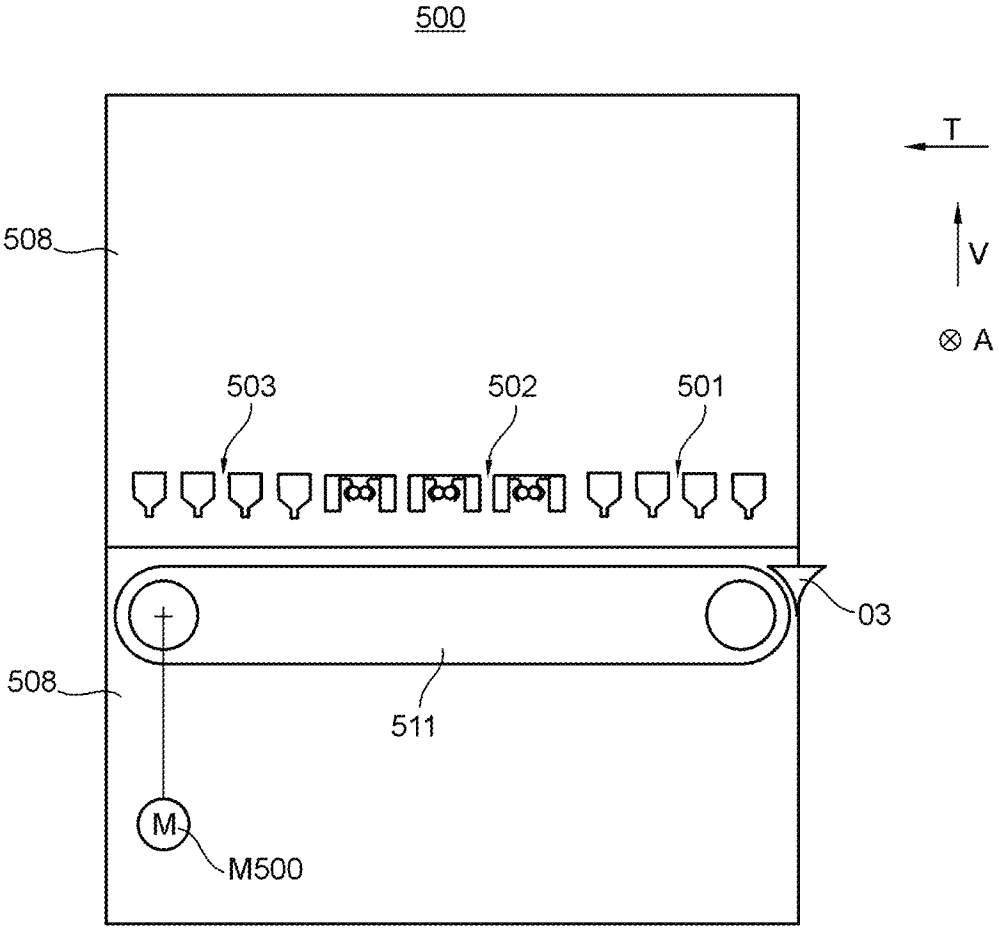
FIG. 7 shows a schematic diagram of a drying unit.
Figure 8A:
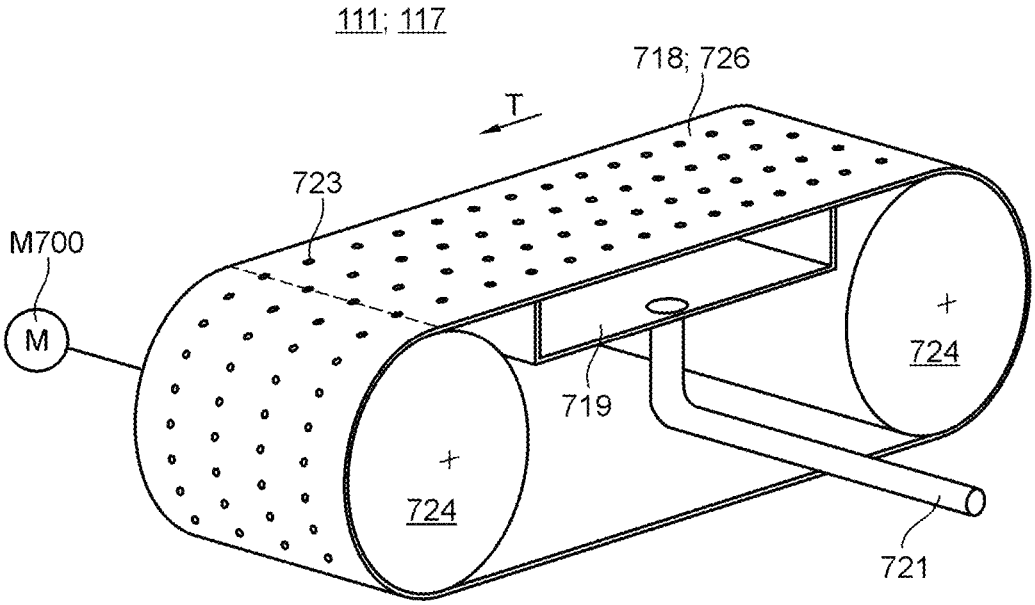
FIG. 8*a* shows a schematic diagram of a suction transport means configured as a suction belt.
Figure 8B:
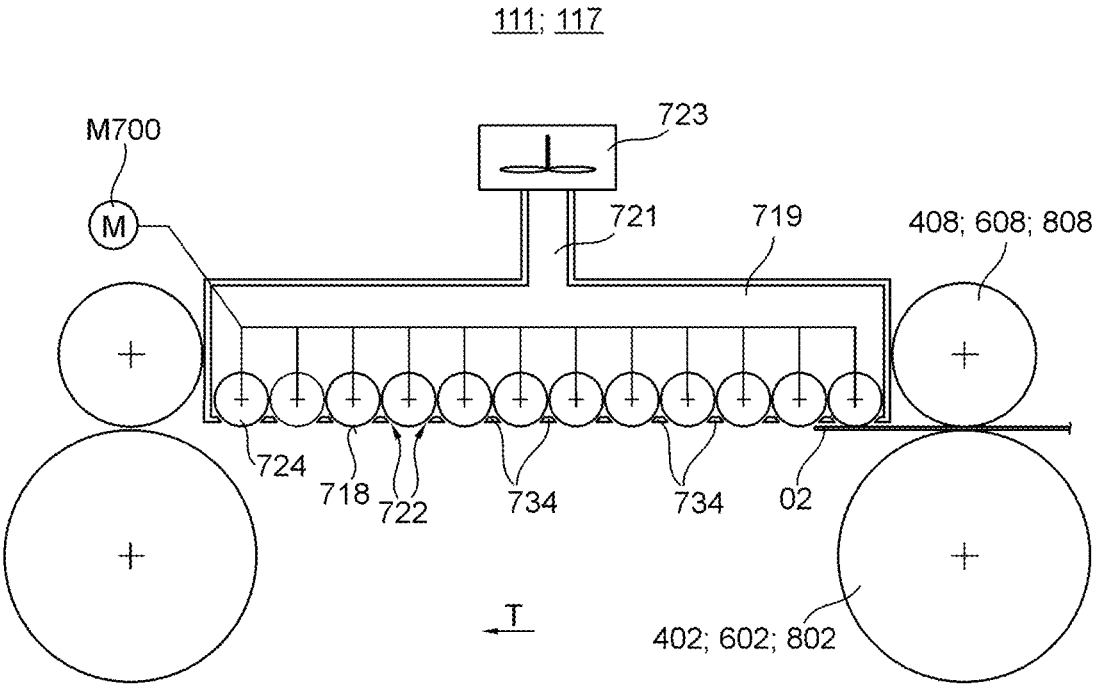
FIG. 8*b* shows a schematic diagram of a suction transport means configured as a roller suction system.
Figure 8C:
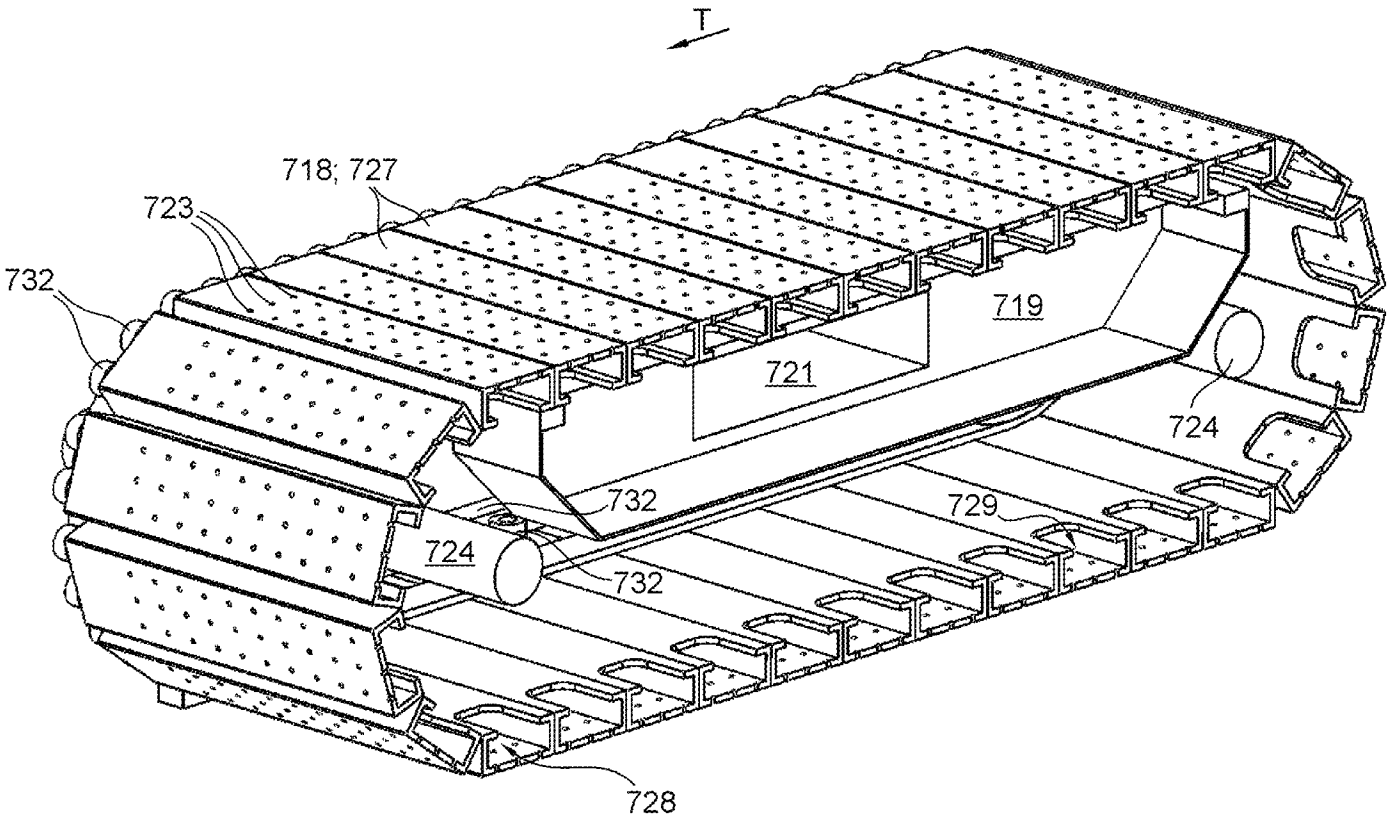
FIG. 8*c* shows a schematic diagram of a longitudinal section of a suction transport means configured as a suction box belt.
Figure 8D:
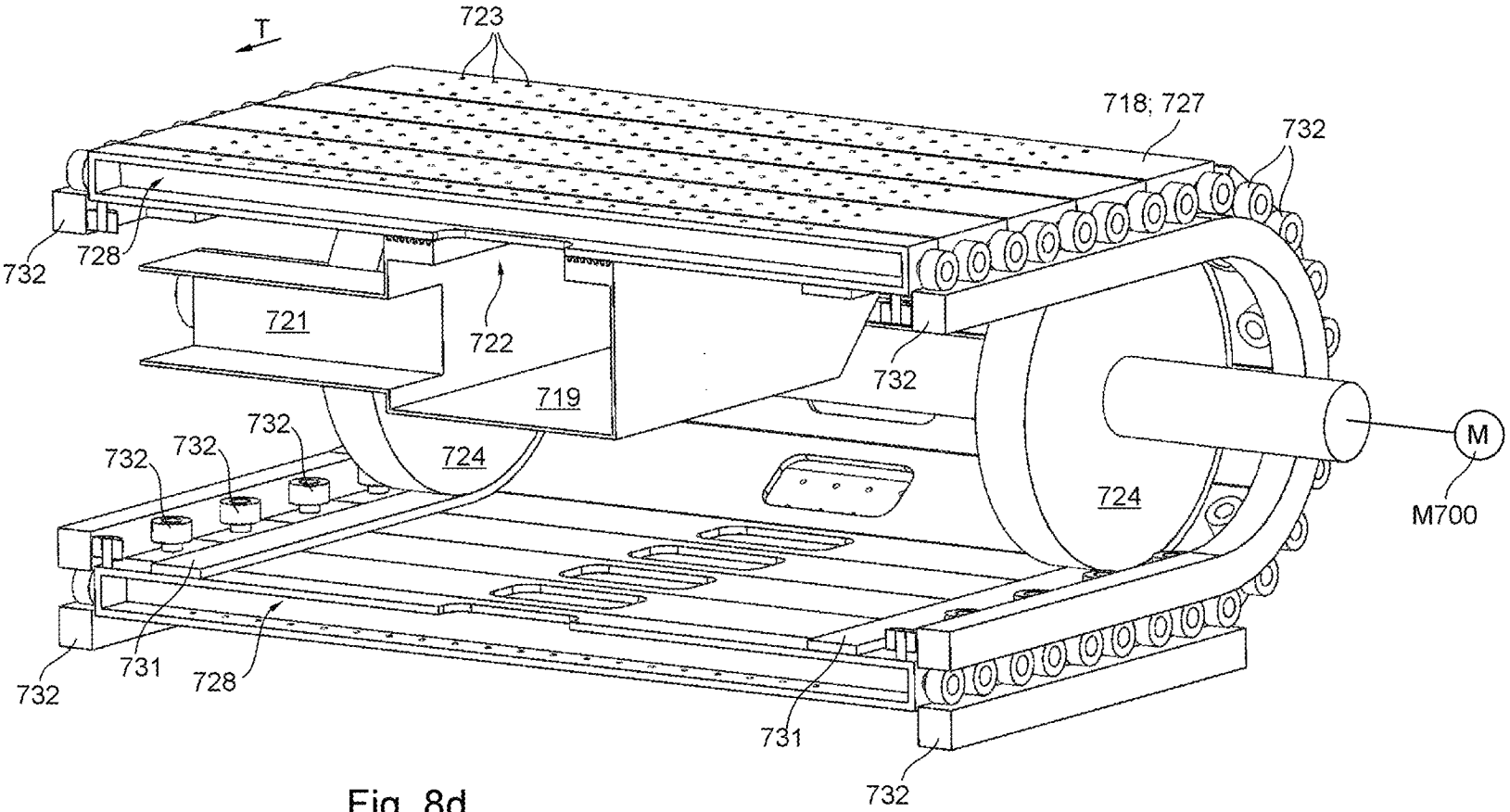
FIG. 8*d* shows a schematic diagram of a cross-section of a suction transport means configured as a suction box belt.
Figure 9:
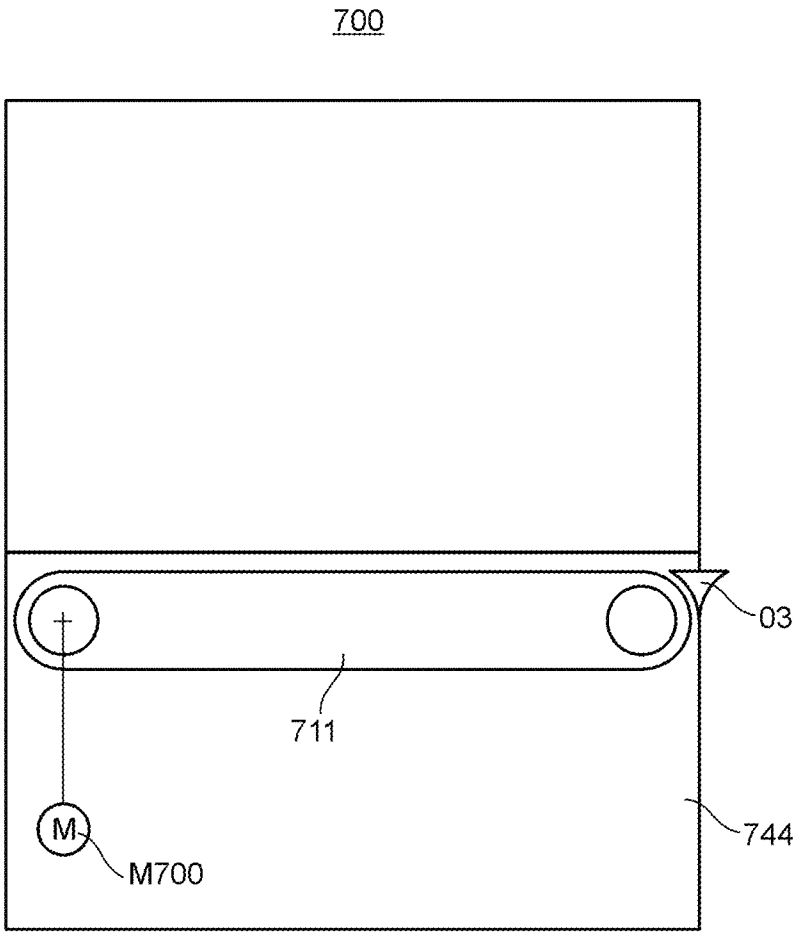
FIG. 9 shows a schematic diagram of a transport unit
Figure 10:
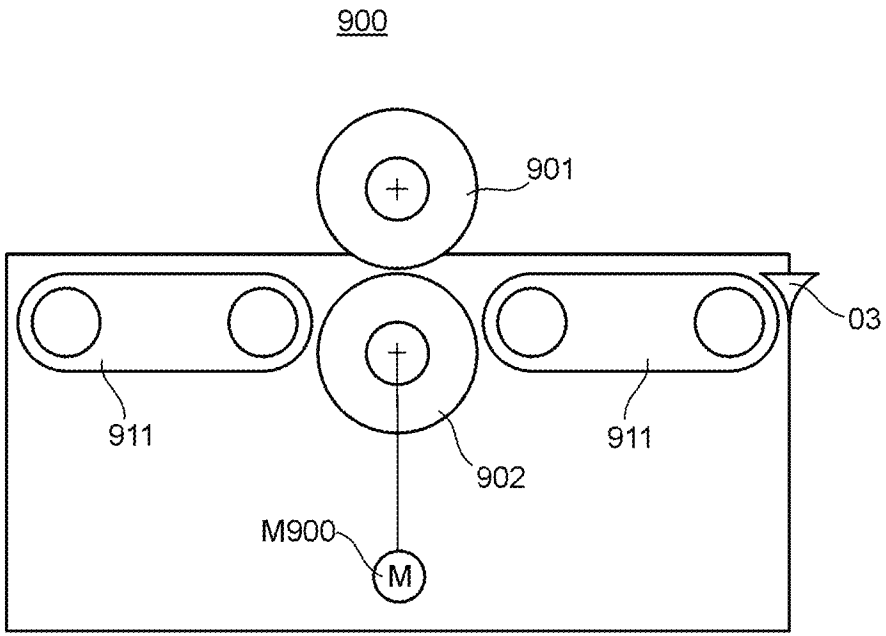
FIG. 10 shows a schematic diagram of a shaping unit.
Figure 11:
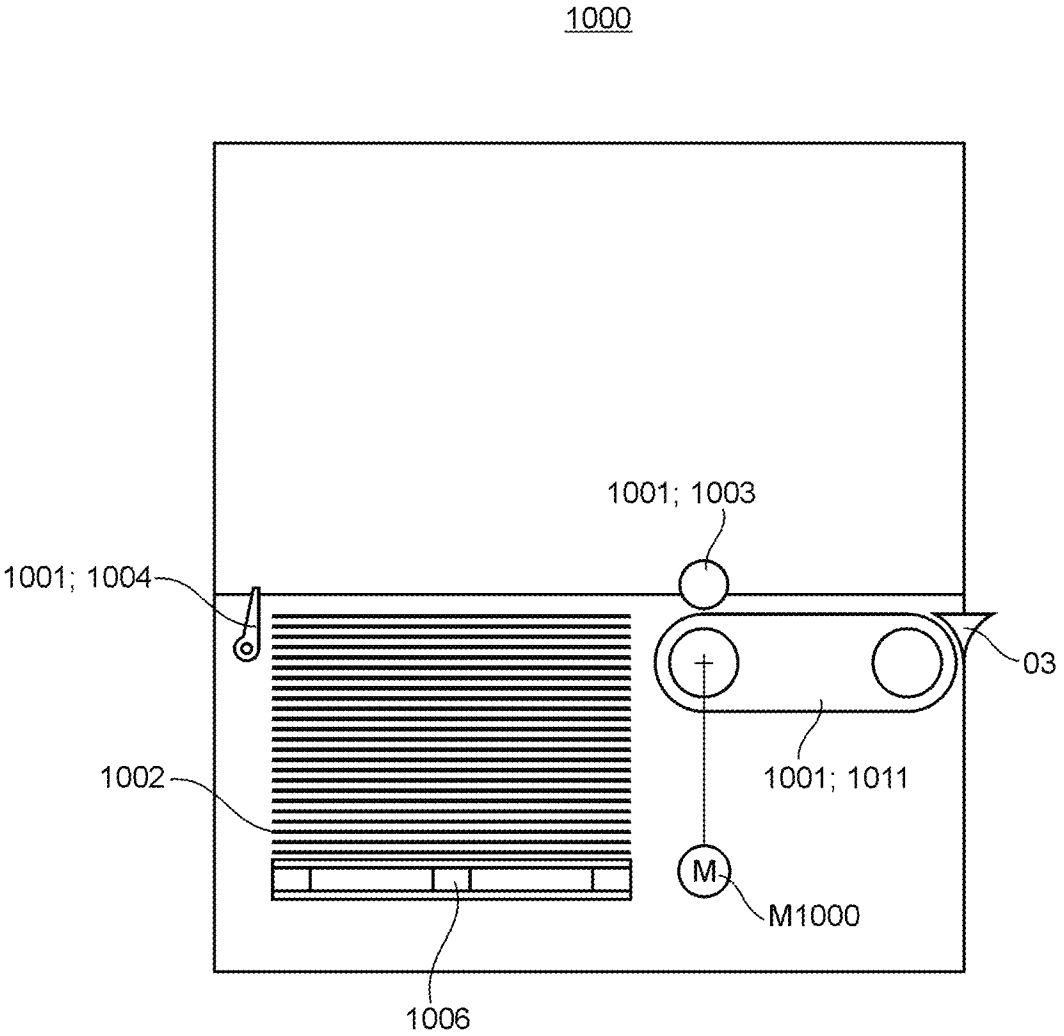
FIG. 11 shows a schematic diagram of a delivery unit.

A first example of a processing machine 01 comprises a sheet feeder module 100, an infeed module 300, a plurality of coating modules 600 each configured as a printing module 600 with transport modules 700 located therebetween, preferably at least one drying module 500, preferably at least one post-processing module 550, at least one shaping module 900 and a delivery module 1000. Such a first example of processing machine 01 is shown schematically and by way of example in FIGS. 2*a*, 2*b* and 2*c*.

Figure 12A:
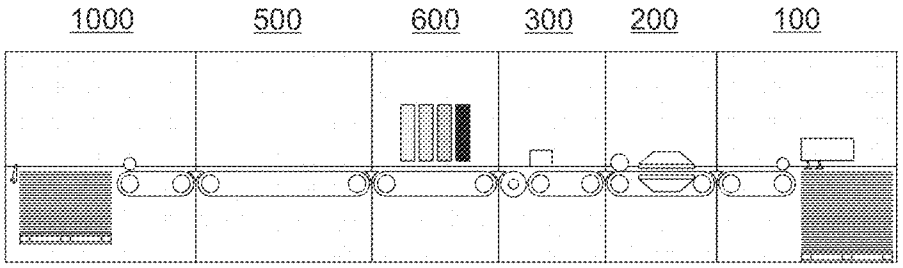
FIG. 12*a* shows a schematic diagram of an exemplary processing machine having four printing elements.

A second example of a processing machine 01 comprises a sheet feeder module 100, a preprocessing module 200, an infeed module 300, a coating module 600 configured as a printing module 600, a drying module 500, and a delivery module 1000. Such a second example of processing machine 01 is shown schematically and by way of example in FIG. 12*a*.

Figure 12B:
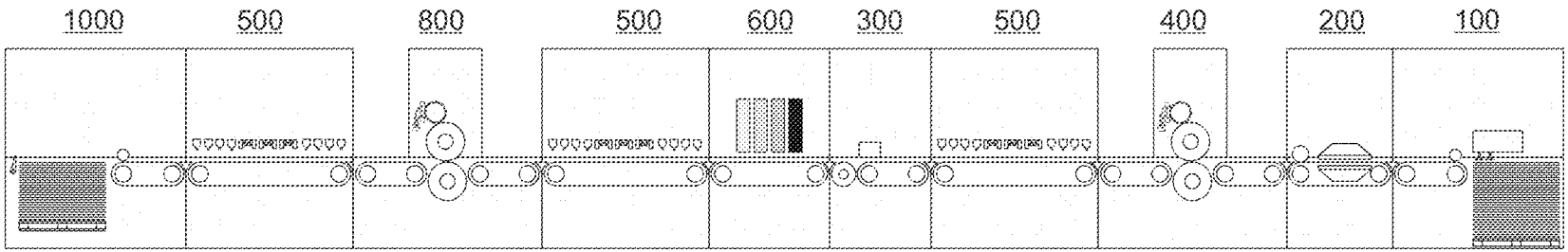
FIG. 12*b* shows a schematic diagram of an exemplary processing machine having four printing elements, a priming module, and a finish coating module.

A third example of a processing machine 01 comprises a sheet feeder module 100, a preprocessing module 200, a coating module 400 configured as a priming module 400, a first drying module 500, an infeed module 300, a coating module 600 configured as printing module 600, a second drying module 500, a coating module 800 configured as finish coating module 800, a third drying module 500, and a delivery module 1000. Such a third example of processing machine 01 is shown schematically and by way of example in FIG. 12*b*.

Figure 12C:
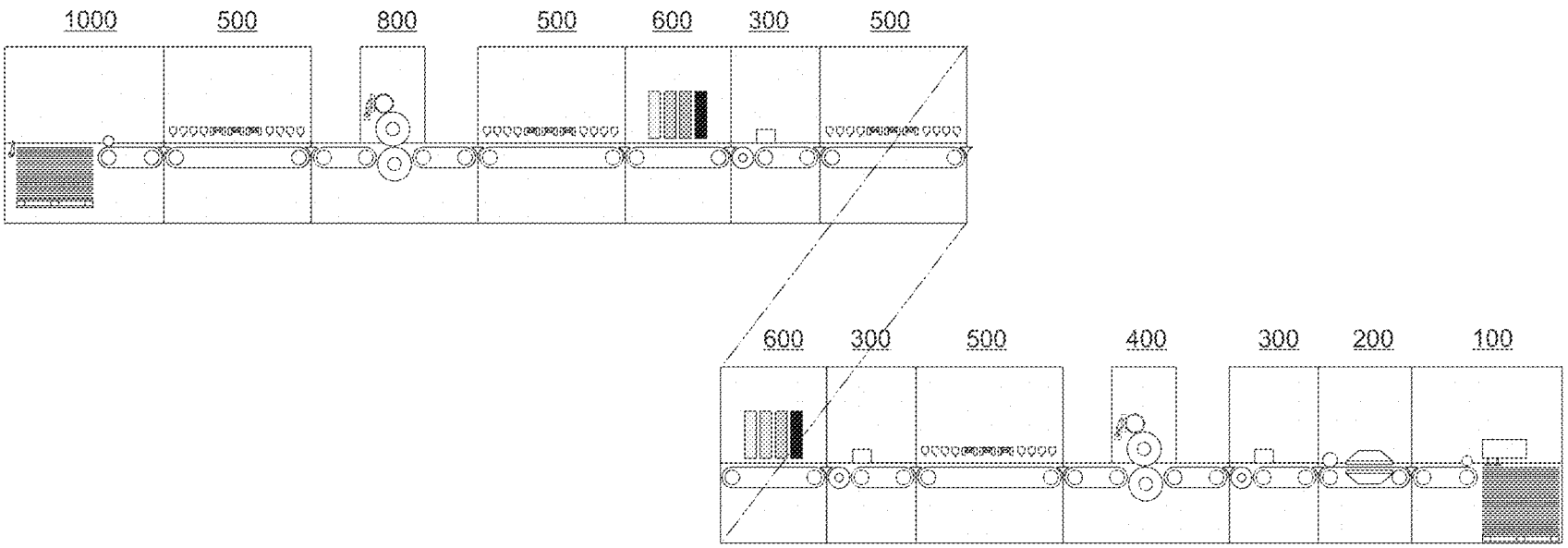
FIG. 12*c* shows a schematic diagram of an exemplary processing machine having eight printing elements, a priming module, and a finish coating module.
Figure 13:
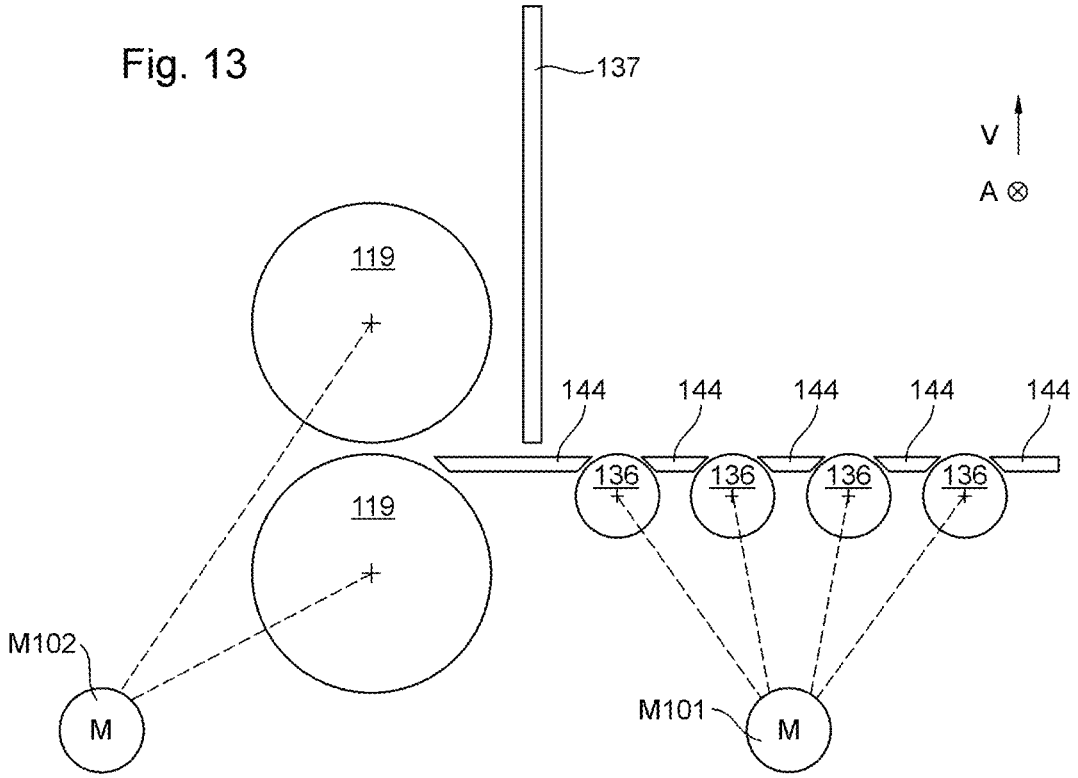
FIG. 13 shows a schematic diagram of primary and secondary acceleration means, each having its own dedicated drive.

A fourth example of a processing machine 01 comprises a sheet feeder module 100, a preprocessing module 200, a first infeed module 300, a coating module 400 configured as a priming module 400, a first drying module 500, optionally a second infeed module 300, a coating module 600 configured as a first printing module 600, a second drying module 500, a third infeed module 300, a coating module 600 configured as a second printing module 600, a third drying module 500, optionally an inspection module or an inspection system, a coating module 800 configured as a finish coating module 800, a fourth drying module 500, and a delivery module 1000. Such a fourth example of processing machine 01 is shown schematically and by way of example in FIG. 12*c*.

A fifth example of a processing machine 01 comprises a sheet feeder module 100, optionally a preprocessing module 200, a coating module 400 configured as a priming module 400, a first drying module 500, an infeed module 300, a coating module 600 configured as a printing module 600, a second drying module 500, a coating module 800 configured as a finish coating module 800, a third drying module 500, and a delivery module 1000. In this case, sheet feeder module 100 is preferably configured, as described, such that in at least one embodiment, its singulating system 109 singulates the sheets 02 from below (as shown, for example, in FIGS. 2*a* and 18*a*) or in at least one other embodiment, its singulating system singulates the sheets from above (as shown, for example, in FIGS. 1 and 18*b*). Also optionally provided, for example, is an ejection system for sheets 02, not shown, which is configured or serves, for example, as a waste diverter. The coating module 600 configured as a printing module 600 preferably has four receiving units 621. Of these four receiving units 621, a first is preferably occupied by a print head assembly 624, which more preferably contains two print head rows, wherein, more preferably, the first print head row is assigned a first color and the second print head row is assigned a second color. Of these four receiving units 621, preferably at least one additional, or more preferably two additional units are occupied by at least one dryer assembly 504. Of these four receiving units 621, preferably one additional, in particular the last, is occupied by a print head assembly 624, which more preferably has two print head rows, wherein more preferably, the entire third print head row is assigned a third color and the entire fourth print head row is assigned a fourth color. Such a fifth example of processing machine 01 is shown schematically and by way of example in FIG. 18*a*. With said system, sheets 02 can be transported at a speed of 150 meters per minute and printed in four colors at 1200 dpi×600 dpi.

The sheet-fed printing press 01 is preferably alternatively or additionally characterized in particular in such a fifth example in that the sheet-fed printing press 01 has precisely one non-impact printing module 600. Preferably, the sheet-fed printing press 01 is alternatively or additionally characterized in that the at least one non-impact printing module 600 has precisely four receiving units 421; 621; 821 and in that a first of the four receiving units 421; 621; 821 as viewed along the transport path provided for sheets 02 is occupied by precisely one standard assembly 424; 504; 624; 824 configured as a print head assembly 424; 624; 824, and in that a second of the four receiving units 421; 621; 821 as viewed along the transport path provided for sheets 02 and/or a third of the four receiving units as viewed along the transport path provided for sheets 02 is occupied, in particular, by a total of one standard assembly 424; 504; 624; 824 configured as a dryer assembly 504, and in that a fourth of the four receiving units 421; 621; 821 as viewed along the transport path provided for sheets 02 is occupied by precisely one standard assembly 424; 504; 624; 824 configured as a print head assembly 424; 624; 824. Preferably, the sheet-fed printing press 01 is alternatively or additionally characterized in that, along the transport path provided for sheets 02, in any case downstream of the at least one non-impact coating module 400; 600; 800, at least one ejection means for sheets 02 is provided. Preferably, the sheet-fed printing press 01 is alternatively or additionally characterized in that, along the transport path provided for sheets 02, in any case downstream of the at least one non-impact coating module 400; 600; 800, at least one substrate delivery system 1000 configured as module 1000 is provided. The fifth example of processing machine 01 is illustrated as described schematically and by way of example in FIG. 18*a*.

A sixth example of a processing machine 01 comprises a sheet feeder module 100, a preprocessing module 200, a first infeed module 300, a coating module 400 configured as a priming module 400, a first drying module 500, optionally a second infeed module 300, a coating module 600 configured as a first printing module 600, optionally a third infeed module 300, a coating module 600 configured as a second printing module 600, a second drying module 500, optionally an inspection module or an inspection system, a coating module 800 configured as a finish coating module 800, a third drying module 500, and a delivery module 1000. In this case, sheet feeder module 100 is preferably configured, as described, such that in at least one embodiment, its singulating system 109 singulates the sheets 02 from below (as shown, for example, in FIGS. 2*a* and 18*a*) or in at least one other embodiment, its singulating system singulates the sheets from above (as shown, for example, in FIGS. 1 and 18*b*). Also optionally provided, for example, is an ejection system for sheets 02, not shown, which is configured or serves, for example, as a waste diverter. The first coating module 600 configured as a printing module 600 preferably has four receiving units 621. Of these four receiving units 621, a first and a second are preferably each occupied by one print head assembly 624, each of which more preferably has two print head rows, wherein more preferably, a first color is assigned to the two print head rows of the first print head assembly 624 and a second color is assigned to the two print head rows of the second print head assembly 624. Of these four receiving units 621, preferably at least one additional, or more preferably two additional units are occupied by at least one dryer assembly 504. Of these four receiving units 621, the third and the fourth are preferably occupied by at least one dryer assembly 504. The second coating module 600 configured as a printing module 600 preferably has four receiving units 621. Of these four receiving units 621, two, in particular the first two, are preferably unoccupied. Of these four receiving units 621, two, in particular the last two, are preferably each occupied by a print head assembly 624, each of which more preferably has two print head rows, wherein more preferably a third color is assigned to the two print head rows of one of these two print head assemblies 624 and a fourth color is assigned to the two print head rows of the other of these two print head assemblies 624. Such a sixth example of processing machine 01 is shown schematically and by way of example in FIG. 18*b*. With this system, sheets 02 can be transported at a speed of 300 meters per minute and printed in four colors at 1200 dpi×600 dpi, for example.

The sheet-fed printing press 01 in such a sixth example, in particular, is preferably alternatively or additionally characterized in that the sheet-fed printing press 01 has precisely two non-impact printing modules 600. Preferably, the sheet-fed printing press 01 is alternatively or additionally characterized in that each of the two non-impact printing modules 600 has exactly four receiving units 421; 621; 821, and/or in that with the first non-impact printing module 600, as viewed along the transport path provided for sheets 02, a first of the four receiving units 421; 621; 821 as viewed along the transport path provided for sheets 02 is occupied by precisely one standard assembly 424; 504; 624; 824 configured as a print head assembly 424; 624; 824, and a second of the four receiving units 421; 621; 821, as viewed along the transport path provided for sheets 02, is occupied by precisely one standard assembly 424; 504; 624; 824 configured as a print head assembly 424; 624; 824, and a third of the four receiving units 421; 621; 821, as viewed along the transport path provided for sheets 02, and/or a fourth of the four receiving units, as viewed along the transport path provided for sheets 02, is occupied, in particular, by a total of one standard assembly 424; 504; 624; 824 configured as a dryer assembly 504, and/or in that with the second non-impact printing module 600, as viewed along the transport path provided for sheets 02, two of the four receiving units 421; 621; 821 are unoccupied and two of the four receiving units 421; 621; 821 are each occupied by precisely one standard assembly 424; 504; 624; 824 configured as a print head assembly 424; 624; 824. The sixth example of processing machine 01 is illustrated as described schematically and by way of example in FIG. 18*b*.

Preferably, the sheet-fed printing press 01 in such a sixth example is alternatively or additionally characterized in that, with the second non-impact printing module 600, as viewed along the transport path provided for sheets 02, a first of the four receiving units 421; 621; 821 as viewed along the transport path provided for sheets 02, and a second of the four receiving units 421; 621; 821, as viewed along the transport path provided for sheets 02, are unoccupied, and a third of the four receiving units 421; 621; 821 as viewed along the transport path provided for sheets 02 is occupied by precisely one standard assembly 424; 624; 824 configured as a print head assembly 424; 504; 624; 824, and a fourth of the four receiving units 421; 621; 821, as viewed along the transport path provided for sheets 02, is occupied by precisely one standard assembly 424; 504; 624; 824 configured as a print head assembly 424; 624; 824. Preferably, sheet-fed printing press 01 is alternatively or additionally characterized in that, along the transport path provided for sheets 02, in any case downstream of the second printing module 600 and/or in any case downstream of the at least one non-impact coating module 400; 600; 800, at least one ejection means for sheets 02 is provided. Preferably, the sheet-fed printing press 01 is alternatively or additionally characterized in that, along the transport path provided for sheets 02, in any case downstream of the second printing module 600 and/or in any case downstream of the at least one non-impact coating module 400; 600; 800, at least one substrate delivery system 1000 configured as module 1000 is provided. The sixth example of processing machine 01 is illustrated as described schematically and by way of example in FIG. 18*b*.

A seventh example of a processing machine 01 comprises a sheet feeder module 100, optionally in particular a first preprocessing module 200, a coating module 400 configured as a priming module 400, preferably having an integrated drying device 506 or a drying device 506 integrated into printing module 600, optionally in particular a second infeed module 300, a coating module 600 configured as a printing module 600 having an integrated drying device 506, optionally in particular a third infeed module 300, optionally an inspection module or an inspection system 551, a coating module 800 configured as a finish coating module 800 having an integrated drying device 506, and a delivery module 1000. In that case, sheet feeder module 100 is preferably configured as described such that in at least one embodiment, the singulating system 109 thereof singulates the sheets 02 from below (as shown, for example, in FIGS. 2*a* and 18*d*), or in at least one other embodiment, said system singulates the sheets from above (as shown, for example, in FIG. 1). Also optionally provided, for example, is an ejection means for sheets 02, not shown, which is configured or serves, for example, as a waste diverter. The first coating module 600 configured as a printing module 600 preferably has four application positions 618. Of these four application positions 618, a first and a second are each preferably formed by at least one or at least two print head rows, wherein further preferably, a first color is assigned to the two print head rows of the first application position 618 and a second color is assigned to the two print head rows of the second application position 618. Of these four application positions 618, the third and fourth are preferably each formed by at least one or at least two print head rows, wherein more preferably, a third color is assigned to the two print head rows of the third application position 618 and a fourth color is assigned to the two print head rows of the fourth application position 618. Such a seventh example of processing machine 01 is shown schematically and by way of example in FIG. 18*c*.

Sheet-fed printing press 01 in such a seventh example, in particular, is preferably characterized in that downstream of the second application position 618 of printing module 600, at least one drying device 506 for intermediate drying is provided, and in that downstream of a last application position 618 of the printing module, at least one and more preferably at least two drying devices 506 are located. Optionally, a fifth and a sixth application position 618 are provided, which are configured similarly to the other application positions 618 and to which a fifth and a sixth color are assigned, respectively. Preferably, all application positions 618 and/or all drying devices 506 of the printing module 600 are arranged aligned toward the one transport means 611 of the printing module 600. Preferably, at least one inspection system 551 is arranged aligned toward the one transport means 611 of the printing module 600. Preferably, at least one platform 629 for a press operator is and/or can be located above the transport means 611 of the printing module 600. Preferably, sheet-fed printing press 01 is alternatively or additionally characterized in that, along the transport path provided for sheets 02, in any case downstream of the printing module 600 and/or in any case downstream of the at least one non-impact coating module 400; 600; 800, at least one ejection means for sheets 02 is provided. Preferably, the sheet-fed printing press 01 is alternatively or additionally characterized in that, along the transport path provided for sheets 02, in any case downstream of the printing module 600 and/or in any case downstream of the at least one non-impact coating module 400; 600; 800, at least one substrate delivery system 1000 configured as module 1000 is provided. The seventh example of processing machine 01 is illustrated as described schematically and by way of example in FIG. 18*b*.

Depending upon the requirements profile, a multiplicity of other combinations is possible. In particular, a plurality of printing units 600 or printing modules 600 can also be arranged directly one behind the other and/or, if required, a plurality of drying units 500 or drying modules 500 can be arranged directly one behind the other, for example for a longer drying distance.

While preferred embodiments of a sheet-fed printing press, in accordance with the present invention, are set forth fully and completely herein above, it will be apparent to one of skill in the art that various changes could be made thereto, without departing from the true spirit and scope of the present invention, which is accordingly to be limited only by the appended claims.

The invention claimed is:

1. A sheet-fed printing press, including;

at least one sheet coating unit of the sheet-fed printing press and configured as a non-impact sheet coating unit, the at least one sheet coating unit including a transport path for sheets to be coated, the at least one sheet coating unit further including at least one sheet coating position configured as at least one sheet coating print head:

at least one first frame of the at least one sheet coating unit of the sheet-fed printing press, the at least one sheet coating print head being connected to the at least one first frame of the at least one sheet coating unit, the at least one first frame having first and second spaced lateral walls and at least one upper cross member and at least one lower cross member, which first and second spaced lateral walls and upper and lower cross members define an opening in the at least one first frame;

at least one conveyor belt for conveying sheets along the transport path in the at least one sheet coating unit of the sheet-fed printing press, the at least one conveyor belt having a circulation path, the conveyor belt circulation path including at least one sheet conveying section, along which at least one sheet conveying section the at least one sheet coating position is located, and which at least one sheet conveying section is parallel to a transport direction of sheets along a section of the transport path of the sheets to be coated, the at least one conveyor belt including at least one deflection means and at least one radial bearing, at least one portion of the at least one conveyor belt passing through the opening in the at least one first frame;

at least one second frame of the sheet coating unit of the sheet-fed printing press, the at least one conveyor belt being connected to the at least one second frame by the at least one deflection means and by the at least one radial bearing; and at least one installation surface different from the at least one first frame of the at least one sheet coating unit and different from the at least one second frame of the at least one sheet coating unit and whereby, to decouple the at least one print head of the at least one sheet coating unit from possible vibrations induced in the at least one print head of the at least one sheet coating unit by one of the at least one conveyor belt and by the at least one deflection means of the at least one coating unit and from drives therefor, the at least one first frame and the at least one second frame have an absence of any rigid connection between each other, apart from their respective connections to the at least one installation surface, which at least one installation surface is different from the at least one first frame and from the at least one second frame, and by their non-rigid connection to each other through only one or more flexible connections.

2. The sheet-fed printing press according to claim 1, wherein at least one drive of the conveyor belt is arranged, at least partially, one of directly and indirectly rigidly connected to the second frame.

3. The sheet-fed printing press according to claim 1, wherein the at least one print head is arranged connected one of by at least one positioning device and by at least one other component to the at least one first frame.

4. The sheet-fed printing press according to claim 1, wherein the at least one print head is connected one of directly and indirectly to lateral walls of the first frame and is located, at least partially, vertically above at least one section of the at least one conveyor belt.

5. The sheet-fed printing press according to claim 1, wherein the at least one print head is configured as an inkjet print head.

6. The sheet-fed printing press according to claim 1, wherein the at least one second frame is a frame of one of another unit and a module.

7. The sheet-fed printing press according to claim 1, wherein one of the second frame and lateral supports of the second frame lie between lateral walls of the at least one first frame in a direction transverse to the transport direction of sheets.

8. The sheet-fed printing press according to claim 1, wherein the at least one installation surface is at least one surface that supports the at least one first frame and the at least one second frame, and that also supports the at least one coating unit and the sheet-fed printing press, and wherein the at least one installation surface is a floor of one of a building and a component of a stable and low-vibration substructure.

9. The sheet-fed printing press according to claim 1, wherein the second frame has at least two lateral supports spaced apart from one another with respect to a direction transverse to the transport direction of sheet, and one of wherein the at least one conveyor belt is arranged at least partially between the at least two lateral supports of the second frame with respect to the transverse direction, and wherein at least one of the at least two lateral supports is arranged connected, via at least one cross member of the second frame to at least another one of the at least two lateral supports of the second frame.

10. The sheet-fed printing press according to claim 9, one of wherein the at least one cross member of the second frame is located at least partially vertically below at least one section of the at least one conveyor belt, and wherein the at least one cross member of the second frame is located at least partially vertically below at least a second section of the at least one conveyor belt, which is arranged at least partially vertically below a further section of the at least one conveyor belt, and wherein at least another cross member of the second frame is arranged at least partially vertically above at least one section of the at least one conveyor belt, wherein at least a further cross member of the second frame is also arranged, at least partially, vertically above at the least one section of the at least one conveyor belt, which at least one section of the at least one conveyor belt is arranged, at least partially, vertically above a further section of said at least one conveyor belt, and wherein at least one additional cross member of the second frame is arranged, at least partially, vertically above at least one section of the at least one conveyor belt and is arranged at least partially vertically below another section of the at least one conveyor belt.

11. The sheet-fed printing press according to claim 1, wherein the one or more flexible connections are one of an interposition of at least one flexible component and/or an interposition of at least one flexible assembly.

12. The sheet-fed printing press according to claim 1, wherein the one or more flexible connections are one of direct contacts and contacts imparted indirectly via other components.

13. The sheet-fed printing press according to claim 1, wherein the one or more flexible connections are formed by at least one of flexible components and by at least one mechanically flexible assembly.

14. The sheet-fed printing press according to claim 1, wherein the one or more flexible connections are at least one of supply lines for power and data and gas and gas mixtures and liquids and one of reversibly deformable bodies and assemblies that have deformable bodies.

* * * * *